US008210923B2

(12) United States Patent
Kido et al.

(10) Patent No.: US 8,210,923 B2
(45) Date of Patent: Jul. 3, 2012

(54) DICE GAMING MACHINE

(75) Inventors: Katsuhiro Kido, Tokyo (JP); Kenta Kitamura, Tokyo (JP)

(73) Assignee: Universal Entertainment Corporation, Koto-Ku, Tokyo (JP)

( * ) Notice: Subject to any disclaimer, the term of this patent is extended or adjusted under 35 U.S.C. 154(b) by 313 days.

(21) Appl. No.: 12/553,435

(22) Filed: Sep. 3, 2009

(65) Prior Publication Data

US 2010/0056257 A1 Mar. 4, 2010

Related U.S. Application Data

(60) Provisional application No. 61/094,176, filed on Sep. 4, 2008, provisional application No. 61/094,204, filed on Sep. 4, 2008, provisional application No. 61/094,216, filed on Sep. 4, 2008, provisional application No. 61/094,229, filed on Sep. 4, 2008.

(51) Int. Cl.
*A63F 9/24* (2006.01)

(52) U.S. Cl. ..... 463/22; 463/1; 463/16; 463/25; 273/146

(58) Field of Classification Search ..... 463/22, 463/25; 273/146
See application file for complete search history.

(56) References Cited

U.S. PATENT DOCUMENTS 6,520,503 B1 * 2/2003 Porto ..... 273/274
6,869,361 B2 * 3/2005 Sharpless et al. ..... 463/25
6,932,707 B2 * 8/2005 Duhamel ..... 463/42
7,179,166 B1 * 2/2007 Abbott ..... 463/9
2002/0160827 A1 * 10/2002 Slomiany et al. ..... 463/16
2003/0085514 A1 * 5/2003 Yoseloff et al. ..... 273/143 R
2003/0216168 A1 * 11/2003 Cannon et al. ..... 463/25
2004/0195763 A1 * 10/2004 Perrie et al. ..... 273/138.1
2006/0237905 A1 * 10/2006 Nicely et al. ..... 273/274
2007/0015567 A1 * 1/2007 Schugar et al. ..... 463/22
2007/0026947 A1 2/2007 Chun
2007/0075490 A1 * 4/2007 Gak ..... 273/146
2007/0105620 A1 * 5/2007 Cuddy et al. ..... 463/26
2008/0064467 A1 * 3/2008 Reiner ..... 463/16
2008/0096642 A1 * 4/2008 Yoshizawa ..... 463/22
2009/0181746 A1 * 7/2009 Nagano ..... 463/17
2009/0181747 A1 * 7/2009 Nagano ..... 463/17
2009/0181748 A1 * 7/2009 Nagano ..... 463/17

* cited by examiner

*Primary Examiner* — Dmitry Suhol
*Assistant Examiner* — Jason Skaarup
(74) *Attorney, Agent, or Firm* — Lexyoume IP Meister, PLLC.

(57) ABSTRACT

A dice gaming machine executes a dice game using a plurality of dice. Gaming values are bet with respect to bet areas making up a betting board. Each bet area is associated with a winning condition based on the spots on the dice and a payout magnification ratio. The prize in the dice game is determined based on the amount of gaming values bet on a bet area whose winning condition is satisfied, and a payout magnification ratio. Once acceptance of bets is ended, the dice gaming machine carries out a lottery. The dice gaming machine changes the payout magnification ratio for the bet area(s) based on the lottery result. Changing of the payout magnification ratio is adopted in the terminal(s) constituting the dice gaming machine.

6 Claims, 45 Drawing Sheets

| CHANCE LOTTERY RESULT | RANDOM NUMBER VALUE |
|---|---|
| WIN | 0~40 |
| LOSE | 41~2047 |

| 1ST CHANCE LOTTERY RESULT | RANDOM NUMBER VALUE |
|---|---|
| WIN | 0~4 |
| LOSE | 5~2047 |

| 2ND CHANCE LOTTERY RESULT | RANDOM NUMBER VALUE |
|---|---|
| WIN | 0~20 |
| LOSE | 21~2047 |

| CHANCE LOTTERY RESULT | RANDOM NUMBER VALUE |
|---|---|
| WIN | 0 ~ 204 |
| LOSE | 205 ~ 2047 |

| TERMINAL | RANDOM NUMBER VALUE |
|---|---|
| FIRST TERMINAL | 0 ~ 399 |
| SECOND TERMINAL | 400 ~ 799 |
| FIFTH TERMINAL | 800 ~ 1199 |
| NINTH TERMINAL | 1200 ~ 1599 |
| TENTH TERMINAL | 1600 ~ 1999 |

| CHANCE LOTTERY PROCESS | RANDOM NUMBER VALUE |
|---|---|
| WIN | 0 ~ 204 |
| LOSE | 205 ~ 2047 |

FIG. 42

| CHANCE LOTTERY RESULT | RANDOM NUMBER VALUE |
|---|---|
| WIN | 0 ~ 102 |
| LOSE | 103 ~ 2047 |

FIG. 43

| CHANCE LOTTERY RESULT | RANDOM NUMBER VALUE |
|---|---|
| WIN | 0 ~ 409 |
| LOSE | 410 ~ 2047 |

FIG. 44

| TERMINAL | RANDOM NUMBER VALUE |
|---|---|
| FIRST TERMINAL | 0 ~ 399 |
| SECOND TERMINAL | 400 ~ 799 |
| FIFTH TERMINAL | 800 ~ 1199 |
| NINTH TERMINAL | 1200 ~ 1599 |
| TENTH TERMINAL | 1600 ~ 1999 |

FIG. 56

| CHANCE LOTTERY RESULT | RANDOM NUMBER VALUE |
|---|---|
| WIN | 0~4 |
| LOSE | 5~2047 |

FIG. 57

| CHANCE LOTTERY RESULT | RANDOM NUMBER VALUE |
|---|---|
| WIN | 0~7 |
| LOSE | 8~2047 |

DICE GAMING MACHINE

CROSS-REFERENCE TO RELATED APPLICATIONS

This application is based upon and claims a priority from the U.S. provisional Patent Application No. 61/094,229 filed on Sep. 4, 2008, the U.S. provisional Patent Application No. 61/094,216 filed on Sep. 4, 2008, the U.S. provisional Patent Application No. 61/094,176 filed on Sep. 4, 2008, the U.S. provisional Patent Application No. 61/094,204 filed on Sep. 4, 2008, the entire contents thereof are incorporated herein by reference.

BACKGROUND

1. Technical Field

One or more aspects of the present invention relate to a dice gaming machine for carrying out a game wherein bets are placed on spots on a plurality of dice.

2. Description of Related Art

Conventionally, dice gaming machines are installed in game arcades. In the dice gaming machines, a game is carried out using a plurality of dice. For instance, one game which is played in such dice gaming machines is the so-called "Sic Bo" game.

In the dice game represented by "Sic Bo", a player bets a gaming value with respect to the spots on a plurality of dice. Once the rolled dice have stopped, the player can win a prize (for instance, payout) based on the spots on the stopped dice. In such a dice game, a player hopes for more various winning prize setting.

The present invention provides a novel dice gaming machine which can accommodate the demands of the players as described above.

SUMMARY

A dice gaming machine related to one or more aspects of present invention has a constitution described hereinafter. More specifically, the dice gaming machine includes a dice box in which a plurality of dice are rolled and stopped, a betting board having a plurality of bet areas each associated with a dice-winning condition based on spots on any of the plurality of dice stopped and with a predetermined payout magnification ratio, a plurality of terminals each accepting an input by a player, a processor executing processes of: (a) accepting a bet of a gaming value to any of the plurality of bet areas at any of the plurality of the terminals; (b) carrying out a lottery based on a lottery-winning probability previously determined when acceptance of the bet of the gaming value ends; (c) changing all payout magnification ratios of the plurality of bet areas making up a betting board for all the plurality of terminals when the lottery is won; (d) rolling and stopping the plurality of dice; (e) identifying a bet area which satisfies the dice-winning condition based on spots on the plurality of dice stopped; and (f) awarding a prize based on an amount of the gaming value bet at the bet area identified and a payout magnification ratio of the bet area.

Thus, in such dice gaming machines, if a player wins in the lottery, he/she can win an even larger amount of prize than usual. Accordingly, such dice gaming machines can accommodate the demands of the players as described above.

A dice gaming machine related to one or more aspects of present invention has a constitution described hereinafter. More specifically, the dice gaming machine includes a dice box in which a plurality of dice are rolled and stopped, a plurality of terminals each of which has a betting board having a plurality of bet areas each associated with a dice-winning condition based on spots on any of the plurality of dice stopped and a payout magnification ratio previously determined, and accepts an input by a player, and a processor executing processes of: (a) accepting a bet of a gaming value on any of the plurality of bet areas at any of the plurality of the terminals; (b) carrying out a lottery based on a lottery-winning probability previously determined when acceptance of the bet of the gaming value ends; (c) determining a target terminal from among participant terminals at which gaming values are bet, in a case of a win in the lottery; (d) changing payout magnification ratio of all of the plurality of bet areas making up the betting board of the target terminal; (e) rolling and stopping the plurality of dice; (f) identifying a bet area which satisfies the dice-winning condition based on spots on the plurality of dice stopped; and (g) awarding a prize based on an amount of the gaming value bet at the bet area identified at the process (f) and a payout magnification ratio of the bet area.

Thus, in the case of a win in the lottery, the dice gaming machine can award to the target terminal an even larger amount of prize than usual. Accordingly, such dice gaming machines can accommodate the demands of the players as described above.

A dice gaming machine related to one or more aspects of present invention has a constitution described hereinafter. More specifically, the dice gaming machine includes a dice box in which a plurality of dice are rolled and stopped, a plurality of terminals each of which has a betting board having a plurality of bet areas each associated with a dice-winning condition based on spots on any of the plurality of dice stopped and a payout magnification ratio previously determined, and accepts an input by a player, and a processor executing processes of: (a) accepting a bet of a gaming value on any of the plurality of bet areas at any of the plurality of the terminals; (b) carrying out a lottery with respect to each of all the plurality of bet areas making up the betting board of each of the plurality of terminals independently, based on a lottery winning probability previously determined, when acceptance of the bet of the gaming value ends; (c) changing a payout magnification ratio of a bet area which has won in the lottery with respect to each of the plurality of terminals; (d) rolling and stopping the plurality of dice; (e) identifying a bet area which satisfies the dice-winning condition based on spots on the plurality of dice stopped; and (f) awarding a prize based on an amount of the gaming value bet at the bet area identified at the process (e) and payout magnification ratio of the bet area.

Thus, in the case of a win in the lottery, the dice gaming machine can award to the target terminal an even larger amount of prize than usual. Accordingly, such dice gaming machines can accommodate the demands of the players as described above.

One or more aspects of the present invention as described above may be sufficiently grasped by reading the following detailed description in connection with the accompanying drawings. However, the purpose of the drawings is solely for exemplification and it should be clearly understood that they are not meant to limit the scope of the present invention.

BRIEF DESCRIPTION OF THE DRAWINGS

FIG. 42 is an exemplary diagram showing one example of a first chance lottery table made up based on a first reference probability;

FIG. 43 is an exemplary diagram showing one example of a second chance lottery table made up based on a second reference probability;

FIG. 44 is an exemplary diagram showing one example of a target terminal identification table according to the third embodiment of the present invention.

FIG. 56 is an exemplary diagram (1) showing one example of a chance lottery table according to the fourth embodiment of the present invention;

FIG. 57 is an exemplary diagram (2) showing one example of a chance lottery table according to the fourth embodiment of the present invention.

DETAILED DESCRIPTION

Figure 1:
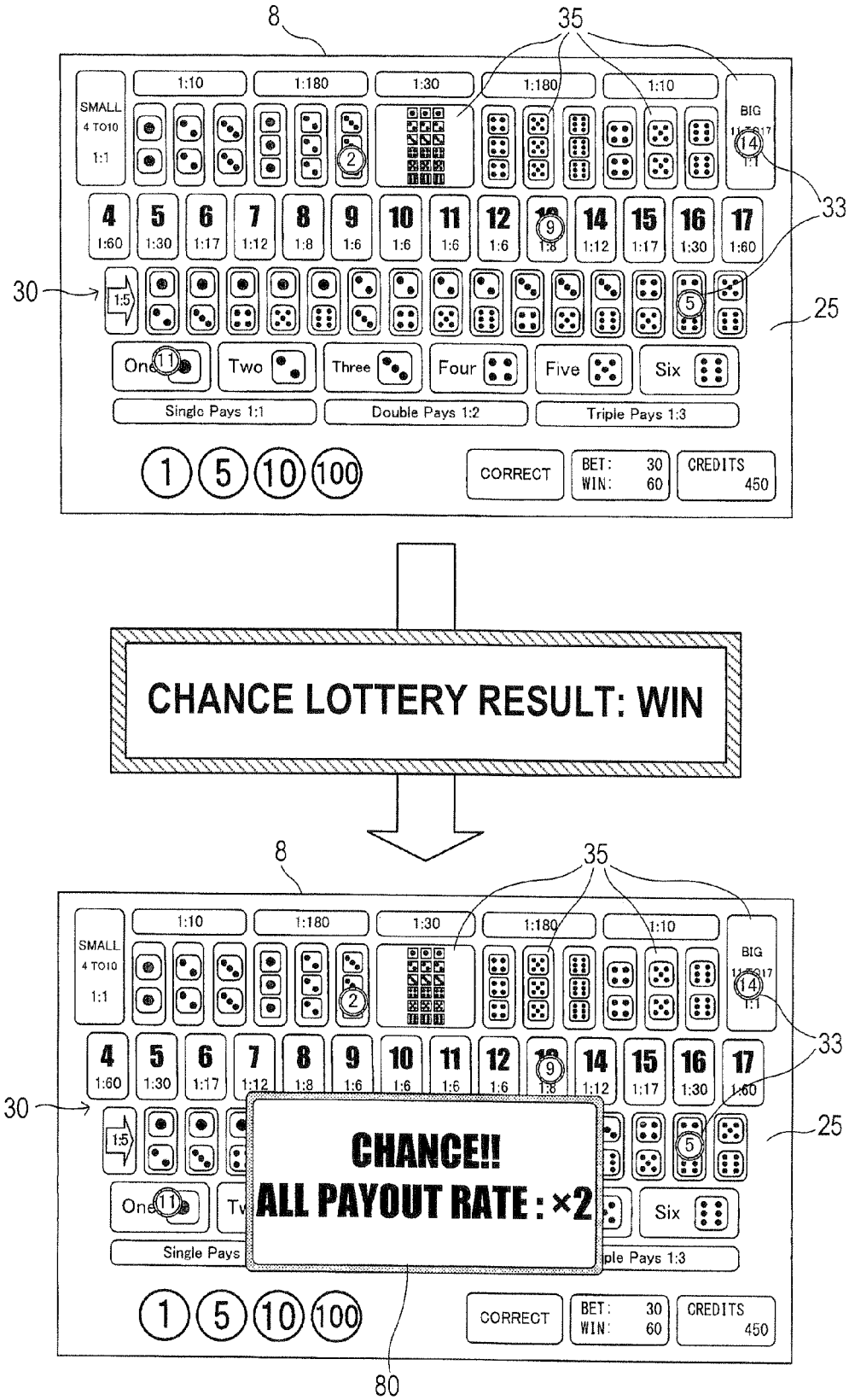
FIG. 1 is an exemplary diagram showing the characteristics of the dice gaming machine according to first embodiment of the present invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A dice gaming machine according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the dice gaming machine may be a virtual dice gaming machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Hereinafter, the dice gaming machine according to the present invention will now be described in detail in a first to fourth embodiments relating to a dice gaming machine, while referring to the drawings.

[First Embodiment ]

Here, characteristics of a dice gaming machine 1 will next be described. FIG. 1 is an exemplary view showing characteristics of a dice gaming machine 1 according to the first embodiment.

A dice game which is called "Sic Bo" is played in the dice gaming machine 1. In "Sic-Bo", three dice 40 are rolled. Players predict the result of dice rolling (specifically, the spots on the three dice 40). Also, the players bet gaming values on a betting board 30 based on their prediction.

Here, the betting board 30 is made up of a plurality of bet areas 35 (refer to FIG. 1, etc.). Each bet area 35 is associated with a winning condition and a payout magnification ratio. The winning condition is a condition defined by spot(s) on some or all of the three dice 40. If the spots on the rolled dice 40 satisfy the winning condition, the player who placed a bet on this bet area 35 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 35 corresponding to their prediction as described above.

If the spots on the rolled dice 40 satisfy the winning condition defined for the bet area that is placed a bet by the player, the player wins a prize. The prize in this case is determined by multiplying the amount of gaming value bet by the player by the payout magnification ratio of the bet area 35 in question.

Here, once reception of gaming value bets ends, the dice gaming machine 1 according to the first embodiment executes a chance lottery process (S6). If the result of the chance lottery is "chance lottery result: win", the dice gaming machine 1 changes the payout magnification ratio to be used in determining the prize contents. More specifically, the dice gaming machine 1 multiplies the payout magnification ratio set for all bet areas by a special magnification ratio (for instance, "33 2"). Accordingly, in the case of a chance lottery win, a player can be awarded twice the payout amount as compared to normal times (specifically, in the case of no win in chance lottery).

The result of this chance lottery is applied to all terminals 5 constituting the dice gaming machine 1. Specifically, in the case of a win in the chance lottery, players at the plurality of terminals 5 can win a larger payout amount than usual on condition that the winning condition of the bet area 35 placed a bet by each of the player is satisfied.

In the first embodiment, the payout magnification ratio includes a base payout magnification ratio and a special payout magnification ratio. The base payout magnification ratio is the payout magnification ratio set for each bet area 35. The base payout magnification ratio is used in calculating the prize (e.g., payout amount) in the case no win occurs in the chance lottery. The special payout magnification ratio is the changed payout magnification ratio directed to the bet area 35. The changed payout magnification ratio is obtained by multiplying the base payout magnification ratio by the special magnification ratio (for instance, "×2"). Specifically, the special payout magnification ratio is used in calculating the prize in the case of a win in the chance lottery.

Figure 2:
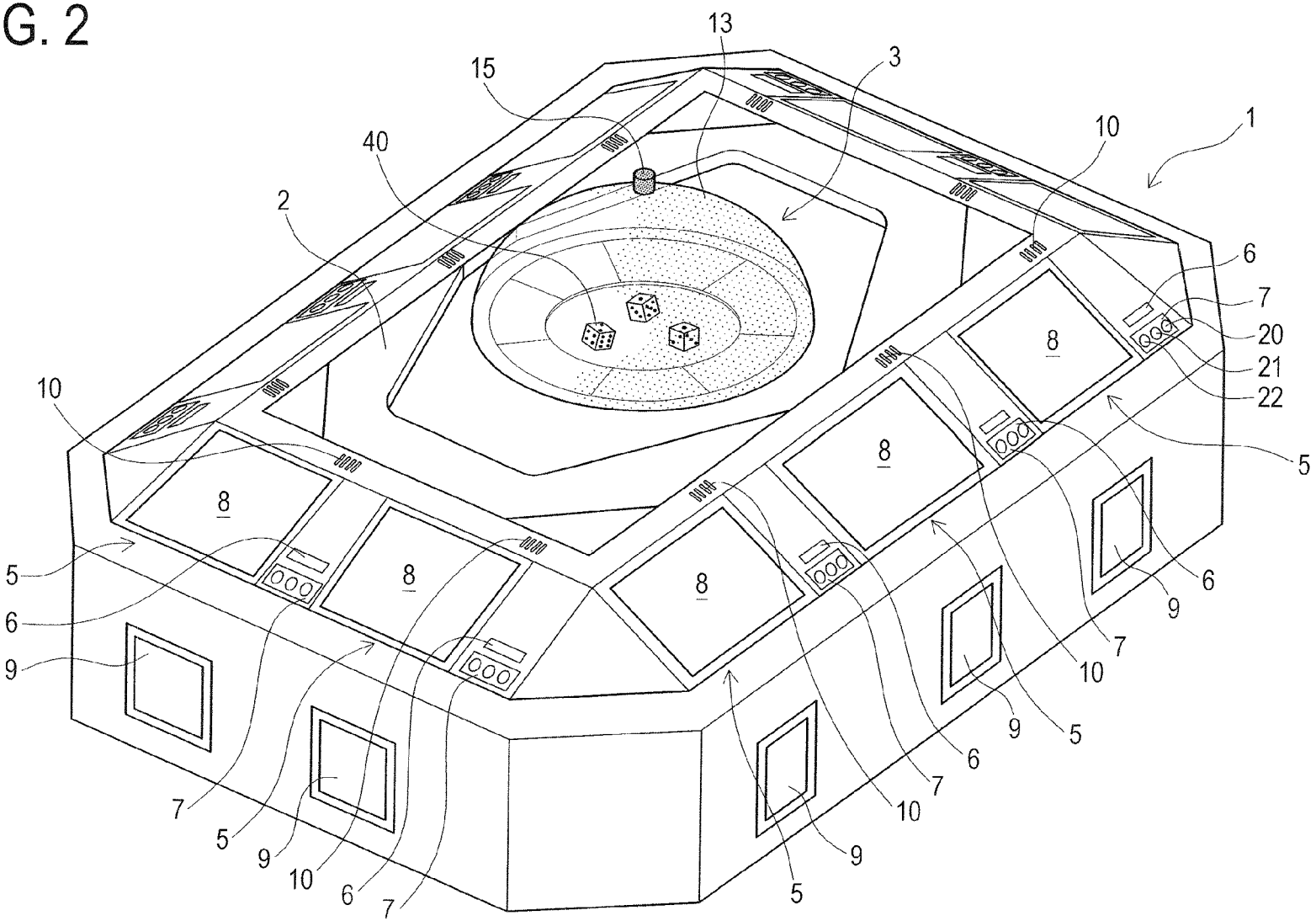
FIG. 2 is a perspective view showing an outer appearance of the dice gaming machine according to first embodiment of the present invention.

Next, a schematic configuration of the dice gaming machine 1 will be described in detail while referring to the drawings. FIG. 2 is a schematic diagram showing an outer appearance of the dice gaming machine 1 according to the first embodiment.

As shown in FIG. 2, the dice gaming machine 1 according to the first embodiment has a cabinet 2, a dice rolling device 3 and a plurality of terminals 5 (in the first embodiment, ten terminals). The cabinet 2 makes up the main part of the dice gaming machine 1. The cabinet 2 houses mechanical components and electrical components such as a main control unit 50 and the like as will be described later.

The dice rolling device 3 is installed at a central portion on an upper face of the cabinet 2. The dice rolling device 3 has a dice box. The dice box houses three dice 40 therein. The three dice 40 are rolled inside the dice box and are then stopped. The configuration of the dice rolling device 3 will be described in detail later.

The terminals 5 are installed at the periphery of the dice rolling device 3. The terminals 5 each have a liquid crystal display 8. The terminals 5 are used in a player's operation with respect to the dice game (e.g., Sic Bo) played in the dice gaming machine 1. Specifically, players enter the dice game played in the dice gaming machine 1 by using the terminals 5.

The terminals 5 each have a medal acceptance device 6, a control panel 7 and a liquid crystal display 8. The medal acceptance device 6 accepts medals ,am exemplary type of gaming value, inserted by the player. Specifically, in the case of playing the dice game, the player inserts medals, an exemplary type of gaming value, in the medal acceptance device 6. The gaming values thus inserted are stored as credit. The player places a bet onto a bet area 35 using such credit.

The control panel 7 is installed at a lower side of the medal acceptance device 6. This control panel 7 has a plurality of operation buttons. More specifically, the control panel 7 also has a BET determination button 20, a CASHOUT button 21 and a HELP button 22.

The BET determination button 20 is operated by the player to determine a bet operation. Specifically, the player operates the BET determination button 20 to determine the bet area 35 which will be the bet target and the amount of gaming values to be bet with respect to the bet area 35 (hereinafter referred to as bet amount).

The CASHOUT button 21 is operated by the player to request payout of the credits he/she possesses. When this CASHOUT button 21 is operated, medals are paid out from a cash out port 9 in accordance with the number of credits that the player possesses.

The HELP button 22 is operated in the case the operation method and the rules of the game are unclear. When the HELP button 22 is operated, the dice gaming machine 1 displays a HELP screen containing explanations with respect to the game operation method and the like onto the liquid crystal display 8.

The liquid crystal display 8 is a display device for displaying information with respect to the dice game. When the dice game is started, each liquid crystal display 8 displays an image of the betting board 30. The touch panel 25 is arranged at a front face of the liquid crystal display 8 in each terminal 5. Accordingly, the player carries out a bet operation with respect to the bet area 35 using this touch panel 25.

Each terminal 5 has a cash out port 9 and a speaker 10. The cash out port 9 is arranged at a lower side of the liquid crystal display 8. This cash out port 9 serves to output medals. For instance, once the CASHOUT button 21 is operated, a number of medals corresponding to the credits the player possesses are paid out to the cash out port 9. Speaker 10 is installed at a right upper side of the liquid crystal display 8. The speaker 10 outputs sounds based on the progress of the game.

Next, the dice rolling device 3 installed in the dice gaming machine 1 will be described in detail while referring to the drawings.

As shown in FIG. 2, the dice rolling device 3 is installed at an upper face of the cabinet 2. The dice rolling device 3 houses three dice 40 therein. The three dice 40 are rolled inside the dice rolling device 3 by controlling the operation of the dice rolling motor 12 as will be described later. The rolled dice 40 are then stopped on a dice rolling board 11. The dice rolling device 3 is installed at a central portion of the cabinet 2. Accordingly, players who are seated at the terminals 5 can see the dice 40 as they are being rolled inside the dice rolling device 3 and the spots on the dice 40 after these are stopped inside the dice rolling device 3.

Figure 3:
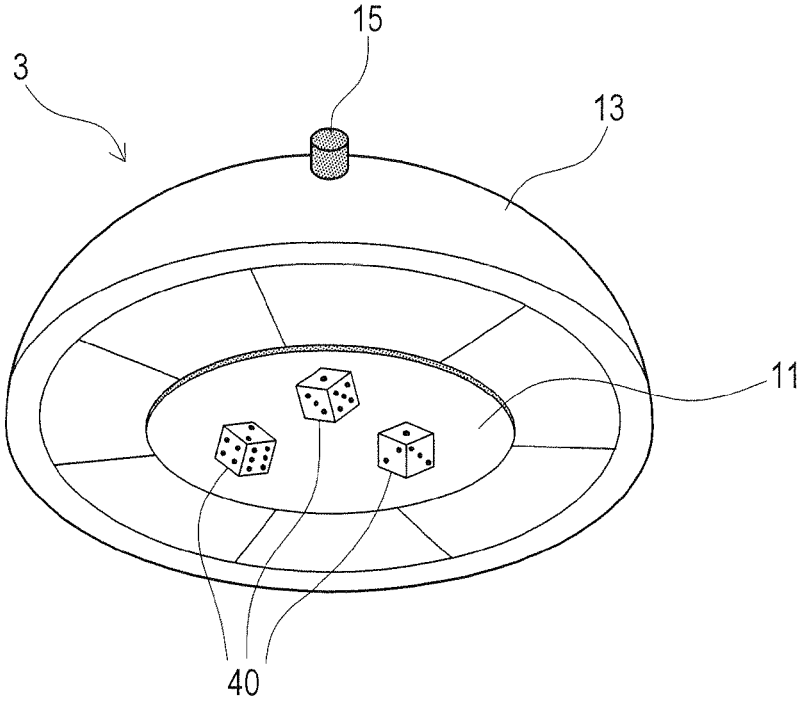
FIG. 3 is a view showing an outer appearance of a dice rolling device according to first embodiment of the present invention.
Figure 4:
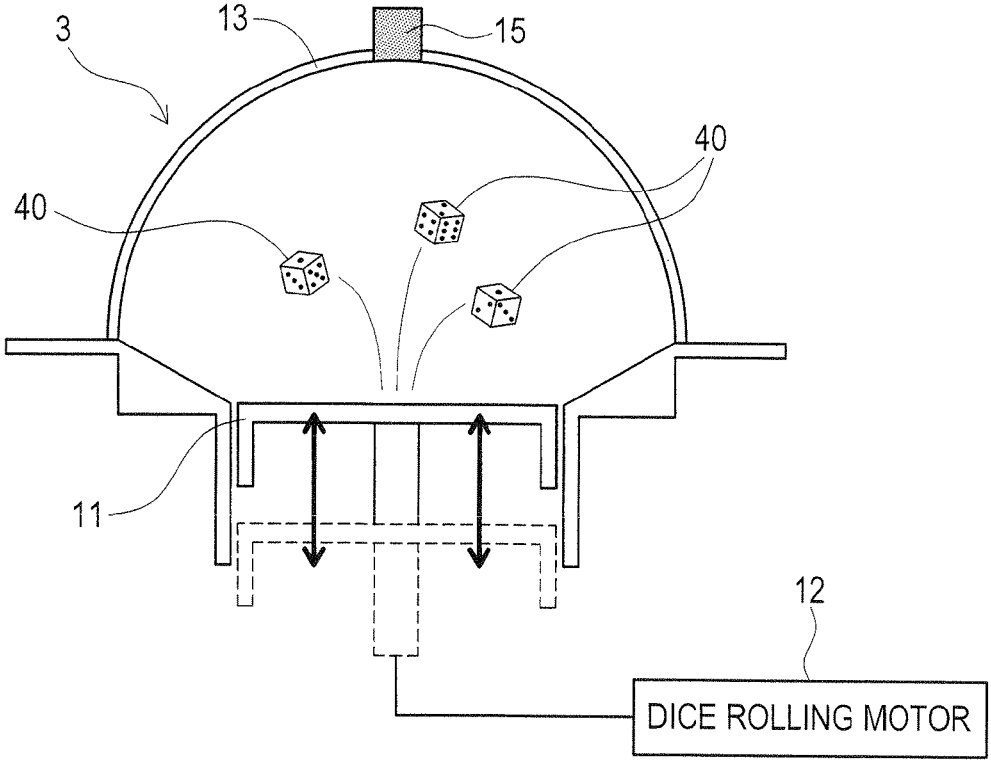
FIG. 4 is an exemplary diagram relating to an operation of the dice rolling device according to first embodiment of the present invention.

As shown in FIG. 3 and FIG. 4, the dice rolling device 3 has a dice rolling board 11, a dice rolling motor 12, a cover member 13 and a rolling result detection unit 15. The dice rolling board 11 moves up and down within a predetermined range inside the dice rolling device 3 (refer to FIG. 4). The dice rolling board 11 is connected to the dice rolling motor 12. Specifically, the dice rolling board 11 moves up and down within the predetermined range based on driving and control of the dice rolling motor 12.

As shown in FIG. 4, in the case of rolling the dice 40, the dice rolling motor 12 causes the dice rolling board 11 to move upwards at a certain speed or faster. Once the dice rolling board 11 moves over a predetermined range, the board stops moving. Accordingly, the dice 40 on the dice rolling board 11 are thrown upwards and are thus rolled inside the dice rolling device 3. As shown in FIG. 4, an inclined face is formed at the periphery of the dice rolling board 11. Accordingly, the three dice 40 thus roll on the inclined face and then stop on the dice rolling board 11.

The cover member 13 is formed in a hemispherical shape to cover the three dice 40 and the dice rolling board 11 (refer to FIG. 3 and FIG. 4). Specifically, the three dice 40 are rolled inside a space defined by the upper face of the dice rolling board 11 and the inner face of the cover member 13. The cover member 13 is made of a transparent acrylic material. Accordingly, the player can sufficiently see the dice 40 while being rolled inside the dice rolling device 3 and the dice 40 as stopped on the dice rolling board 11.

The rolling result detection unit 15 is installed at a top of the cover member 13 (refer to FIG. 3 and FIG. 4). The rolling result detection device 15 detects the spots on each die 40 which is stopped on the dice rolling board 11 (hereinafter referred to as rolling result). More specifically, the rolling result detection unit 15 acquires an image of each die 40 which is stopped on the dice rolling board 11. The rolling result detection unit 15 identifies the spots on each die 40 by carrying out a predetermined image process with respect to the images thus acquired. Here, information showing the identified spots on the three dice 40 is referred to as rolling result information.

The image processing for identifying the spots on dice 40 is heretofore known in the art. Therefore, further description thereof will hereby be omitted.

Figure 5:
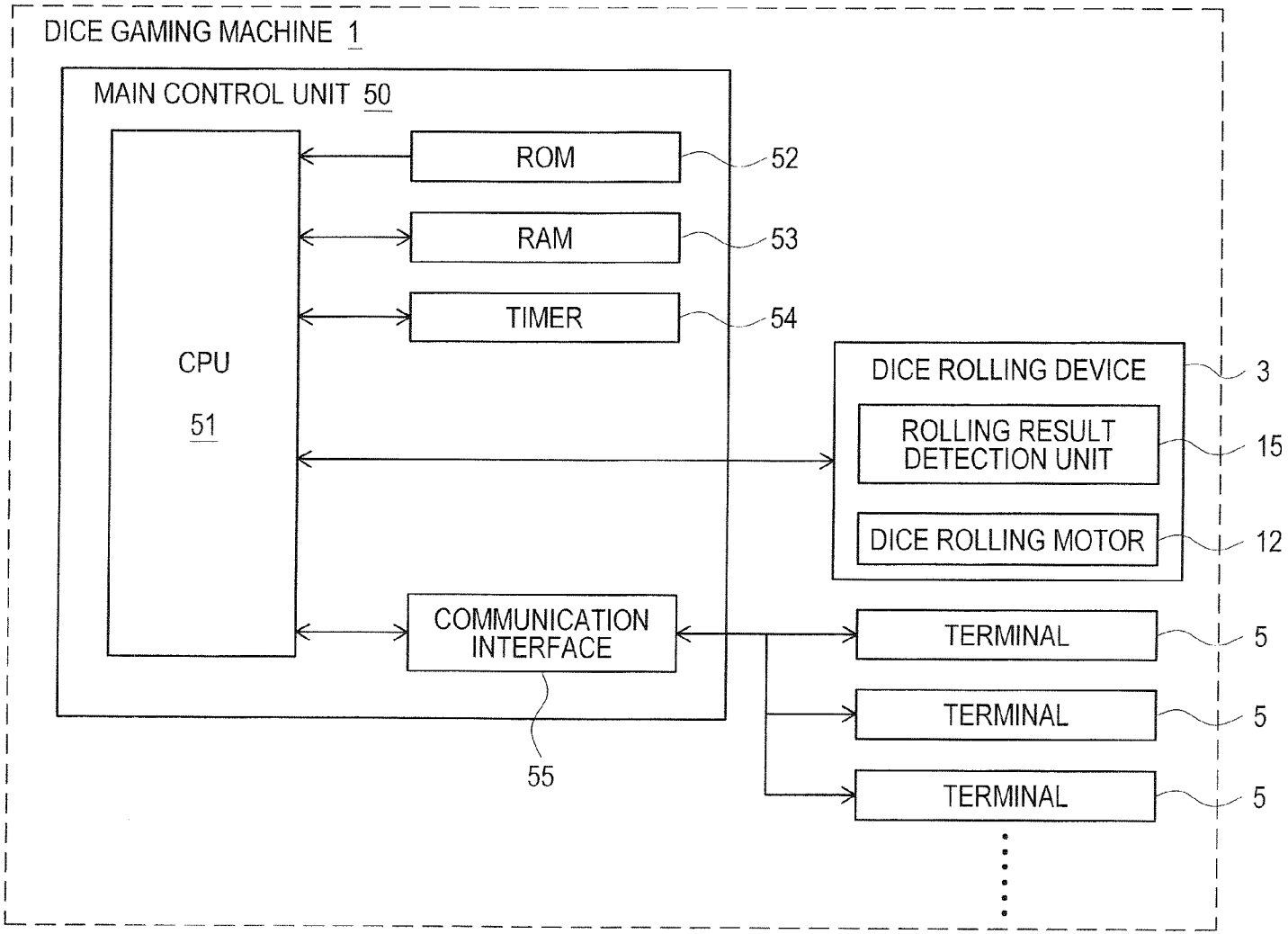
FIG. 5 is a block diagram showing an internal configuration of the dice gaming machine according to first embodiment of the present invention.

Next, the internal configuration of the dice gaming machine 1 according to the first embodiment will be further described in detail while referring to the drawings. FIG. 5 is a block diagram showing an internal configuration of the dice gaming machine according to the first embodiment.

As shown in FIG. 5, the dice gaming machine 1 has a main control unit 50. The main control unit 50 controls the entire dice gaming machine 1. The main control unit 50 has a CPU 51, a ROM 52 and a RAM 53.

The CPU 51 is a central processing unit with respect to control by the main control unit 50. Specifically, the CPU 51 plays a central role in the control by the main control unit 50. In other words, the CPU 51 controls the entire dice gaming machine 1 by executing the various programs stored in the ROM 52. For instance, the CPU 51 progresses the dice game in the dice gaming machine 1 by executing a dice game execution process program (refer to FIG. 8 and FIG. 9) as will be described later.

The ROM 52 stores various types of programs to be executed in the CPU 51. More specifically, the ROM 52 stores a dice game execution process program (refer to FIG. 8 and FIG. 9), a payout amount determination process program (refer to FIG. 10) and a lottery program and the like. The ROM 52 also stores various types of data tables. These data tables are referenced upon executing various programs. Accordingly, the payout table and the chance lottery table as will be described later (refer to FIG. 11) are also stored in the ROM 52.

The ROM 52 stores a BIOS (Basic Input/Output System) and an authentication program. When power is applied to the dice gaming machine 1, the CPU 51 executes the BIOS stored in the ROM 52. As a result, the CPU 51 initializes the peripheral devices constituting the dice gaming machine 1. The CPU 51 authenticates the dice game execution process program and the like by executing an authentication program. At this time, the CPU 51 checks the presence of any alterations with respect to the dice game execution process program and the like. These processes are executed in an initial setting process executed at the time of applying power.

The RAM 53 temporarily stores the results of the processing executed by the CPU 51. Specifically, the RAM 53 temporarily stores the processing results following execution of the above-mentioned programs (for instance, lottery results of the chance lottery process and the like). The RAM 53 temporarily stores various types of information regarding the dice game (for instance, bet information transmitted from the terminals 5, rolling result information transmitted from the rolling result detection device 15 and the like).

The main control unit 50 has a timer 54 and a communication interface 55. The timer 54 is a clock device which is connected to the CPU 51. The CPU 51 references the measurement result of the timer 54 in the case of judging the lapse of the bet period and in the case of judging the arrival of rolling timing.

The bet period refers to the period of accepting the bet operation made by the players at the terminals 5. Specifically, lapse of the bet period indicates that acceptance of bets for gaming values with respect to the bet area 35 has ended. Rolling timing indicates the timing when rolling of dice 40 inside the dice rolling device 3 is started.

The communication interface 55 is connected to the CPU 51. The communication interface 55 is also connected to the terminals 5 constituting the dice gaming machine 1. Specifically, the CPU 51 transmits various types of information and control signals with respect to the terminals 5 through the communication interface 55. Further, the CPU 51 can receive the information (for instance, bet information) and the control signals from the terminals 5 through the communication interface 55.

Further, the CPU 51 constituting the main control unit 50 is connected to the dice rolling device 3. As was described earlier, the dice rolling device 3 has a dice rolling motor 12 and a rolling result detection device 15. Accordingly, the CPU 51 can drive and control the dice rolling motor 12 by transmitting a predetermined control signal to the dice rolling device 3. Specifically, the CPU 51 can cause the dice 40 to roll and stop in the dice rolling device 3. The rolling result detection device 15 can identify a rolling result indicating the spots on the stopped dice 40. Accordingly, the CPU 51 can acquire the rolling result information based on the spots on the dice 40 as identified by the rolling result detection device 15 (S11).

Figure 6:
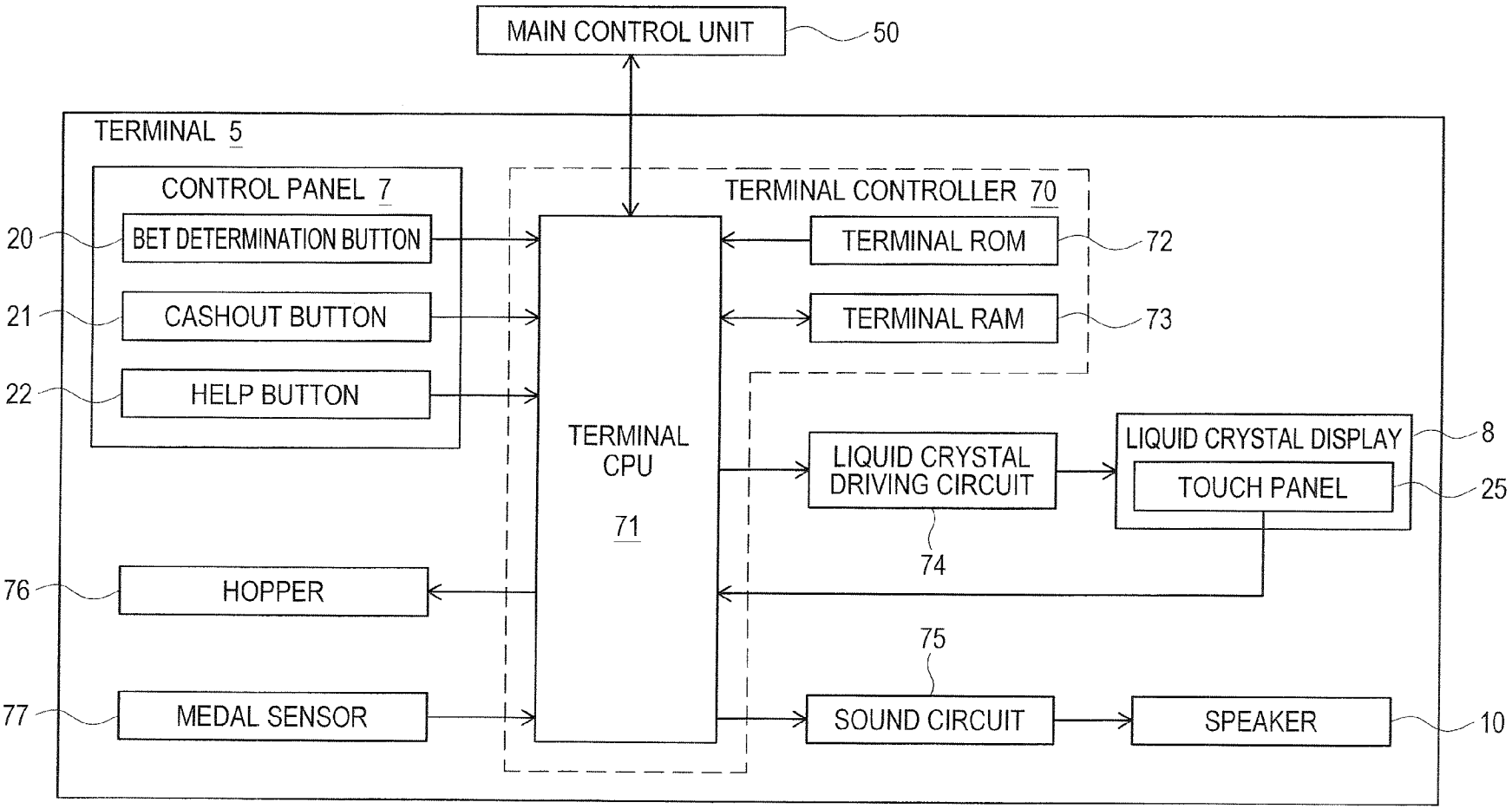
FIG. 6 is a block diagram showing an internal configuration of a terminal according to first embodiment of the present invention.

Next, the terminals 5 constituting the dice gaming machine 1 will be described in detail while referring to the drawing. FIG. 6 is a block diagram showing the internal configuration of a terminal 5.

The terminals 5 constituting the dice gaming machine 1 all have the same configuration. Accordingly, the internal configuration of one terminal 5 will be described in detail. Description of the other terminals 5 constituting the dice gaming machine 1 will hereby be omitted.

As shown in FIG. 6, the terminal 5 has a terminal controller 70. This terminal controller 70 controls the various functions of the terminal 5. The terminal controller 70 has a terminal CPU 71, a terminal ROM 72 and a terminal RAM 73.

The terminal CPU 71 is a central processing unit with respect to control made by the terminal controller 70. Specifically, the terminal CPU 71 plays a central role in the control with respect to the terminal 5. More specifically, the terminal CPU 71 controls the terminal 5 by executing various types of programs stored in the terminal ROM 72. For instance, the terminal CPU 71 carries out control with respect to the dice game (for instance, control with respect to acceptance of bet operation and payment of payout) by executing the dice game execution process program (refer to FIG. 8 and FIG. 9) as will be described later.

The terminal ROM 72 stores various types of programs to be executed in the terminal CPU 71. More specifically, the terminal ROM 72 stores dice game execution process programs (refer to FIG. 8 and FIG. 9) and the like. The terminal ROM 72 stores various types of data tables. These data tables are referenced upon execution of the various programs.

The terminal ROM 72 also stores a BIOS (Basic Input/Output System) and an authentication program. When power is applied to the dice gaming machine 1, the terminal CPU 71 executes the BIOS stored in the terminal ROM 72. As a result, the terminal CPU 71 initializes the peripheral devices constituting the terminals 5. The terminal CPU 71 authenticates the dice game execution process program and the like by executing an authentication program. At this time, the terminal CPU 71 checks the presence of any alterations with respect to the dice game execution process program and the like. These processes are executed in an initial setting process executed at the time of power application.

The terminal RAM 73 temporarily stores the results of the processing executed in the terminal CPU 71. Specifically, the terminal RAM 73 temporarily stores the processing results following execution of the above-mentioned programs (for instance, bet information based on the players' bet operation). The terminal RAM 73 temporarily stores various types of information regarding the dice game (for instance, payout information transmitted from the main control unit 50 and the like).

The terminal CPU 71 is connected with the control panel 7. As was described earlier, the control panel 7 has a BET determination button 20, a CASHOUT button 21 and a HELP button 22. Specifically, the BET determination button 20, the CASHOUT button 21 and the HELP button 22 are each connected to the terminal CPU 71. Accordingly, when a player operates the BET determination button 20, the CASHOUT button 21 and the HELP button 22, a control signal based on each such operation can be inputted to the terminal CPU 71. The terminal CPU 71 can thus carry out control in accordance with the button that was operated, based on the operation signal thus inputted.

The terminal CPU 71 is connected with the liquid crystal display 8 through a liquid crystal driving circuit 74. The liquid crystal driving circuit 74 serves as a control circuit with respect to display on the liquid crystal display 8. The liquid crystal driving circuit 74 is made up of a program ROM, an image ROM, an image control CPU, a work RAM, a VDP (video display processor) and a video RAM, etc. The program ROM stores various types of selection tables and image control programs regarding display on the liquid crystal display 8. The image ROM stores dot data. This dot data is used for forming images to be displayed on the liquid crystal display 8. The image control CPU determines images to be displayed on the liquid crystal display 8 from the dot data stored in the image ROM, based on the parameters set in the terminal CPU 71 and the image control program. The work RAM serves as a temporary storage device at the time the image control program is executed in the image control CPU. The VDP forms images in accordance with the display contents determined by the image control CPU. The VDP outputs the images thus formed to the liquid crystal display 8. The video RAM serves as a temporary storage device at the time images are formed in the VDP.

As was described earlier, the liquid crystal display 8 has a touch panel 25 provided at a front face thereof. As is shown in FIG. 6, the terminal CPU 71 is connected with the touch panel 25. The touch panel 25 detects the coordinate information corresponding to a portion touched by the player. Accordingly, the touch panel 25 can identify a player's operation with respect to the touch panel 25 based on the coordinate information. The operation information indicating a player's operation with respect to the touch panel 25 is transmitted from the touch panel 25 to the terminal CPU 71.

In the dice gaming machine 1 according to the first embodiment, when the betting board 30 is displayed on the liquid crystal display 8 (refer to FIG. 7), the players select the bet areas 35 making up the betting board 30 and depress the unit BET button 31 using the touch panel 25. Accordingly, information with respect to the bet areas 35 thus selected and the unit BET button 31 is transmitted from the touch panel 25 to the terminal CPU 71.

The terminal CPU 71 is connected with the speaker 10 through a sound circuit 75. The sound circuit 75 carries out control with respect to sound output from speaker 10 based on the control signal transmitted from the terminal CPU 71. The speaker 10 outputs various effect sounds in accordance with the progress of the dice game. As a result, the dice gaming machine 1 can execute effects in accordance with the progress of the dice game at each terminal 5.

The terminal CPU 71 is connected with a hopper 76 and a medal sensor 77. The hopper 76 pays out medals to the cash out port 9 based on the control signal from the terminal CPU 71. The medal sensor 77 detects the medals paid out from the hopper 76. As a result, the terminal CPU 71 can pay out a predetermined number of medals to the players by controlling the hopper 76 and the medal sensor 77.

Figure 7:
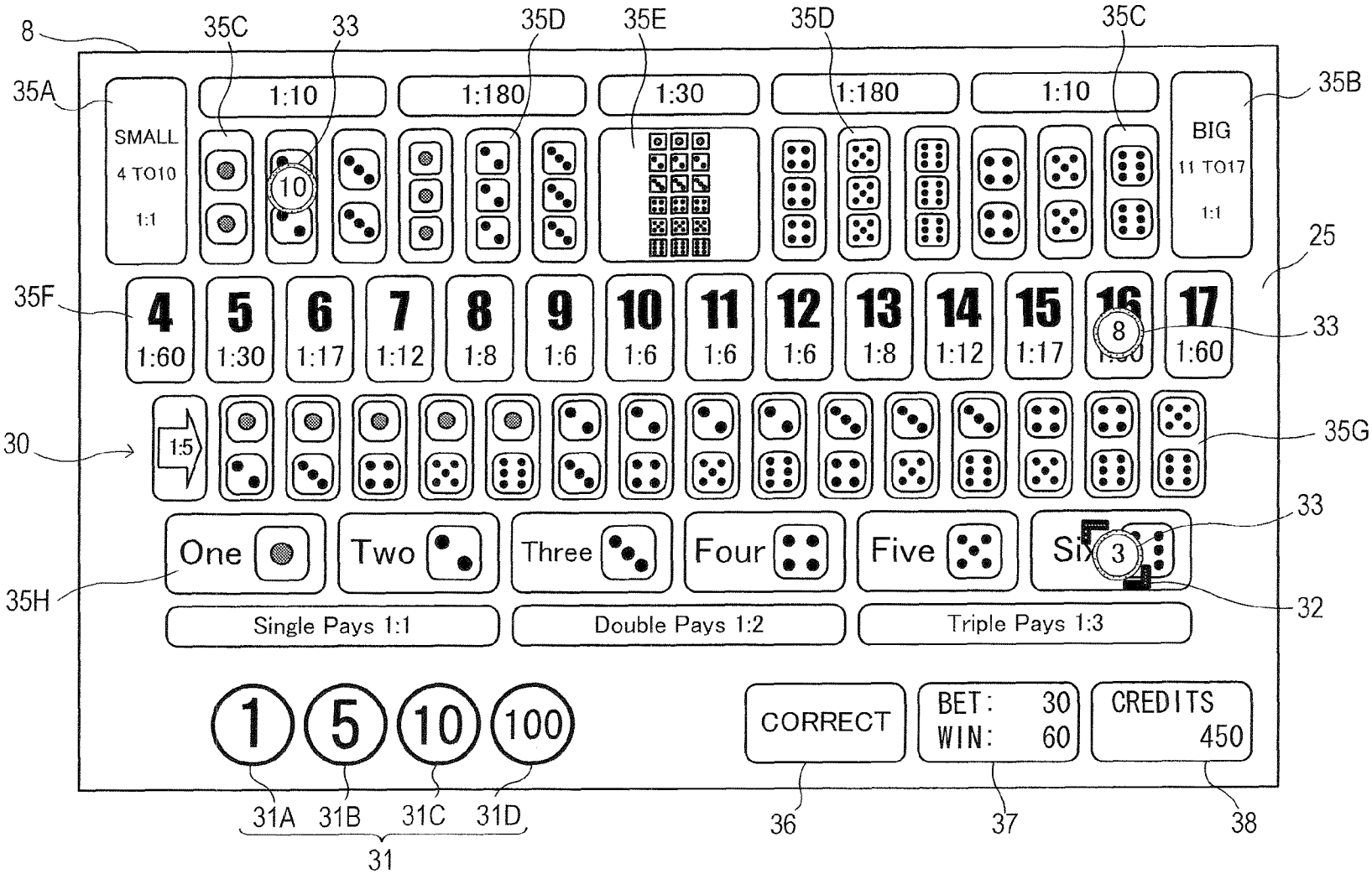
FIG. 7 is an exemplary view showing a game screen including a betting board according to first embodiment of the present invention.

Next, a detailed description will be given with respect to the game screen to be displayed on the liquid crystal display 8 in the dice gaming machine 1 according to the first embodiment, while referring to the drawings. FIG. 7 is an explanatory diagram showing one example of a game screen to be displayed on the liquid crystal display 8.

As shown in FIG. 7, the game screen displayed on the liquid crystal display 8 includes the betting board 30. Here, when a dice game (e.g., Sic Bo) is played, the players bet gaming values with respect to the spots on the stopped three dice 40. The betting board 30 is used by the player in betting the gaming values.

The betting board 30 has a plurality of bet areas 35. Each bet area 35 is associated with a winning condition and a payout magnification ratio (e.g., base payout magnification ratio). The winning condition is the condition determined by the stopped three dice 40. The base payout magnification ratio shows the payout amount to be paid out in return to the unit gaming value (specifically, one credit) bet, in a case where the winning condition of the bet area 35 is satisfied.

More specifically, the betting board 30 has eight types of bet areas 35. Specifically, the betting board 30 has a small bet area 35A, a big bet area 35B, a specific double bet area 35C, a specific triple bet area 35D, an any triple bet area 35E, a total bet area 35F, a combination bet area 35G and a number bet area 35H.

The small bet area 35A and the big bet area 35B are bet areas in each of which a condition is defined with a range of values as a result of adding up the spots on the stopped dice 40 (hereinafter referred to as total value). More specifically, the winning condition of the small bet area 35A is that "the total value is in a range between 4 and 10". The base payout magnification ratio of the small bet area 35A is set to 1:1 (two medals are paid out in return to a win with one medal placed as a bet). Alternatively, the winning condition of the big bet area 35B is that "the total value is in a range between 11 and 17". The base payout magnification ratio of the big bet area 35B is also set to 1:1.

The specific double bet area 35C is a bet area in which a winning condition is defined with a combination of spots on the stopped dice 40. More specifically, the winning condition of the specific double bet area 35C is satisfied if "amongst the three dice 40 which are stopped, the spots on two dice 40 are the same, and the spots on these two dice 40 correspond to specific spots". The betting board 30 has six specific double bet areas 35C. Accordingly, if the spots on two dice 40 from amongst the three dice 40 are "1,1", "2,2", "3,3" . . . or "6,6", the winning condition for one specific double bet area 35C is satisfied (refer to FIG. 7). The base payout magnification ratio of each specific double bet area 35C is set to 1:10.

The specific triple bet area 35D is a bet area in which a winning condition is defined a combination of the stopped three dice 40. More specifically, the winning condition of the specific triple bet area 35D is satisfied if "the spots on the three dice 40 which are stopped are the same and the spots on the three dice 40 correspond to specific spots". The betting board 30 has six specific triple bet areas 35D. Accordingly, if the spots on the three dice 40 are "1,1,1", "2,2,2", "3,3,3" . .

. or "6,6,6", the winning condition for one specific triple bet area 35D is satisfied (refer to FIG. 7). The base payout magnification ratio of each specific triple bet area 35C is set to 1:180.

The any triple bet area 35E is a bet area in which a winning condition is defined with a combination of the spots on the stopped three dice 40. More specifically, the winning combination of the any triple bet area 35E is satisfied if "the spots on the stopped dice 40 are all the same". Accordingly, if the spots on the three dice 40 are "1,1,1", "2,2,2", "3,3,3" . . . or "6,6,6", the winning combination of the any triple bet area 35E is satisfied (refer to FIG. 7). The base payout magnification ratio of the any triple bet area 35E is set to 1:30.

The total bet area 35F is a bet area in which a winning condition is defined with a total value of the spots on the stopped three dice 40. More specifically, the winning combination of the total bet area 35F is satisfied if "the total value is a specific value". As shown in FIG. 7, the betting board 30 has fourteen total bet areas 35F. Specifically, the betting board 30 has a total bet area 35F corresponding to each total value "4", "5" . . . "17". As shown in FIG. 7, the base payout magnification ratio of each total bet area 35F is set in accordance with the appearance frequency of the total value for each winning condition. For instance, if the winning condition for the total value "16" is the total bet area 35F thus set, the base payout magnification ratio is 1:30.

The combination bet area 35G is a bet area in which a winning condition is defined with a combination of the spots on the stopped dice 40. More specifically, the winning condition of the combination bet area 35G is satisfied if "the spots on two dice 40 from amongst the stopped three dice 40 correspond to a specific combination". As shown in FIG. 7, the betting board 30 has fifteen combination bet areas 35G. The base payout magnification ratio for the combination bet area 35G is set to 1:5.

The combination for the case that the spots on two dice 40 are the same is excluded from the combination bet area 35G.

The number bet area 35H is a bet area in which a winning condition is defined with the spots' numbers on the dice 40. More specifically, the winning combination of the number bet area 35H is satisfied if "a specific spot is included in the spots on the stopped three dice 40". As shown in FIG. 7, the betting board 30 has six number bet areas 35H. One number bet area 35H corresponds to any of "1", "2" . . . "6". The base payout magnification ratio of the number bet area 35H is set to "1:1", "1:2", "1:3", in accordance with the number of dices showing the spots corresponding to the winning combination.

The game screen can include a cursor 32 and a chip mark 33. The cursor 32 and the chip mark 33 are displayed on the betting board 30 in accordance with a player's operation. The cursor 32 shows the bet area 35 which is currently selected by the player. The chip mark 33 shows the amount of gaming values bet with respect to the bet area 35 (hereinafter referred to as bet amount). As shown in FIG. 7, the chip mark 33 shows the above-mentioned bet amount through the number displayed at the center of the chip mark 33. The chip mark 33 is displayed on the bet area 35. Specifically, the chip mark shows the bet area 35 onto which the bet is made through the location of its display.

Further, as shown in FIG. 7, the game screen includes a unit BET button 31, a CORRECT button 36, a payout result display portion 37 and a credit amount display portion 38.

The unit BET button 31 is formed at a lower left side of the betting board 30. The unit BET button 31 is used to set the bet amount with respect to the bet area 35 selected by the player.

As shown in FIG. 7, the unit BET button 31 is made up of 1 BET button 31A, 5 BET button 31B, 10 BET button 31C and 100 BET button 31D. The 1 BET button 31A is operated by the player to increase the bet amount with respect to the bet area 35 selected by the player by "1". The 5 BET button 31B is operated by the player to increase the bet amount with respect to the bet area 35 selected by the player by "5". The 10 BET button 31C is operated by the player to increase the bet amount with respect to the bet area 35 selected by the player by "10". The 100 BET button 31D is operated by the player to increase the bet amount with respect to the bet area 35 selected by the player by "100".

Each time the player carries out such operation, the unit BET button 31 adds a bet amount in accordance with such operation to the current bet amount.

The CORRECT button 36 is operated to cancel the bet area 35 already selected and the setting of the bet amount. If selection of the bet area 35 and setting of the bet amount are incorrect, the player can correct the bet area 35 and the bet amount by operating this CORRECT button 36.

The payout result display portion 37 displays the total bet amount in the previous game and the payout amount in the previous game (the payout credit amount).

The credit amount display portion 38 displays the credit amount possessed by the player. The display contents of the credit amount display portion 38 are updated based on the bet with respect to the bet area 35 and award of the payout in the dice game.

Next, the bet operation carried out by the player using the game screen will be described. As was described earlier, the touch panel 25 is installed at a front face of the liquid crystal display 8. The touch panel 25 transmits the coordinate information corresponding to the portion touched by the player to the terminal CPU 71. Accordingly, if the game screen is displayed on the liquid crystal display 8, the player can select the bet area 35 and set the bet amount using the touch panel 25.

More specifically, the player first touches with his/her finger the touch panel 25 at the portion corresponding to the desired bet area 35. As a result, the player selects the desired bet area 35. At this time, the cursor 32 is displayed on the bet area 35 thus selected. Thereafter, the player touches with his/her finger the touch panel 25 at the portion corresponding to the unit BET button 31. As a result, the player selects the bet amount with respect to the selected bet area 35. Once the bet amount is selected, the chip mark 33 is displayed on the bet area 35.

Figure 8:
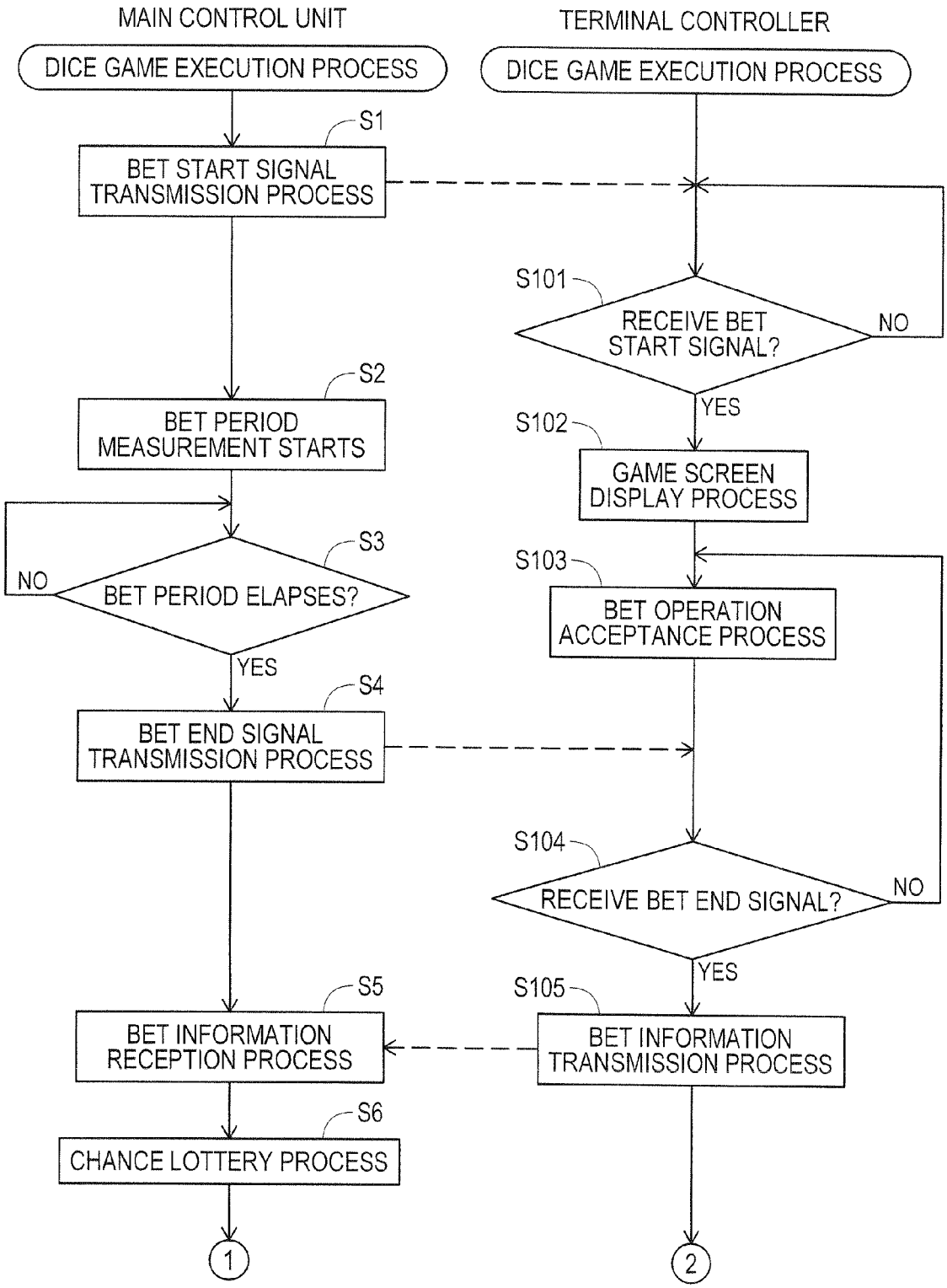
FIG. 8 is a flow chart (1) of a dice game execution process program according to first embodiment of the present invention.
Figure 9:
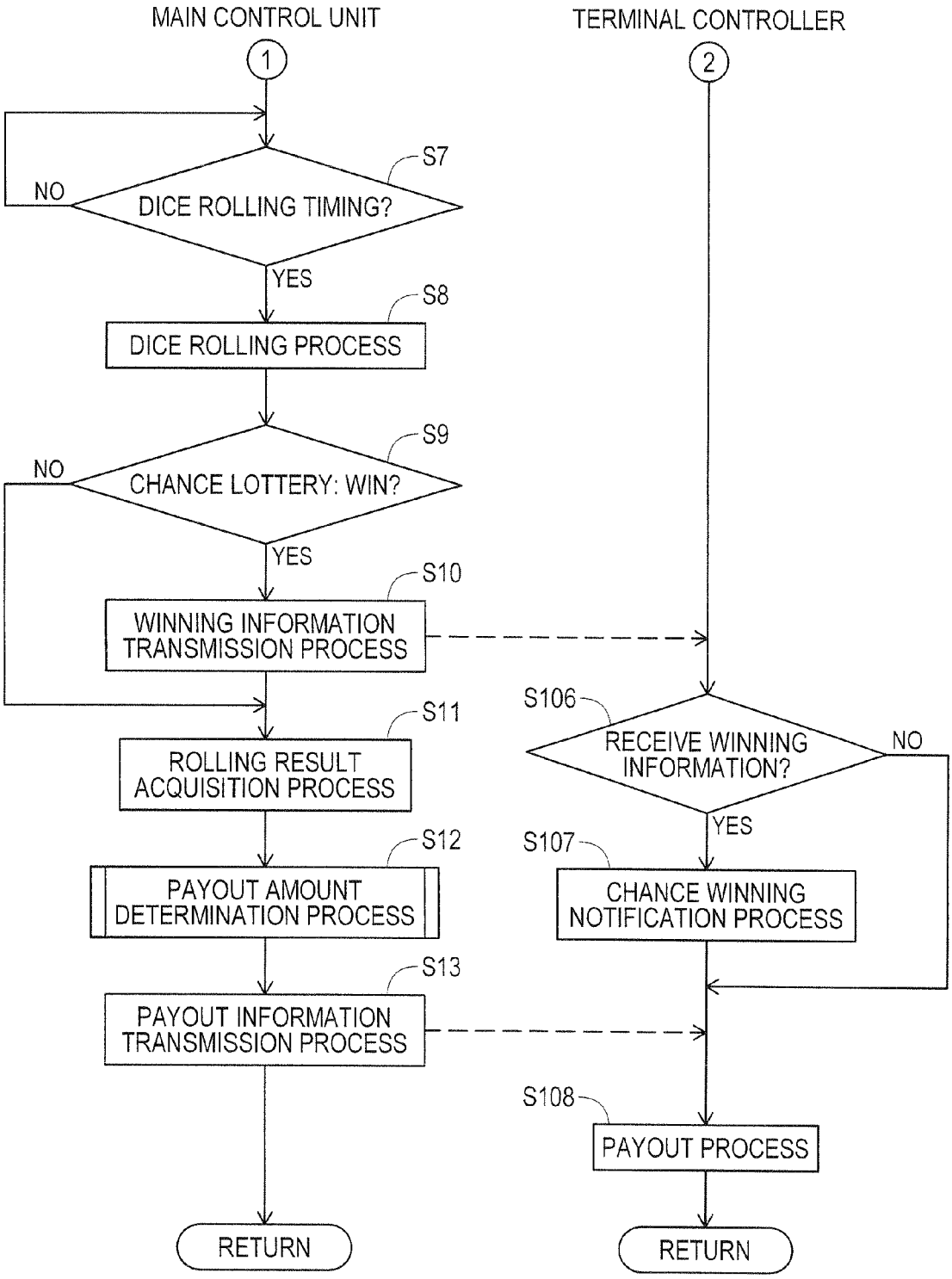
FIG. 9 is a flow chart (2) of the dice game execution process program according to first embodiment of the present invention.

Next, a dice game execution process program to be executed in the dice gaming machine 1 according to the first embodiment will be described in detail while referring to the drawings. FIG. 8 and FIG. 9 are flow charts of the dice game execution process program.

The initial setting process executed in the main control unit 50 and the initial setting process executed in the terminal controller 70 of each terminal 5 are executed prior to the dice game execution process program. Specifically, the main control unit 50 and the terminal controller 70 end initialization of the peripheral devices and the program authentication process. These initial setting processes are heretofore known in the art. Therefore, description of the contents of such processes is hereby omitted.

First, the dice game execution process program in the main control unit 50 will be described in detail.

Once execution of the dice game execution process program is started, the CPU 51 first executes the bet start signal transmission process (S1). In the bet start signal transmission process (S1), the CPU 51 transmits the bet start signal to the terminals 5 through the communication interface 55. The bet start signal serves to instruct start of the bet period in the terminals 5. The bet period is the period for accepting the players' bets for the gaming values with respect to the bet areas 35 at each terminal 5. After the bet start signal is transmitted to the terminals 5, the CPU 51 shifts the process to S2.

Once the bet start signal is received, the terminal CPU 71 executes the game screen display process (S102) and the bet operation acceptance process (S103). This will be described in more detail later.

After shifting to S2, the CPU 51 starts measuring the bet period. More specifically, the CPU 51 transmits the control signal to the timer 54. As a result, the timer 54 starts measurement. After the control signal is transmitted to the timer 54, the CPU 51 shifts the process to S3.

At S3, the CPU 51 judges whether the bet period has lapsed. More specifically, the CPU 51 references the measurement results of the timer 54. The CPU 51 judges whether the predetermined period (e.g., bet period) has lapsed based on the measurement result of the timer 54. If the bet period has lapsed (S3: YES), the CPU 51 shifts the process to S4. Alternatively, if the bet period has not lapsed yet (S3: NO), the CPU 51 puts the process in stand-by until the bet period lapses.

At S4, the CPU 51 executes the bet end signal transmission process. In the bet end signal transmission process (S4), the CPU 51 transmits a bet end signal to the terminals 5. The bet end signal serves to instruct ending of the bet period in each terminal 5. In other words, the bet end signal means that acceptance of bets for gaming values in the terminal 5 is ended. After the bet end signal is transmitted to each terminal 5, the CPU 51 shifts the process to S5.

Once the bet end signal is received, the terminal CPU 71 ends the bet operation acceptance process (S103). Accordingly, the terminal 5 ends acceptance of bets with respect to the bet area 35. Thereafter, the terminal CPU 71 transmits the bet information based on the bet operation carried out in the bet operation acceptance process (S103) to the main control unit 50 (S105). This bet information includes information showing the bet area 35 on which the gaming value has been bet and information showing the bet amount bet on the bet area 35 in question. The bet information includes identification information showing the terminal 5 from which the bet information is transmitted.

After shifting to S5, the CPU 51 executes the bet information reception process. In the bet information reception process (S5), the CPU 51 receives the bet information transmitted from each terminal 5 through the communication interface 55. The CPU 51 stores the bet information thus received in the RAM 53. At this time, the CPU 51 classifies the bet information for each terminal 5 based on the identification information included in the bet information. Once the bet information reception process (S5) ends, the CPU 51 shifts the process to S6.

At S6, the CPU 51 executes a chance lottery process. In this chance lottery process (S6), the CPU 51 determines whether to change the payout magnification ratio of the bet areas 35, by the lottery. In other words, the CPU 51 determines whether to use either the "base payout magnification ratio" or the "special payout magnification ratio" as the payout magnification ratio of each bet area 35. More specifically, the CPU 51 first samples one random number value from a predetermined random number value range by executing a lottery program stored in the ROM 52. Then, the CPU 51 determines the chance lottery result based on the random number value thus sampled and the chance lottery result determination table (refer to FIG. 11). The "chance lottery result: win" means that the payout magnification ratio of all bet areas 35 constituting the betting board 30 changes in all terminals 5 constituting the dice gaming machine 1. As was described earlier, the payout magnification ratio is changed by multiplying the payout magnification ratio set for that bet area 35 by the special magnification ratio (for instance, "×2"). Specifically, in this case, the payout magnification ratio of the bet area 35 is changed from the "base payout magnification ratio" to the "special payout magnification ratio". The "chance lottery result: lose" means using the base payout magnification ratio set for that bet area 35 in the payout amount calculation process as will be described later. After the lottery in the chance lottery process (S6), the CPU 51 stores the lottery result information in the RAM 53. The lottery result information shows the lottery result of the change lottery process (S6). After storing the lottery result information in the RAM 53, the CPU 51 shifts the process to S7.

Figures 10, 11:
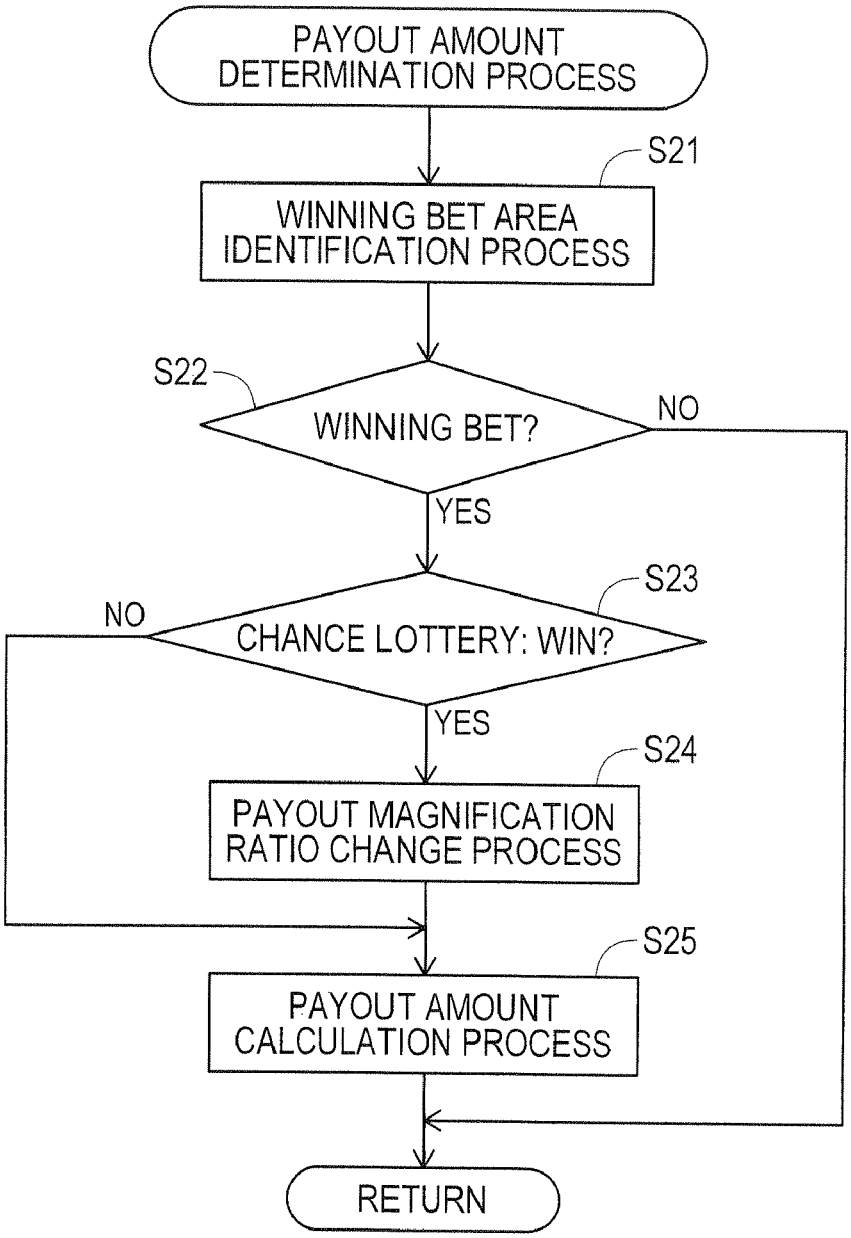
FIG. 10 is a flow chart of a payout amount determination process program according to first embodiment of the present invention.
FIG. 11 is an exemplary diagram showing one example of a chance lottery result determination table according to first embodiment of the present invention.

Here, the chance lottery result determination table used in the chance lottery process (S6) will be described in detail while referring to the drawings. FIG. 11 is an explanatory diagram showing one example of the chance lottery result determination table.

The chance lottery result determination table shown in FIG. 11 is set so that an expected value of all bet areas 35 when the special payout magnification ratio is used does not exceed "1" (e.g., 100%). Here, the expected value of the bet area 35 is calculated by multiplying the amount of unit gaming values (specifically, "bet amount: 1") and the payout magnification ratio of the bet area 35 by the dice winning probability of the bet area 35. The dice winning probability of the bet area 35 is the probability that the winning condition of the bet area 35 will be satisfied in one dice game. For instance, the dice winning probability of a certain specific triple bet area 35D is "1/216".

The expected value of each bet area 35 at a normal time (specifically, in the case of no win in the chance lottery) on the betting board 30 according to the first embodiment ranges from "0.65 to 0.9722" (e.g., 65% to 97.22%). Specifically, in the case of using the base payout magnification ratio, the maximum expected value is "97.22%". Accordingly, if, as a result of changing the payout magnification ratio, the expected value of the bet area 35 corresponding to this maximum value does not exceed "100%", none of the expected values for all the bet areas 35 will exceed "100%".

In the chance lottery result determination table shown in FIG. 11, the "chance lottery result: win" corresponds to "0 to 40" from a random number value range "0 through 2047". Specifically, the probability of the "chance lottery result: win" is approximately 2.00%. Accordingly, even in the case of using the chance lottery result table as shown in FIG. 11, the expected value of the bet area 35 corresponding to the maximum value does not exceed "100%". Specifically, in the case of using this chance lottery result determination table (refer to FIG. 11), the expected value of all bet areas 35 is equal to or lower than "1", even if the chance lottery process (S6) is executed. As a result, the dice gaming machine 1 does not severely impair the game characteristics of the dice game (e.g., Sic Bo) even if a large payout is awarded following the chance lottery process (S6). Since the expected value of each bet area 35 does not exceed "1", the dice gaming machines 1 can reliably ensure a profit at the game arcade where such dice gaming machines 1 are installed.

At S7, the CPU 51 judges whether the dice rolling timing has arrived. The dice rolling timing shows the timing at which rolling of the three dice 40 is started in the dice rolling device 3. More specifically, at S7, the CPU 51 first references the measurement results of the timer 54. Specifically, the CPU 51 carries out the judgment process at S7 based on the measurement result of timer 54. When the dice rolling timing arrives (S7: YES), the CPU 51 shifts the process to S8. Alternatively, if the dice rolling timing has not yet arrived (S7: NO), the CPU 51 puts the process in stand-by until such dice rolling timing arrives.

At S8, the CPU 51 executes a dice rolling process. In this dice rolling process (S8), the CPU 51 transmits a control signal to the dice rolling device 3. As a result, the dice rolling motor 12 is driven and controlled. Accordingly, the three dice 40 are rolled inside the dice rolling device 3. The three dice 40 which have been rolled are then stopped on the dice rolling board 11. Once the dice rolling process ends, the CPU 51 shifts the process to S9.

After shifting to S9, the CPU 51 judges whether a win has occurred in the lottery carried out in the chance lottery process (S6). More specifically, the CPU 51 carries out the judgment process at S9, by referencing the lottery result information stored in the RAM 53. In the case of a win in the lottery carried out in the chance lottery process (S9: YES), the CPU 51 shifts the process to S10. Alternatively, in the case of no win in the lottery carried out in the chance lottery process (S6) (S9: NO), the CPU 51 shifts the process to S11.

At S10, the CPU 51 executes a winning information transmission process. In this winning information transmission process (S10), the CPU 51 transmits the winning information to all terminals 5 constituting the dice gaming machine 1. This winning information shows that a win has occurred in the lottery in the chance lottery process (S6). In the winning information transmission process (S10), the CPU 51 first generates the winning information based on the lottery result information stored in the RAM 53. Thereafter, the CPU 51 transmits the winning information thus generated to all terminals 5 through the communication interface 55. After transmitting the winning information to all terminals 5, the CPU 51 shifts the process to S11.

At S11, the CPU 51 executes a rolling result acquisition process. In this rolling result acquisition process (S11), the CPU 51 acquires the rolling result information showing the spots on the stopped three dice 40, by controlling the rolling result detection device 15 of the dice rolling device 3. More specifically, the CPU 51 transmits the control signal to the dice rolling device 3. Upon receiving the control signal, the dice rolling device 3 acquires an image with an imaging device provided in the dice rolling device 3. The acquired image includes the image of the stopped three dice 40 on the dice rolling board 11. Thereafter, the dice rolling device 3 carries out a predetermined image process with respect to the acquired image by controlling the rolling result detection device 15. As a result, the dice rolling device 3 can identify the spots on the three dice 40 which are stopped on the dice rolling board 11. The dice rolling device 3 generates rolling result information showing the spots on the three dice 40 thus identified. The dice rolling device 3 then transmits the rolling result information thus generated to the CPU 51. Once the rolling result information acquired from the dice rolling device 3 is stored in the RAM 53, the CPU 51 shifts the process to S12.

After shifting to S12, the CPU 51 executes a payout amount determination process. In this payout amount determination process (S12), the CPU 51 executes a payout amount determination process program (refer to FIG. 10) as will be described later. In this payout amount determination process, the CPU 51 calculates the payout amount of each terminal 5 based on the rolling result information and the bet information of each terminal 5. Here, in the case of a win in the lottery carried out in the chance lottery process (S6), the CPU 51 changes the payout magnification ratio used in the payout amount determination process (S12) from "base payout magnification ratio" to "special payout magnification ratio". The contents of the payout amount determination process (S12) will next be described in detail. Once the payout amount determination process ends, the CPU 51 shifts the process to S13.

At S13 the CPU 51 executes a payout information transmission process. In this payout information transmission process (S13), the CPU 51 transmits the payout information to each terminal 5 through the communication interface 55. This payout information shows the payout amount calculated in the payout amount determination process (S12). After transmitting the payout information to each terminal 5, the CPU 51 ends the payout information transmission process. The CPU 51 then ends the dice game execution process program in the main control unit 50.

Once execution of the dice game execution process program is ended, the CPU 51 restarts execution of the dice game execution process program. Specifically, the CPU 51 repeatedly executes the dice game execution process program while power is being supplied to the dice gaming machine 1.

Next, the dice game execution process program at each terminal 5 will next be described in detail.

Upon starting the dice game execution process program, the terminal CPU 71 first judges whether the bet start signal has been received (S101). As was described earlier, the bet start signal serves to instruct start of the bet period in the dice gaming machine 1. The bet start signal is transmitted from the main control unit 50 to each terminal 5 (S1). If the bet start signal is received (S101: YES), the terminal CPU 71 shifts the process to S102. As a result, the bet period in each terminal 5 is started. Alternatively, if the bet start signal has not yet been received (S101: NO), the terminal CPU 71 puts the process in stand-by until the bet start signal is received.

After shifting to S102, the terminal CPU 71 executes a game screen display process. In this game screen display process (S102), the terminal CPU 71 transmits the control signal to the liquid crystal driving circuit 74. The game screen is displayed on the liquid crystal display 8 based on the control of the liquid crystal driving circuit 74 (refer to FIG. 7). Once the game screen is displayed on the liquid crystal display 8, the terminal CPU 71 shifts the process to S103.

At S103, the terminal CPU 71 executes a bet operation acceptance process. In this bet operation acceptance process (S103), the terminal CPU 71 accepts a player's operation using the touch panel 25. More specifically, the terminal CPU 71 carries out various types of controls corresponding to a player's operation based on the operation signal transmitted from the touch panel. Such controls include control with respect to selecting the bet area 35, control with respect to setting the bet amount corresponding to the selected bet area 35 and control corresponding to operation of the CORRECT button 36.

If the bet area 35 is selected and the bet amount with respect to the selected area 35 is set, the terminal CPU 71 stores the bet information in the terminal RAM 73. The bet information includes information with respect to the selected bet area 35 and information showing the bet amount of the bet area 35.

In the next step S104, the terminal CPU 71 judges whether the bet end signal has been received. As was described earlier, the bet end signal shows the end of the bet period. Specifically, reception of the bet end signal means that acceptance of bets in the current dice game ends. The bet end signal is transmitted from the main control unit 50 (S4). If the bet end signal is received (S104: YES), the terminal CPU 71 shifts the process to S105. Alternatively, if the bet end signal has not yet been received (S104: NO), the terminal CPU 71 returns the process to the bet operation acceptance process (S103). Thus, the player at each terminal can bet a gaming value in the current game until the end of the bet period.

After shifting to S105, the terminal CPU 71 executes a bet information transmission process. In this bet information transmission process (S105), the terminal CPU 71 transmits the bet information stored in the terminal RAM 73 to the main control unit 50. Here, the terminal CPU 71 adds identification information showing the terminal 5 in question to the bet information. After receiving the bet information including the identification information, the terminal CPU 71 shifts the process to S106.

At S106, the terminal CPU 71 judges whether the winning information has been received. As was described earlier, the winning information shows that a win has occurred in the lottery carried out in the chance lottery process (S6). This winning information is transmitted from the main control unit 50 to each terminal 5 through the communication interface 55 (S10). If the winning information is received (S106: YES), the terminal CPU 71 shifts the process to S107. Alternatively, if the winning information has not been received (S106: NO), the terminal CPU 71 shifts the process to the payout process (S108). If the winning information is received (S106: YES), the terminal CPU 71 shifts the process to S107. Alternatively, if the winning information is not received (S106: NO), the terminal CPU 71 shifts the process to the payout process (S108).

At S107, the terminal CPU 71 executes the chance winning notification process. In the chance winning notification process (S107), the terminal CPU 71 notifies the player that he/she won in the chance lottery, through the display on the liquid crystal display 8. More specifically, the terminal CPU 71 transmits the control signal to the liquid crystal driving circuit 74. As a result, the liquid crystal display 8 displays the chance lottery winning image 80 on the game screen (refer to FIG. 12).

Figure 12:
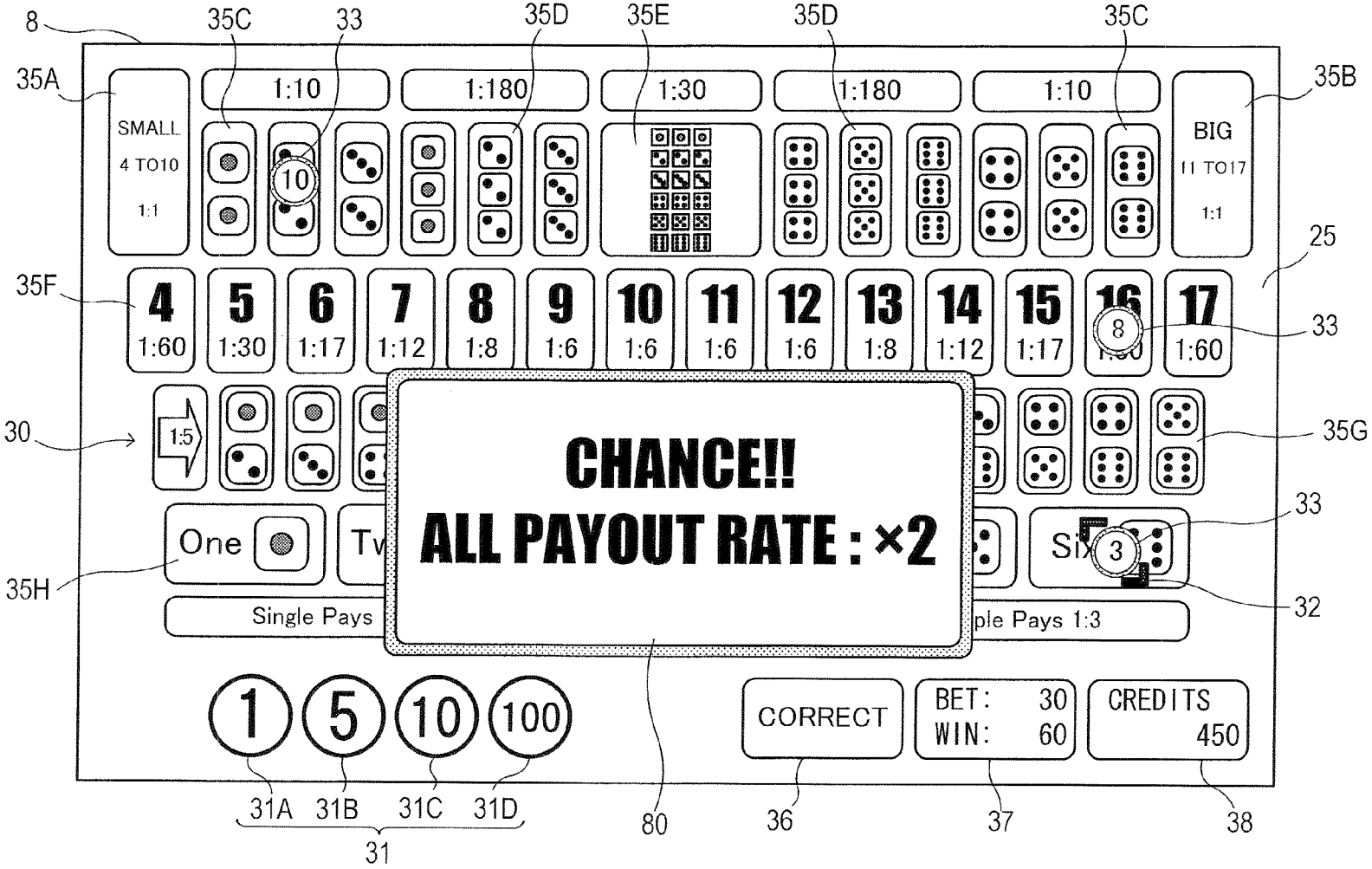
FIG. 12 is an exemplary diagram showing one example of a game screen including a chance lottery winning image according to first embodiment of the present invention.

As shown in FIG. 12, the chance lottery winning image 80 includes displaying a message that "as a result of winning in the chance lottery, the base payout magnification ratio of all bet areas 35 is multiplied by the special magnification ratio (e.g., ×2)". Specifically the chance lottery winning image 80 notifies the player of the fact that the payout magnification ratio used in calculating the payout has been changed from the "base payout magnification ratio" to the "special payout magnification ratio". Accordingly, the player can understand that a win occurred in the chance lottery by looking at the chance lottery winning image 80. As a result, the dice gaming machine 1 can increase the sense of expectancy of the player with respect to a larger payout. Once the chance winning notification process (S107) ends, the terminal CPU 71 shifts the process to S108.

After shifting to S108, the terminal CPU 71 executes a payout process. In this payout process (S108), the terminal CPU 71 awards to the player a payout in the current dice game based on the payout information. As was described earlier, the payout information is transmitted from the main control unit 50 to each terminal 5 (S13). The payout information shows the payout amount calculated in the payout amount determination process (S12). Accordingly, the terminal CPU 71 adds the payout amount calculated in the payout amount determination process (S12) to the credit amount possessed by the player. The payout amount can also be awarded in the form of medals which are paid out from the cash out port 9. Once the payout process ends, the terminal CPU 71 ends the dice game execution process program in the terminal 5.

Once execution of the dice game execution process program ends, the terminal CPU 71 restarts execution of the dice game execution process program. Specifically, the terminal CPU 71 can repeatedly execute the dice game execution process program while power is being supplied to the dice gaming machine 1.

Next, the payout amount determination process program to be executed by the CPU 51 in the payout amount determination process (S12) will be described in detail while referring to the drawings. FIG. 10 is a flow chart of the payout amount determination process program.

In the dice game execution process program of the main control unit 50, after shifting to the payout amount determination process (S12), the CPU 51 executes a winning bet area identification process. In the winning bet area identification process (S21), the CPU 51 identifies the winning bet area based on the rolling result information and the winning condition set for each bet area 35. The winning bet area is the bet area 35 whose specified winning condition is satisfied by the spots on the stopped dice 40. As was described earlier, the rolling result information shows the spots on the three stopped dice 40 which have been identified by the rolling result detection unit 15. Accordingly, the CPU 51 identifies the winning bet area based on the rolling result information and the winning condition of each bet area 35. After identifying the winning bet area, the CPU 51 shifts the process to S22.

After shifting to S22, the CPU 51 judges whether or not any of the bets are winning bets. The winning bet refers to the gaming values bet on the winning bet area identified in the winning bet area identification process (S21). More specifically, the CPU 51 carries out the judgment process at S22 based on the bet information of each terminal 5 stored in the RAM 53. If a winning bet has been made (S22: YES), the CPU 51 shifts the process to S23.

Alternatively, if none of the bets are winning bets (S22: NO), the CPU 51 sets the payout amount at each terminal 5 to "0". Thereafter, the CPU 51 ends the payout amount determination process program. Here, the case that none of the bets are winning bets includes the case that no bets for gaming values are made with respect to the bet area 35 and the case that all gaming values are bet with respect to a bet area 35 other than the winning bet area.

At S23, the CPU 51 judges whether or not the lottery result of the chance lottery process (S6) shows winning. More specifically, the CPU 51 carries out the judgment process at S23 based on the lottery result information stored in the RAM 53. In the case of a win in the lottery carried out in the chance lottery process (S6) (S23: YES), the CPU 51 shifts the process to the payout magnification ratio change process (S24). Alternatively, in the case of no win in the lottery carried out in the chance lottery process (S6) (S23: NO), the CPU 51 shifts the process to S25.

At S24, the CPU 51 executes the payout magnification ratio change process. In the payout magnification ratio change process (S24), the CPU 51 changes the payout magnification ratio of all bet areas 35 constituting the betting board 30. At this time, the CPU 51 changes the payout magnification ratio of the bet area 35 with respect to all terminals 5 constituting the dice gaming machine 1. More specifically the CPU 51 multiplies the base payout magnification ratio of all bet areas 35 constituting the betting board 30 by the special magnification ratio (e.g., ×2). As a result, the payout magnification ratio of each bet area 35 is changed from "base payout magnification ratio" to "special payout magnification ratio". After the payout magnification ratio of each bet area 35 is changed to the "special payout magnification ratio", the CPU 51 shifts the process to S25.

After shifting to S25, the CPU 51 executes a payout amount calculation process. In this payout amount calculation process (S25), the CPU 51 calculates the payout amount in the current game with respect to all terminals 5. More specifically, the CPU 51 calculates the payout amount at each terminal 5 in the current game by executing the following processes in each terminal 5.

In the case of a win in the chance lottery, the CPU 51 calculates the payout amount related to the winning bet area by using the "special payout magnification ratio". More specifically, the CPU 51 multiplies the "special payout magnification ratio" of the winning bet area by the bet amount bet on the winning bet area in question. In the case of no win in the chance lottery, the CPU 51 calculates the payout amount related to the winning bet area by using the "base payout magnification ratio". More specifically, the CPU 51 multiplies the "base payout magnification ratio" of the winning bet area by the bet amount bet on the winning bet area in question. If bets of gaming values are made with respect to a plurality of winning bet areas, the CPU 51 calculates a payout amount corresponding to each winning bet area, respectively.

The CPU 51 sets the payout amount corresponding to the bet areas other than the winning bet area to "0". The CPU 51 adds up the payout amounts of the bet areas calculated through the processes described above, for each terminal 5. As a result, the CPU 51 calculates the resultant payout amount of each terminal 5. The CPU 51 stores the information showing the payout amount at each terminal 5 in the RAM 53, respectively. The information showing the payout amount of each terminal 5 makes up the payout information of each terminal 5. Then, the CPU 51 ends the payout amount determination process program. As shown in FIG. 9, once the payout amount determination process (S12) ends, the CPU 51 shifts the process to the payout information transmission process (S13).

As was described earlier, in the payout information transmission process (S13), the CPU 51 respectively transmits the payout information showing the payout amount thus calculated from the main control unit 50 to each terminal 5. In each terminal 5, the terminal CPU 71 executes the payout process (S108) based on the payout information thus received.

Specifically, in the case of no win in the chance lottery, the player can win a payout amount based on the "base payout magnification ratio". The payout amount based on the "base payout magnification ratio" is obtained by multiplying the "base payout magnification ratio" of the winning bet area by the bet amount bet on the winning bet area in question. Alternatively, in the case of a win in the chance lottery, the player can win a payout amount based on the "special payout magnification ratio". The payout amount based on the "special payout magnification ratio" is obtained by multiplying the "special payout magnification ratio" of the winning bet area by the bet amount bet on the winning bet area in question. The "special payout magnification ratio" is obtained by multiplying the "base payout magnification ratio" by the "special magnification ratio (e.g., ×2)". Accordingly, in the case of a win in the chance lottery, the player can be awarded a larger payout amount as compared to the case no win occurs in the chance lottery.

As was described earlier, the dice gaming machine 1 according to the first embodiment executes the chance lottery process (S6) after acceptance of bets for gaming values with respect to the bet area 35 has ended. In the case of a win in the lottery carried out in the chance lottery process (S6), the dice gaming machine 1 calculates the payout amount corresponding to the winning bet area by multiplying the bet amount with respect to the winning bet area by the special payout magnification ratio (S24, S25). Alternatively, in the case of no win in the lottery carried out in the chance lottery process (S6), the dice gaming machine 1 calculates the payout amount corresponding to the winning bet area by multiplying the bet amount with respect to the winning bet area by the base payout magnification ratio (S25). The special payout magnification ratio is obtained by multiplying the base payout magnification ratio by the special magnification ratio (e.g., ×2).

The player is awarded a payout amount calculated in the payout amount calculation process, as a prize in the current game (S25). Specifically, in the case of a win in the chance lottery, the player can be awarded an even larger payout amount. As a result, the dice gaming machine 1 can accommodate a player's desire to receive a larger payout.

The dice gaming machine 1 carries out a lottery using the chance lottery result determination table (refer to FIG. 11) in the chance lottery process (S6). The chance lottery result determination table shown in FIG. 11 is a table wherein the condition that the expected value of all bet areas 35 in the case of using the special payout magnification ratio does not exceed "1" is satisfied. Accordingly, the dice gaming machine 1 can ensure the possibility of increasing the profit from all bet areas 35 even in the case of granting to the player the chance of receiving a higher payout in the chance lottery. Specifically, the dice gaming machines 1 can sufficiently ensure profit at the game arcade where such dice gaming machines 1 are installed.

Further, in the case of a win in the chance lottery, the dice gaming machine 1 displays the chance lottery winning image 80 on the game screen (S107). As shown in FIG. 12, the chance lottery winning image 80 shows a win in the chance lottery. Accordingly, the player can understand he/she won in the chance lottery by looking at the chance lottery winning image 80 on the game screen. As a result, the dice gaming machine 1 can increase the sense of expectancy of a player with respect to award of a large payout by notifying the player of the win in the chance lottery.

The present invention is not limited to the first embodiments described above, but various improvements and modifications can be made thereto without departing from the spirit of the present invention. For instance, a plurality of types of special magnification ratios can be used. The case in which such plurality of types of special magnification ratios (e.g., first special magnification ratio "×4", second special magnification ratio "×2) are used is described in detail based on FIG. 13 through FIG. 15.

In this case, the basic configuration of the dice gaming machine 1 is the same as the configuration described in the above embodiments. The chance lottery process (S6) of the dice game execution process program in the main control unit 50 differs from the chance lottery process (S6) in the above-described embodiments. Accordingly, this chance lottery process (S6) will be described in detail while referring to FIG. 13.

Figures 13, 14, 15:
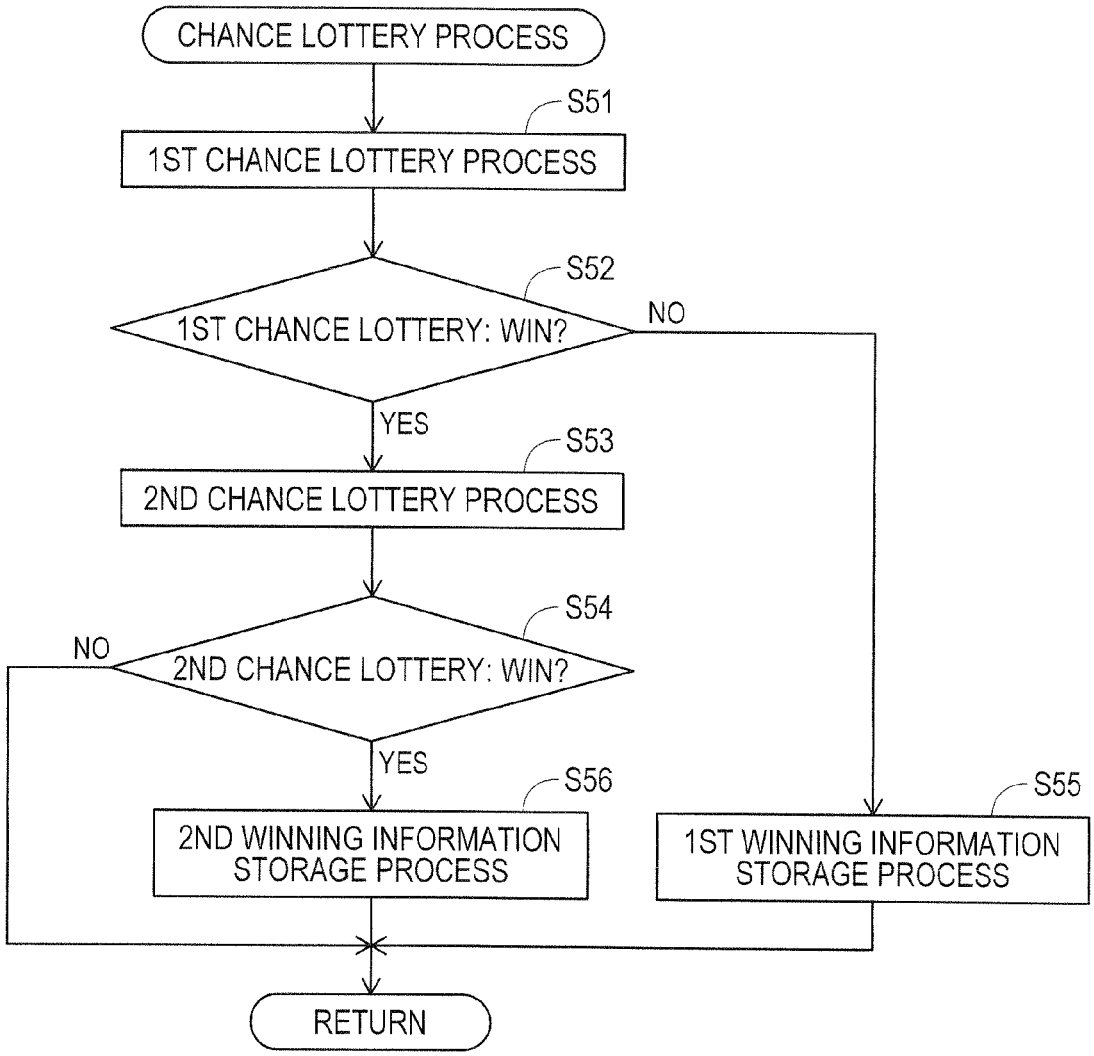
FIG. 13 is a flow chart of a chance lottery process program according to first embodiment of the present invention.
FIG. 14 is an exemplary diagram showing one example of a first chance lottery result determination table according to first embodiment of the present invention.
FIG. 15 is an explanatory diagram showing one example of a second chance lottery result determination table according to first embodiment of the present invention.

In the chance lottery process in this case, the CPU 51 executes a chance lottery process program as shown in FIG. 13. Specifically, after shifting to the chance lottery process (S6), the CPU 51 first executes the first chance lottery process (S51). In the first chance lottery process (S51), the CPU 51 determines whether or not to use the "first special magnification ratio (i.e., ×4)" to change the payout magnification ratio by a lottery. More specifically, the CPU 51 executes the lottery program to sample one random number value.

In the following process S52, the CPU 51 judges whether or not a win has occurred in the lottery carried out in the first chance lottery process (S51). More specifically, the CPU 51 judges the lottery results for the first chance lottery based on the sampled random value and the first chance lottery result determination table (refer to FIG. 14). In the case of a win in the first chance lottery (S52: YES), the CPU 51 stores the first winning information in the RAM 53 (S55). The first winning information shows a win has occurred in the first chance lottery. Thereafter, the CPU 51 ends the chance lottery process program. In this case, the CPU 51 multiplies the base payout magnification ratio of each bet area 35 by the "first special magnification ratio" in the payout magnification ratio change process (S23). Alternatively, in the case of no win in the first chance lottery (S52: NO), the CPU 51 shifts the process to S53.

At S53, the CPU 51 executes the second chance lottery process. In this second chance lottery process (S53), the CPU 51 determines whether or not to use the "second special magnification ratio (i.e., 33 2)" to change the payout magnification ratio by a lottery. More specifically, the CPU 51 executes the lottery program to sample one random value.

In the following step S54, the CPU 51 judges whether a win has occurred in the lottery in the second chance lottery process (S53). More specifically, the CPU 51 judges the lottery results of the second chance lottery based on the sampled random value and the second chance lottery result determination table (refer to FIG. 15). In the case of a win in the second chance lottery (S54:YES), the CPU 51 stores the second winning information in the RAM 53 (S56). The second winning information shows a win has occurred in the second chance lottery. Thereafter, the CPU 51 ends the chance lottery process program. In this case, the CPU 51 multiplies the base payout magnification ratio of each bet area 35 by the "second special magnification ratio" in the payout magnification ratio change process (S23). As a result, the payout magnification ratio of each bet area 35 is changed based on the "second special magnification ratio". Alternatively, in the case of no win in the second chance lottery (S54: NO), the CPU 51 ends the chance lottery process program as is. The CPU 51 executes the payout amount calculation process (S24) without executing the payout magnification ratio change process (S23). Accordingly, in this case, the CPU 51 calculates the payout amount of each terminal 5 using the base payout magnification ratio.

In the case described above, if the player wins the second chance lottery, he/she can be awarded a larger payout than at a normal time (the case of no win in the first chance lottery and the second chance lottery). Further, in the case of a win in the first chance lottery, the player can be awarded a larger payout than in the case of a win in the second chance lottery. Accordingly, in such a case, the dice gaming machine 1 can award to the player an even higher payout. Specifically, the dice gaming machine 1 can accommodate the player's demands for a larger payout.

In this case as well, the first chance lottery result determination table and the second chance lottery result determination table are set so that the expected value of each bet area 35 in the case the magnification ratio is changed to the special payout magnification ratio becomes equal to or lower than "1". Specifically, the dice gaming machines 1 can ensure sufficient profit for the game arcade wherein such dice gaming machines 1 are installed.

Further, in the first embodiments described above, the special magnification ratio is set to "×2" or "×4". However, the special magnification ratio is not limited to the above values. Various other values can be adopted as the special magnification ratio as long as the player can be awarded a larger payout.

In the payout magnification ratio change process described in the first embodiments (S24), the CPU 51 changes the payout magnification ratio of each bet area 35 by multiplying the base payout magnification ratio by the special magnification ratio. Multiplying the base payout magnification ratio by the special magnification ratio is not limited to the payout magnification ratio change process (S24). Specifically, the special payout magnification ratio obtained by multiplying the base payout magnification ratio by the special magnification ratio can be stored in advance in memory. In this case, in the payout magnification ratio change process (S24), the CPU 51 reads out the special payout magnification ratio from the memory and changes the "base payout magnification ratio" in each bet area 35 to the corresponding "special payout magnification ratio". The dice gaming machine 1 can thus reduce the processing burden with respect to the payout magnification ratio change process (S24).

The present invention can also be realized as a gaming method for executing the above-described processes. Further, the present invention can also be realized as a program for causing a computer to execute such gaming method, and a recording medium onto which such program is recorded.

[Second Embodiment ]

Figure 16:
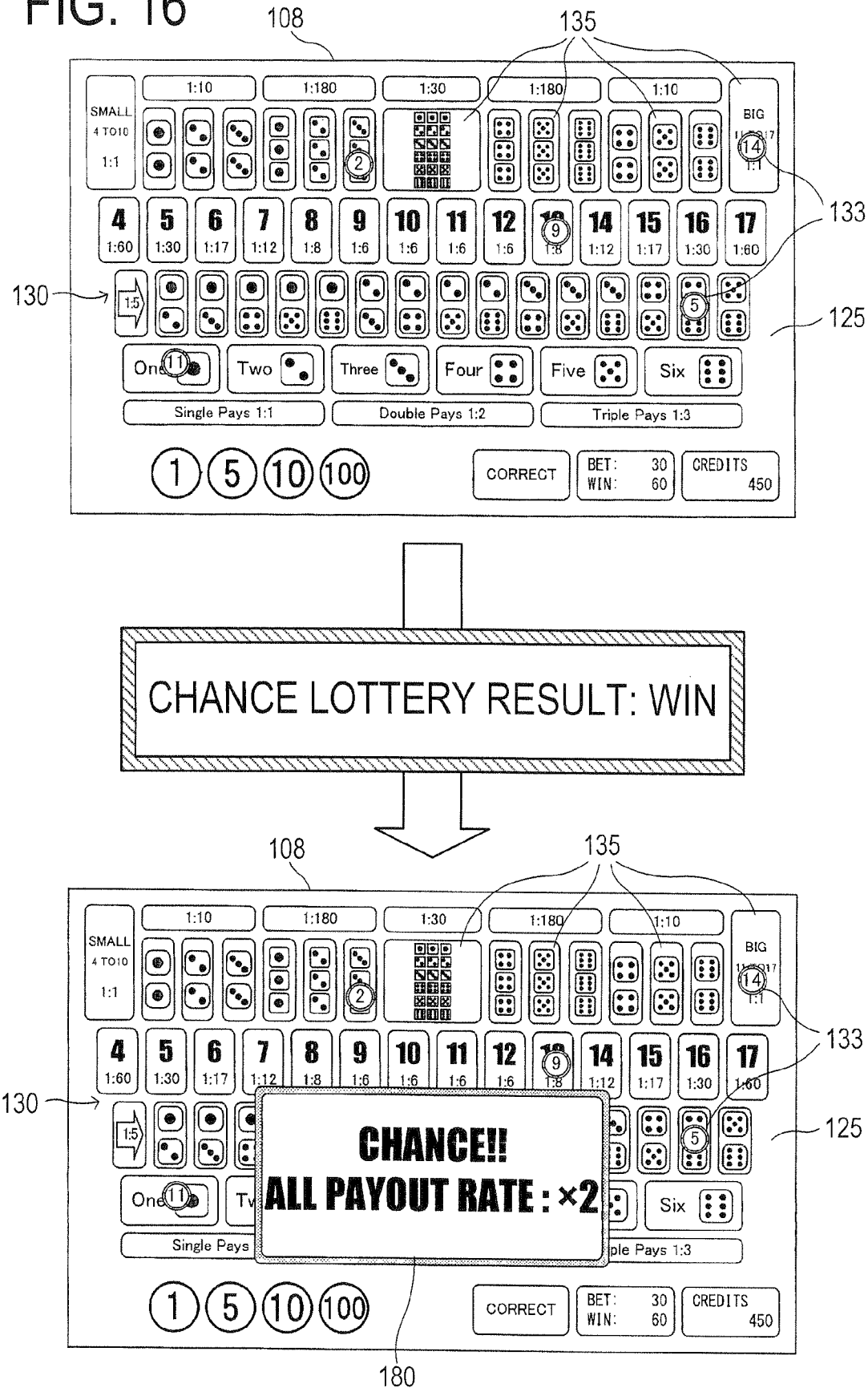
FIG. 16 is an exemplary diagram showing the characteristics of the dice gaming machine according to the second embodiment of the present invention.

Here, characteristics of a dice gaming machine 1 will next be described. FIG. 16 is an exemplary view showing characteristics of a dice gaming machine 101 according to the second embodiment.

A dice game which is called "Sic Bo" is played in the dice gaming machine 101. In "Sic-Bo", three dice 140 are rolled. Players predict the result of dice rolling (specifically, the spots on the three dice 140). Also, the players bet gaming values on a betting board 130 based on their prediction.

Here, the betting board 130 is made up of a plurality of bet areas 135 (refer to FIG. 16, etc.). Each bet area 135 is associated with a winning condition and a payout magnification ratio. The winning condition is a condition defined by spot(s) on some or all of the three dice 140. If the spots on the rolled dice 140 satisfy the winning condition, the player who placed a bet on this bet area 135 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 135 corresponding to their prediction as described above.

If the spots on the rolled dice 140 satisfy the winning condition defined for the bet area on which a bet is placed by the player, the player wins a prize. The prize in this case is determined by multiplying the amount of gaming value bet by the player by the payout magnification ratio of the bet area 135 in question.

Here, once reception of gaming value bets ends, the dice gaming machine 101 according to the second embodiment executes a chance lottery process (S1006). If the result of the chance lottery is "chance lottery result: win", the dice gaming machine 101 identifies one target terminal among from terminals 105 that participate in the dice game (S1026). After that, the dice gaming machine 101 changes the payout magnification ratio to be used in determining the prize contents of the target terminal (S1012). More specifically, for the target terminal only, the dice gaming machine 101 multiplies the payout magnification ratio set for all bet areas by a special magnification ratio (for instance, "×2"). Accordingly, in the case of a win in a chance lottery, a player seated at the target terminal can be awarded twice the payout amount as compared to normal times (specifically, in the case of no win in chance lottery).

The result of this chance lottery is applied only to the target terminal identified at the chance lottery process (S1006). Specifically, in the case of a win in the chance lottery, the player at the target terminal can win a larger payout amount than usual on condition that spots on the stopped three dice 140 satisfy the winning condition of the bet area 135 on which a bet is placed by the player. It is to be noted that players at non-target terminals can win a payout amount based on a base payout magnification ratio on condition that spots on the stopped three dice 140 satisfy the winning condition of the bet area on which a bet is placed by each of those players.

In the second embodiment, the payout magnification ratio includes a base payout magnification ratio and a special payout magnification ratio. The base payout magnification ratio is the payout magnification ratio set for each bet area 135. The base payout magnification ratio is used in calculating the prize (e.g., payout amount) in the case no win occurs in the chance lottery. The special payout magnification ratio is the changed payout magnification ratio set for each bet area 135, which is obtained by multiplying the base payout magnification ratio by the special magnification ratio (for instance, "×2"). Specifically, the special payout magnification ratio is used in calculating the prize set for the target terminal in the case of a win in the chance lottery.

Figure 17:
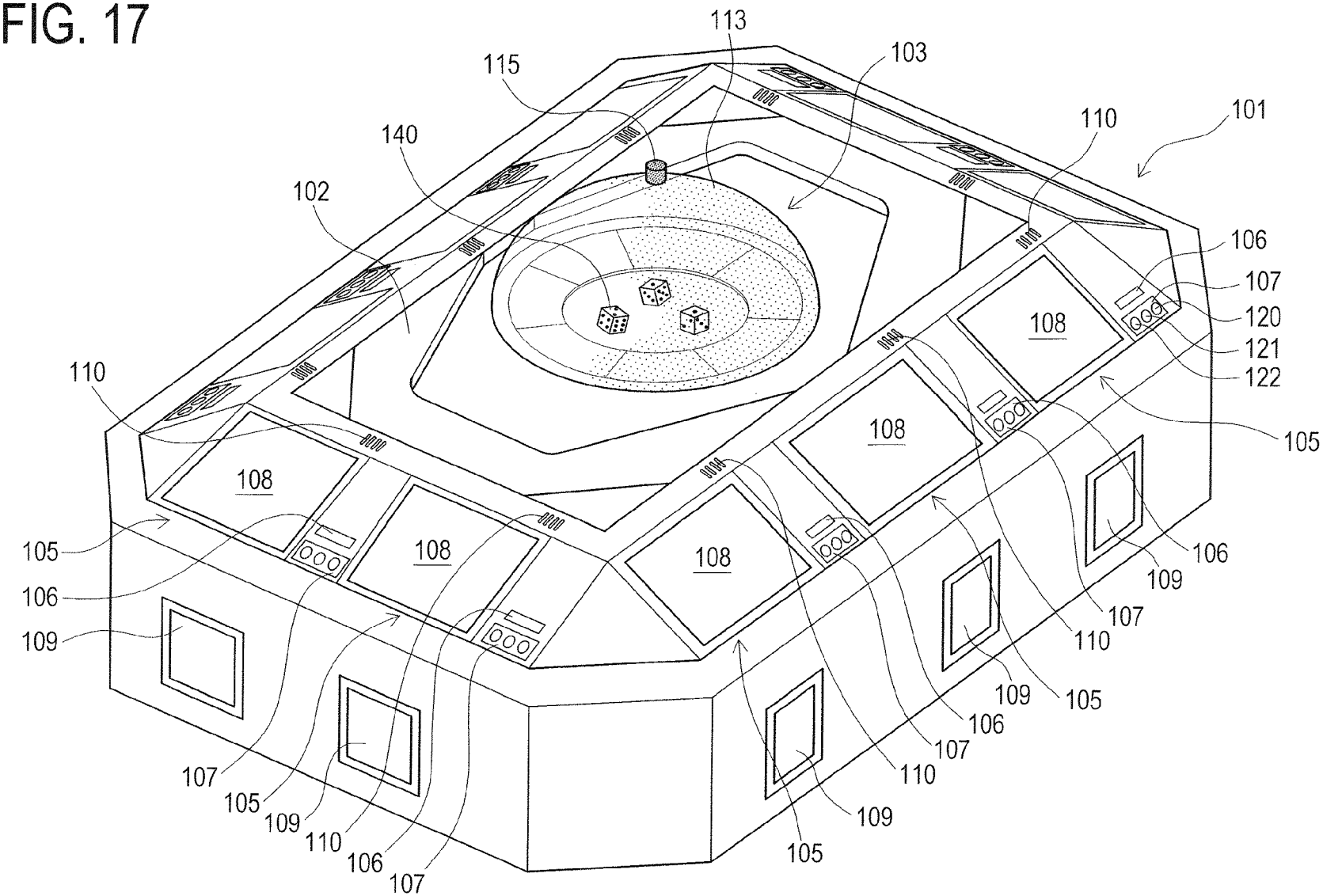
FIG. 17 is a perspective view showing an outer appearance of the dice gaming machine according to one embodiment of the present invention.

Next, a schematic configuration of the dice gaming machine 101 will be described in detail while referring to the drawings. FIG. 17 is a schematic diagram showing an outer appearance of the dice gaming machine 1 according to the second embodiment.

As shown in FIG. 17, the dice gaming machine 101 according to the second embodiment has a cabinet 102, a dice rolling device 103 and a plurality of terminals 105 (in the second embodiment, ten terminals). The cabinet 102 makes up the main part of the dice gaming machine 101. The cabinet 102 houses mechanical components and electrical components such as a main control unit 150 and the like as will be described later.

The dice rolling device 103 is installed at a central portion on an upper face of the cabinet 102. The dice rolling device 103 has a dice box. The dice box houses three dice 140 therein. The three dice 140 are rolled inside the dice box and are then stopped. The configuration of the dice rolling device 103 will be described in detail later.

The terminals 105 are installed at the periphery of the dice rolling device 103. The terminals 105 each have a liquid crystal display 108. The terminals 105 are used in a player's operation with respect to the dice game (e.g., Sic Bo) played in the dice gaming machine 101. Specifically, players enter the dice game played in the dice gaming machine 101 by using the terminals 105.

In the second embodiment, the ten terminals 105 each constituting the dice gaming machine 101 are termed "first terminal" through "tenth terminal".

The terminals 105 each have a medal acceptance device 106, a control panel 107 and a liquid crystal display 108. The medal acceptance device 106 accepts medals, an exemplary type of gaming value, inserted by the player. Specifically, in the case of playing the dice game, the player inserts medals, an exemplary type of gaming value, in the medal acceptance device 106. The gaming values thus inserted are stored as credit. The player places a bet onto a bet area 135 using such credit.

The control panel 107 is installed at a lower side of the medal acceptance device 106. This control panel 107 has a plurality of operation buttons. More specifically, the control panel 107 also has a BET determination button 120, a CASHOUT button 121 and a HELP button 122.

The BET determination button 120 is operated by the player to determine a bet operation. Specifically, the player operates the BET determination button 120 to determine the bet area 135 which will be the bet target and the amount of gaming values to be bet with respect to the bet area 135 (hereinafter referred to as bet amount).

The CASHOUT button 121 is operated by the player to request payout of the credits he/she possesses. When this CASHOUT button 121 is operated, medals are paid out from a cash out port 109 in accordance with the number of credits that the player possesses.

The HELP button 122 is operated in the case the operation method and the rules of the game are unclear. When the HELP button 122 is operated, the dice gaming machine 101 displays a HELP screen containing explanations with respect to the game operation method and the like onto the liquid crystal display 108.

The liquid crystal display 108 is a display device for displaying information with respect to the dice game. When the dice game is started, each liquid crystal display 108 displays an image of the betting board 130. The touch panel 125 is arranged at a front face of the liquid crystal display 108 in each terminal 105. Accordingly, the player carries out a bet operation with respect to the bet area 135 using this touch panel 125.

Each terminal 105 has a cash out port 109 and a speaker 110. The cash out port 109 is arranged at a lower side of the liquid crystal display 108. This cash out port 109 serves to output medals. For instance, once the CASHOUT button 121 is operated, a number of medals corresponding to the credits the player possesses are paid out to the cash out port 109. Speaker 110 is installed at a right upper side of the liquid crystal display 108. The speaker 110 outputs sounds based on the progress of the game.

Next, the dice rolling device 103 installed in the dice gaming machine 101 will be described in detail while referring to the drawings.

As shown in FIG. 17, the dice rolling device 103 is installed at an upper face of the cabinet 102. The dice rolling device 103 houses three dice 140 therein. The three dice 140 are rolled inside the dice rolling device 103 by controlling the operation of the dice rolling motor 112 as will be described later. The rolled dice 140 are then stopped on a dice rolling board 111. The dice rolling device 103 is installed at a central portion of the cabinet 102. Accordingly, players who are seated at the terminals 105 can see the dice 140 as they are being rolled inside the dice rolling device 103 and the spots on the dice 140 after these are stopped inside the dice rolling device 103.

Figure 18:
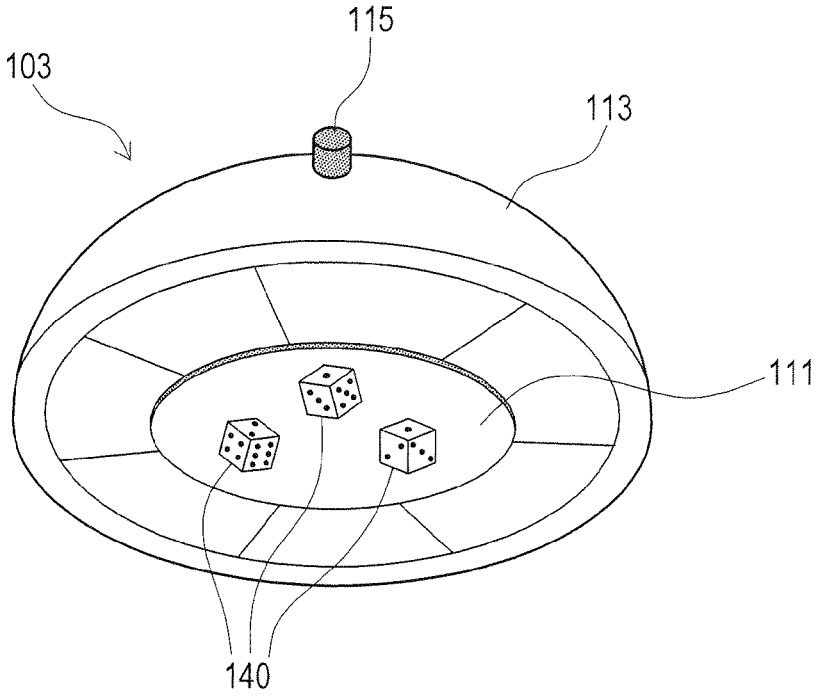
FIG. 18 is a view showing an outer appearance of a dice rolling device according to the second embodiment of the present invention.
Figure 19:
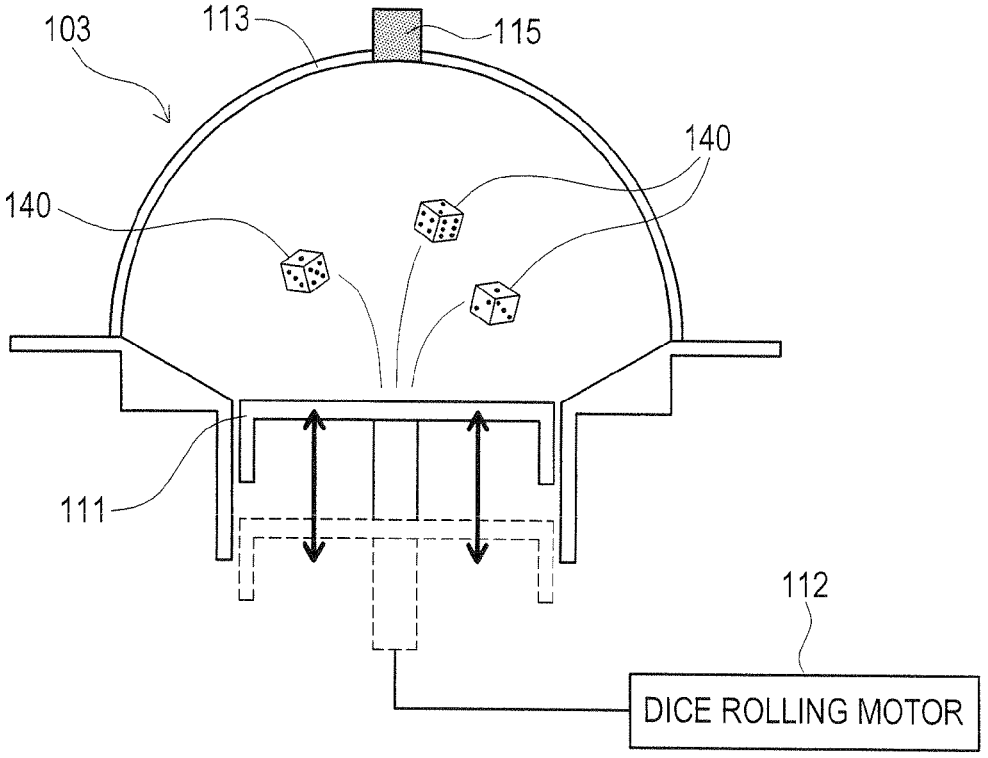
FIG. 19 is an exemplary diagram relating to an operation of the dice rolling device according to the second embodiment of the present invention.

As shown in FIG. 18 and FIG. 19, the dice rolling device 103 has a dice rolling board 111, a dice rolling motor 112, a cover member 113 and a rolling result detection unit 115. The dice rolling board 111 moves up and down within a predetermined range inside the dice rolling device 103 (refer to FIG. 19). The dice rolling board 111 is connected to the dice rolling motor 112. Specifically, the dice rolling board 111 moves up and down within the predetermined range based on driving and control of the dice rolling motor 112.

As shown in FIG. 19, in the case of rolling the dice 140, the dice rolling motor 112 causes the dice rolling board 111 to move upwards at a certain speed or faster. Once the dice rolling board 111 moves over a predetermined range, the board stops moving. Accordingly, the dice 140 on the dice rolling board 111 are thrown upwards and are thus rolled inside the dice rolling device 103. As shown in FIG. 19, an inclined face is formed at the periphery of the dice rolling board 111. Accordingly, the three dice 140 thus roll on the inclined face and then stop on the dice rolling board 111.

The cover member 113 is formed in a hemispherical shape to cover the three dice 140 and the dice rolling board 111 (refer to FIG. 18 and FIG. 19). Specifically, the three dice 140 are rolled inside a space defined by the upper face of the dice rolling board 111 and the inner face of the cover member 113. The cover member 113 is made of a transparent acrylic material. Accordingly, the player can sufficiently see the dice 140 while being rolled inside the dice rolling device 103 and the dice 140 as stopped on the dice rolling board 111.

The rolling result detection unit 115 is installed at a top of the cover member 113 (refer to FIG. 18 and FIG. 19). The rolling result detection device 115 detects the spots on each die 140 which is stopped on the dice rolling board 111 (hereinafter referred to as rolling result). More specifically, the rolling result detection unit 115 acquires an image of each die 140 which is stopped on the dice rolling board 111. The rolling result detection unit 115 identifies the spots on each die 140 by carrying out a predetermined image process with respect to the images thus acquired. Here, information showing the identified spots on the three dice 140 is referred to as rolling result information.

The image processing for identifying the spots on dice 140 is heretofore known in the art. Therefore, further description thereof will hereby be omitted.

Figure 20:
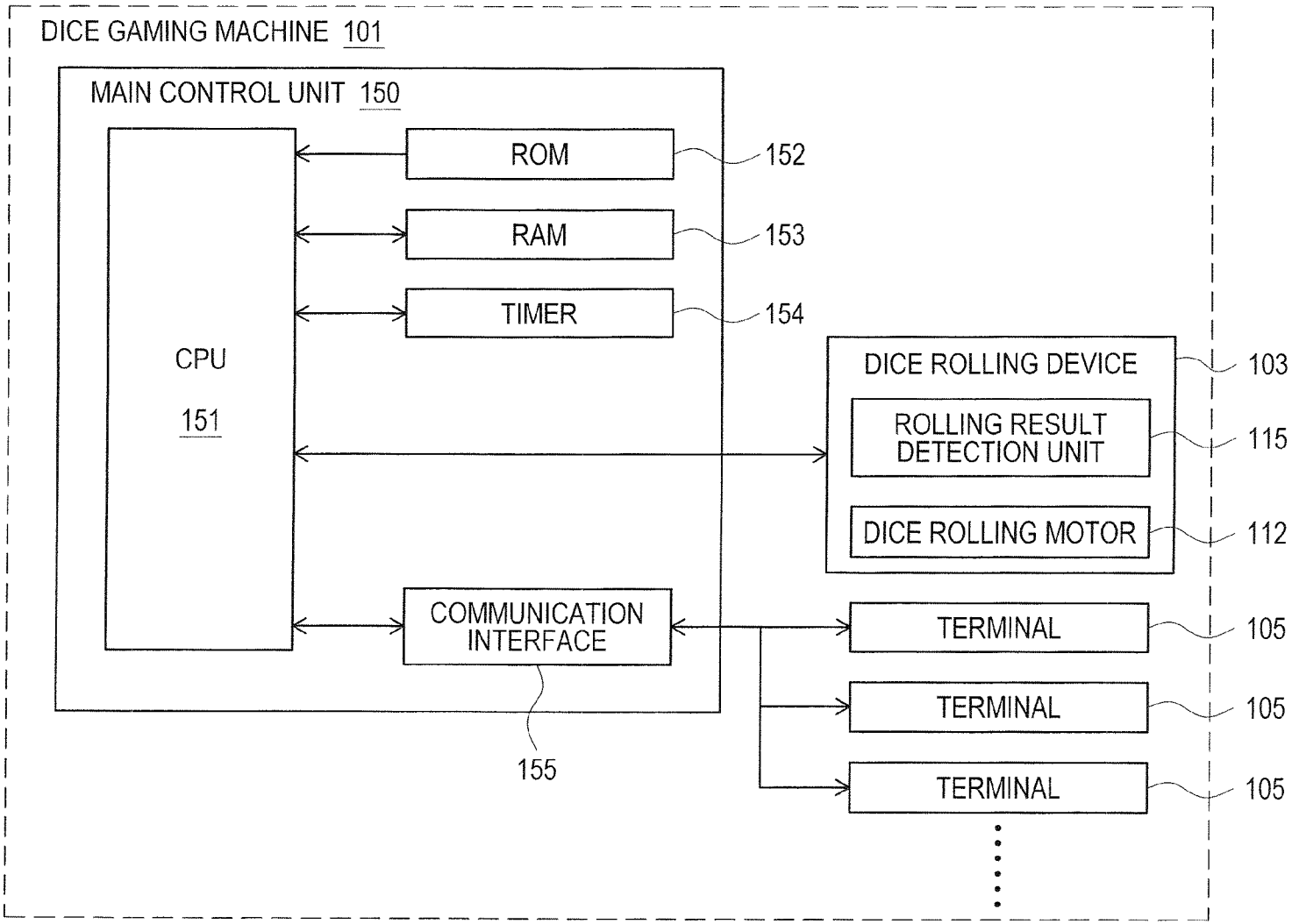
FIG. 20 is a block diagram showing an internal configuration of the dice gaming machine according to the second embodiment of the present invention.

Next, the internal configuration of the dice gaming machine 101 according to the second embodiment will be further described in detail while referring to the drawings. FIG. 20 is a block diagram showing an internal configuration of the dice gaming machine according to the second embodiment.

As shown in FIG. 20, the dice gaming machine 101 has a main control unit 150. The main control unit 150 controls the entire dice gaming machine 101. The main control unit 150 has a CPU 151, a ROM 152 and a RAM 153.

The CPU 151 is a central processing unit with respect to control by the main control unit 150. Specifically, the CPU 151 plays a central role in the control by the main control unit 150. In other words, the CPU 151 controls the entire dice gaming machine 101 by executing the various programs stored in the ROM 152. For instance, the CPU 151 progresses the dice game in the dice gaming machine 101 by executing a dice game execution process program (refer to FIG. 23 and FIG. 24) as will be described later.

The ROM 152 stores various types of programs to be executed in the CPU 151. More specifically, the ROM 152 stores a dice game execution process program (refer to FIG. 23 and FIG. 24), a chance lottery process program (refer to FIG. 26), a payout amount determination process program (refer to FIG. 29) and a lottery program and the like. The ROM 152 also stores various types of data tables. These data tables are referenced upon executing various programs. Accordingly, the payout table and the like are also stored in the ROM 152.

The ROM 152 stores a BIOS (Basic Input/Output System) and an authentication program. When power is applied to the dice gaming machine 1, the CPU 151 executes the BIOS stored in the ROM 152. As a result, the CPU 151 initializes the peripheral devices constituting the dice gaming machine 101. The CPU 151 authenticates the dice game execution process program and the like by executing an authentication program. At this time, the CPU 151 checks the presence of any alterations with respect to the dice game execution process program and the like. These processes are executed in an initial setting process executed at the time of applying power.

The RAM 153 temporarily stores the results of the processing executed by the CPU 151. Specifically, the RAM 153 temporarily stores the processing results following execution of the above-mentioned programs (for instance, lottery results of the chance lottery process and the like). The RAM 153 temporarily stores various types of information regarding the dice game (for instance, bet information transmitted from the terminals 105, rolling result information transmitted from the rolling result detection device 115 and the like).

The main control unit 150 has a timer 154 and a communication interface 155. The timer 154 is a clock device which is connected to the CPU 151. The CPU 151 references the measurement result of the timer 154 in the case of judging the lapse of the bet period and in the case of judging the arrival of rolling timing.

The bet period refers to the period of accepting the bet operation made by the players at the terminals 105. Specifically, lapse of the bet period indicates that acceptance of bets for gaming values with respect to the bet area 135 has ended. Rolling timing indicates the timing when rolling of dice 140 inside the dice rolling device 103 is started.

The communication interface 155 is connected to the CPU 151. The communication interface 155 is also connected to the terminals 105 constituting the dice gaming machine 101. Specifically, the CPU 151 transmits various types of information and control signals with respect to the terminals 105 through the communication interface 155. Further, the CPU 151 can receive the information (for instance, bet information) and the control signals from the terminals 105 through the communication interface 155.

Further, the CPU 151 constituting the main control unit 150 is connected to the dice rolling device 103. As was described earlier, the dice rolling device 103 has a dice rolling motor 112 and a rolling result detection device 115. Accordingly, the CPU 151 can drive and control the dice rolling motor 112 by transmitting a predetermined control signal to the dice rolling device 103. Specifically, the CPU 151 can cause the dice 140 to roll and stop in the dice rolling device 103. The rolling result detection device 115 can identify a rolling result indicating the spots on the stopped dice 140. Accordingly, the CPU 151 can acquire the rolling result information based on the spots on the dice 140 as identified by the rolling result detection device 115 (S1011).

Figure 21:
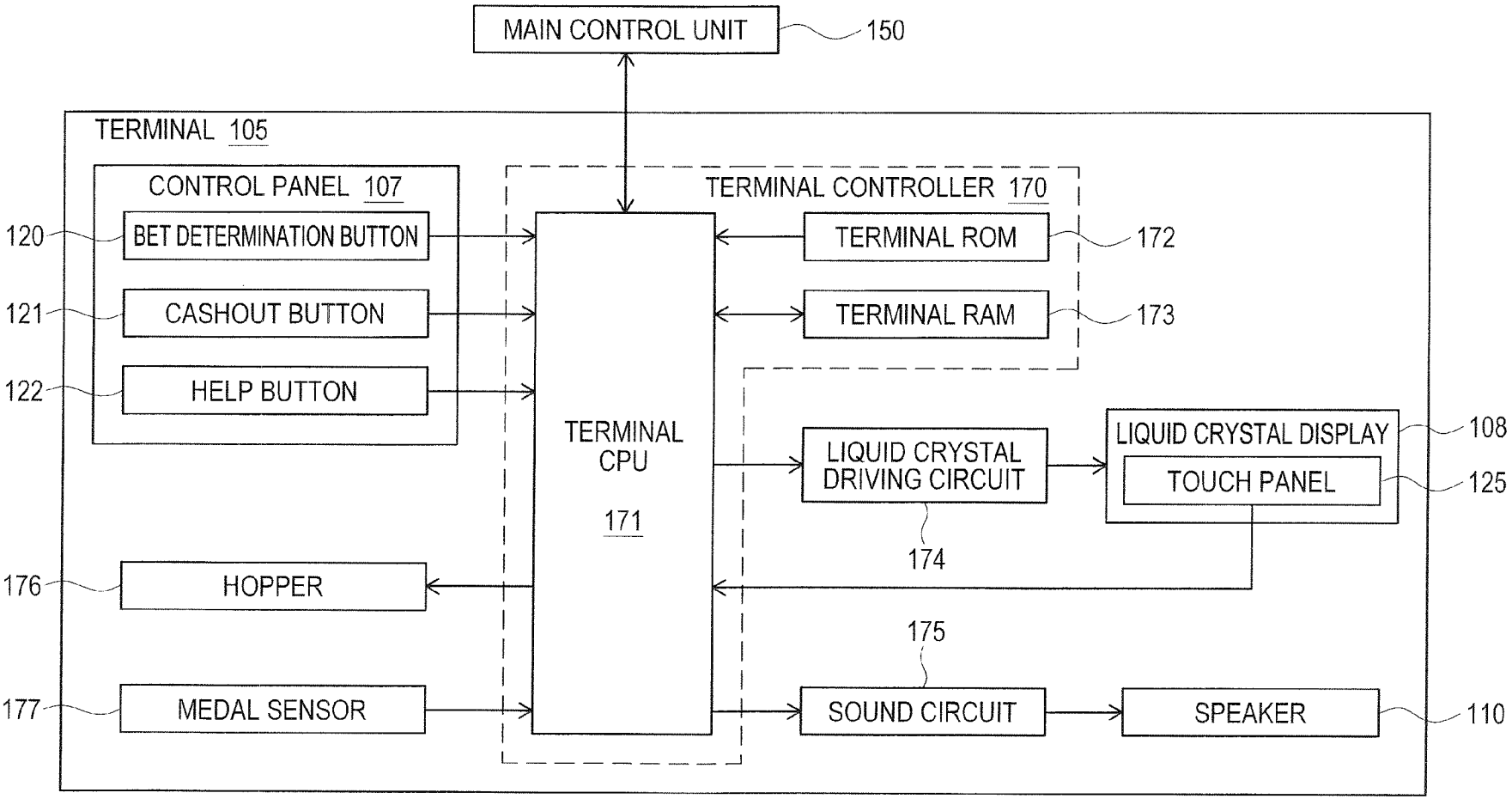
FIG. 21 is a block diagram showing an internal configuration of a terminal according to the second embodiment of the present invention.

Next, the terminals 105 constituting the dice gaming machine 101 will be described in detail while referring to the drawing. FIG. 21 is a block diagram showing the internal configuration of a terminal 105.

The terminals 105 constituting the dice gaming machine 101 all have the same configuration. Accordingly, the internal configuration of one terminal 105 will be described in detail. Description of the other terminals 105 constituting the dice gaming machine 101 will hereby be omitted.

As shown in FIG. 21, the terminal 105 has a terminal controller 170. This terminal controller 170 controls the various functions of the terminal 105. The terminal controller 170 has a terminal CPU 171, a terminal ROM 172 and a terminal RAM 173.

The terminal CPU 171 is a central processing unit with respect to control made by the terminal controller 170. Specifically, the terminal CPU 171 plays a central role in the control with respect to the terminal 105. More specifically, the terminal CPU 171 controls the terminal 105 by executing various types of programs stored in the terminal ROM 172. For instance, the terminal CPU 171 carries out control with respect to the dice game (for instance, control with respect to acceptance of bet operation and payment of payout) by executing the dice game execution process program (refer to FIG. 23 and FIG. 24) as will be described later.

The terminal ROM 172 stores various types of programs to be executed in the terminal CPU 171. More specifically, the terminal ROM 172 stores dice game execution process programs (refer to FIG. 23 and FIG. 24) and the like. The terminal ROM 172 stores various types of data tables. These data tables are referenced upon execution of the various programs.

The terminal ROM 172 also stores a BIOS (Basic Input/Output System) and an authentication program. When power is applied to the dice gaming machine 1, the terminal CPU 171 executes the BIOS stored in the terminal ROM 172. As a result, the terminal CPU 171 initializes the peripheral devices constituting the terminals 105. The terminal CPU 171 authenticates the dice game execution process program and the like by executing an authentication program. At this time, the terminal CPU 171 checks the presence of any alterations with respect to the dice game execution process program and the like. These processes are executed in an initial setting process executed at the time of power application.

The terminal RAM 173 temporarily stores the results of the processing executed in the terminal CPU 171. Specifically, the terminal RAM 173 temporarily stores the processing results following execution of the above-mentioned programs (for instance, bet information based on the players' bet operation). The terminal RAM 173 temporarily stores various types of information regarding the dice game (for instance, payout information transmitted from the main control unit 150 and the like).

The terminal CPU 171 is connected with the control panel 107. As was described earlier, the control panel 107 has a BET determination button 120, a CASHOUT button 121 and a HELP button 122. Specifically, the BET determination button 120, the CASHOUT button 121 and the HELP button 122 are each connected to the terminal CPU 171. Accordingly, when a player operates the BET determination button 120, the CASHOUT button 121 and the HELP button 122, a control signal based on each such operation can be inputted to the terminal CPU 171. The terminal CPU 171 can thus carry out control in accordance with the button that was operated, based on the operation signal thus inputted.

The terminal CPU 171 is connected with the liquid crystal display 108 through a liquid crystal driving circuit 174. The liquid crystal driving circuit 174 serves as a control circuit with respect to display on the liquid crystal display 108. The liquid crystal driving circuit 174 is made up of a program ROM, an image ROM, an image control CPU, a work RAM, a VDP (video display processor) and a video RAM, etc. The program ROM stores various types of selection tables and image control programs regarding display on the liquid crystal display 108. The image ROM stores dot data. This dot data is used for forming images to be displayed on the liquid crystal display 108. The image control CPU determines images to be displayed on the liquid crystal display 108 from the dot data stored in the image ROM, based on the parameters set in the terminal CPU 171 and the image control program. The work RAM serves as a temporary storage device at the time the image control program is executed in the image control CPU. The VDP forms images in accordance with the display contents determined by the image control CPU. The VDP outputs the images thus formed to the liquid crystal display 108. The video RAM serves as a temporary storage device at the time images are formed in the VDP.

As was described earlier, the liquid crystal display 108 has a touch panel 125 provided at a front face thereof. As is shown in FIG. 21, the terminal CPU 171 is connected with the touch panel 125. The touch panel 125 detects the coordinate information corresponding to a portion touched by the player. Accordingly, the touch panel 125 can identify a player's operation with respect to the touch panel 125 based on the coordinate information. The operation information indicating a player's operation with respect to the touch panel 125 is transmitted from the touch panel 125 to the terminal CPU 171.

In the dice gaming machine 1 according to the second embodiment, when the betting board 130 is displayed on the liquid crystal display 108 (refer to FIG. 22), the players select the bet areas 135 making up the betting board 130 and depress the unit BET button 131 using the touch panel 125. Accordingly, information with respect to the bet areas 135 thus selected and the unit BET button 131 is transmitted from the touch panel 125 to the terminal CPU 171.

The terminal CPU 171 is connected with the speaker 110 through a sound circuit 175. The sound circuit 175 carries out control with respect to sound output from speaker 110 based on the control signal transmitted from the terminal CPU 171. The speaker 110 outputs various effect sounds in accordance with the progress of the dice game. As a result, the dice gaming machine 101 can execute effects in accordance with the progress of the dice game at each terminal 105.

The terminal CPU 171 is connected with a hopper 176 and a medal sensor 177. The hopper 176 pays out medals to the cash out port 109 based on the control signal from the terminal CPU 171. The medal sensor 177 detects the medals paid out from the hopper 176. As a result, the terminal CPU 171 can pay out a predetermined number of medals to the players by controlling the hopper 176 and the medal sensor 177.

Figure 22:
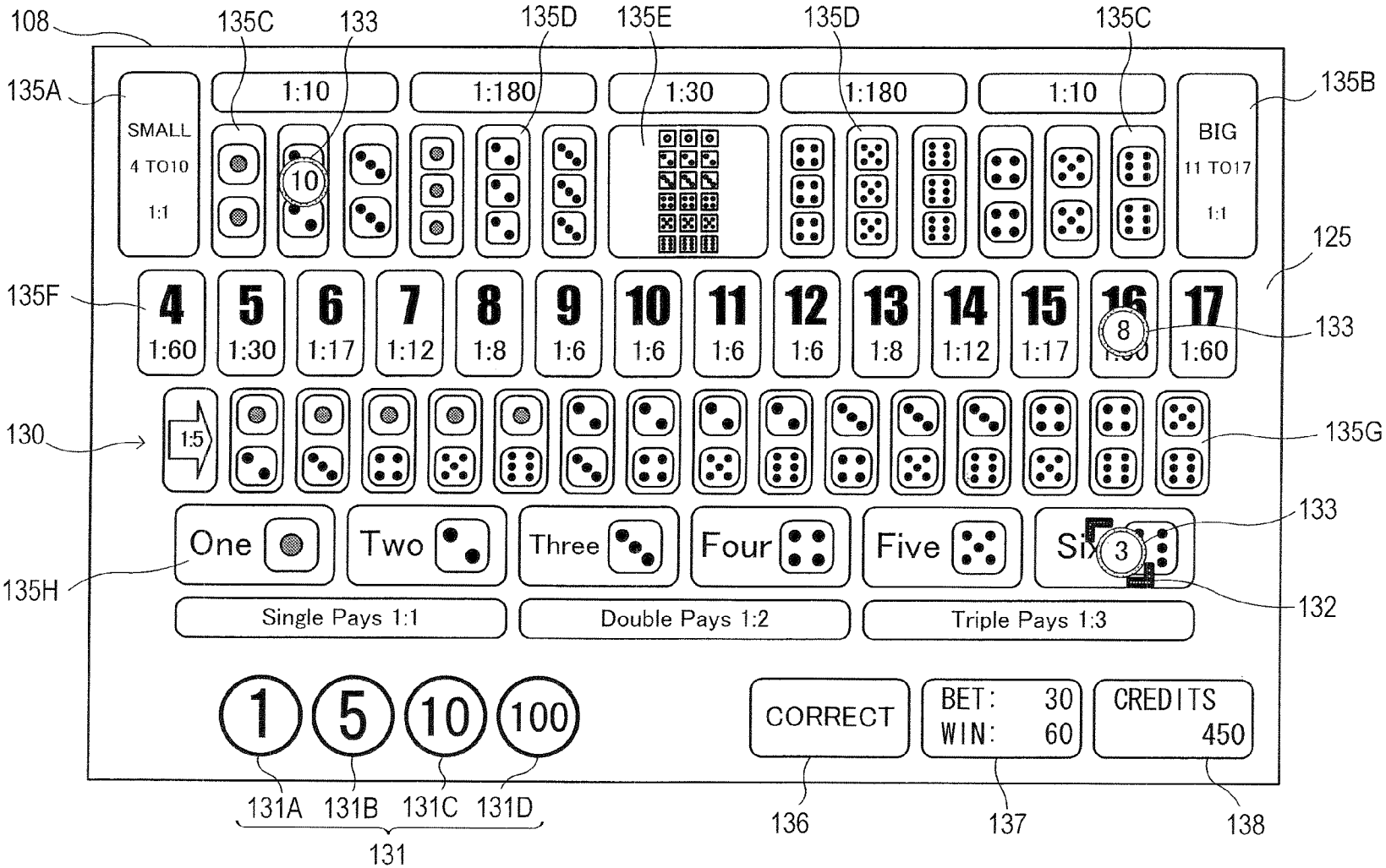
FIG. 22 is an exemplary view showing a game screen including a betting board according to the second embodiment of the present invention.

Next, a detailed description will be given with respect to the game screen to be displayed on the liquid crystal display 108 in the dice gaming machine 101 according to the second embodiment, while referring to the drawings. FIG. 22 is an explanatory diagram showing one example of a game screen to be displayed on the liquid crystal display 108.

As shown in FIG. 22, the game screen displayed on the liquid crystal display 108 includes the betting board 130. Here, when a dice game (e.g., Sic Bo) is played, the players bet gaming values with respect to the spots on the stopped three dice 40. The betting board 130 is used by the player in betting the gaming values.

The betting board 130 has a plurality of bet areas 135. Each bet area 135 is associated with a winning condition and a payout magnification ratio (e.g., base payout magnification ratio). The winning condition is the condition determined by the stopped three dice 140. The base payout magnification ratio shows the payout amount to be paid out in return to the unit gaming value (specifically, one credit) bet, in a case where spots on the stopped three dice 140 satisfy the winning condition of the bet area 135.

More specifically, the betting board 130 has eight types of bet areas 135. Specifically, the betting board 130 has a small bet area 135A, a big bet area 135B, a specific double bet area 135C, a specific triple bet area 135D, an any triple bet area 135E, a total bet area 135F, a combination bet area 135G and a number bet area 135H.

The small bet area 135A and the big bet area 135B are bet areas in each of which a condition is defined with a range of values as a result of adding up the spots on the stopped dice 140 (hereinafter referred to as total value). More specifically, the winning condition of the small bet area 135A is that "the total value is in a range between 4 and 10". The base payout magnification ratio of the small bet area 135A is set to 1:1 (two medals are paid out in return to a win with one medal placed as a bet). Alternatively, the winning condition of the big bet area 135B is that "the total value is in a range between 11 and 17". The base payout magnification ratio of the big bet area 135B is also set to 1:1.

The specific double bet area 135C is a bet area in which a winning condition is defined with a combination of spots on the stopped dice 140. More specifically, the winning condition of the specific double bet area 135C is satisfied if "amongst the three dice 140 which are stopped, the spots on two dice 140 are the same, and the spots on these two dice 140 correspond to specific spots". The betting board 130 has six specific double bet areas 135C. Accordingly, if the spots on two dice 140 from amongst the three dice 140 are "1,1", "2,2", "3,3" . . . or "6,6", the winning condition for one specific double bet area 135C is satisfied (refer to FIG. 22). The base payout magnification ratio of each specific double bet area 135C is set to 1:10.

The specific triple bet area 135D is a bet area in which a winning condition is defined a combination of the stopped three dice 140. More specifically, the winning condition of the specific triple bet area 135D is satisfied if "the spots on the three dice 140 which are stopped are the same and the spots on the three dice 140 correspond to specific spots". The betting board 130 has six specific triple bet areas 135D. Accordingly, if the spots on the three dice 140 are "1,1,1", "2,2,2", "3,3,3" . . . or "6,6,6", the winning condition for one specific triple bet area 135D is satisfied (refer to FIG. 22). The base payout magnification ratio of each specific triple bet area 135D is set to 1:180.

The any triple bet area 135E is a bet area in which a winning condition is defined with a combination of the spots on the stopped three dice 140. More specifically, the winning combination of the any triple bet area 135E is satisfied if "the spots on the stopped dice 140 are all the same". Accordingly, if the spots on the three dice 140 are "1,1,1", "2,2,2", "3,3,3" . . . or "6,6,6", the winning combination of the any triple bet area 135E is satisfied (refer to FIG. 22). The base payout magnification ratio of the any triple bet area 135E is set to 1:30.

The total bet area 135F is a bet area in which a winning condition is defined with a total value of the spots on the stopped three dice 140. More specifically, the winning combination of the total bet area 135F is satisfied if "the total value is a specific value". As shown in FIG. 22, the betting board 130 has fourteen total bet areas 135F. Specifically, the betting board 130 has a total bet area 135F corresponding to each total value "4", "5" . . . "17". As shown in FIG. 22, the base payout magnification ratio of each total bet area 135F is set in accordance with the appearance frequency of the total value for each winning condition. For instance, if the winning condition for the total value "16" is the total bet area 135F thus set, the base payout magnification ratio is 1:30.

The combination bet area 135G is a bet area in which a winning condition is defined with a combination of the spots on the stopped dice 140. More specifically, the winning condition of the combination bet area 135G is satisfied if "the spots on two dice 140 from amongst the stopped three dice 140 correspond to a specific combination". As shown in FIG. 22, the betting board 130 has fifteen combination bet areas 135G. The base payout magnification ratio for the combination bet area 135G is set to 1:5.

The combination for the case that the spots on two dice 140 are the same is excluded from the combination bet area 135G.

The number bet area 135H is a bet area in which a winning condition is defined with the spots' numbers on the dice 140. More specifically, the winning combination of the number bet area 135H is satisfied if "a specific spot is included in the spots on the stopped three dice 140". As shown in FIG. 22, the betting board 130 has six number bet areas 135H. One number bet area 135H corresponds to any of "1", "2" . . . "6". The base payout magnification ratio of the number bet area 135H is set to "1:1", "1:2", "1:3", in accordance with the number of dices showing the spots corresponding to the winning combination.

The game screen can include a cursor 132 and a chip mark 133. The cursor 132 and the chip mark 133 are displayed on the betting board 130 in accordance with a player's operation. The cursor 132 shows the bet area 135 which is currently selected by the player. The chip mark 133 shows the amount of gaming values bet with respect to the bet area 135 (hereinafter referred to as bet amount). As shown in FIG. 22, the chip mark 133 shows the above-mentioned bet amount through the number displayed at the center of the chip mark 133. The chip mark 133 is displayed on the bet area 135. Specifically, the chip mark shows the bet area 135 onto which the bet is made through the location of its display.

Further, as shown in FIG. 22, the game screen includes a unit BET button 131, a CORRECT button 136, a payout result display portion 137 and a credit amount display portion 138.

The unit BET button 131 is formed at a lower left side of the betting board 130. The unit BET button 131 is used to set the bet amount with respect to the bet area 135 selected by the player.

As shown in FIG. 22, the unit BET button 131 is made up of 1 BET button 131A, 5 BET button 131B, 10 BET button 131C and 100 BET button 131D. The 1 BET button 131A is operated by the player to increase the bet amount with respect to the bet area 135 selected by the player by "1". The 5 BET button 131B is operated by the player to increase the bet amount with respect to the bet area 135 selected by the player by "5". The 10 BET button 131C is operated by the player to increase the bet amount with respect to the bet area 135 selected by the player by "10". The 100 BET button 131D is operated by the player to increase the bet amount with respect to the bet area 135 selected by the player by "100".

Each time the player carries out such operation, the unit BET button 131 adds a bet amount in accordance with such operation to the current bet amount.

The CORRECT button 136 is operated to cancel the bet area 135 already selected and the setting of the bet amount. If selection of the bet area 135 and setting of the bet amount are incorrect, the player can correct the bet area 135 and the bet amount by operating this CORRECT button 136.

The payout result display portion 137 displays the total bet amount in the previous game and the payout amount in the previous game (the payout credit amount).

The credit amount display portion 138 displays the credit amount possessed by the player. The display contents of the credit amount display portion 138 are updated based on the bet with respect to the bet area 135 and award of the payout in the dice game.

Next, the bet operation carried out by the player using the game screen will be described. As was described earlier, the touch panel 125 is installed at a front face of the liquid crystal display 108. The touch panel 125 transmits the coordinate information corresponding to the portion touched by the player to the terminal CPU 171. Accordingly, if the game screen is displayed on the liquid crystal display 108, the player can select the bet area 135 and set the bet amount using the touch panel 125.

More specifically, the player first touches with his/her finger the touch panel 125 at the portion corresponding to the desired bet area 135. As a result, the player selects the desired bet area 135. At this time, the cursor 132 is displayed on the bet area 135 thus selected. Thereafter, the player touches with his/her finger the touch panel 125 at the portion corresponding to the unit BET button 131. As a result, the player selects the bet amount with respect to the selected bet area 135. Once the bet amount is selected, the chip mark 133 is displayed on the bet area 135.

Figure 23:
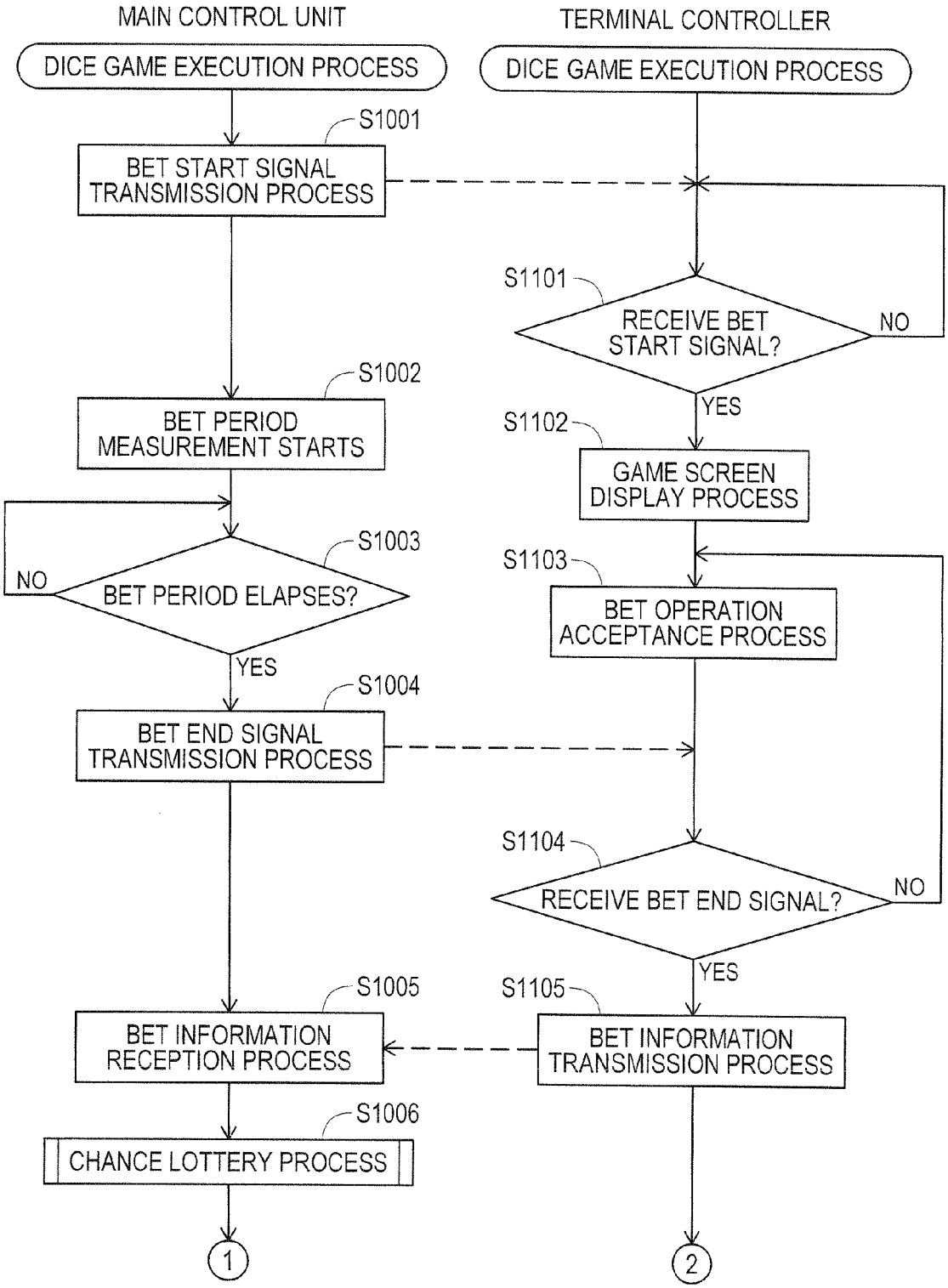
FIG. 23 is a flow chart (1) of a dice game execution process program according to the second embodiment of the present invention.
Figure 24:
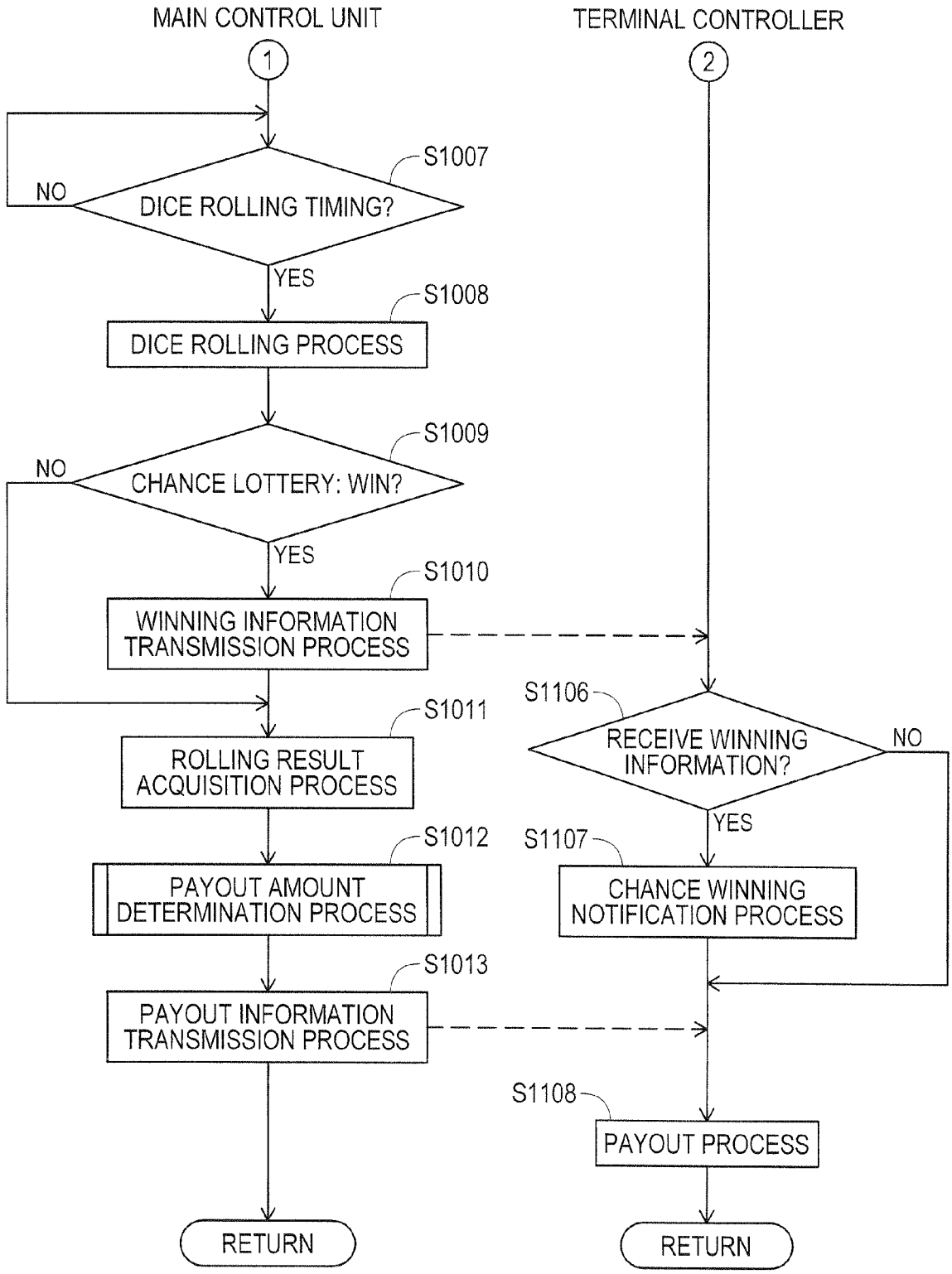
FIG. 24 is a flow chart (2) of the dice game execution process program according to the second embodiment of the present invention.

Next, a dice game execution process program to be executed in the dice gaming machine 101 according to the second embodiment will be described in detail while referring to the drawings. FIG. 23 and FIG. 24 are flow charts of the dice game execution process program.

The initial setting process executed in the main control unit 150 and the initial setting process executed in the terminal controller 170 of each terminal 105 are executed prior to the dice game execution process program. Specifically, the main control unit 150 and the terminal controller 170 end initialization of the peripheral devices and the program authentication process. These initial setting processes are heretofore known in the art. Therefore, description of the contents of such processes is hereby omitted.

First, the dice game execution process program in the main control unit 150 will be described in detail.

Once execution of the dice game execution process program is started, the CPU 151 first executes the bet start signal transmission process (S1001). In the bet start signal transmission process (S1001), the CPU 151 transmits the bet start signal to the terminals 5 through the communication interface 155. The bet start signal serves to instruct start of the bet period in the terminals 105. The bet period is the period for accepting the players' bets for the gaming values with respect to the bet areas 135 at each terminal 105. After the bet start signal is transmitted to the terminals 105, the CPU 151 shifts the process to S1002.

Once the bet start signal is received, the terminal CPU 171 executes the game screen display process (S1102) and the bet operation acceptance process (S1103). This will be described in more detail later.

After shifting to S1002, the CPU 151 starts measuring the bet period. More specifically, the CPU 151 transmits the control signal to the timer 154. As a result, the timer 154 starts measurement. After the control signal is transmitted to the timer 154, the CPU 151 shifts the process to S1003.

At S1003, the CPU 151 judges whether the bet period has lapsed. More specifically, the CPU 151 references the measurement results of the timer 154. The CPU 151 judges whether the predetermined period (e.g., bet period) has lapsed based on the measurement result of the timer 154. If the bet period has lapsed (S1003: YES), the CPU 151 shifts the process to S1004. Alternatively, if the bet period has not lapsed yet (S1003: NO), the CPU 151 puts the process in stand-by until the bet period lapses.

At S1004, the CPU 151 executes the bet end signal transmission process. In the bet end signal transmission process (S1004), the CPU 151 transmits a bet end signal to the terminals 105. The bet end signal serves to instruct ending of the bet period in each terminal 105. In other words, the bet end signal means that acceptance of bets for gaming values in the terminal 105 is ended. After the bet end signal is transmitted to each terminal 105, the CPU 151 shifts the process to S1005.

Once the bet end signal is received, the terminal CPU 171 ends the bet operation acceptance process (S1103). Accordingly, the terminal 105 ends acceptance of bets with respect to the bet area 135. Thereafter, the terminal CPU 171 transmits the bet information based on the bet operation carried out in the bet operation acceptance process (S1103) to the main control unit 150 (S1105). This bet information includes information showing the bet area 135 on which the gaming value has been bet and information showing the bet amount bet on the bet area 135 in question. The bet information includes identification information showing the terminal 105 from which the bet information is transmitted.

After shifting to S1005, the CPU 151 executes the bet information reception process. In the bet information reception process (S1005), the CPU 151 receives the bet information transmitted from each terminal 5 through the communication interface 155. The CPU 151 stores the bet information thus received in the RAM 153. At this time, the CPU 151 classifies the bet information for each terminal 105 based on the identification information included in the bet information. Once the bet information reception process (S1005) ends, the CPU 151 shifts the process to S1006.

At S1006, the CPU 151 executes a chance lottery process. In this chance lottery process (S1006), the CPU 151 first executes a chance lottery process program (refer to FIG. 26) to be described later. More specifically, the CPU 151 determines whether to change the payout magnification ratio of each bet area 135 by a lottery. Thereafter, in the case of a win in the lottery (i.e., in the case of changing the payout magnification ratio), the CPU 151 identifies one target terminal from among terminals which participate in the game. The target terminal is the only terminal wherein payout magnification ratio for game(s) is changed from the base payout magnification ratio to the special payout magnification ratio. After the lottery in the chance lottery process (S1006), the CPU 151 stores the lottery result information in the RAM 153. The lottery result information shows the lottery result of the chance lottery process (S1006). After storing the lottery result information in the RAM 153, the CPU 151 shifts the process to S1007. The details of the chance lottery process (S1006) will be described will be described later by referring to drawings.

At S1007, the CPU 151 judges whether the dice rolling timing has arrived. The dice rolling timing shows the timing at which rolling of the three dice 140 is started in the dice rolling device 103. More specifically, at S1007, the CPU 151 first references the measurement results of the timer 154. Specifically, the CPU 151 carries out the judgment process at S1007 based on the measurement result of timer 154. When the dice rolling timing arrives (S1007: YES), the CPU 151 shifts the process to S1008. Alternatively, if the dice rolling timing has not yet arrived (S1007: NO), the CPU 151 puts the process in stand-by until such dice rolling timing arrives.

At S1008, the CPU 151 executes a dice rolling process. In this dice rolling process (S1008), the CPU 151 transmits a control signal to the dice rolling device 103. As a result, the dice rolling motor 112 is driven and controlled. Accordingly, the three dice 140 are rolled inside the dice rolling device 103. The three dice 140 which have been rolled are then stopped on the dice rolling board 111. Once the dice rolling process ends, the CPU 151 shifts the process to S1009.

After shifting to S1009, the CPU 151 judges whether a win has occurred in the lottery carried out in the chance lottery process (S1006). More specifically, the CPU 151 carries out the judgment process at S1009, by referencing the lottery result information stored in the RAM 153. In the case of a win in the lottery carried out in the chance lottery process (S1009: YES), the CPU 151 shifts the process to S1010. Alternatively, in the case of no win in the lottery carried out in the chance lottery process (S1006) (S1009: NO), the CPU 151 shifts the process to S1011.

At S1010, the CPU 151 executes a winning information transmission process. In this winning information transmission process (S1010), the CPU 151 transmits the winning information to the target terminal identified in the chance lottery process (S1006) through the lottery. This winning information shows that a win has occurred in the lottery in the chance lottery process (S1006) and the "special payout magnification ratio" is to be used for calculating payout amount for the target terminal. In the winning information transmission process (S1010), the CPU 151 first generates the winning information based on the lottery result information stored in the RAM 153. Thereafter, the CPU 151 identifies the target terminal based on the lottery result information. Thereafter, the CPU 151 transmits the winning information thus generated to the target terminal through the communication interface 155. After transmitting the winning information to the target terminal, the CPU 151 shifts the process to S1011.

At S1011, the CPU 151 executes a rolling result acquisition process. In this rolling result acquisition process (S1011), the CPU 151 acquires the rolling result information showing the spots on the stopped three dice 140, by controlling the rolling result detection device 115 of the dice rolling device 103. More specifically, the CPU 151 transmits the control signal to the dice rolling device 103. Upon receiving the control signal, the dice rolling device 103 acquires an image with an imaging device provided in the dice rolling device 103. The acquired image includes the image of the stopped three dice 140 on the dice rolling board 111. Thereafter, the dice rolling device 103 carries out a predetermined image process with respect to the acquired image by controlling the rolling result detection device 115. As a result, the dice rolling device 103 can identify the spots on the three dice 140 which are stopped on the dice rolling board 111. The dice rolling device 103 generates rolling result information showing the spots on the three dice 140 thus identified. The dice rolling device 103 then transmits the rolling result information thus generated to the CPU 151. Once the rolling result information acquired from the dice rolling device 103 is stored in the RAM 153, the CPU 151 shifts the process to S1012.

After shifting to S1012, the CPU 151 executes a payout amount determination process. In this payout amount determination process (S1012), the CPU 151 executes a payout amount determination process program (refer to FIG. 29) as will be described later. In this payout amount determination process, the CPU 151 calculates the payout amount of each terminal 105 based on the rolling result information and the bet information of each terminal 105. Here, in the case of a win in the lottery carried out in the chance lottery process (S1006), the CPU 151 changes the payout magnification ratio used in the payout amount determination process (S1012) for only the target terminal from "base payout magnification ratio" to "special payout magnification ratio". Meanwhile, for the other non-target terminals 105, the CPU 151 calculates each of their payout amounts using the "base payout magnification ratio". The contents of the payout amount determination process (S1012) will next be described in detail. Once the payout amount determination process ends, the CPU 151 shifts the process to S1013.

At S1013, the CPU 151 executes a payout information transmission process. In this payout information transmission process (S1013), the CPU 151 transmits the payout information to each terminal 105 through the communication interface 155. This payout information shows the payout amount calculated in the payout amount determination process (S1012). After transmitting the payout information to each terminal 105, the CPU 151 ends the payout information transmission process. The CPU 151 then ends the dice game execution process program in the main control unit 150.

Once execution of the dice game execution process program is ended, the CPU 151 restarts execution of the dice game execution process program. Specifically, the CPU 151 repeatedly executes the dice game execution process program while power is being supplied to the dice gaming machine 101.

Next, the dice game execution process program at each terminal 105 will next be described in detail.

Upon starting the dice game execution process program, the terminal CPU 171 first judges whether the bet start signal has been received (S1101). As was described earlier, the bet start signal serves to instruct start of the bet period in the dice gaming machine 101. The bet start signal is transmitted from the main control unit 150 to each terminal 105 (S1001). If the bet start signal is received (S1101: YES), the terminal CPU 171 shifts the process to S1102. As a result, the bet period in each terminal 105 is started. Alternatively, if the bet start signal has not yet been received (S1101: NO), the terminal CPU 171 puts the process in stand-by until the bet start signal is received.

After shifting to S1102, the terminal CPU 171 executes a game screen display process. In this game screen display process (S1102), the terminal CPU 171 transmits the control signal to the liquid crystal driving circuit 174. The game screen is displayed on the liquid crystal display 108 based on the control of the liquid crystal driving circuit 174 (refer to FIG. 22). Once the game screen is displayed on the liquid crystal display 108, the terminal CPU 171 shifts the process to S1103.

At S1103, the terminal CPU 171 executes a bet operation acceptance process. In this bet operation acceptance process (S1103), the terminal CPU 171 accepts a player's operation using the touch panel 125. More specifically, the terminal CPU 171 carries out various types of controls corresponding to a player's operation based on the operation signal transmitted from the touch panel. Such controls include control with respect to selecting the bet area 135, control with respect to setting the bet amount corresponding to the selected bet area 135 and control corresponding to operation of the CORRECT button 136.

If the bet area 135 is selected and the bet amount with respect to the selected bet area 135 is set, the terminal CPU 171 stores the bet information in the terminal RAM 173. The bet information includes information with respect to the selected bet area 135 and information showing the bet amount of the bet area 135.

In the next step S1104, the terminal CPU 171 judges whether the bet end signal has been received. As was described earlier, the bet end signal shows the end of the bet period. Specifically, reception of the bet end signal means that acceptance of bets in the current dice game ends. The bet end signal is transmitted from the main control unit 150 (S1004). If the bet end signal is received (S1104: YES), the terminal CPU 171 shifts the process to S1105. Alternatively, if the bet end signal has not yet been received (S1104: NO), the terminal CPU 171 returns the process to the bet operation acceptance process (S1103). Thus, the player at each terminal 105 can bet a gaming value in the current game until the end of the bet period.

After shifting to S1105, the terminal CPU 171 executes a bet information transmission process. In this bet information transmission process (S1105), the terminal CPU 171 transmits the bet information stored in the terminal RAM 173 to the main control unit 150. Here, the terminal CPU 171 adds identification information showing the terminal 105 in question to the bet information. After transmitting the bet information including the identification information, the terminal CPU 171 shifts the process to S1106.

At S1106, the terminal CPU 171 judges whether the winning information has been received. As was described earlier, the winning information shows that a win has occurred in the lottery carried out in the chance lottery process (S1006) and the terminal 105 in question has been identified as target terminal. This winning information is transmitted from the main control unit 150 to the target terminal through the communication interface 155 (S1010). If the winning information is received (S1106: YES), the terminal CPU 171 shifts the process to S1107. Alternatively, if the winning information has not been received (S1106: NO), the terminal CPU 171 shifts the process to the payout process (S1108).

At S1107, the terminal CPU 171 executes the chance winning notification process. In the chance winning notification process (S1107), the terminal CPU 171 notifies the player that he/she has won in the chance lottery and the terminal at which he/she is seated has been identified to be the target terminal, through the display on the liquid crystal display 108. More specifically, the terminal CPU 171 transmits the control signal to the liquid crystal driving circuit 174. As a result, the liquid crystal display 108 displays the chance lottery winning image 180 on the game screen (refer to FIG. 25). Once the chance winning notification process (S1107) ends, the terminal CPU 171 shifts the process to S1108.

Figure 25:
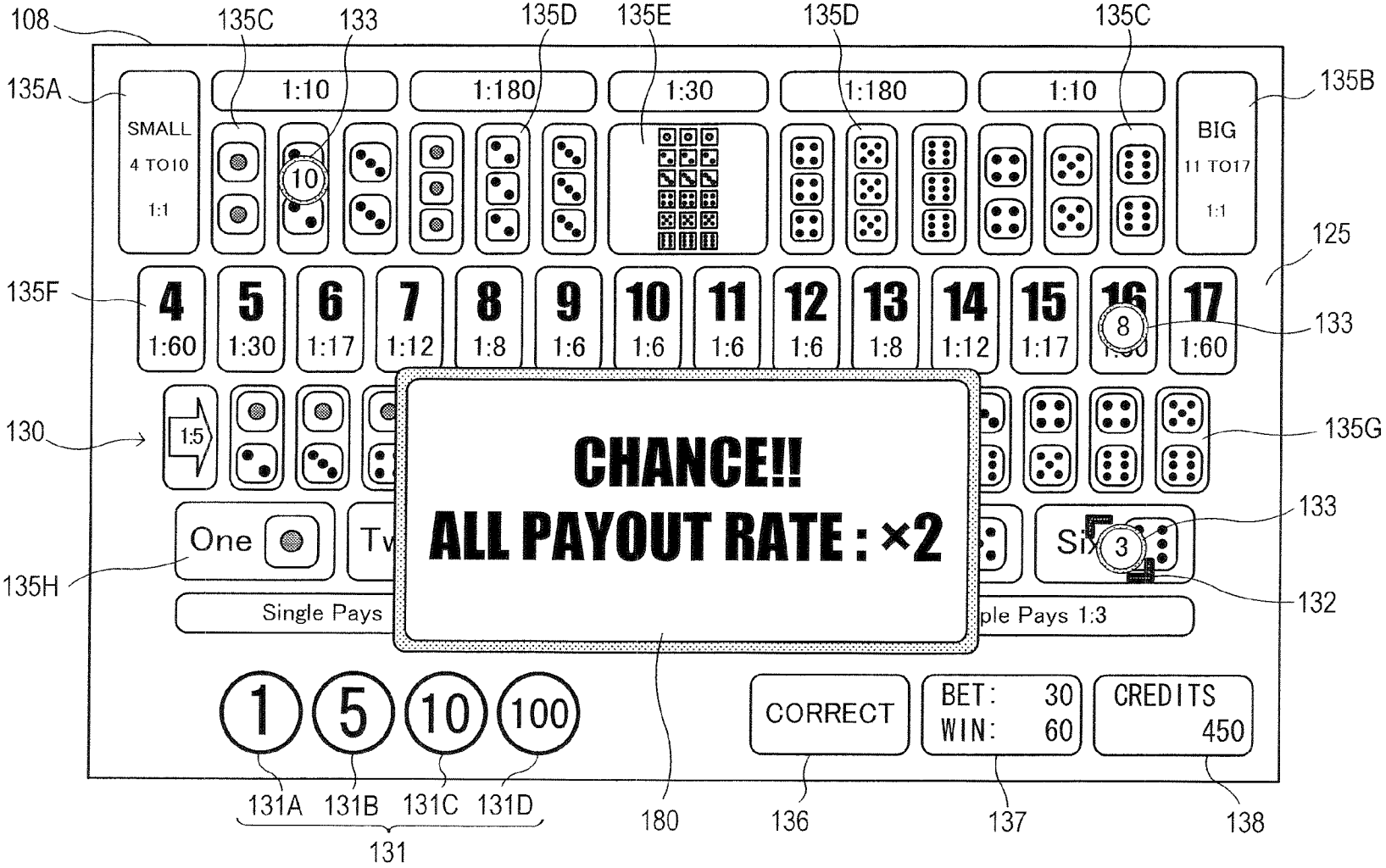
FIG. 25 is an exemplary diagram showing one example of a game screen including a chance lottery winning image according to the second embodiment of the present invention.

As shown in FIG. 25, the chance lottery winning image 180 includes displaying a message that "as a result of winning in the chance lottery, the base payout magnification ratio of all bet areas 135 is multiplied by the special magnification ratio (e.g., ×2)". Specifically the chance lottery winning image 180 notifies the player of the fact that the payout magnification ratio used in calculating the payout has been changed from the "base payout magnification ratio" to the "special payout magnification ratio". Accordingly, the player can understand that a win occurred in the chance lottery by looking at the chance lottery winning image 180. As a result, the dice gaming machine 101 can increase the sense of expectancy of the player with respect to a larger payout.

It is to be noted that the chance lottery winning image 180 is displayed at only the liquid crystal display 108 of the target terminal among terminals 105 constituting the dice gaming machine 101. That is, in the case of no win in the chance lottery process (S1006) or in the case of no terminal 105 being identified to be a target terminal, in either case, the chance lottery winning image 180 is not displayed in the liquid crystal display 108. Accordingly, only the player seated at the target terminal can recognize that his/her terminal has got a chance to win a high amount of payout. Therefore, the dice gaming machine 101 can bring the player at the target terminal a sense of superiority over other players at non-target terminals.

After shifting to S1108, the terminal CPU 171 executes a payout process. In this payout process (S1108), the terminal CPU 171 awards to the player a payout in the current dice game based on the payout information. As was described earlier, the payout information is transmitted from the main control unit 150 to each terminal 105 (S1013). The payout information shows the payout amount calculated in the payout amount determination process (S1012). Accordingly, the terminal CPU 171 adds the payout amount calculated in the payout amount determination process (S1012) to the credit amount possessed by the player. The payout amount can also be awarded in the form of medals which are paid out from the cash out port 109. That is, in the case the terminal 105 in question has been identified to be the target terminal, the terminal CPU 171 pays out a payout amount calculated based on the "special payout magnification ratio". Alternatively, in the case the terminal 105 in question has not been identified to be the target terminal, the terminal CPU 171 pays out a payout amount calculated based on the "base payout magnification ratio". Once the payout process ends, the terminal CPU 171 ends the dice game execution process program in the terminal 105.

Once execution of the dice game execution process program ends, the terminal CPU 171 restarts execution of the dice game execution process program. Specifically, the terminal CPU 171 can repeatedly execute the dice game execution process program while power is being supplied to the dice gaming machine 101.

Figures 26, 27:
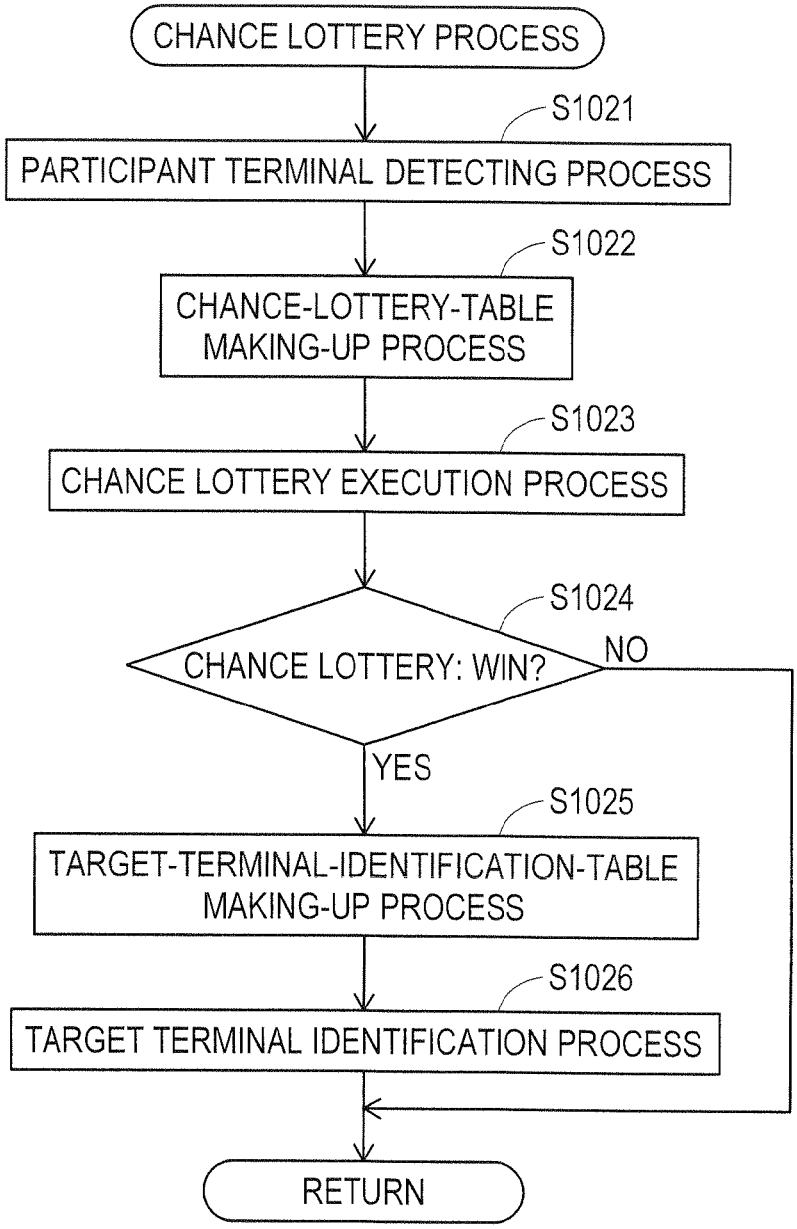
FIG. 26 is a flow chart of a chance lottery process program according to the second embodiment of the present invention.
FIG. 27 is an exemplary diagram showing one example of a chance lottery table according to the second embodiment of the present invention.

Next, there will be described a chance lottery process program to be executed by the CPU 151 at the chance lottery process (S1006) by referring to drawings. FIG. 26 is a flow chart of the chance lottery process program.

In the dice game execution process program of the main control unit 150, the CPU 151 executes a participant terminal detecting process (S1021) upon shifting the process to the chance lottery process (S1006). In the participant terminal detecting process, the CPU 151 detects participant terminal (s) from among all the terminals 105 constituting the dice gaming machine 101. A participant terminal corresponds to a terminal 105 which participates in a current dice game. That is, a participant terminal refers to a terminal 105 where a bet is placed on a bet area 135 in a current dice game. More specifically, the CPU 151 detects terminal(s) 105 where a gaming value is bet on a bet area 135 based on bet information stored in the RAM 153. As was described earlier, the bet information received at the bet information reception process (S1005) includes identification information of the terminal 105 which has transmitted the bet information. Each piece of bet information stored in the RAM 153 is classified into each terminal 105, based on the identification information. Accordingly, the CPU 151 can detect participant terminal(s) by referring to the bet information stored in the RAM 153. Once the participant terminal detecting process ends, the CPU 151 shifts the process to S1022.

In S1022, the CPU 151 executes a chance-lottery-table making-up process. In this chance-lottery-table making-up process (S1022), the CPU 151 makes up a chance lottery table to be used at a chance lottery execution process (S1023) to be described later, based on a detection result obtained at the participant terminal detecting process (S1021). The details of the chance-lottery-table making-up process (S1022) will be described later. Upon storing the thus made up chance lottery table (e.g., refer to FIG. 27) in the RAM 153, the CPU 151 shifts the process to S1023.

After shifting the process to S1023, the CPU 151 executes a chance lottery execution process. In this chance lottery execution process, the CPU 151 determines whether to calculate a payout amount based on the "special payout magnification ratio" through a lottery. More specifically, the CPU 151 extracts a random number value from a predetermined range of random number values (e.g., between 0 and 2047) by executing a lottery program. Thereafter, the CPU 151 determines a chance lottery result based on the extracted random number value and the chance lottery table (e.g., refer to FIG. 27). It is to be noted that the chance lottery table is a table made up at the chance-lottery-table making-up process (S1022). The chance lottery result includes both "chance lottery result: win" and "chance lottery result: lose". This "chance lottery result: win" means that payout magnification ratio of all the bet area 135 constituting the betting board 130 is changed when payout amount is calculated with respect to one terminal 105 identified from participant terminals (i.e., target terminal). Meanwhile, the "chance lottery result: lose" means that the base payout magnification ratio defined for each of the bet area is used when payout amount is calculated with respect to all the terminals 105. After storing the chance lottery result in the RAM 153, the CPU 151 shifts the process to S1024.

At S1024, the CPU 151 judges whether the lottery results in a win or not in the chance lottery execution process (S1023). More specifically, the CPU 151 executes the judgment process of S1024 by referring to the lottery result stored in the RAM 153. In the case the lottery at the chance lottery execution process (S1023) results in a win (S1024: YES), the CPU 151 shifts the process to S1025. Alternatively in the case the lottery at the chance lottery execution process (S1023) results in no win (S1024: NO), the CPU 151 ends the chance lottery process program as is.

At S1025, the CPU 151 executes a target-terminal-identification-table making-up process. At this target-terminal-identification-table making-up process (S1025), the CPU 151 makes up a target terminal identification table to be used at a target terminal identification process (S1026) to be described later. More specifically, the CPU 151 makes up the target terminal identification table (e.g., refer to FIG. 28) based on a detection result obtained at the participant terminal detecting process (S1021). That is, the CPU 151 associates each of the participant terminals detected at the participant terminal detecting process (S1021) with a random number value range (refer to FIG. 28). The details of the target-terminal-identification-table making-up process (S1025)will be described later. Once storing the thus made up target terminal identification table in the RAM 153, the CPU 151 shifts the process to S1026.

After shifting the process to S1026, the CPU 151 executes a target terminal identification process. In this target terminal identification process (S1026), the CPU 151 identifies one target terminal from participant terminals by referring to the target terminal identification table made up at the target-terminal-identification-table making-up process (S1025). More specifically, the CPU 151 extracts a random number value from a predetermined range of random number values (e.g., between 0 and 2047) by executing a lottery program. Thereafter, the CPU 151 identifies one target terminal from participant terminals by referring to the target terminal identification table. Thereafter, the CPU 151 makes up winning information based on both information indicating the thus identified target terminal and information indicating a win at the chance lottery execution process (S1023). Upon storing the winning information in the RAM 153, the CPU 151 ends the chance lottery process execution program.

Here will be described making-up of the chance lottery table at the chance-lottery-table making-up process (S1022) and making-up of the target terminal identification table at the target-terminal-identification-table making-up process (S1025), by referring to drawings.

It is preferable not to exceed "1" (i.e., 100%) for any expected value of any of the bet areas 135 set for each of the terminals 105 constituting the dice gaming machine 101 according to the second embodiment, even if a target terminal is present. This is because a game arcade which installs the dice gaming machine 101 receives damage of expense more than necessary, if there is a bet area 135 of which expected value exceeds "1".

Here, an expected value of each bet area 135 can be obtained by multiplying the following three factors: the amount of unit gaming value (specifically, "bet amount: 1"); the payout magnification ratio (either base payout magnification ratio or special payout magnification ratio) of the bet area 135 in question; and the dice winning probability of the bet area 135. The winning probability of the bet area 135 is the probability that the winning condition of the bet area 135 in question is satisfied in one dice game. For instance, the probability of a certain specific triple bet area 135D is "1/216".

The expected value of each bet area 135 at a normal time (specifically, in the case of non-target terminal) on the betting board 130 according to the second embodiment ranges from "0.65 to 0.9722" (e.g., 65% to 97.22%). Specifically, in the case of using the base payout magnification ratio, the maximum expected value is "97.22%". Accordingly, if, as a result of changing the payout magnification ratio, the expected value of the bet area 135 corresponding to this maximum value does not exceed "100%", none of the expected values for all the bet areas 135 will exceed "100%".

For instance, the dice gaming machine 101 can provide a dice game which makes a target terminal present with a probability that a total of expected values which is synthesis of expected values of respective bet areas 135 set for all the terminals 105 (referred as "synthetic expected value", hereinafter) is made to increased by 2%. Following the above, a synthetic expected value when a target terminal is present is "0.9922" (i.e., 99.22%). That is, in this case, the synthetic expected value when a target terminal is present does not exceed "1" (i.e., 100%).

The probability that the synthetic expected value is made to increase by 2% is a probability obtained by dividing the number of target terminal(s) by that of all the participant terminals. That is, if it goes with a probability that one target terminal is identified from fifty participant terminals (i.e., 1/50), there is satisfied a condition that a synthetic expected value when a target terminal is present is smaller than "1". In other words, the condition regarding the above-mentioned synthetic expected value is satisfied with a 1/50 (i.e., 2%) of probability that one target terminal is made present in the chance lottery process (S1006).

As was described earlier, in the chance lottery process (S1006), the CPU 151 executes the chance lottery execution process (S1023) and the target terminal identification process (S1026). The chance lottery execution process (S1023) is a process to determine whether or not a target terminal is made present based on the chance lottery table. The target terminal identification process (S1026) is a process to identify one target terminal from current participant terminals based on the target terminal identification table in the case it has been determined that a target terminal is made present. Accordingly, it is necessary that a probability based on the chance lottery table and a probability based on target terminal identification table be correlatively considered and set so that the above mentioned condition of "1/50" can be induced. The probability based on the chance lottery table is a probability that a target terminal is made present. The probability based on the target terminal identification table is a probability that a certain terminal 105 is identified to be a target terminal among from current participant terminals. That is, the probability based on the target terminal identification table corresponds to 1/"the number of current participant terminals (i.e., the number of participant terminals detected at S1021)". The probability based on the chance lottery table corresponds to "the number of current participant terminals"/50.

There will be specifically described on detailed contents of the chance-lottery-table making-up process (S1022) and the chance lottery table based on a case where five current participant terminals have been detected at the participant terminal detecting process (S1021), in line with the above-mentioned probabilities. In this exemplary case, it is assumed that the CPU 151 has detected a "first terminal", a "second terminal", a "fifth terminal", a "ninth terminal" and a "tenth terminal" at the participant terminal detecting process (S1021).

In this case, the probability based on the chance lottery table needs to be 5/50 for satisfying the condition with regard to the above-mentioned synthetic expected value. Accordingly, the CPU 151 associates "chance lottery result: win" with a random number value range of "0-204" out of the predetermined random number value range "0-2047". The CPU 151 associates "chance lottery result: lose" with a random number value range of "205-2047" (refer to FIG. 27). As was described earlier, the thus made up chance lottery table is used for executing the chance lottery execution process (S1023). Accordingly, at the chance lottery execution process (S1023) in this case, the probability for one target terminal to be made present is approximately "5/50" (refer to FIG. 27).

Not to mention, contents of the chance lottery table to be made up at the chance-lottery-table making-up process (S1022) are subject to vary depending on the number of participant terminals detected at S1021. For instance, in the case there are detected two participant terminals, the CPU 151 makes up a chance lottery table so that the probability for one target terminal to be made present should be "2/50" (S1022).

Next, there will be described on contents of the target-terminal-identification-table making-up process (S1025) and the target terminal identification table by referring to drawings.

As was described earlier, the probability based on the target terminal identification table needs to be 1/5 for satisfying the condition with regard to the above-mentioned synthetic expected value. Accordingly, the CPU 151 associates each participant terminal detected at the participant terminal detecting process (S1021) with a constant range of random number values (refer to FIG. 28). In this case, the CPU 151 associates the "fifth terminal" detected as a participant terminal with a "random number value range: 800-1199". The thus made up target terminal identification table is used for executing the target terminal identification process (S1026). Accordingly, at the participant terminal detecting process (S1026) in this case, the probability that each of the five participant terminals is identified to be a target terminal should be equally set to "1/5" (refer to FIG. 28).

Not to mention, contents of the participant terminal identification table to be made up at the participant-terminal-identification-table making-up process (S1025) are subject to vary depending on the number of participant terminals detected at S1021. For instance, in the case there are detected two participant terminals, the CPU 151 makes up a participant terminal identification table so that the probability that each of the two participant terminal is identified to be a target terminal should be "1/2" (S1025).

As was described earlier, the CPU 151 executes the chance lottery execution process (S1023) based on the chance lottery table made up at the chance-lottery-table making-up process (S1022), and further executes the target-terminal-identification-table making-up process (S1026) based on the target terminal identification table made up at the target-terminal-identification-table making-up process (S1025). Accordingly, in the dice gaming machine 101, a synthetic expected value when a target terminal is present will not exceed "1" (i.e., 100%). That is, even if the chance lottery process (S1006) is executed, an expected value of any bet area 135 is equal to or lower than "1". As a result, even if a chance lottery process (S1006) is configured to bring large amount of payout, the dice gaming machine 101 does not get rid of essential game characteristics from dice game (i.e., Sic Bo) seriously. Moreover, the dice gaming machine 101 can surely secure profit of a game arcade that installs the dice gaming machine 101.

Figures 28, 29:
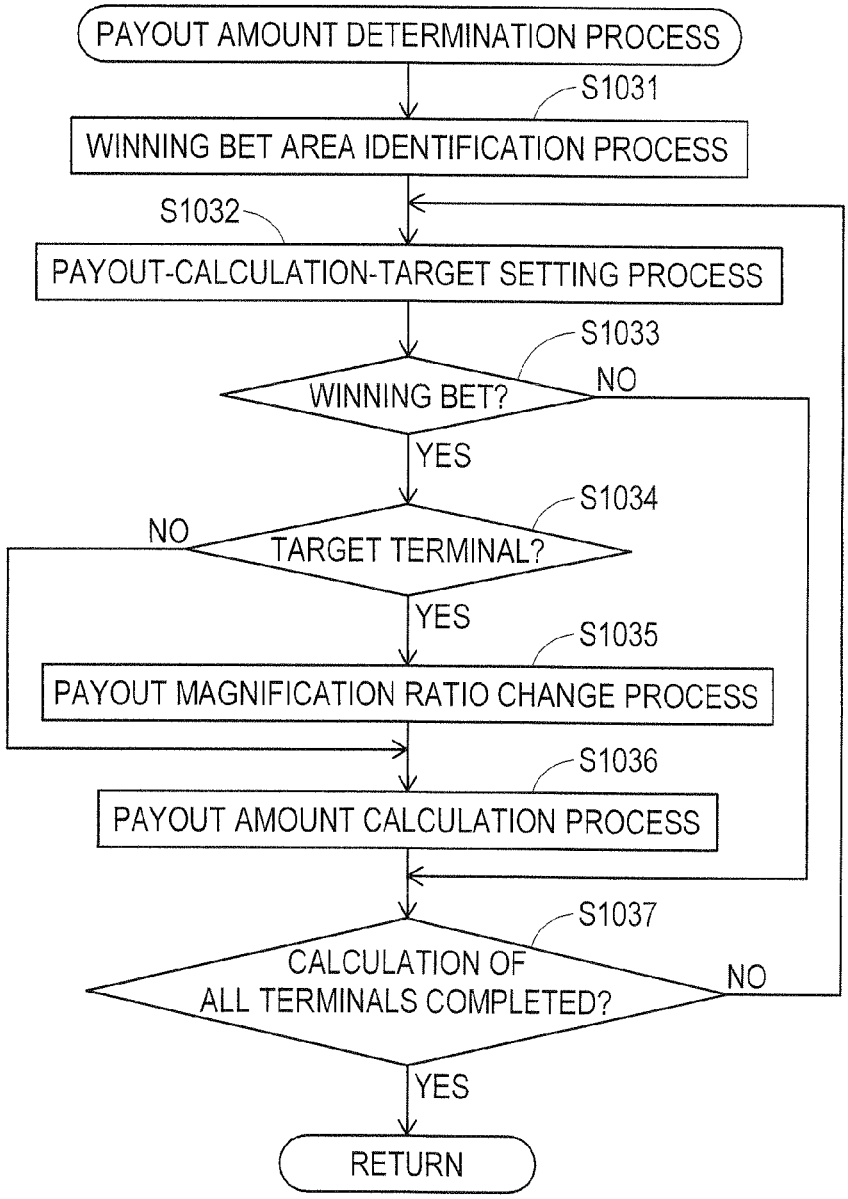
FIG. 28 is an exemplary diagram showing one example of a target terminal identification table according to the second embodiment of the present invention.
FIG. 29 is a flow chart of a payout amount determination process program according to the second embodiment of the present invention.

Next, the payout amount determination process program to be executed by the CPU 151 in the payout amount determination process (S1012) will be described in detail while referring to the drawings. FIG. 29 is a flow chart of the payout amount determination process program.

In the dice game execution process program of the main control unit 150, after shifting to the payout amount determination process (S1012), the CPU 151 executes a winning bet area identification process (S1031). In the winning bet area identification process (S1031), the CPU 151 identifies the winning bet area based on the rolling result information and the winning condition set for each bet area 135. The winning bet area is the bet area 135 whose specified winning condition is satisfied by the spots on the stopped dice 140. As was described earlier, the rolling result information shows the spots on the three stopped dice 140 which have been identified by the rolling result detection unit 115. Accordingly, the CPU 151 identifies the winning bet area based on the rolling result information and the winning condition of each bet area 135. After identifying the winning bet area, the CPU 151 shifts the process to S1032.

After shifting to S1032, the CPU 151 sets one terminal selected from all the terminals 105 constituting the dice gaming machine 101 as payout amount calculation target. The terminal selected as payout amount calculation target will be termed as "calculation target terminal", hereinafter. After setting the calculation target terminal, the CPU 151 shifts the process to S1033.

After shifting to S1033, the CPU 151 judges whether or not any of the bets placed by the calculation target terminal coincides with a winning bet. The winning bet refers to the gaming values bet on the winning bet area identified in the winning bet area identification process (S1031). More specifically, the CPU 151 carries out the judgment process at S1033 based on the bet information of the calculation target terminal stored in the RAM 153. If a winning bet has been made (S1033: YES), the CPU 151 shifts the process to S1034.

Alternatively, if none of the bets are winning bets (S1033: NO), the CPU 151 sets the payout amount of the calculation target terminal to "0". Thereafter, the CPU 151 shifts the process to S1037. Here, the case that none of the bets are winning bets includes the case that no bets for gaming values are made with respect to the bet area 135 and the case that all gaming values are bet with respect to a bet area 135 other than the winning bet area.

At S1034, the CPU 151 judges whether or not the calculation target terminal coincides with a "target terminal". More specifically, the CPU 151 judges whether or not the calculation target terminal has won in the chance lottery execution process (S1023) and coincides with a terminal 105 identified at the target terminal identification process (S1026). More specifically, the CPU 151 carries out the judgment process at S1034 based on the winning information stored in the RAM 153. In the case the calculation target terminal coincides with the "target terminal" (S1034: YES), the CPU 151 shifts the process to a payout magnification ratio change process (S1035). Alternatively, in the case the calculation target terminal dose not coincide with the "target terminal" (S1034: NO), the CPU 151 shifts the process to S1036.

At S1035, the CPU 151 executes the payout magnification ratio change process. In the payout magnification ratio change process (S1035), the CPU 151 changes the payout magnification ratio of all bet areas 135 constituting the betting board 130. At this time, the CPU 151 changes the payout magnification ratio of all the bet areas 135, with respect to only the calculation target terminal which corresponds to "target terminal". More specifically, the CPU 151 multiplies the base payout magnification ratio of all bet areas 135 constituting the betting board 130 by the special magnification ratio (i.e., ×2). As a result, the payout magnification ratio of each bet area 135 is changed from "base payout magnification ratio" to "special payout magnification ratio". After the payout magnification ratio of each bet area 135 is changed to the "special payout magnification ratio", the CPU 151 shifts the process to S1036.

After shifting to S1036, the CPU 151 executes a payout amount calculation process. In this payout amount calculation process (S1036), the CPU 151 calculates the payout amount in the current game with respect to the calculation target terminal. More specifically, the CPU 151 calculates the payout amount of the calculation target terminal in the current game by executing the following processes for the calculation target terminal.

In the case the calculation target terminal coincides with a "target terminal", the CPU 151 calculates the payout amount related to the winning bet area by using the "special magnification ratio". More specifically, the CPU 151 multiplies the "special payout magnification ratio" of the winning bet area by the bet amount bet on the winning bet area in question. In the case the calculation target terminal does not coincide with a "target terminal", the CPU 151 calculates the payout amount related to the winning bet area by using the "base payout magnification ratio". More specifically, the CPU 151 multiplies the "base payout magnification ratio" of the winning bet area by the bet amount bet on the winning bet area in question. If bets of gaming values are made with respect to a plurality of winning bet areas, the CPU 151 calculates a payout amount corresponding to each winning bet area.

The CPU 151 sets the payout amount corresponding to the bet areas other than the winning bet area to "0". The CPU 151 adds up the payout amounts of the bet areas calculated through the processes described above so as to calculate payout amount of the calculation target terminal. Thereafter, the CPU 151 stores the information showing the payout amount of the calculation target terminal (termed as "payout amount information" hereinafter) in the RAM 153. The payout amount 6 information constitutes payout information of the calculation target terminal. Thereafter, the CPU 151 shifts the process to S1037.

After shifting to S1037, the CPU 151 judges whether or not calculation of payout amounts has been finished with respect to all the terminals 105 constituting the dice gaming machine 101. More specifically, the CPU 151 executes the judgment process of S1037 by referring to the payout amount information stored in the RAM 153. In the case calculation of payout amounts has been finished with respect to all the terminals 105 (S1037: YES), the CPU 151 finishes the payout amount determination process program. As shown in FIG. 24, after finishing the payout amount determination process (S1012), the CPU 151 shifts the process to the payout information transmission process (S1013). In the case calculation of payout amounts has not been finished with respect to all the terminals 105 (S1037: NO), the CPU 151 reverts the process to the payout-calculation-target setting process (S1032). In this case, the CPU 151 sets a terminal 105 of which payout amount has not yet been calculated, as new calculation target terminal. Then, the CPU 151 executes processes concerning payout amount calculation of the new calculation target terminal (S1033 through S1036).

As was described earlier, in the payout information transmission process (S1013), the CPU 151 transmits the payout information showing the payout amount thus calculated, from the main control unit 150 to each terminal 105. In each terminal 105, the terminal CPU 171 executes the payout process (S1108) based on the payout information thus received.

In the case the terminal 105 in question does not coincides with a target terminal, the player of the terminal 105 can win a payout amount based on the "base payout magnification ratio". The payout amount based on the "base payout magnification ratio" is obtained by multiplying the "base payout magnification ratio" of the winning bet area by the bet amount bet on the winning bet area in question. Alternatively, in the case the terminal 105 in question coincides with a target terminal, the player can win a payout amount based on the "special payout magnification ratio". The payout amount based on the "special magnification ratio" is obtained by multiplying the "special payout magnification ratio" of the winning bet area by the bet amount bet on the winning bet area in question. The "special payout magnification ratio" is obtained by multiplying the "base payout magnification ratio" by the "special magnification ratio (i.e., ×2)". Accordingly, in the case the terminal in question coincides with a target terminal, the player at the target terminal can be awarded a larger payout amount as compared to the case of non-target terminal.

As described, once acceptance of bets of gaming values on bet areas 135 ends, the dice gaming machine 101 according the second embodiment executes the chance lottery process (S1006). At the chance lottery process (S1006), the dice gaming machine 101 first executes the chance lottery execution process (S1023) by referring to a chance lottery table made up at the chance-lottery-table making-up process (S1022). In the chance lottery execution process (S1023), the dice gaming machine 101 determines whether or not a "chance to calculate a payout amount based on a special magnification ratio" is won in a lottery which refers to the chance lottery table. In the case of a win in the lottery of the chance lottery execution process (S1023), the dice gaming machine 101 then executes the target terminal identification process (S1026) by using a target terminal identification table made up at the target-terminal-identification-table making-up process (S1025). In the target terminal identification process (S1026), the dice gaming machine 101 identifies one target terminal from participant terminals of a current dice game.

In the case of a win in the chance lottery execution process, the dice gaming machine 101 calculates payout amount of the target terminal (S1035 and S1036). More specifically, the payout amount of the target terminal is obtained by multiplying bet amount bet on a winning bet area by the special payout magnification ratio. The dice gaming machine 101 also calculates payout amount of each of non-target terminals (S1036). More specifically, the payout amount of each of the non-target terminals is obtained by multiplying bet amount bet on a winning bet area by the base payout magnification ratio. The "special payout magnification ratio" is obtained by multiplying the "base payout magnification ratio" by the "special magnification ratio (i.e., ×2)".

As a result, each player acquires payout amount calculated at the payout amount calculation process (S1036) as a prize for the current game. That is, in the case a terminal 105 is identified to be a target terminal, the player at the target terminal can acquire larger amount of payout. As a result, the dice gaming machine 101 can meet players' desire to win larger amount of payout.

The dice gaming machine 101 executes the chance lottery execution process (S1023) by using the chance lottery table (refer to FIG. 27) made up at the chance-lottery-table making-up process (S1022). Moreover, the dice gaming machine 101 executes the target terminal identification process (S1026) by using the target terminal identification table (refer to FIG. 28) made up at the target-terminal-identification-table making-up process (S1025).

At S1022 and S1025, the dice gaming machine 101 makes up a chance lottery table and the target terminal identification table while keeping the condition that "the synthetic expected value when a target terminal is present is smaller than '1'".

Therefore, even if the dice gaming machine 1 has awarded a chance to win large payout along with a chance lottery, the dice gaming machine 101 can keep the possibility to secure sufficient profit with respect to all the bet areas 135. That is, the dice gaming machine 101 can sufficiently secure profit of a game arcade which installs the dice gaming machine 101.

Moreover, in the case a target terminal is made present, the dice gaming machine 101 displays the chance lottery wining image 180 on the game screen of the target terminal (S1107). As shown in FIG. 25, the chance lottery winning image 180 serves to notify that this terminal has been identified to be a target terminal and this terminal has acquired a chance to win large amount of payout. Accordingly, the player at the target terminal can recognize that this terminal has been identified to be a target terminal and this terminal has acquired a chance to win large amount of payout by looking at the chance lottery winning image 180. As a result, the dice gaming machine 1 can increase the sense of expectancy of the player with respect to a larger payout with the notification by the chance lottery winning image 180.

The present invention is not limited to the embodiments described above, but various improvements and modifications can be made thereto without departing from the spirit of the present invention. For instance, the dice gaming machine 101 according to the present invention can use plural types of special magnification ratios when the base payout magnification ratio is changed to a special magnification ratio.

More specifically, a first special magnification ratio (e.g., "×2") and a second special magnification ratio (e.g., "×4") can be used. In this case, it is also preferable that a lottery winning probability satisfies the condition that a synthetic expected value when a target terminal is present is lower than "1". For instance, provided that an occurrence probability to multiply the base payout magnification ratio of a target terminal by the first special magnification ratio is set to "1/100" and an occurrence probability to multiply the base payout magnification ratio of a target terminal by the second special magnification ratio is set to "1/400", the dice gaming machine is allowed to identify a target terminal by applying proper one of lottery winning probabilities to make a synthetic expected value lower than "1".

Further, in the example described above, the special magnification ratio is set to "×2" or "×4". However, the special magnification ratio is not limited to the above values. Various other values can be adopted as the special magnification ratio as long as the player can be awarded a larger payout.

In the payout magnification ratio change process (S1035) described in the second embodiments, the CPU 151 changes the payout magnification ratio of each bet area 135 by multiplying the base payout magnification ratio by the special magnification ratio. Multiplying the base payout magnification ratio by the special magnification ratio is not limited to the payout magnification ratio change process (S1035). Specifically, the special payout magnification ratio obtained by multiplying the base payout magnification ratio by the special magnification ratio can be stored in advance in a memory. In this case, in the payout magnification ratio change process (S1035), the CPU 151 reads out the special payout magnification ratio from the memory and changes the "base payout magnification ratio" in each bet area 135 to the corresponding "special payout magnification ratio". The dice gaming machine 101 can thus reduce the processing burden with respect to the payout magnification ratio change process (S1035).

The dice gaming machine according to the second embodiment identifies one target terminal among from participant terminals based on a lottery (S1026). In the present invention, the manner to identify a target terminal, however, is not limited to lottery. The present invention can apply various manners of target-terminal identification as long as one target terminal can be identified anyhow.

Furthermore, in the above-mentioned embodiment, the target terminal identification table is made up in such a fashion that probability that each participant terminal is identified to be a target terminal is set equally (refer to FIG. 28). In this regard, probability setting, however, is not limited to the above-mentioned fashion. For instance, the target terminal identification table may be made up in such a fashion that "identified-to-be-target-terminal probability" is made different by each participant terminal. For instance, the "identified-to-be-target-terminal probability" is made different depending on large or small of bet amount for a current game.

The present invention can also be realized as a gaming method for executing the above-described processes. Further, the present invention can also be realized as a program for causing a computer to execute such gaming method, and a recording medium onto which such program is recorded.

[Third Embodiment ]

Here, characteristics of a dice gaming machine 201 will be described. A dice game which is called "Sic Bo" is played in the dice gaming machine 201. In "Sic-Bo", three dice 240 are rolled. Players predict the result of dice rolling (specifically, the spots on the three dice 240). Also, the players bet gaming values on a betting board 230 based on their prediction.

Figure 36:
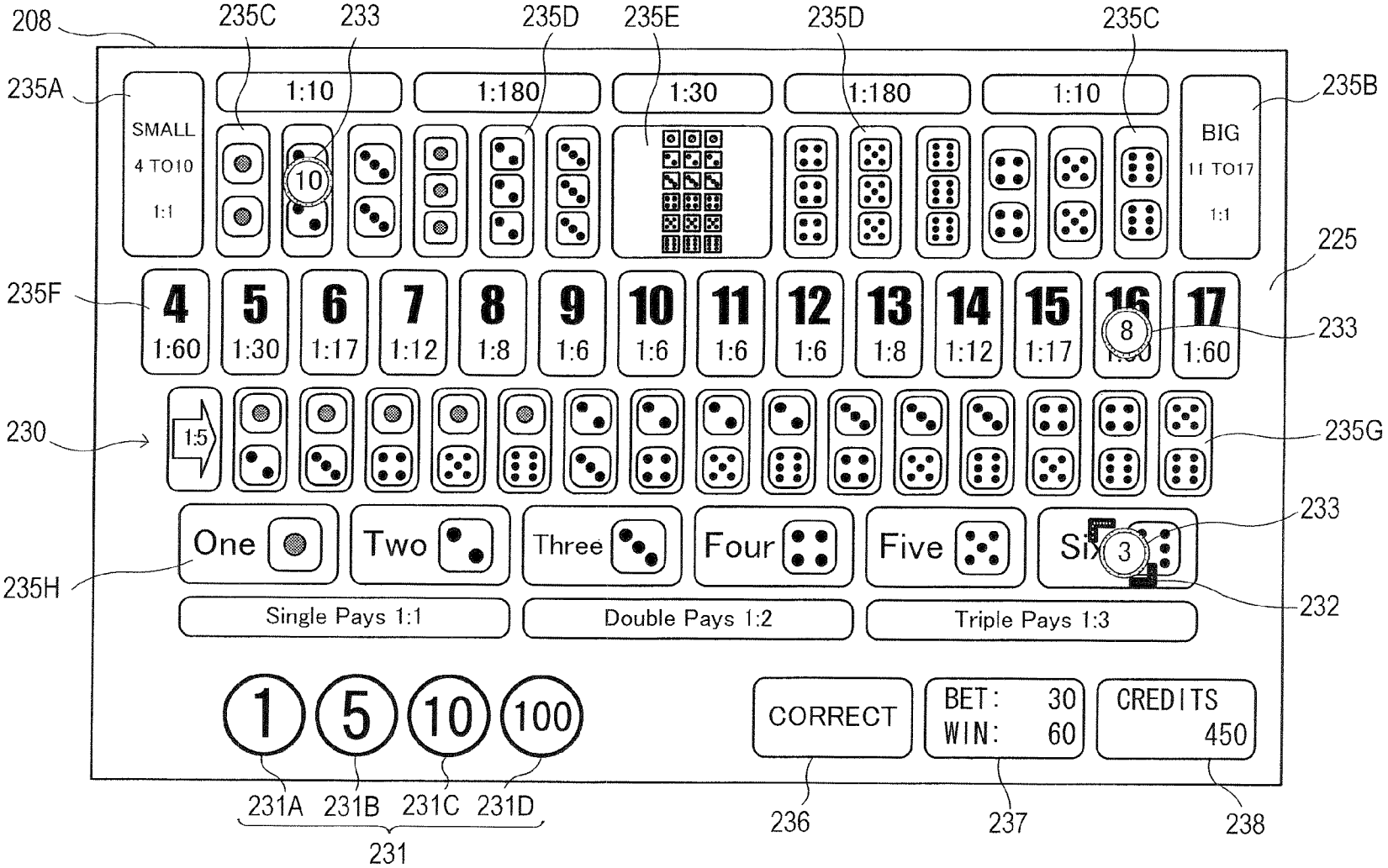
FIG. 36 is an exemplary view showing a game screen including a betting board according to the third embodiment of the present invention.

Here, the betting board 230 is made up of a plurality of bet areas 235 (refer to FIG. 36 etc.). Each bet area 235 is associated with a winning condition and a payout magnification ratio. The winning condition is a condition defined by spot(s) on some or all of the three dice 240. If the spots on the rolled dice 240 satisfy the winning condition, the player who placed a bet on this bet area 235 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 235 corresponding to their prediction as described above.

If the spots on the rolled dice 240 satisfy the winning condition defined for the bet area on which a bet is placed by the player, the player wins a prize. The prize in this case is determined by multiplying the amount of gaming value bet by the player by the payout magnification ratio of the bet area 235 in question.

Here, once reception of gaming value bets ends, the dice gaming machine 201 according to the third embodiment executes a chance lottery process (S2008). If the result of the chance lottery is "chance lottery result: win", the dice gaming machine 201 identifies one target terminal among from terminals 205 that participate in the current dice game (S2036). After that, the dice gaming machine 201 changes the payout magnification ratio to be used in determining the prize contents of the target terminal (S2045). More specifically, for the target terminal only, the dice gaming machine 201 multiplies the payout magnification ratio set for all bet areas by a special magnification ratio (for instance, "×2"). Accordingly, in the case of a win in a chance lottery, a player seated at the target terminal can be awarded twice the payout amount as compared to normal times (specifically, in the case of no win in chance lottery).

The result of this chance lottery is applied only to the target terminal identified at the chance lottery process (S2008). Specifically, in the case of a win in the chance lottery, the player at the target terminal can win a larger payout amount than usual on condition that the winning condition is satisfied in a bet area 235 on which he/she placed a bet. It is to be noted that a player at a non-target terminal can win a payout amount based on a base payout magnification ratio on condition that the winning condition is satisfied in a bet area 235 on which he/she placed a bet.

In the third embodiment, the payout magnification ratio includes a base payout magnification ratio and a special payout magnification ratio. The base payout magnification ratio is the payout magnification ratio set for each bet area 235. The base payout magnification ratio is used in calculating the prize (e.g., payout amount) if no win occurs in the chance lottery. The special payout magnification ratio is the changed payout magnification ratio set for each bet area 235, which is obtained by multiplying the base payout magnification ratio by the special magnification ratio (for instance, "×2"). Specifically, the special payout magnification ratio is used in calculating the prize set for the target terminal in the case of a win in the chance lottery.

Here, the dice gaming machine 201 updates income information when the acceptance of bets from players ends. The income information refers to income based on the gaming values bet by players. The dice gaming machine 201 updates outgo information when awarding of a prize (prizes) (that is, payout amount) to a player (players) ends. The outgo information refers to outgo based on the prize-awarding to a player (players).

The dice gaming machine 201 then calculates a balance at the dice gaming machine 201 based on the income information and the outgo information (S2021). The dice gaming machine 201 changes a chance lottery table used at the chance lottery process (S2008) based on the balance. Specifically, the dice gaming machine 201 sets a condition for making-up a chance lottery table (i.e., later-described base probability, first reference probability or second reference probability) based on the calculated balance (S2001). Then, the dice gaming machine 201 makes up a chance lottery table based on the making-up condition thus set (S2033). Thus, the dice gaming machine can change the probability of awarding a chance to obtain larger amount of payout based on the balance of the dice gaming machine 201.

Figure 31:
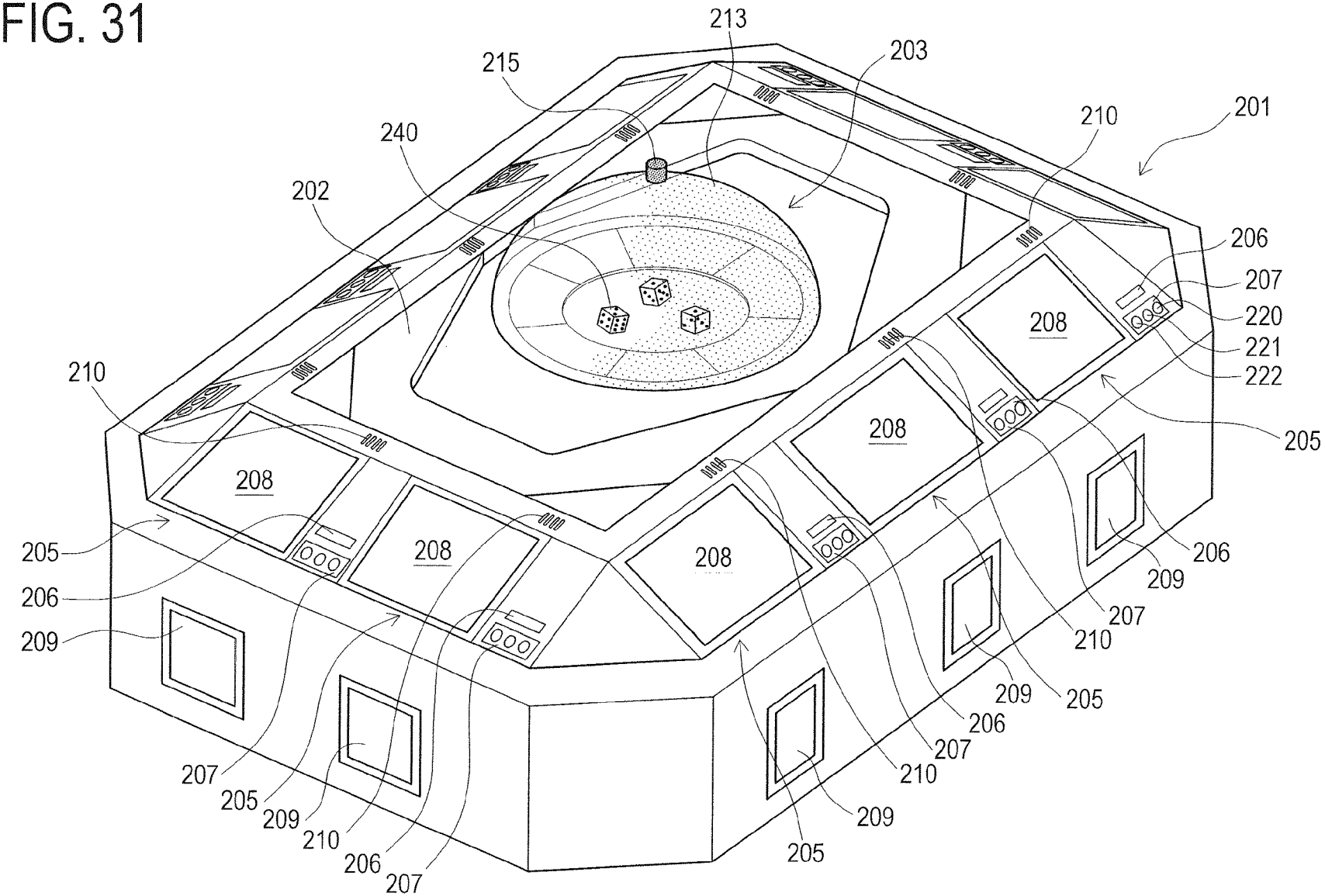
FIG. 31 is a perspective view showing an outer appearance of the dice gaming machine according to the third embodiment of the present invention.

Next, a schematic configuration of the dice gaming machine 201 will be described in detail while referring to the drawings. FIG. 31 is a schematic diagram showing an outer appearance of the dice gaming machine 201 according to the third embodiment.

As shown in FIG. 31, the dice gaming machine 201 according to the third embodiment has a cabinet 202, a dice rolling device 203 and a plurality of terminals 205 (in the third embodiment, ten terminals). The cabinet 202 makes up the main part of the dice gaming machine 201. The cabinet 202 houses mechanical components and electrical components such as a main control unit 250 and the like as will be described later.

The dice rolling device 203 is installed at a central portion on an upper face of the cabinet 202. The dice rolling device 203 has a dice box. The dice box houses three dice 240 therein. The three dice 240 are rolled inside the dice box and are then stopped. The configuration of the dice rolling device 203 will be described in detail later.

The terminals 205 are installed at the periphery of the dice rolling device 203. The terminals 205 each have a liquid crystal display 208. The terminals 205 are used in a player's operation with respect to the dice game (e.g., Sic Bo) played in the dice gaming machine 201. Specifically, players enter the dice game played in the dice gaming machine 201 by using the terminals 205.

In the third embodiment, the ten terminals 205 each constituting the dice gaming machine 201 are termed "first terminal" through "tenth terminal".

The terminals 205 each have a medal acceptance device 206, a control panel 207 and a liquid crystal display 208. The medal acceptance device 206 accepts medals, an exemplary type of gaming value, inserted by the player. Specifically, in the case of playing the dice game, the player inserts medals, an exemplary type of gaming value, in the medal acceptance device 206. The gaming values thus inserted are stored as credit. The player places a bet onto a bet area 235 using such credit.

The control panel 207 is installed at a lower side of the medal acceptance device 206. This control panel 207 has a plurality of operation buttons. More specifically, the control panel 207 also has a BET determination button 220, a CASHOUT button 221 and a HELP button 222.

The BET determination button 220 is operated by the player to determine a bet operation. Specifically, the player operates the BET determination button 220 to determine the bet area 235 which will be the bet target and the amount of gaming values to be bet with respect to the bet area 235 (hereinafter referred to as bet amount).

The CASHOUT button 221 is operated by the player to request payout of the credits he/she possesses. When this CASHOUT button 221 is operated, medals are paid out from a cash out port 209 in accordance with the number of credits that the player possesses.

The HELP button 222 is operated in the case the operation method and the rules of the game are unclear. When the HELP button 222 is operated, the dice gaming machine 1 displays a HELP screen containing explanations with respect to the game operation method and the like onto the liquid crystal display 208.

The liquid crystal display 208 is a display device for displaying information with respect to the dice game. When the dice game is started, each liquid crystal display 208 displays an image of the betting board 230. The touch panel 225 is arranged at a front face of the liquid crystal display 208 in each terminal 205. Accordingly, the player carries out a bet operation with respect to the bet area 235 using this touch panel 225.

Each terminal 205 has a cash out port 209 and a speaker 210. The cash out port 209 is arranged at a lower side of the liquid crystal display 208. This cash out port 209 serves to output medals. For instance, once the CASHOUT button 221 is operated, a number of medals corresponding to the credits the player possesses are paid out to the cash out port 209. Speaker 210 is installed at a right upper side of the liquid crystal display 208. The speaker 210 outputs sounds based on the progress of the game.

Next, the dice rolling device 203 installed in the dice gaming machine 201 will be described in detail while referring to the drawings.

As shown in FIG. 31, the dice rolling device 203 is installed at an upper face of the cabinet 202. The dice rolling device 203 houses three dice 240 therein. The three dice 240 are rolled inside the dice rolling device 203 by controlling the operation of the dice rolling motor 212 as will be described later. The rolled dice 240 are then stopped on a dice rolling board 211. The dice rolling device 203 is installed at a central portion of the cabinet 202. Accordingly, players who are seated at the terminals 205 can see the dice 240 as they are being rolled inside the dice rolling device 203 and the spots on the dice 240 after these are stopped inside the dice rolling device 203.

Figure 32:
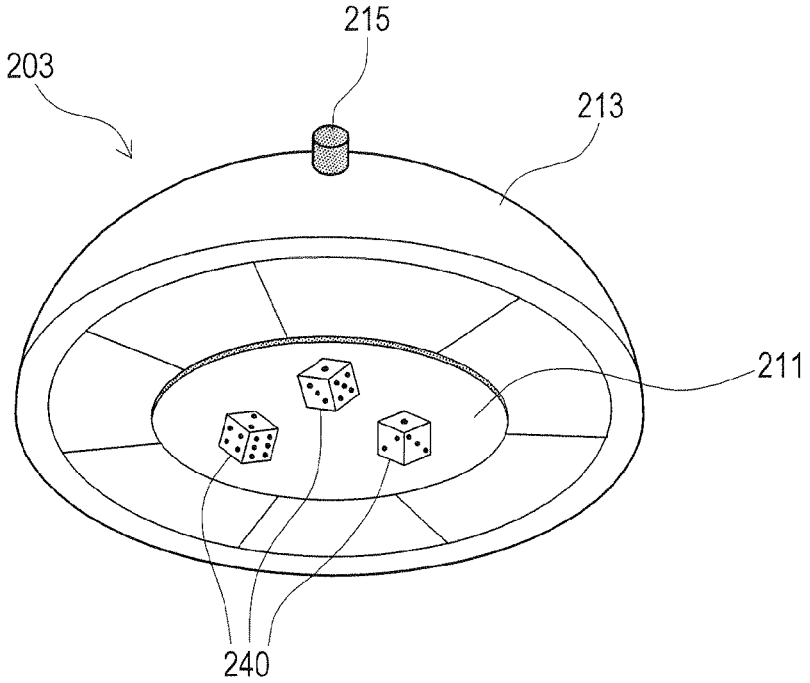
FIG. 32 is a view showing an outer appearance of a dice rolling device according to the third embodiment of the present invention.
Figure 33:
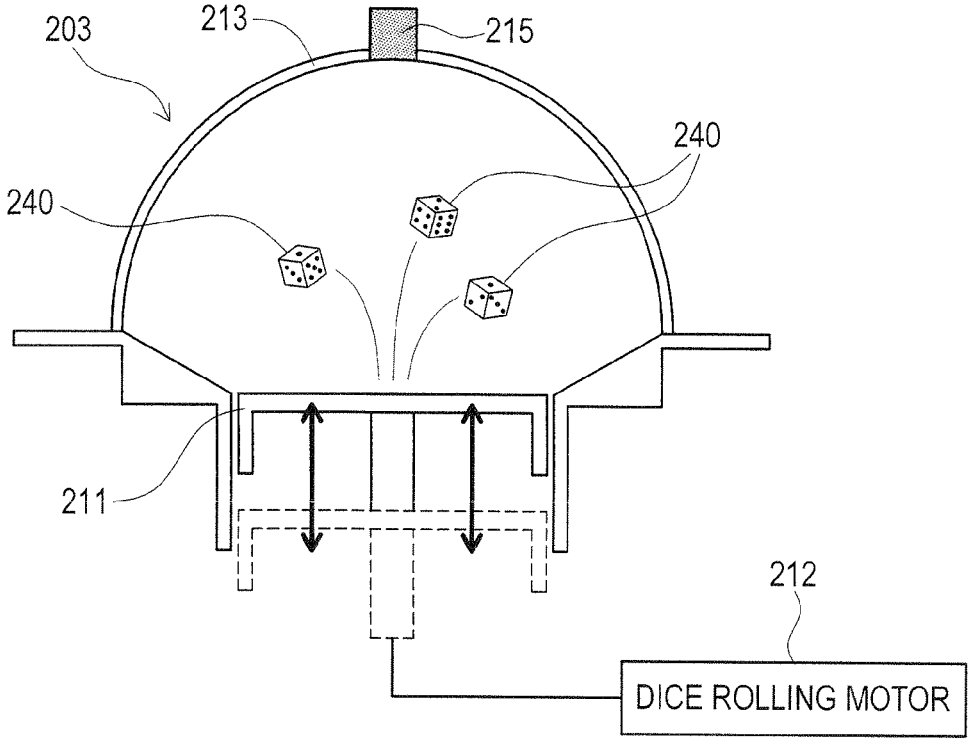
FIG. 33 is an exemplary diagram relating to an operation of the dice rolling device according to the third embodiment of the present invention.

As shown in FIG. 32 and FIG. 33, the dice rolling device 203 has a dice rolling board 211, a dice rolling motor 212, a cover member 213 and a rolling result detection unit 215. The dice rolling board 211 moves up and down within a predetermined range inside the dice rolling device 203 (refer to FIG. 33). The dice rolling board 211 is connected to the dice rolling motor 212. Specifically, the dice rolling board 211 moves up and down within the predetermined range based on driving and control of the dice rolling motor 212.

As shown in FIG. 33, in the case of rolling the dice 240, the dice rolling motor 212 causes the dice rolling board 211 to move upwards at a certain speed or faster. Once the dice rolling board 211 moves over a predetermined range, the board stops moving. Accordingly, the dice 240 on the dice rolling board 211 are thrown upwards and are thus rolled inside the dice rolling device 203. As shown in FIG. 33, an inclined face is formed at the periphery of the dice rolling board 211. Accordingly, the three dice 240 thus roll on the inclined face and then stop on the dice rolling board 211.

The cover member 213 is formed in a hemispherical shape to cover the three dice 240 and the dice rolling board 211 (refer to FIG. 32 and FIG. 33). Specifically, the three dice 240 are rolled inside a space defined by the upper face of the dice rolling board 211 and the inner face of the cover member 213. The cover member 213 is made of a transparent acrylic material. Accordingly, the player can sufficiently see the dice 240 while being rolled inside the dice rolling device 203 and the dice 240 as stopped on the dice rolling board 211.

The rolling result detection unit 215 is installed at a top of the cover member 213 (refer to FIG. 32 and FIG. 33). The rolling result detection device 215 detects the spots on each die 240 which is stopped on the dice rolling board 211 (hereinafter referred to as rolling result). More specifically, the rolling result detection unit 215 acquires an image of each die 240 which is stopped on the dice rolling board 211. The rolling result detection unit 215 identifies the spots on each die 240 by carrying out a predetermined image process with respect to the images thus acquired. Here, information showing the identified spots on the three dice 240 is referred to as rolling result information.

The image processing for identifying the spots on dice 240 is heretofore known in the art. Therefore, further description thereof will hereby be omitted.

Figure 34:
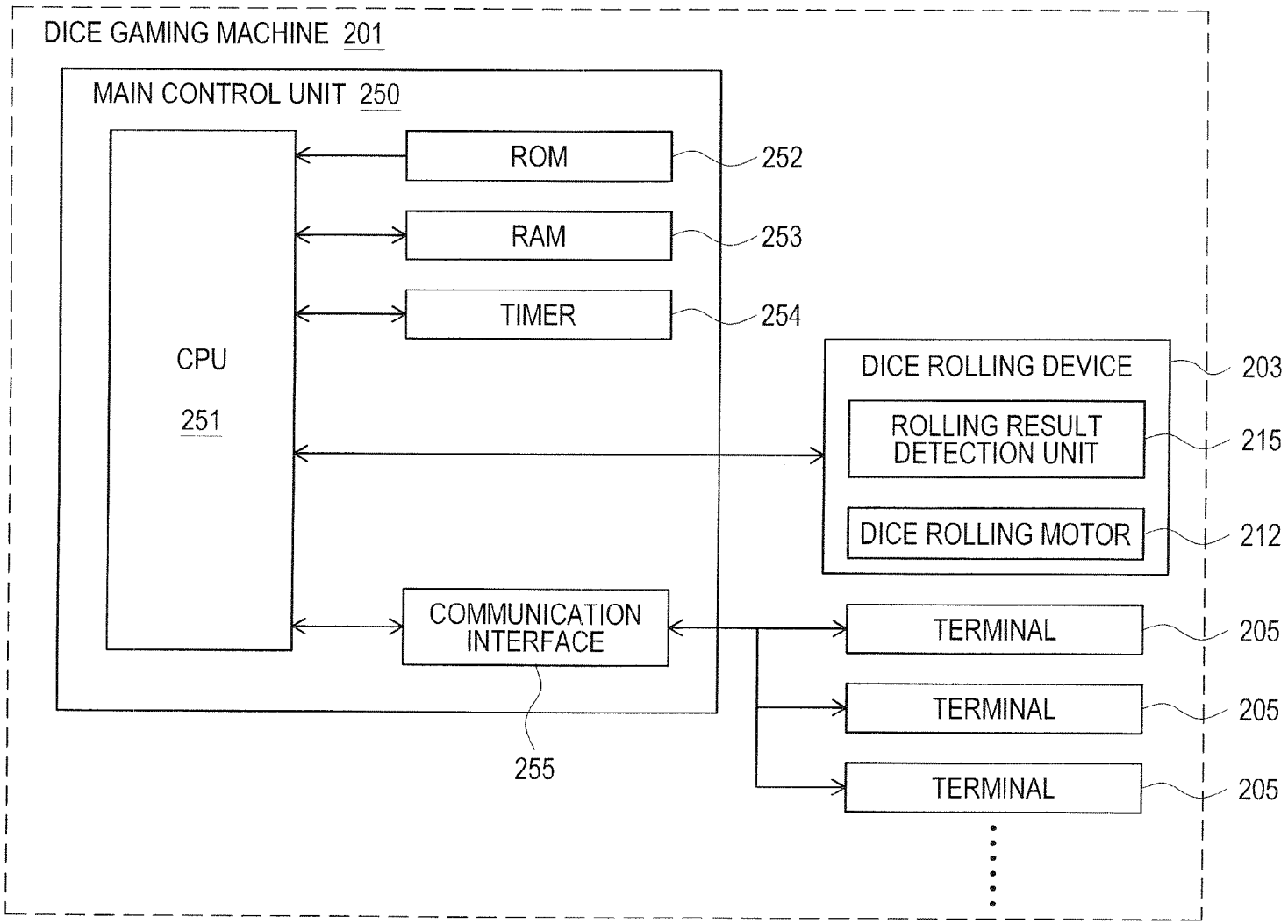
FIG. 34 is a block diagram showing an internal configuration of the dice gaming machine according to the third embodiment of the present invention.

Next, the internal configuration of the dice gaming machine 1 according to the third embodiment will be further described in detail while referring to the drawings. FIG. 34 is a block diagram showing an internal configuration of the dice gaming machine according to the third embodiment.

As shown in FIG. 34, the dice gaming machine 201 has a main control unit 250. The main control unit 250 controls the entire dice gaming machine 201. The main control unit 250 has a CPU 251, a ROM 252 and a RAM 253.

The CPU 251 is a central processing unit with respect to control by the main control unit 250. Specifically, the CPU 251 plays a central role in the control by the main control unit 250. In other words, the CPU 251 controls the entire dice gaming machine 201 by executing the various programs stored in the ROM 252. For instance, the CPU 251 progresses the dice game in the dice gaming machine 201 by executing a dice game execution process program (refer to FIG. 37 and FIG. 38) as will be described later.

The ROM 252 stores various types of programs to be executed in the CPU 251. More specifically, the ROM 252 stores a dice game execution process program (refer to FIG. 37 and FIG. 38), a reference probability setting process program (refer to FIG. 30), a chance lottery process program (refer to FIG. 40), a payout amount determination process program (refer to FIG. 45) and a lottery program and the like. The ROM 252 also stores various types of data tables. These data tables are referenced upon executing various programs. Accordingly, the payout table and the like are also stored in the ROM 252. In addition, the ROM 252 stores information representing a balance of the dice gaming machine 201 (i.e., later-described first reference value and second reference value).

The ROM 252 stores a BIOS (Basic Input/Output System) and an authentication program. When power is applied to the dice gaming machine 201, the CPU 251 executes the BIOS stored in the ROM 252. As a result, the CPU 251 initializes the peripheral devices constituting the dice gaming machine 201. The CPU 251 authenticates the dice game execution process program and the like by executing an authentication program. At this time, the CPU 251 checks the presence of any alterations with respect to the dice game execution process program and the like. These processes are executed in an initial setting process executed at the time of applying power.

The RAM 253 temporarily stores the results of the processing executed by the CPU 51. Specifically, the RAM 253 temporarily stores the processing results following execution of the above-mentioned programs (for instance, lottery results of the chance lottery process and the like). The RAM 253 temporarily stores various types of information regarding the dice game (for instance, bet information transmitted from the terminals 205, rolling result information transmitted from the rolling result detection device 215 and the like).

Furthermore, the RAM 253 stores income information and outgo information. The income information refers to the total amount of gaming values bet by players through a predetermined number of games (for instance, 1,000 games). Accordingly, the income information is updated whenever the acceptance of bets for a new game (S2007) ends. The outgo information refers to the total amount of prizes paid out to players (i.e., payout amounts) through a predetermined number of games (for instance, 1,000 games). Accordingly, the outgo information is updated whenever payout for the new game is executed (S2016). The income information and the outgo information are referenced at the calculation of the balance in a reference probability setting process (S2001) to be later described.

The main control unit 250 has a timer 254 and a communication interface 255. The timer 254 is a clock device which is connected to the CPU 251. The CPU 251 references the measurement result of the timer 254 in the case of judging the lapse of the bet period and in the case of judging the arrival of rolling timing.

The bet period refers to the period of accepting the bet operation made by the players at the terminals 205. Specifically, lapse of the bet period indicates that acceptance of bets for gaming values with respect to the bet area 235 has ended. Rolling timing indicates the timing when rolling of dice 240 inside the dice rolling device 203 is started.

The communication interface 255 is connected to the CPU 251. The communication interface 255 is also connected to the terminals 205 constituting the dice gaming machine 201. Specifically, the CPU 251 transmits various types of information and control signals with respect to the terminals 5 through the communication interface 255. Further, the CPU 251 can receive the information (for instance, bet information) and the control signals from the terminals 205 through the communication interface 255.

Further, the CPU 251 constituting the main control unit 250 is connected to the dice rolling device 203. As was described earlier, the dice rolling device 203 has a dice rolling motor 212 and a rolling result detection device 215. Accordingly, the CPU 251 can drive and control the dice rolling motor 212 by transmitting a predetermined control signal to the dice rolling device 203. Specifically, the CPU 251 can cause the dice 240 to roll and stop in the dice rolling device 203. The rolling result detection device 215 can identify a rolling result indicating the spots on the stopped dice 240. Accordingly, the CPU 251 can acquire the rolling result information based on the spots on the dice 240 as identified by the rolling result detection device 215 (S2011).

Figure 35:
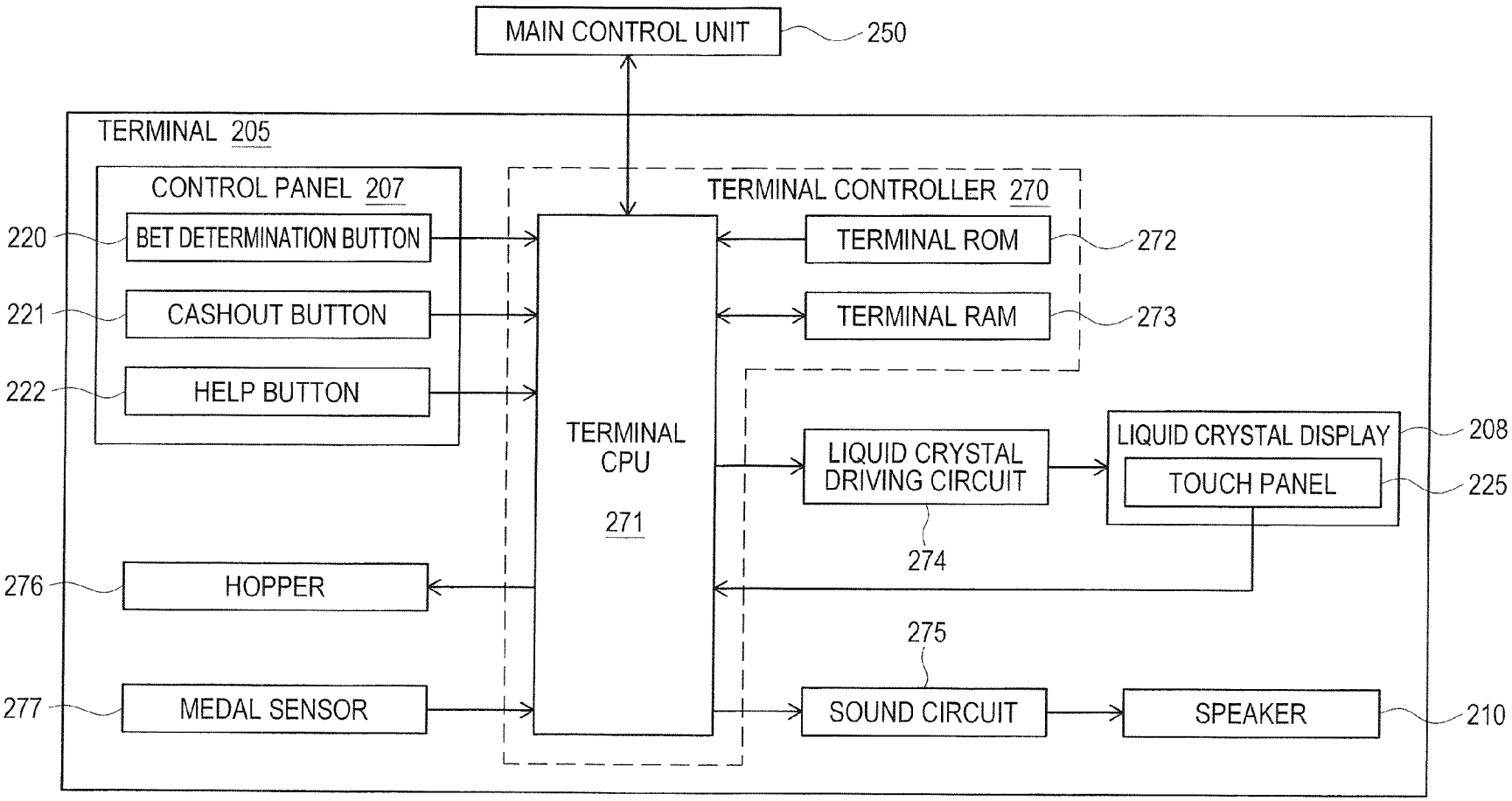
FIG. 35 is a block diagram showing an internal configuration of a terminal according to the third embodiment of the present invention.

Next, the terminals 205 constituting the dice gaming machine 201 will be described in detail while referring to the drawing. FIG. 35 is a block diagram showing the internal configuration of a terminal 205.

The terminals 205 constituting the dice gaming machine 201 all have the same configuration. Accordingly, the internal configuration of one terminal 205 will be described in detail. Description of the other terminals 205 constituting the dice gaming machine 201 will hereby be omitted.

As shown in FIG. 35, the terminal 205 has a terminal controller 270. This terminal controller 270 controls the various functions of the terminal 205. The terminal controller 270 has a terminal CPU 271, a terminal ROM 272 and a terminal RAM 273.

The terminal CPU 271 is a central processing unit with respect to control made by the terminal controller 270. Specifically, the terminal CPU 271 plays a central role in the control with respect to the terminal 205. More specifically, the terminal CPU 271 controls the terminal 205 by executing various types of programs stored in the terminal ROM 272. For instance, the terminal CPU 271 carries out control with respect to the dice game (for instance, control with respect to acceptance of bet operation and payment of payout) by executing the dice game execution process program (refer to FIG. 37 and FIG. 38) as will be described later.

The terminal ROM 272 stores various types of programs to be executed in the terminal CPU 271. More specifically, the terminal ROM 272 stores dice game execution process programs (refer to FIG. 37 and FIG. 38) and the like. The terminal ROM 272 stores various types of data tables. These data tables are referenced upon execution of the various programs.

The terminal ROM 272 also stores a BIOS (Basic Input/Output System) and an authentication program. When power is applied to the dice gaming machine 201, the terminal CPU 271 executes the BIOS stored in the terminal ROM 272. As a result, the terminal CPU 271 initializes the peripheral devices constituting the terminals 205. The terminal CPU 271 authenticates the dice game execution process program and the like by executing an authentication program. At this time, the terminal CPU 271 checks the presence of any alterations with respect to the dice game execution process program and the like. These processes are executed in an initial setting process executed at the time of power application.

The terminal RAM 273 temporarily stores the results of the processing executed in the terminal CPU 271. Specifically, the terminal RAM 273 temporarily stores the processing results following execution of the above-mentioned programs (for instance, bet information based on the players' bet operation). The terminal RAM 273 temporarily stores various types of information regarding the dice game (for instance, payout information transmitted from the main control unit 250 and the like).

The terminal CPU 271 is connected with the control panel 207. As was described earlier, the control panel 207 has a BET determination button 220, a CASHOUT button 221 and a HELP button 222. Specifically, the BET determination button 220, the CASHOUT button 221 and the HELP button 222 are each connected to the terminal CPU 271. Accordingly, when a player operates the BET determination button 220, the CASHOUT button 221 and the HELP button 222, a control signal based on each such operation can be inputted to the terminal CPU 271. The terminal CPU 271 can thus carry out control in accordance with the button that was operated, based on the operation signal thus inputted.

The terminal CPU 271 is connected with the liquid crystal display 208 through a liquid crystal driving circuit 274. The liquid crystal driving circuit 274 serves as a control circuit with respect to display on the liquid crystal display 208. The liquid crystal driving circuit 274 is made up of a program ROM, an image ROM, an image control CPU, a work RAM, a VDP (video display processor) and a video RAM, etc. The program ROM stores various types of selection tables and image control programs regarding display on the liquid crystal display 208. The image ROM stores dot data. This dot data is used for forming images to be displayed on the liquid crystal display 208. The image control CPU determines images to be displayed on the liquid crystal display 208 from the dot data stored in the image ROM, based on the parameters set in the terminal CPU 271 and the image control program. The work RAM serves as a temporary storage device at the time the image control program is executed in the image control CPU. The VDP forms images in accordance with the display contents determined by the image control CPU. The VDP outputs the images thus formed to the liquid crystal display 208. The video RAM serves as a temporary storage device at the time images are formed in the VDP.

As was described earlier, the liquid crystal display 208 has a touch panel 225 provided at a front face thereof. As is shown in FIG. 35, the terminal CPU 271 is connected with the touch panel 225. The touch panel 225 detects the coordinate information corresponding to a portion touched by the player. Accordingly, the touch panel 225 can identify a player's operation-with respect to the touch panel 225 based on the coordinate information. The operation information indicating a player's operation with respect to the touch panel 225 is transmitted from the touch panel 225 to the terminal CPU 271.

In the dice gaming machine 201 according to the third embodiment, when the betting board 230 is displayed on the liquid crystal display 208 (refer to FIG. 36), the players select the bet areas 235 making up the betting board 230 and depress the unit BET button 231 using the touch panel 225. Accordingly, information with respect to the bet areas 235 thus selected and the unit BET button 231 is transmitted from the touch panel 225 to the terminal CPU 271.

The terminal CPU 271 is connected with the speaker 210 through a sound circuit 275. The sound circuit 275 carries out control with respect to sound output from speaker 210 based on the control signal transmitted from the terminal CPU 271. The speaker 210 outputs various effect sounds in accordance with the progress of the dice game. As a result, the dice gaming machine 201 can execute effects in accordance with the progress of the dice game at each terminal 205.

The terminal CPU 271 is connected with a hopper 276 and a medal sensor 277. The hopper 276 pays out medals to the cash out port 209 based on the control signal from the terminal CPU 271. The medal sensor 277 detects the medals paid out from the hopper 276. As a result, the terminal CPU 271 can pay out a predetermined number of medals to the players by controlling the hopper 276 and the medal sensor 277.

Next, a detailed description will be given with respect to the game screen to be displayed on the liquid crystal display 208 in the dice gaming machine 201 according to the third embodiment, while referring to the drawings. FIG. 36 is an explanatory diagram showing one example of a game screen to be displayed on the liquid crystal display 208.

As shown in FIG. 36, the game screen displayed on the liquid crystal display 208 includes the betting board 230. Here, when a dice game (e.g., Sic Bo) is played, the players bet gaming values with respect to the spots on the stopped three dice 240. The betting board 230 is used by the player in betting the gaming values.

The betting board 230 has a plurality of bet areas 235. Each bet area 235 is associated with a winning condition and a payout magnification ratio (e.g., base payout magnification ratio). The winning condition is the condition determined by the stopped three dice 240. The base payout magnification ratio shows the payout amount to be paid out in return to the unit gaming value (specifically, one credit) bet, in a case where spots on the stopped three dice 240 satisfy the winning condition of the bet area 235.

More specifically, the betting board 230 has eight types of bet areas 235. Specifically, the betting board 230 has a small bet area 235A, a big bet area 235B, a specific double bet area 235C, a specific triple bet area 235D, an any triple bet area 235E, a total bet area 235F, a combination bet area 235G and a number bet area 235H.

The small bet area 235A and the big bet area 235B are bet areas in each of 'which a condition is defined with a range of values as a result of adding up the spots on the stopped dice 240 (hereinafter referred to as total value). More specifically, the winning condition of the small bet area 235A is that "the total value is in a range between 4 and 10". The base payout magnification ratio of the small bet area 235A is set to 1:1 (two medals are paid out in return to a win with one medal placed as a bet). Alternatively, the winning condition of the big bet area 235B is that "the total value is in a range between 11 and 17". The base payout magnification ratio of the big bet area 235B is also set to 1:1.

The specific double bet area 235C is a bet area in which a winning condition is defined with a combination of spots on the stopped dice 240. More specifically, the winning condition of the specific double bet area 235C is satisfied if "amongst the three dice 240 which are stopped, the spots on two dice 240 are the same, and the spots on these two dice 240 correspond to specific spots". The betting board 230 has six specific double bet areas 235C. Accordingly, if the spots on two dice 240 from amongst the three dice 240 are "1,1", "2,2", "3,3" . . . or "6,6", the winning condition for one specific double bet area 235C is satisfied (refer to FIG. 36). The base payout magnification ratio of each specific double bet area 235C is set to 1:10.

The specific triple bet area 235D is a bet area in which a winning condition is defined a combination of the stopped three dice 240. More specifically, the winning condition of the specific triple bet area 235D is satisfied if "the spots on the three dice 240 which are stopped are the same and the spots on the three dice 240 correspond to specific spots". The betting board 230 has six specific triple bet areas 235D. Accordingly, if the spots on the three dice 240 are "1,1,1", "2,2,2", "3,3,3" . . . or "6,6,6", the winning condition for one specific triple bet area 235D is satisfied (refer to FIG. 36). The base payout magnification ratio of each specific triple bet area 235D is set to 1:180.

The any triple bet area 235E is a bet area in which a winning condition is defined with a combination of the spots on the stopped three dice 240. More specifically, the winning combination of the any triple bet area 235E is satisfied if "the spots on the stopped dice 240 are all the same". Accordingly, if the spots on the three dice 240 are "1,1,1", "2,2,2", "3,3,3" . . . or "6,6,6", the winning combination of the any triple bet area 235E is satisfied (refer to FIG. 36). The base payout magnification ratio of the any triple bet area 235E is set to 1:30.

The total bet area 235F is a bet area in which a winning condition is defined with a total value of the spots on the stopped three dice 240. More specifically, the winning combination of the total bet area 235F is satisfied if "the total value is a specific value". As shown in FIG. 36, the betting board 230 has fourteen total bet areas 235F. Specifically, the betting board 230 has a total bet area 235F corresponding to each total value "4", "5" . . . "17". As shown in FIG. 36, the base payout magnification ratio of each total bet area 235F is set in accordance with the appearance frequency of the total value for each winning condition. For instance, if the winning condition for the total value "16" is the total bet area 235F thus set, the base payout magnification ratio is 1:30.

The combination bet area 235G is a bet area in which a winning condition is defined with a combination of the spots on the stopped dice 240. More specifically, the winning condition of the combination bet area 235G is satisfied if "the spots on two dice 240 from amongst the stopped three dice 240 correspond to a specific combination". As shown in FIG. 36, the betting board 230 has fifteen combination bet areas 235G. The base payout magnification ratio for the combination bet area 235G is set to 1:5.

The combination for the case that the spots on two dice 240 are the same is excluded from the combination bet area 235G.

The number bet area 235H is a bet area in which a winning condition is defined with the spots' numbers on the dice 240. More specifically, the winning combination of the number bet area 235H is satisfied if "a specific spot is included in the spots on the stopped three dice 240". As shown in FIG. 36, the betting board 230 has six number bet areas 235H. One number bet area 235H corresponds to any of "1", "2" . . . "6". The base payout magnification ratio of the number bet area 235H is set to "1:1", "1:2", "1:3", in accordance with the number of dices showing the spots corresponding to the winning combination.

The game screen can include a cursor 232 and a chip mark 233. The cursor 232 and the chip mark 233 are displayed on the betting board 230 in accordance with a player's operation. The cursor 232 shows the bet area 235 which is currently selected by the player. The chip mark 233 shows the amount of gaming values bet with respect to the bet area 235 (hereinafter referred to as bet amount). As shown in FIG. 36, the chip mark 233 shows the above-mentioned bet amount through the number displayed at the center of the chip mark 233. The chip mark 233 is displayed on the bet area 235. Specifically, the chip mark shows the bet area 235 onto which the bet is made through the location of its display.

Further, as shown in FIG. 36, the game screen includes a unit BET button 231, a CORRECT button 236, a payout result display portion 237 and a credit amount display portion 238.

The unit BET button 231 is formed at a lower left side of the betting board 230. The unit BET button 231 is used to set the bet amount with respect to the bet area 235 selected by the player.

As shown in FIG. 36, the unit BET button 231 is made up of 1 BET button 231A, 5 BET button 231B, 10 BET button 231C and 100 BET button 231D. The 1 BET button 231A is operated by the player to increase the bet amount with respect to the bet area 235 selected by the player by "1". The 5 BET button 231B is operated by the player to increase the bet amount with respect to the bet area 235 selected by the player by "5". The 10 BET button 231C is operated by the player to increase the bet amount with respect to the bet area 235 selected by the player by "10". The 100 BET button 231D is operated by the player to increase the bet amount with respect to the bet area 235 selected by the player by "100".

Each time the player carries out such operation, the unit BET button 231 adds a bet amount in accordance with such operation to the current bet amount.

The CORRECT button 236 is operated to cancel the bet area 235 already selected and the setting of the bet amount. If selection of the bet area 235 and setting of the bet amount are incorrect, the player can correct the bet area 235 and the bet amount by operating this CORRECT button 236.

The payout result display portion 237 displays the total bet amount in the previous game and the payout amount in the previous game (the payout credit amount).

The credit amount display portion 238 displays the credit amount possessed by the player. The display contents of the credit amount display portion 238 are updated based on the bet with respect to the bet area 235 and award of the payout in the dice game.

Next, the bet operation carried out by the player using the game screen will be described. As was described earlier, the touch panel 225 is installed at a front face of the liquid crystal display 208. The touch panel 225 transmits the coordinate information corresponding to the portion touched by the player to the terminal CPU 271. Accordingly, if the game screen is displayed on the liquid crystal display 208, the player can select the bet area 235 and set the bet amount using the touch panel 225.

More specifically, the player first touches with his/her finger the touch panel 225 at the portion corresponding to the desired bet area 235. As a result, the player selects the desired bet area 235. At this time, the cursor 232 is displayed on the bet area 235 thus selected. Thereafter, the player touches with his/her finger the touch panel 225 at the portion corresponding to the unit BET button 231. As a result, the player selects the bet amount with respect to the selected bet area 235. Once the bet amount is selected, the chip mark 233 is displayed on the bet area 235.

Figure 37:
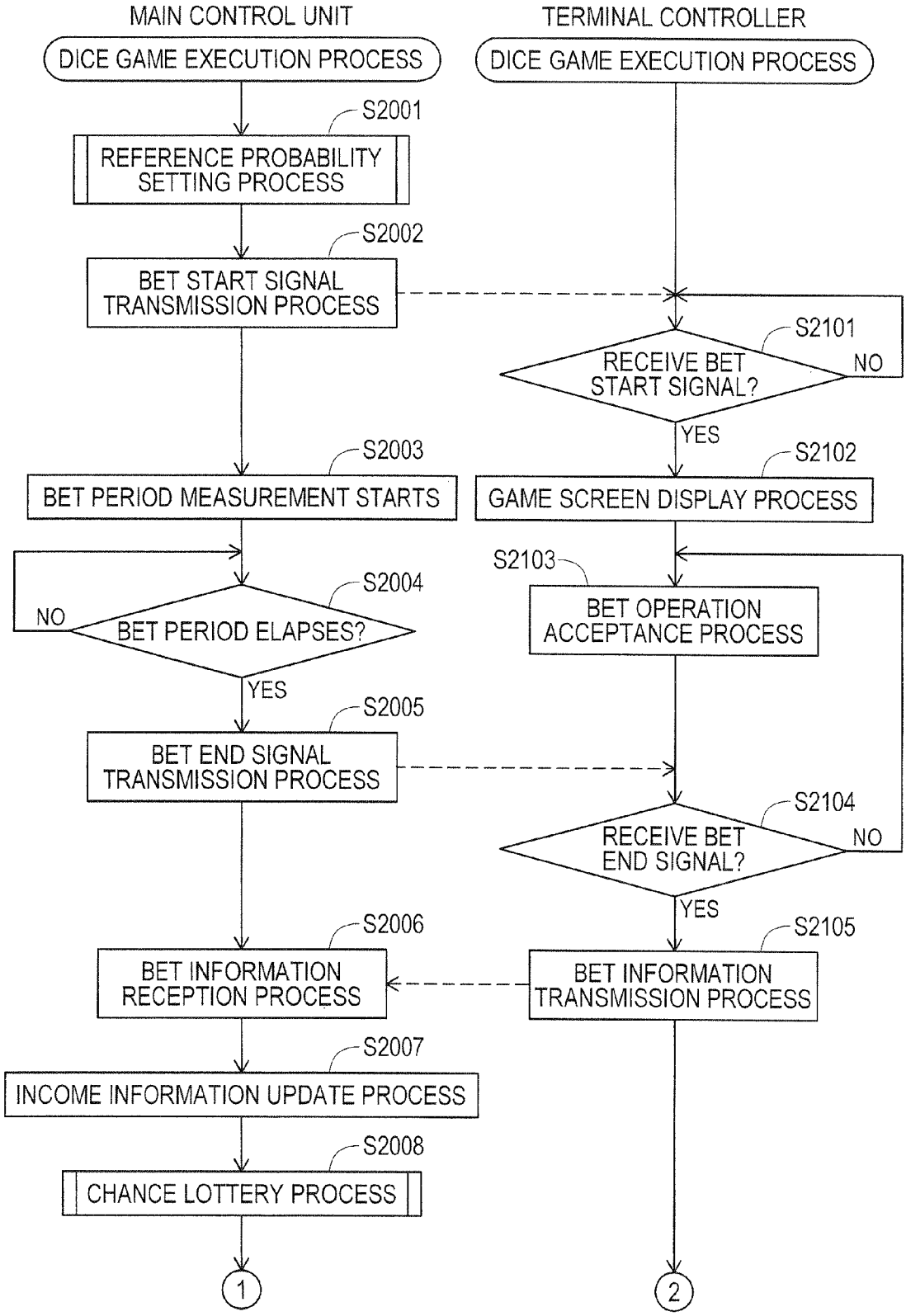
FIG. 37 is a flow chart (1) of a dice game execution process program according to the third embodiment of the present invention.
Figure 38:
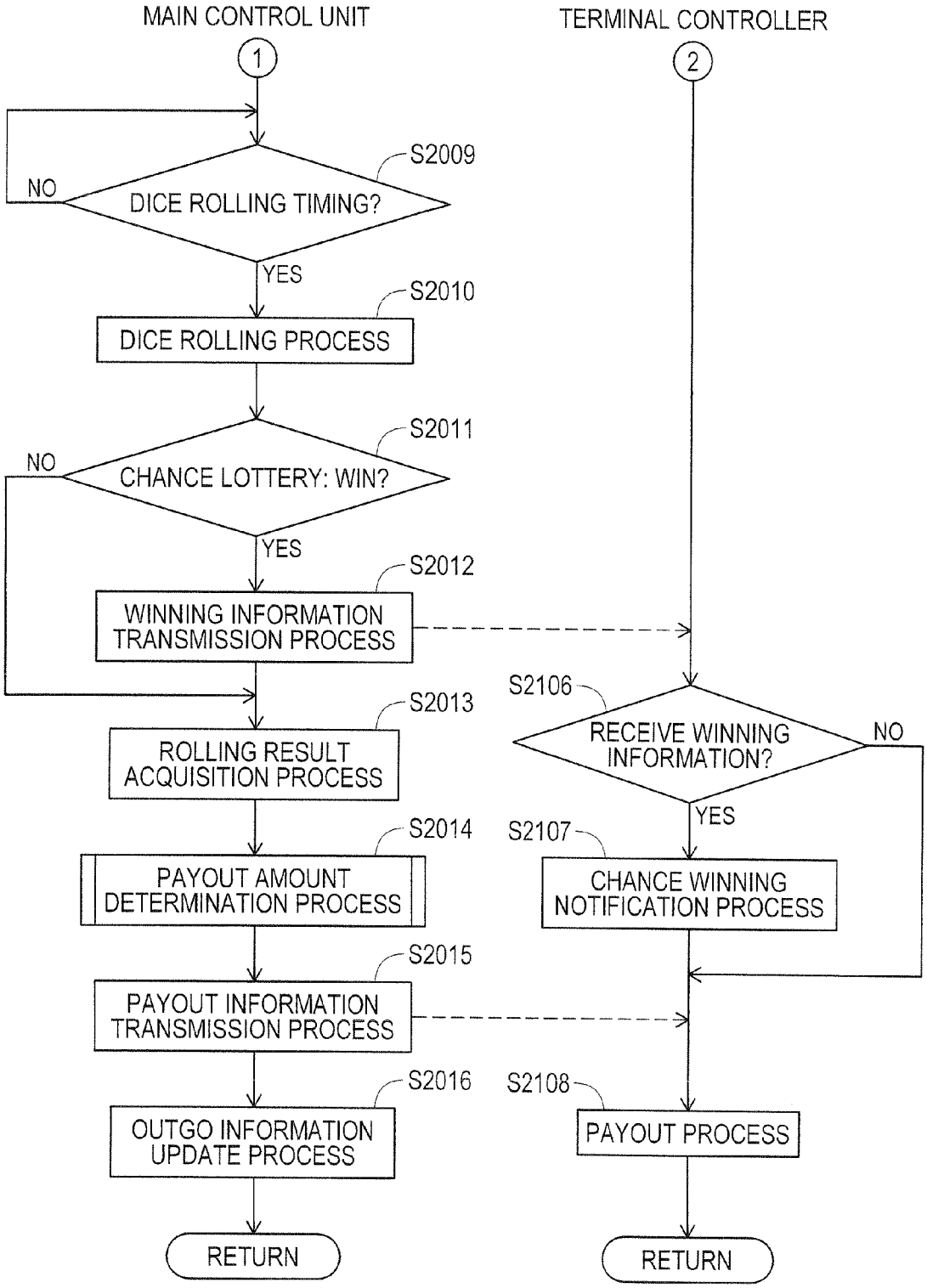
FIG. 38 is a flow chart (2) of the dice game execution process program according to the third embodiment of the present invention.

Next, a dice game execution process program to be executed in the dice gaming machine 201 according to the third embodiment will be described in detail while referring to the drawings. FIG. 37 and FIG. 38 are flow charts of the dice game execution process program.

The initial setting process executed in the main control unit 250 and the initial setting process executed in the terminal controller 270 of each terminal 205 are executed prior to the dice game execution process program. Specifically, the main control unit 250 and the terminal controller 270 end initialization of the peripheral devices and the program authentication process. These initial setting processes are heretofore known in the art. Therefore, description of the contents of such processes is hereby omitted.

First, the dice game execution process program in the main control unit 250 will be described in detail.

Once execution of the dice game execution process program is started, the CPU 251 first executes a reference probability setting process (S2001). In the reference probability setting process (S2001), the CPU 251 executes a reference probability setting process program (refer to FIG. 30). The CPU 251 calculates, in the reference probability setting process (S2001), the balance with respect to the dice gaming machine 1 from the income information and the outgo information stored in the RAM 253. Then the CPU 251 sets a condition for making up a chance lottery table based on the balance calculated. The detail of the reference probability setting process (S2001) will later be described referring to drawings. When the reference probability setting process (S2001) ends, the CPU 251 shifts the process to S2002.

In S2002, the CPU 251 executes the bet start signal transmission process (S2002). In the bet start signal transmission process (S2002), the CPU 251 transmits the bet start signal to the terminals 205 through the communication interface 255. The bet start signal serves to instruct start of the bet period in the terminals 205. The bet period is the period for accepting the players' bets for the gaming values with respect to the bet areas 235 at each terminal 205. After the bet start signal is transmitted to the terminals 205, the CPU 251 shifts the process to S2003.

Once the bet start signal is received, the terminal CPU 271 executes the game screen display process (S2102) and the bet operation acceptance process (S2103). This will be described in more detail later.

After shifting to S2003, the CPU 251 starts measuring the bet period. More specifically, the CPU 251 transmits the control signal to the timer 254. As a result, the timer 254 starts measurement. After the control signal is transmitted to the timer 254, the CPU 251 shifts the process to S2004.

At S2004, the CPU 251 judges whether the bet period has lapsed. More specifically, the CPU 251 references the measurement results of the timer 254. The CPU 251 judges whether the predetermined period (e.g., bet period) has lapsed based on the measurement result of the timer 254. If the bet period has lapsed (S2004: YES), the CPU 251 shifts the process to S2005. Alternatively, if the bet period has not lapsed yet (S2004: NO), the CPU 251 puts the process in stand-by until the bet period lapses.

At S2005, the CPU 251 executes the bet end signal transmission process. In the bet end signal transmission process (S2005), the CPU 251 transmits a bet end signal to the terminals 205. The bet end signal serves to instruct ending of the bet period in each terminal 205. In other words, the bet end signal means that acceptance of bets for gaming values in the terminal 205 is ended. After the bet end signal is transmitted to each terminal 205, the CPU 251 shifts the process to S2006.

Once the bet end signal is received, the terminal CPU 271 ends the bet operation acceptance process (S2103). Accordingly, the terminal 205 ends acceptance of bets with respect to the bet area 235. Thereafter, the terminal CPU 271 transmits the bet information based on the bet operation carried out in the bet operation acceptance process (S2103) to the main control unit 250 (S2105). This bet information includes information showing the bet area 235 on which the gaming value has been bet and information showing the bet amount bet on the bet area 235 in question. The bet information includes identification information showing the terminal 205 from which the bet information is transmitted.

After shifting to S2006, the CPU 251 executes the bet information reception process. In the bet information reception process (S2006), the CPU 251 receives the bet information transmitted from each terminal 205 through the communication interface 255. The CPU 251 stores the bet information thus received in the RAM 253. At this time, the CPU 51 classifies the bet information for each terminal 205 based on the identification information included in the bet information. Once the bet information reception process (S2006) ends, the CPU 251 shifts the process to S2007.

After shifting to S2007, the CPU 251 executes an income information update process. In the income information update process (S2007), the CPU 251 updates the income information stored in the RAM 253 based on the bet information received at the bet information reception process (S2006). More specifically, the CPU 251 calculates the total amount of gaming values bet in the current game. The total amount of gaming values bet in the current game represents the income of the dice gaming machine 201 in this game. The CPU 251 calculates the total amount of gaming values bet through the most recent 1,000 games including the current game. The CPU 251 then stores in the RAM 253 the income information which indicates the total amount of gaming values bet through the most recent 1,000 games including the current game. Once the income information update process (S2007) ends, the CPU 251 shifts the process to S2008.

At S2008, the CPU 251 executes a chance lottery process. In this chance lottery process (S2008), the CPU 251 executes a chance lottery process program (refer to FIG. 40) to be described later. More specifically, the CPU 251 first executes a lottery based on the chance lottery table made up based on the settings of the reference probability setting process (S2001), so as to determine whether to change the payout magnification ratio of each bet area 235. Thereafter, in the case of a win in the lottery (i.e., in the case of changing the payout magnification ratio), the CPU 251 identifies one target terminal from among terminals which participate in the game. The target terminal is the terminal whose payout magnification ratio in any bet area 235 thereof is changed from the "base payout magnification ratio" to the "special payout magnification ratio". After the lottery in the chance lottery process (S2008), the CPU 251 stores the lottery result information in the RAM 253. The lottery result information shows the lottery result of the chance lottery process (S2008). After storing the lottery result information in the RAM 253, the CPU 251 shifts the process to S2009. The details of the chance lottery process (S2008) will be described later by referring to drawings.

At S2009, the CPU 251 judges whether the dice rolling timing has arrived. The dice rolling timing shows the timing at which rolling of the three dice 240 is started in the dice rolling device 203. More specifically, at S2009, the CPU 251 first references the measurement results of the timer 254. Specifically, the CPU 251 carries out the judgment process at S2009 based on the measurement result of timer 254. When the dice rolling timing arrives (S2009: YES), the CPU 251 shifts the process to S2010. Alternatively, if the dice rolling timing has not yet arrived (S2009: NO), the CPU 251 puts the process in stand-by until such dice rolling timing arrives.

At S2010, the CPU 251 executes a dice rolling process. In this dice rolling process (S2010), the CPU 251 transmits a control signal to the dice rolling device 203. As a result, the dice rolling motor 212 is driven and controlled. Accordingly, the three dice 240 are rolled inside the dice rolling device 203. The three dice 240 which have been rolled are then stopped on the dice rolling board 211. Once the dice rolling process ends, the CPU 251 shifts the process to S2011.

After shifting to S2011, the CPU 251 judges whether a win has occurred in the lottery carried out in the chance lottery process (S2008). More specifically, the CPU 251 carries out the judgment process at S2011, by referencing the lottery result information stored in the RAM 253. In the case of a win in the lottery carried out in the chance lottery process (S2011: YES), the CPU 251 shifts the process to S2012. Alternatively, in the case of no win in the lottery carried out in the chance lottery process (S2008) (S2011: NO), the CPU 251 shifts the process to S2013.

At S2012, the CPU 251 executes a winning information transmission process. In this winning information transmission process (S2012), the CPU 251 transmits the winning information to the target terminal identified in the chance lottery process (S2008). This winning information shows that a win has occurred in the lottery in the chance lottery process (S2008) and the "special payout magnification ratio" is to be used for calculating payout amount for the target terminal. In the winning information transmission process (S2012), the CPU 251 first generates the winning information based on the lottery result information stored in the RAM 253. Thereafter, the CPU 251 identifies the target terminal based on the lottery result information. Thereafter, the CPU 251 transmits the winning information thus generated to the target terminal through the communication interface 255. After transmitting the winning information to the target terminal, the CPU 251 shifts the process to S2013.

At S2013, the CPU 251 executes a rolling result acquisition process. In this rolling result acquisition process (S2013), the CPU 251 acquires the rolling result information showing the spots on the stopped three dice 240, by controlling the rolling result detection device 215 of the dice rolling device 203. More specifically, the CPU 251 transmits the control signal to the dice rolling device 203. Upon receiving the control signal, the dice rolling device 203 acquires an image with an imaging device provided in the dice rolling device 203. The acquired image includes the image of the stopped three dice 240 on the dice rolling board 211. Thereafter, the dice rolling device 203 carries out a predetermined image process with respect to the acquired image by controlling the rolling result detection device 215. As a result, the dice rolling device 203 can identify the spots on the three dice 240 which are stopped on the dice rolling board 211. The dice rolling device 203 generates rolling result information showing the spots on the three dice 240 thus identified. The dice rolling device 203 then transmits the rolling result information thus generated to the CPU 251. Once the rolling result information acquired from the dice rolling device 203 is stored in the RAM 253, the CPU 251 shifts the process to S2014.

After shifting to S2014, the CPU 251 executes a payout amount determination process. In this payout amount determination process (S2014), the CPU 251 executes a payout amount determination process program (refer to FIG. 45) as will be described later. In this payout amount determination process, the CPU 251 calculates the payout amount of each terminal 205 based on the rolling result information and the bet information of each terminal 205. Here, in the case of a win in the lottery carried out in the chance lottery process (S2008), the CPU 251 changes the payout magnification ratio used in the payout amount determination process (S2014) for only the target terminal from "base payout magnification ratio" to "special payout magnification ratio". Meanwhile, for the other non-target terminals 205, the CPU 251 calculates each of their payout amounts using the "base payout magnification ratio". The contents of the payout amount determination process (S2014) will next be described in detail. Once the payout amount determination process ends, the CPU 251 shifts the process to S2015.

At S2015, the CPU 251 executes a payout information transmission process. In this payout information transmission process (S2015), the CPU 251 transmits the payout information to each terminal 205 through the communication interface 255. This payout information shows the payout amount calculated in the payout amount determination process (S2014). After transmitting the payout information to each terminal 205, the CPU 251 ends the payout information transmission process. Once the payout information transmission process (S2015) ends, the CPU 251 shifts the process to S2016.

At S2016, the CPU 251 executes a outgo information update process. In the outgo information update process (S2016), the CPU 251 updates the outgo information stored in the RAM 253 based on the payout information transmitted in the payout information transmission process (S2015). More specifically, the CPU 251 calculates the total amount of prizes (i.e., payouts) to be awarded to a player (players) in the current game based on the payout information transmitted in the payout information transmission process (S2015). The total amount of prizes (i.e., payouts) to be awarded to a player (players) (i.e., payout) in the current game represents the outgo of the dice gaming machine 201 in the current game. The CPU 251 stores in the RAM 253 the outgo information indicating the total amount of prize (i.e., payouts) to be awarded to a player (players) through the most recent 1,000 games including the current game. Once the outgo information update process (S2016) ends, the CPU 251 ends the dice game execution process program in the main control unit 250.

Once execution of the dice game execution process program is ended, the CPU 251 restarts execution of the dice game execution process program. Specifically, the CPU 251 repeatedly executes the dice game execution process program while power is being supplied to the dice gaming machine 201.

Next, the dice game execution process program at each terminal 205 will be described in detail.

Upon starting the dice game execution process program, the terminal CPU 271 first judges whether the bet start signal has been received (S2101). As was described earlier, the bet start signal serves to instruct start of the bet period in the dice gaming machine 201. The bet start signal is transmitted from the main control unit 250 to each terminal 205 (S2002). If the bet start signal is received (S2101: YES), the terminal CPU 271 shifts the process to S2102. As a result, the bet period in each terminal 205 is started. Alternatively, if the bet start signal has not yet been received (S2101: NO), the terminal CPU 271 puts the process in stand-by until the bet start signal is received.

After shifting to S2102, the terminal CPU 271 executes a game screen display process. In this game screen display process (S2102), the terminal CPU 271 transmits the control signal to the liquid crystal driving circuit 274. The game screen is displayed on the liquid crystal display 208 based on the control of the liquid crystal driving circuit 274 (refer to FIG. 36). Once the game screen is displayed on the liquid crystal display 208, the terminal CPU 271 shifts the process to S2103.

At S2103, the terminal CPU 271 executes a bet operation acceptance process. In this bet operation acceptance process (S2103), the terminal CPU 271 accepts a player's operation using the touch panel 225. More specifically, the terminal CPU 271 carries out various types of controls corresponding to a player's operation based on the operation signal transmitted from the touch panel. Such controls include control with respect to selecting the bet area 235, control with respect to setting the bet amount corresponding to the selected bet area 235 and control corresponding to operation of the CORRECT button 236.

If the bet area 235 is selected and the bet amount with respect to the selected area 235 is set, the terminal CPU 271 stores the bet information in the terminal RAM 273. The bet information includes information with respect to the selected bet area 235 and information showing the bet amount of the bet area 235.

In the next step S2104, the terminal CPU 271 judges whether the bet end signal has been received. As was described earlier, the bet end signal shows the end of the bet period. Specifically, reception of the bet end signal means that acceptance of bets in the current dice game ends. The bet end signal is transmitted from the main control unit 250 (S2005). If the bet end signal is received (S2104: YES), the terminal CPU 271 shifts the process to S2105. Alternatively, if the bet end signal has not yet been received (S2104: NO), the terminal CPU 71 returns the process to the bet operation acceptance process (S2103). Thus, the player at each terminal 205 can bet a gaming value in the current game until the end of the bet period.

After shifting to S2105, the terminal CPU 271 executes a bet information transmission process. In this bet information transmission process (S2105), the terminal CPU 271 transmits the bet information stored in the terminal RAM 273 to the main control unit 250. Here, the terminal CPU 271 adds identification information showing the terminal 205 in question to the bet information. After transmitting the bet information including the identification information, the terminal CPU 271 shifts the process to S2106.

At S2106, the terminal CPU 271 judges whether the winning information has been received. As was described earlier, the winning information shows that a win has occurred in the lottery carried out in the chance lottery process (S2008) and the terminal 205 in question has been identified as target terminal. This winning information is transmitted from the main control unit 250 to the target terminal through the communication interface 255 (S2012). If the winning information is received (S2106: YES), the terminal CPU 271 shifts the process to S2107. Alternatively, if the winning information has not been received (S2106: NO), the terminal CPU 271 shifts the process to the payout process (S2108).

At S2107, the terminal CPU 271 executes the chance winning notification process. In the chance winning notification process (S2107), the terminal CPU 271 notifies the player that he/she has won in the chance lottery and the terminal at which he/she is seated has been identified to be the target terminal, through the display on the liquid crystal display 208. More specifically, the terminal CPU 271 transmits the control signal to the liquid crystal driving circuit 274. As a result, the liquid crystal display 208 displays the chance lottery winning image 280 on the game screen (refer to FIG. 39). Once the chance winning notification process (S2107) ends, the terminal CPU 271 shifts the process to S2108.

Figure 39:
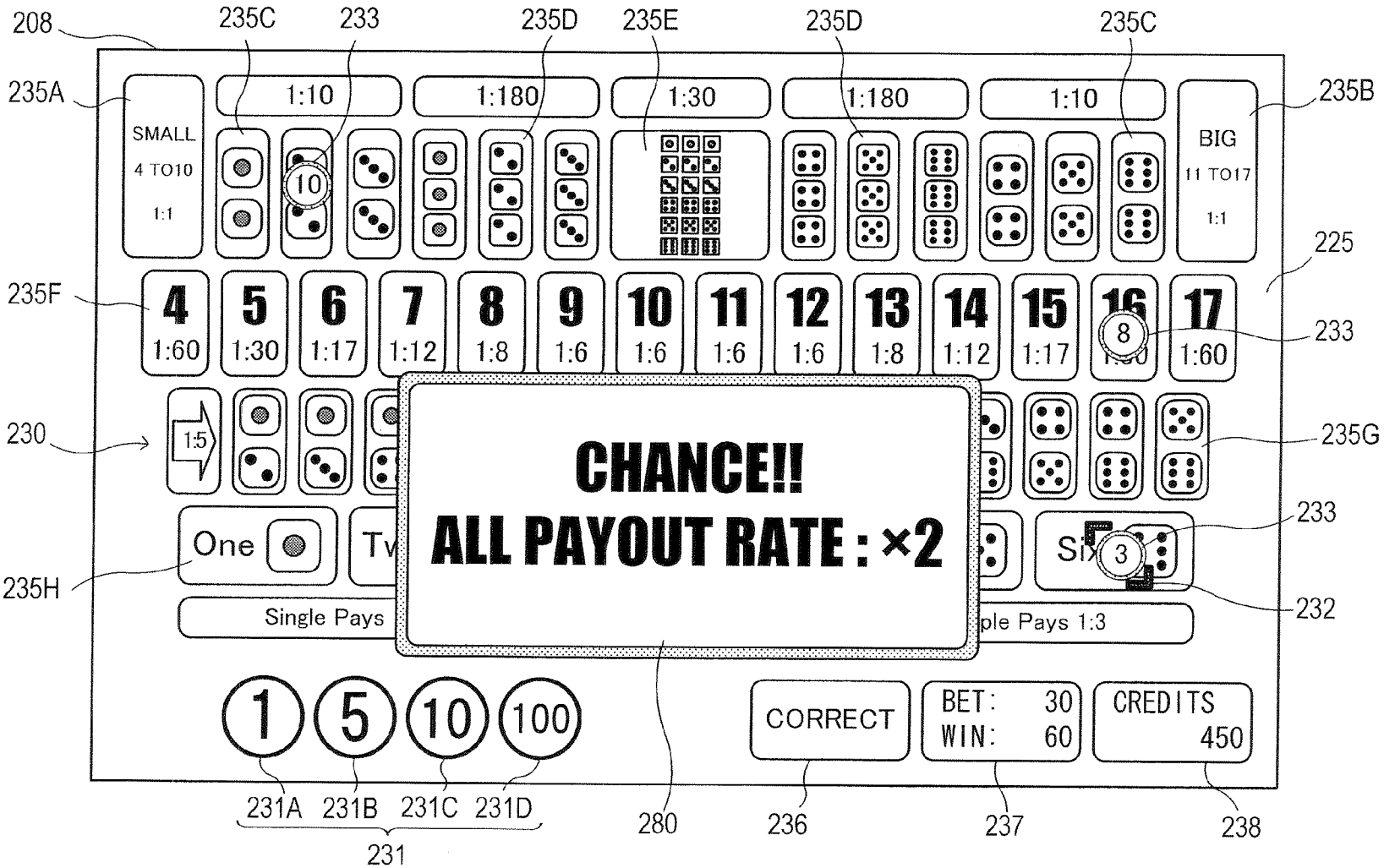
FIG. 39 is an exemplary diagram showing one example of a game screen including a chance lottery winning image according to the third embodiment of the present invention.

As shown in FIG. 39, the chance lottery winning image 280 includes displaying a message that "as a result of winning in the chance lottery, the base payout magnification ratio of all bet areas 235 is multiplied by the special magnification ratio (e.g., ×2)". Specifically the chance lottery winning image 280 notifies the player of the fact that the payout magnification ratio used in calculating the payout has been changed from the "base payout magnification ratio" to the "special payout magnification ratio". Accordingly, the player can understand that a win occurred in the chance lottery by looking at the chance lottery winning image 280. As a result, the dice gaming machine 201 can increase the sense of expectancy of the player with respect to a larger payout.

It is to be noted that the chance lottery winning image 280 is displayed at only the liquid crystal display 208 of the target terminal among terminals 205 constituting the dice gaming machine 201. That is, in the case of no win in the chance lottery process (S2008) or in the case of no terminal 205 being identified to be a target terminal, in either case, the chance lottery winning image 280 is not displayed in the liquid crystal display 208. Accordingly, only the player seated at the target terminal can recognize that his/her terminal has got a chance to win a high amount of payout. Therefore, the dice gaming machine 201 can bring the player at the target terminal a sense of superiority over other players at non-target terminals.

After shifting to S2108, the terminal CPU 271 executes a payout process. In this payout process (S2108), the terminal CPU 271 awards to the player a payout in the current dice game based on the payout information. As was described earlier, the payout information is transmitted from the main control unit 250 to each terminal 205 (S2015). The payout information shows the payout amount calculated in the payout amount determination process (S2014). Accordingly, the terminal CPU 271 adds the payout amount calculated in the payout amount determination process (S2014) to the credit amount possessed by the player. The payout amount can also be awarded in the form of medals which are paid out from the cash out port 209. That is, in the case the terminal 205 in question has been identified to be the target terminal, the terminal CPU 271 pays out a payout amount calculated based on the "special payout magnification ratio". Alternatively, in the case the terminal 205 in question has not been identified to be the target terminal, the terminal CPU 271 pays out a payout amount calculated based on the "base payout magnification ratio". Once the payout process ends, the terminal CPU 271 ends the dice game execution process program in the terminal 205.

Once execution of the dice game execution process program ends, the terminal CPU 271 restarts execution of the dice game execution process program. Specifically, the terminal CPU 271 can repeatedly execute the dice game execution process program while power is being supplied to the dice gaming machine 1.

Figure 30:
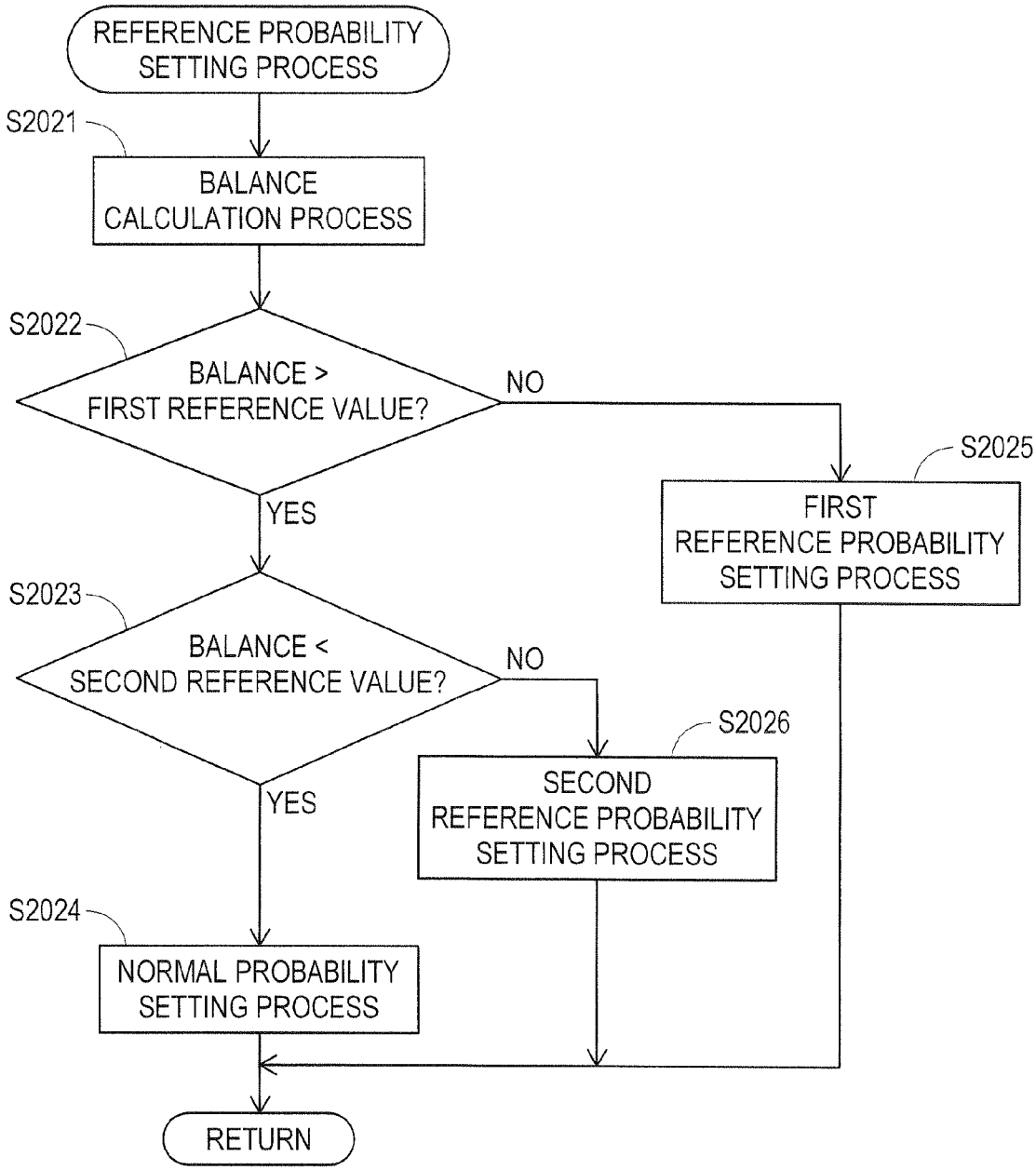
FIG. 30 is a flowchart of a reference probability setting process program according to the third embodiment of the present invention.

Next, the reference probability setting process program to be executed by the CPU 251 in the reference probability setting process (S2001) will be described in detail, referring to drawings. FIG. 30 is a flowchart of the reference probability setting process program.

In the dice game execution process program of the main control unit 50, the CPU 251 executes a balance calculation process upon shifting to the reference probability setting process (S2001). In the balance calculation process (S2021), the CPU 251 first obtains income information and outgo information from the RAM 253. Then, the CPU 251 calculates the balance through the most recent 1,000 games, based on the income amount through the most recent 1,000 games indicated by the income information and the outgo amount through the most recent 1,000 games indicated by the outgo information. After storing balance information indicating the balance through the most recent 1,000 games in the RAM 253, the CPU 251 shifts the process to S2022.

In S2022, the CPU 251 determines whether the calculated balance exceeds a first reference value. The first reference value indicates that the balance through the most recent 1,000 games is in deficit by a predetermined amount. If the balance according to the balance information exceeds the first reference value (S2022: YES), the CPU 51 shifts the process to S2023. It is to be noted that the cases in which the balance exceeds the first reference value include a case in which the balance is in surplus and also a case in which the balance is in deficit by an amount smaller than the deficit amount of the first reference value. Meanwhile, if the balance according to the balance information is equal to or lower than the first reference value (S2022: NO), the CPU 251 shifts the process to S2025. The case in which the balance according to the balance information is equal to or lower than the first reference value means that the balance is in deficit by an amount equal to or larger than the deficit amount of the first reference value.

In S2023, the CPU 251 determines whether the balance calculated is lower than a second reference value. The second reference value indicates that the balance through the most recent 1,000 games is in surplus by a predetermined amount. If the balance according to the balance information is lower than the second reference value (S2023: YES), the CPU 251 shifts the process to S2024. It is to be noted that the cases in which the balance is lower than the second reference value include a case in which the balance is in deficit and also a case in which the balance is in surplus by an amount smaller than the surplus amount of the second reference value. Meanwhile, if the balance according to the balance information is equal to or higher than the second reference value (S2023: NO), the CPU 251 shifts the process to S2026. The case in which the balance according to the balance information is equal to or larger than the second reference value means that the balance is in surplus by an amount equal to or larger than the surplus amount of the second reference value.

After shifting to S2024, the CPU 251 executes a base probability setting process. In the base probability setting process (S2024), the CPU 251 sets a base probability (i.e., 2%) as a condition for making up a chance lottery table. That is, the CPU 251 sets the base probability (i.e., 2%) as a condition for making up the chance lottery table if the balance according to the balance information belongs to the numerical range defined by the first and second reference values. In other words, the dice gaming machine 201 makes up the chance lottery table based on the base probability in a case where the balance of the most recent 1,000 game is in surplus smaller than a predetermined amount, or in deficit smaller than (a predetermined amount (including a case where the balance is "0"). This will be explained later in more detail. After storing in the RAM 53 the information indicating the base probability, the CPU 251 ends the reference probability setting process program.

After shifting to S2025, the CPU 251 executes a first reference probability setting process. In the first reference probability setting process (S2025), the CPU 251 sets a first reference probability (i.e., 1%) as a condition for making up a chance lottery table. That is, the CPU 251 sets the first reference probability (i.e., 1%) as a condition for making up the chance lottery table if the balance according to the balance information is in deficit by an amount larger than the deficit amount of the first reference value. In other words, the dice gaming machine 201 makes up the chance lottery table based on the first reference probability if the balance of the most recent 1,000 games is in deficit larger than the predetermined amount. This will be explained later in more detail. After storing in the RAM 253 the information indicating the first reference probability, the CPU 251 ends the reference probability setting process program.

After shifting to S2026, the CPU 251 executes a second reference probability setting process. In the second reference probability setting process (S2026), the CPU 251 sets a second reference probability (i.e., 4%) as a condition for making up a chance lottery table. That is, the CPU 251 sets the second reference probability (i.e., 4%) as a condition for making up the chance lottery table if the balance according to the balance information is in surplus by an amount larger than the surplus amount of the second reference value. In other words, the dice gaming machine 201 makes up the chance lottery table based on the second reference probability if the balance of the most recent 1,000 games is in surplus larger than a predetermined amount. This will be explained later in more detail. After storing in the RAM 253 the information indicating the second reference probability, the CPU 251 ends the reference probability setting process program.

Figures 40, 41:
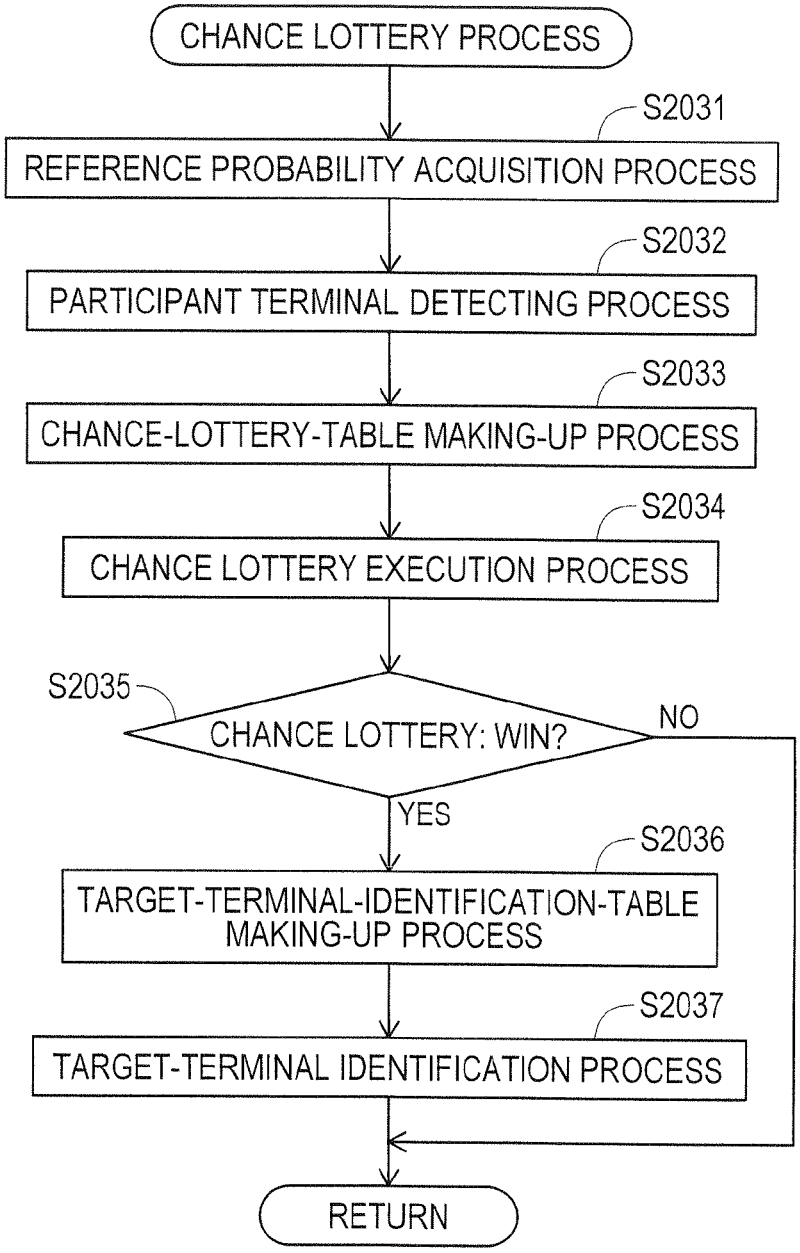
FIG. 40 is a flow chart of a chance lottery process program according to the third embodiment of the present invention.
FIG. 41 is an exemplary diagram showing one example of a base chance lottery table made up based on a base probability.

Next, there will be described a chance lottery process program to be executed by the CPU 251 at the chance lottery process (S2008) by referring to drawings. FIG. 40 is a flow chart of the chance lottery process program.

In the dice game execution process program of the main control unit 250, the CPU 251 executes a reference probability acquisition process upon shifting the process to the chance lottery process (S2008). In the reference probability acquisition process (S2031), the CPU 251 obtains a condition for making up a chance lottery table set at the reference probability setting process (S2001) (i/e., one of the base probability, the first reference probability and the second reference probability). When the reference probability acquisition process (S2031) ends, the CPU 251 shifts the process to S2032.

The CPU 251 executes a participant terminal detecting process upon shifting the process to S2032. In the participant terminal detecting process (S2032), the CPU 251 detects participant terminal(s) from among all the terminals 205 constituting the dice gaming machine 201. A participant terminal corresponds to a terminal 205 which participates in a current dice game. That is, a participant terminal refers to a terminal 205 where a bet is placed on a bet area 235 in a current dice game. More specifically, the CPU 251 detects terminal(s) 205 where a gaming value is bet on a bet area 235 based on bet information stored in the RAM 253. As was described earlier, the bet information received at the bet information reception process (S2006) includes identification information of the terminal 205 which has transmitted the bet information. Each piece of bet information stored in the RAM 253 is classified into each terminal 205, based on the identification information. Accordingly, the CPU 251 can detect participant terminal(s) by referring to the bet information stored in the RAM 253. Once the participant terminal detecting process ends, the CPU 251 shifts the process to S2033.

In S2033, the CPU 251 executes a chance-lottery-table making-up process. In this chance-lottery-table making-up process (S2033), the CPU 251 makes up a chance lottery table, based on the condition for generation set at the reference probability setting process (S2001) and a detection result obtained at the participant terminal detecting process (S2032). The chance lottery table is to be used at a later-described chance lottery execution process (S2034). The details of the chance-lottery-table making-up process (S2033) will be described later. Upon storing the thus made up chance lottery table (e.g., refer to FIG. 41 through FIG. 43) in the RAM 253, the CPU 251 shifts the process to S2034.

After shifting the process to S2034, the CPU 251 executes a chance lottery execution process. In this chance lottery execution process (S2034), the CPU 251 determines whether to calculate a payout amount based on the "special payout magnification ratio" through a lottery. More specifically, the CPU 251 extracts a random number value from a predetermined range of random number values (e.g., between 0 and 2047) by executing a lottery program. Thereafter, tne CPU 251 determines a chance lottery result based on the extracted random number value and the chance lottery table (e.g., refer to FIG. 41 through FIG. 43). It is to be noted that the chance lottery table is a table made up at the chance-lottery-table making-up process (S2033) based on the making-up condition set at the reference probability setting process (S2001). The chance lottery result includes both "chance lottery result: win" and "chance lottery result: lose". This "chance lottery result: win" means that payout magnification ratio of all the bet area 235 constituting the betting board 230 is changed when payout amount is calculated with respect to one terminal 205 identified from participant terminals (i.e., target terminal). Meanwhile, the "chance lottery result: lose" means that the base payout magnification ratio defined for each of the bet area is used when payout amount is calculated with respect to all the terminals 205. After storing the chance lottery result in the RAM 253, the CPU 251 shifts the process to S2035.

At S2035, the CPU 251 judges whether the lottery results in a win or not in the chance lottery execution process (S2034). More specifically, the CPU 251 executes the judgment process of S2035 by referring to the lottery result stored in the RAM 253. In the case the lottery at the chance lottery execution process (S2034) results in a win (S2035: YES), the CPU 251 shifts the process to S2036. Alternatively in the case the lottery at the chance lottery execution process (S2034) results in no win (S2035: NO), the CPU 251 ends the chance lottery process program as is.

At S2036, the CPU 251 executes a target-terminal-identification-table making-up process. At this target-terminal-identification-table making-up process (S2036), the CPU 251 makes up a target terminal identification table to be used at a target terminal identification process (S2037) to be described later. More specifically, the CPU 251 makes up the target terminal identification table (e.g., refer to FIG. 44) based on a detection result obtained at the participant terminal detecting process (S2032). That is, the CPU 251 associates each of the participant terminals detected at the participant terminal detecting process (S2032) with a random number value range (refer to FIG. 44). The details of the target-terminal-identification-table making-up process (S2036) will be described later. Once storing the thus made up target terminal identification table in the RAM 253, the CPU 251 shifts the process to S2037.

After shifting the process to S2037, the CPU 251 executes a target terminal identification process. In this target terminal identification process (S2037), the CPU 251 identifies one target terminal from participant terminals by referring to the target terminal identification table made up at the target-terminal-identification-table making-up process (S2036). More specifically, the CPU 251 extracts a random number value from a predetermined range of random number values (e.g., between 0 and 2047) by executing a lottery program. Thereafter, the CPU 251 identifies one target terminal from participant terminals by referring to the extracted random number value and the target terminal identification table. Thereafter, the CPU 251 makes up winning information based on both information indicating the thus identified target terminal and information indicating a win at the chance lottery execution process (S2034). Upon storing the winning information in the RAM 253, the CPU 251 ends the chance lottery process execution program.

Here will be described making-up of the chance lottery table at the chance-lottery-table making-up process (S2033) and making-up of the target terminal identification table at the target-terminal-identification-table making-up process (S2036), by referring to drawings.

Here, a lottery-winning probability (i.e., the base probability, the first reference probability or the second reference probability) set at the reference probability setting process (S2001) refers to a probability that one certain terminal 205 is identified as a target terminal. That is, the lottery-winning probability set at the reference probability setting process (S2001) is obtained by dividing the number of target terminals by the number of total participant terminals corresponding to the lottery-winning probability set at the reference probability setting process (S2001).

As was described earlier, in the chance lottery process (S2008), the CPU 251 executes the chance lottery execution process (S2034) and the target terminal identification process (S2037). The chance lottery execution process (S2034) is a process to determine whether or not a target terminal is made present based on the chance lottery table. The target terminal identification process (S2037) is a process to identify one target terminal from current participant terminals based on the target terminal identification table in the case it has been determined that a target terminal is made present.

Accordingly, it is necessary that a probability based on the chance lottery table and a probability based on the target terminal identification table be correlatively considered and set so that the above mentioned "lottery-winning probability set at the reference probability setting process (S2001)" can be obtained. The probability based on the chance lottery table is a probability that a target terminal is made present. The probability based on the target terminal identification table is a probability that a certain terminal 205 is identified to be a target terminal among from current participant terminals. That is, the probability based on the target terminal identification table corresponds to 1/"the number of current participant terminals (i.e., the number of participant terminals detected at S2032)". The probability based on the chance lottery table corresponds to "the number of current participant terminals"/"the number of total participant terminals corresponding to the lottery-winning probability set at the reference probability setting process (S2001)".

First, the making-up of a chance lottery table in a case where the base probability is set is described in detail referring to FIG. 41. As above mentioned, the base probability of the third embodiment is assumed to be "2%". In this case, the base probability represents a probability that one target terminal is identified among fifty participant terminals in total in the chance lottery process (S2008). That is, the probability based on the target terminal identification table here corresponds to 1/"the number of current participant terminals (i.e., the number of participant terminals detected at S2032)". The probability based on the chance lottery table corresponds to "the number of current participant terminals"/50.

Here will be specifically described detailed contents of the chance-lottery-table making-up process (S2033) and the chance lottery table made up based on the base probability (hereinafter referred to as a base chance lottery table) in a case where five current participant terminals have been detected at the participant terminal detecting process (S2032), as an example. In this exemplary case, it is assumed that the CPU 251 has detected a "first terminal", a "second terminal", a "fifth terminal", a "ninth terminal" and a "tenth terminal" as participant terminals at the participant terminal detecting process (S2032).

In this case, the probability based on the base chance lottery table is 5/50. Accordingly, the CPU 251 associates "chance lottery result: win" with a random number value range of "0-204" out of the predetermined random number value range "0-2047". The CPU 251 associates "chance lottery result: lose" with a random number value range of "205-2047" (refer to FIG. 41). As was described earlier, the thus made up base chance lottery table is used for executing the chance lottery execution process (S2034). Accordingly, at the chance lottery execution process (S2034) in this case, the probability for one target terminal to be made present is approximately "5/50" (refer to FIG. 41).

It goes without saying that, contents of the base chance lottery table to be made up at the chance-lottery-table making-up process (S2033) are subject to vary depending on the number of participant terminals detected at S2032. For instance, if there are detected two participant terminals, the CPU 251 makes up a chance lottery table so that the probability for one target terminal to be made present should be "2/50" (S2033).

Here, the expected value of a bet area 235 is calculated by multiplying a dice-winning probability of the bet area 235 by amount of unit gaming value (i.e., "bet amount: 1") and the payout magnification ratio of the bet area 235 (base payout magnification ratio or special payout magnification ratio). The dice-winning probability of the bet area 235 is a probability that a winning condition of the bet area 235 is satisfied in one dice game. For instance, a dice-winning probability of a specific triple bet area 235D is "1/216".

In the betting board 230 according to the third embodiment, an expected value of each bet area 235 belongs to a range of "0.65 through 0.9722" (i.e., 65% through 97.22%) in a base case (specifically, in the case where the terminal is not identified as a target terminal). That is, when the base payout magnification ratio is used, the maximum expected value is "97.22%". Accordingly, the expected values of all bet areas 235 will never exceed "100%", if the expected value of the bet area 235 according to the above maximum value does not exceed "100%" as a result of changing a payout magnification ratio.

If the base chance lottery table is used, the expected value obtained by synthesis of expected values of respective bet areas 235 set for all the terminals 205 (referred to as synthetic expected value, hereinafter) is increased by 2%. Accordingly, even if a target terminal is present, the synthetic expected value of the dice gaming machine 201 is smaller than "100%". Thus, the dice gaming machine 201 can prevent the outgo of more than necessary amount in a game arcade installing the dice gaming machine 201.

Next, the making-up of a chance lottery table when a first reference probability is set will be explained in detail referring to FIG. 42. As has been described above, the first reference probability is "1%" in the third embodiment. In this case, the first reference probability represents a probability that one target terminal is identified among one hundred participant terminals in total in the chance lottery process (S2008). That is, the probability based on the target terminal identification table here corresponds to 1/"the number of current participant terminals (i.e., the number of participant terminals detected at S2032)". The probability based on the chance lottery table here corresponds to "the number of current participant terminals"/100.

Here will be specifically described detailed contents of the chance-lottery-table making-up process (S2033) and the chance lottery table made up based on the first reference probability (hereinafter referred to as a first chance lottery table) in a case where five current participant terminals have been detected at the participant terminal detecting process (S2032), for instance. The participant terminals detected at the participant terminal detecting process (S2032) in this exemplary case are also the same as those detected in the exemplary case of the above-mentioned base chance lottery table.

In this case, the probability based on the first chance lottery table is 5/100. Accordingly, the CPU 251 associates "chance lottery result: win" with a random number value range of "0-102" out of the predetermined random number value range "0-2047". The CPU 251 associates "chance lottery result: lose" with a random number value range of "103-2047" (refer to FIG. 42). As was described earlier, the thus made up first chance lottery table is used for executing the chance lottery execution process (S2034). Accordingly, at the chance lottery execution process (S2034) in this case, the probability for one target terminal to be made present is approximately "5/100" (refer to FIG. 42).

It goes without saying that contents of the first chance lottery table to be made up at the chance lottery table making-up process (S2033) are subject to vary depending on the number of participant terminals detected at S2032. For instance, in the case there are detected two participant terminals, the CPU 251 makes up a chance lottery table so that the probability for one target terminal to be made present should be "2/100" (S2033).

Here, if the first chance lottery table is used, the synthetic expected value is increased by 1%. Accordingly, even in this case, the synthetic expected value of the dice gaming machine 201 is smaller than "100%". Thus, the dice gaming machine 201 can prevent the outgo of more than necessary amount in a game arcade installing the dice gaming machine 201. In addition, the synthetic expected value when the first chance lottery table is used is smaller than the synthetic expected value when the base chance lottery table is used. Here, the case where the first chance lottery table is made up is the case where the dice gaming machine 201 has a deficit larger than the predetermined amount. Accordingly, the dice gaming machine 201 can compensate a loss accompanying the execution of games in an appropriate manner while maintaining the possibility of the presence of a target terminal.

Next, the making-up of a chance lottery table when a second reference probability is set will be explained in detail referring to FIG. 43. As has been described above, the second reference probability is "4%" in the third embodiment. In this case, the second reference probability represents a probability that one target terminal is identified among twenty-five participant terminals in total in the chance lottery process (S2008). That is, the probability based on the target terminal identification table here corresponds to 1/"the number of current participant terminals (i.e., the number of participant terminals detected at S2032)". The probability based on the chance lottery table here corresponds to "the number of current participant terminals"/25.

Here will be specifically described detailed contents of the chance-lottery-table making-up process (S2033) and the chance lottery table made up based on the second probability (hereinafter referred to as a second chance lottery table) in a case where five current participant terminals have been detected at the participant terminal detecting process (S2032), for instance. The participant terminals detected at the participant terminal detecting process (S2032) in this exemplary case are also the same as those detected in the exemplary case of the above-mentioned base chance lottery table.

In this case, the probability based on the second chance lottery table is 5/25. Accordingly, the CPU 251 associates "chance lottery result: win" with a random number value range of "0-409" out of the predetermined random number value range "0-2047". The CPU 251 associates "chance lottery result: lose" with a random number value range of "409-2047" (refer to FIG. 43). As was described earlier, the thus made up second chance lottery table is used for executing the chance lottery execution process (S2034). Accordingly, at the chance lottery execution process (S2034) in this case, the probability for one target terminal to be made present is approximately "5/25" (refer to FIG. 43).

It goes without saying that contents of the second chance lottery table to be made up at the chance-lottery-table making-up process (S2033) are subject to vary depending on the number of participant terminals detected at S2002. For instance, in the case there are detected two participant terminals, the CPU 251 makes up a chance lottery table so that the probability for one target terminal to be made present should be "2/25" (S2033).

Here, if the second chance lottery table is used, the synthetic expected value is increased by 4% . Accordingly, in this case, the synthetic expected value of the dice gaming machine 201 exceeds "100%". In other words, the synthetic expected value when the second chance lottery table is used is larger than the synthetic expected value when the base chance lottery table is used. Thus, the dice gaming machine 201 can offer a player a chance to win a larger amount of payout with a higher probability. Here, the case where the second chance lottery table is made up is the case where the dice gaming machine 201 has a surplus larger than the predetermined amount. Accordingly, the dice gaming machine 201 will not cause a loss to a game arcade installing the dice gaming machine 201 even offering a chance to win a larger amount of payout with a higher probability. Thus, the dice gaming machine 201 can answer the demand of players for a larger amount of payout by offering a chance to win a larger amount of payout with a higher probability.

Next, based on the above-mentioned exemplary case, there will be described contents of the target-terminal-identification-table making-up process (S2036) and the target terminal identification table by referring to drawings.

As was described earlier, the probability based on the target terminal identification table is 1/"the number of current participant terminals (i.e., the number of participant terminals detected at S2032)". Accordingly, in the above exemplary case, the probability based on the target terminal identification table needs to be 1/5. Accordingly, the CPU 251 associates each participant terminal detected at the participant terminal detecting process (S2032)) with a constant range of random number values (refer to FIG. 44). In this case, the CPU 251 associates the "fifth terminal" detected as a participant terminal with a "random number value range: 800-1199". The thus made up target terminal identification table is used for executing the target terminal identification process (S2037). Accordingly, at the target terminal identification process (S2037) in this case, the probability that each of the five participant terminals is identified to be a target terminal should be equally set to "1/5" (refer to FIG. 44).

It goes without saying that contents of the target terminal identification table to be made up at the target-terminal-identification-table making-up process (S2036)) are subject to vary depending on the number of participant terminals detected at S2032. For instance, in the case there are detected two participant terminals, the CPU 251 makes up a target terminal identification table so that the probability that each of the two participant terminal is identified to be a target terminal should be "1/2" (S2036)).

Figure 45:
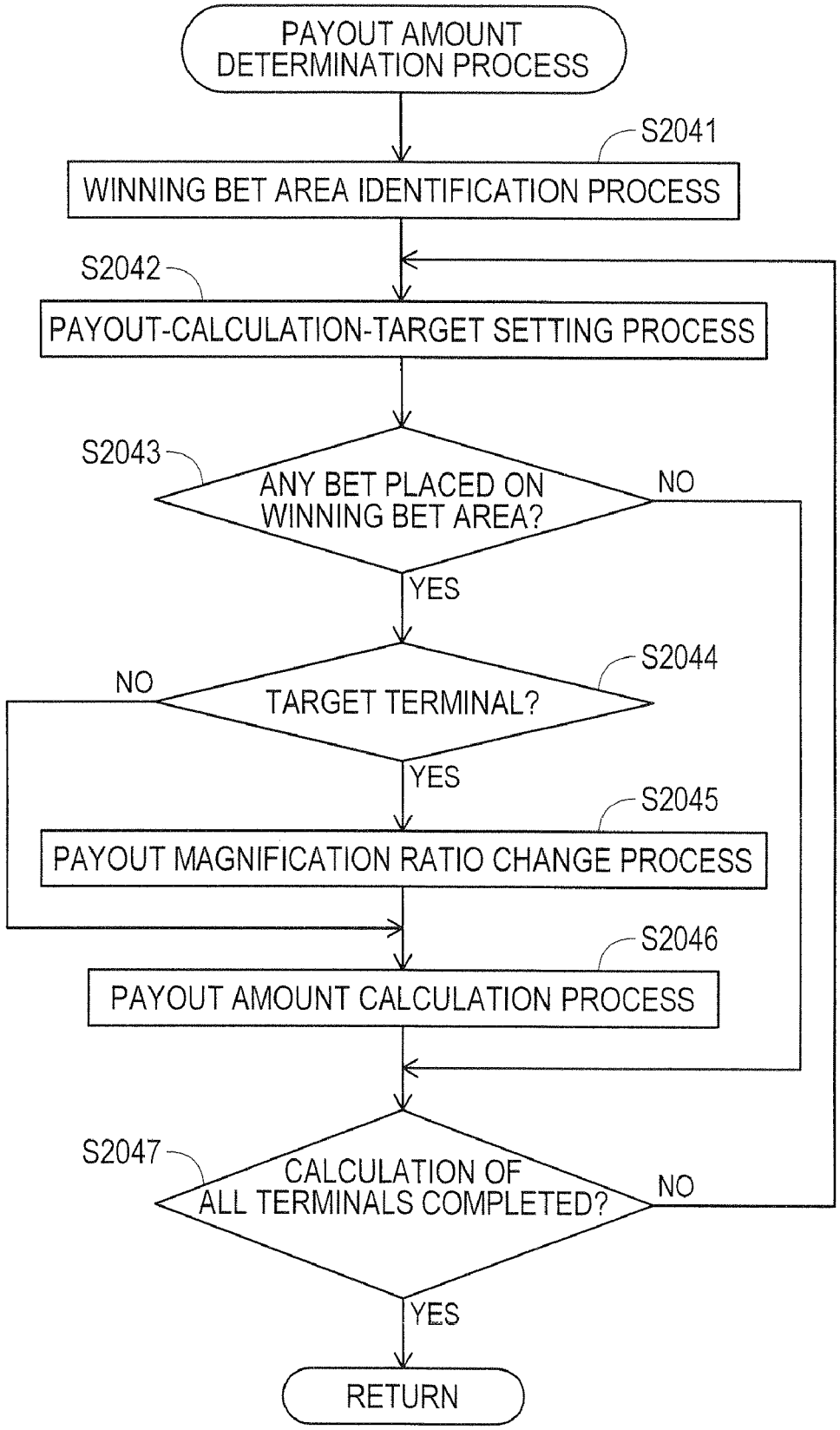
FIG. 45 is a flow chart of a payout amount determination process program according to the third embodiment of the present invention.

Next, the payout amount determination process program to be executed by the CPU 251 in the payout amount determination process (S2014) will be described in detail while referring to the drawings. FIG. 45 is a flow chart of the payout amount determination process program.

In the dice game execution process program of the main control unit 250, after shifting to the payout amount determination process (S2014), the CPU 251 executes a winning bet area identification process (S2041). In the winning bet area identification process (S2041), the CPU 251 identifies the winning bet area based on the rolling result information and the winning condition set for each bet area 235. The winning bet area is the bet area 235 whose specified winning condition is satisfied by the spots on the stopped dice 240. As was described earlier, the rolling result information shows the spots on the three stopped dice 240 which have been identified by the rolling result detection unit 215. Accordingly, the CPU 251 identifies the winning bet area based on the rolling result information and the winning condition of each bet area 235. After identifying the winning bet area, the CPU 251 shifts the process to S2042.

After shifting to S2042, the CPU 251 executes a payout-calculation-target setting process. In the payout-calculation-target setting process (S2042), the CPU 251 sets one terminal selected from all the terminals 205 constituting the dice gaming machine 201 as payout amount calculation target. The terminal selected as payout amount calculation target will be termed as "calculation target terminal", hereinafter. After setting the calculation target terminal, the CPU 251 shifts the process to S2043.

After shifting to S2043, the CPU 251 judges whether or not any of the bets placed by the calculation target terminal coincides with a winning bet. The winning bet refers to the gaming values bet on the winning bet area identified in the winning bet area identification process (S2041). More specifically, the CPU 251 carries out the judgment process at S2043 based on the bet information of the calculation target terminal stored in the RAM 253. If a winning bet has been made (S2043: YES), the CPU 251 shifts the process to S2044.

Alternatively, if none of the bets are winning bets (S2043: NO), the CPU 251 sets the payout amount of the calculation target terminal to "0". Thereafter, the CPU 251 shifts the process to S2047. Here, the case that none of the bets are winning bets includes the case that no bets for gaming values are made with respect to the bet area 235 and the case that all gaming values are bet with respect to a bet area 235 other than the winning bet area.

At S2044, the CPU 251 judges whether or not the calculation target terminal coincides with a "target terminal". More specifically, the CPU 251 judges whether or not the calculation target terminal has won in the chance lottery execution process (S2034) and coincides with a terminal 205 identified at the target terminal identification process (S2037). More specifically, the CPU 251 carries out the judgment process at S2044 based on the winning information stored in the RAM 253. In the case the calculation target terminal coincides with the "target terminal" (S2044: YES), the CPU 251 shifts the process to a payout magnification ratio change process (S2045). Alternatively, in the case the calculation target terminal dose not coincide with the "target terminal" (S2044: NO), the CPU 251 shifts the process to S2046.

At S2045, the CPU 251 executes the payout magnification ratio change process. In the payout magnification ratio change process (S2045), the CPU 251 changes the payout magnification ratio of all bet areas 235 constituting the betting board 230. At this time, the CPU 251 changes the payout magnification ratio of all the bet areas 235, with respect to only the calculation target terminal which corresponds to "target terminal". More specifically, the CPU 251 multiplies the base payout magnification ratio of all bet areas 235 constituting the betting board 230 by the special magnification ratio (i.e., ×2). As a result, the payout magnification ratio of each bet area 235 is changed from "base payout magnification ratio" to "special payout magnification ratio". After the payout magnification ratio of each bet area 235 is changed to the "special payout magnification ratio", the CPU 251 shifts the process to S2046.

After shifting to S2046, the CPU 251 executes a payout amount calculation process. In this payout amount calculation process (S2046), the CPU 251 calculates the payout amount in the current game with respect to the calculation target terminal. More specifically, the CPU 251 calculates the payout amount of the calculation target terminal in the current game by executing the following processes for the calculation target terminal.

In the case the calculation target terminal coincides with a "target terminal", the CPU 251 calculates the payout amount related to the winning bet area by using the "special magnification ratio". More specifically, the CPU 251 multiplies the "special payout magnification ratio" of the winning bet area by the bet amount bet on the winning bet area in question. In the case the calculation target terminal does not coincide with a "target terminal", the CPU 251 calculates the payout amount related to the winning bet area by using the "base payout magnification ratio". More specifically, the CPU 251 multiplies the "base payout magnification ratio" of the winning bet area by the bet amount bet on the winning bet area in question. If bets of gaming values are made with respect to a plurality of winning bet areas, the CPU 251 calculates a payout amount corresponding to each winning bet area.

The CPU 251 sets the payout amount corresponding to the bet areas other than the winning bet area to "0". The CPU 251 adds up the payout amounts of the bet areas calculated through the processes described above so as to calculate payout amount of the calculation target terminal. Thereafter, the CPU 251 stores the information showing the payout amount of the calculation target terminal (termed as "payout amount information" hereinafter) in the RAM 253. The payout amount information constitutes payout information of the calculation target terminal. Thereafter, the CPU 251 shifts the process to S2047.

After shifting to S2047, the CPU 251 judges whether or not calculation of payout amounts has been finished with respect to all the terminals 205 constituting the dice gaming machine 201. More specifically, the CPU 251 executes the judgment process of S2047 by referring to the payout amount information stored in the RAM 253. In the case calculation of payout amounts has been finished with respect to all the terminals 205 (S2047: YES), the CPU 251 finishes the payout amount determination process program. As shown in FIG. 38, after finishing the payout amount determination process (S2014), the CPU 251 shifts the process to the payout information transmission process (S2015). In the case calculation of payout amounts has not been finished with respect to all the terminals 205 (S2047: NO), the CPU 251 reverts the process to the payout-calculation-target setting process (S2042). In this case, the CPU 251 sets a terminal 205 of which payout amount has not yet been calculated, as new calculation target terminal. Then, the CPU 251 executes processes concerning payout amount calculation of the new calculation target terminal (S2043 through S2046).

As was described earlier, in the payout information transmission process (S2015), the CPU 251 transmits the payout information showing the payout amount thus calculated, from the main control unit 250 to each terminal 205. In each terminal 205, the terminal CPU 271 executes the payout process (S2108) based on the payout information thus received.

In the case the terminal 205 in question does not coincides with a target terminal, the player of the terminal 205 can win a payout amount based on the "base payout magnification ratio". The payout amount based on the "base payout magnification ratio" is obtained by multiplying the "base payout magnification ratio" of the winning bet area by the bet amount bet on the winning bet area in question. Alternatively, in the case the terminal 205 in question coincides with a target terminal, the player can win a payout amount based on the "special payout magnification ratio". The payout amount based on the "special magnification ratio" is obtained by multiplying the "special payout magnification ratio" of the winning bet area by the bet amount bet on the winning bet area in question. The "special payout magnification ratio" is obtained by multiplying the "base payout magnification ratio" by the "special magnification ratio (i.e., ×2)". Accordingly, in the case the terminal in question coincides with a target terminal, the player at the target terminal can be awarded a larger payout amount as compared to the case of non-target terminal.

As described, once acceptance of bets of gaming values on bet areas 235 ends, the dice gaming machine 201 according the third embodiment executes the chance lottery process (S2008). At the chance lottery process (S2008), the dice gaming machine 201 first executes the chance lottery execution process (S2034) by referring to a chance lottery table made up at the chance-lottery-table making-up process (S2033). In the chance lottery execution process (S2034), the dice gaming machine 201 determines whether or not a "chance to calculate a payout amount based on a special magnification ratio" is won in a lottery which refers to the chance lottery table. In the case of a win in the lottery of the chance lottery execution process (S2034), the dice gaming machine 201 then executes the target terminal identification process (S2037) by using a target terminal identification table made up at the target-terminal-identification-table making-up process (S2036). In the target terminal identification process (S2037), the dice gaming machine 201 identifies one target terminal from participant terminals of a current dice game.

In the case of a win in the chance lottery execution process, the dice gaming machine 201 calculates payout amount of the target terminal (S2045 and S2046). More specifically, the payout amount of the target terminal is obtained by multiplying bet amount bet on a winning bet area by the special payout magnification ratio. The dice gaming machine 201 also calculates payout amount of each of non-target terminals (S2046). More specifically, the payout amount of each of the non-target terminals is obtained by multiplying bet amount bet on a winning bet area by the base payout magnification ratio. The "special payout magnification ratio" is obtained by multiplying the "base payout magnification ratio" by the "special magnification ratio (i.e., ×2)".

As a result, each player acquires payout amount calculated at the payout amount calculation process (S2046) as a prize for the current game. That is, in the case a terminal 205 is identified to be a target terminal, the player at the target terminal can acquire larger amount of payout. As a result, the dice gaming machine 201 can meet players' desire to win larger amount of payout.

In addition, the dice gaming machine 201 updates the income information and the outgo information in every execution of a game (S2007, S2016). The dice gaming machine 201 then calculates the balance of the dice gaming machine 201 through the most recent 1,000 games based on the updated income information and outgo information (S2021). The dice gaming machine 201 sets a condition for making up a chance lottery table (i.e., base probability, first probability and second probability) (S2024 through S2026). Then, the dice gaming machine 201 executes a chance lottery execution process (S2034) using a chance lottery table made up based on the balance. Thus, the dice gaming machine 201 changes the probability for awarding a chance to win a larger amount of payout based on the balance of the dice gaming machine 201. As a result, the dice gaming machine 201 can award a player a chance to win a larger amount of payout in an appropriate manner while securing a profit of a game arcade installing the dice gaming machine 201.

Moreover, in the case a target terminal is made present, the dice gaming machine 201 displays the chance lottery wining image 280 on the game screen of the target terminal (S2107). As shown in FIG. 39, the chance lottery winning image 280 serves to notify that this terminal has been identified to be a target terminal and this terminal has acquired a chance to win large amount of payout. Accordingly, the player at the target terminal can recognize that this terminal has been identified to be a target terminal and this terminal has acquired a chance to win large amount of payout by looking at the chance lottery winning image 280. As a result, the dice gaming machine 201 can increase the sense of expectancy of the player with respect to a larger payout with the notification by the chance lottery winning image 280.

The present invention is not limited to the embodiments described above, but various improvements and modifications can be made thereto without departing from the spirit of the present invention. For instance, the dice gaming machine 201 according to the present invention can use plural types of special magnification ratios when the base payout magnification ratio is changed to a special magnification ratio. Further, the special magnification ratio is not limited to the above value (i.e., "×2"). Various other values can be adopted as the special magnification ratio as long as the player can be awarded a larger payout.

In the payout magnification ratio change process (S2045) described in the third embodiments, the CPU 251 changes the payout magnification ratio of each bet area 235 by multiplying the base payout magnification ratio by the special magnification ratio. Multiplying the base payout magnification ratio by the special magnification ratio is not limited to the payout magnification ratio change process (S2045). Specifically, the special payout magnification ratio obtained by multiplying the base payout magnification ratio by the special magnification ratio can be stored in advance in a memory. In this case, in the payout magnification ratio change process (S2045), the CPU 251 reads out the special payout magnification ratio from the memory and changes the "base payout magnification ratio" in each bet area 235 to the corresponding "special payout magnification ratio". The dice gaming machine 201 can thus reduce the processing burden with respect to the payout magnification ratio change process (S2045).

The dice gaming machine according to the third embodiment identifies one target terminal among from participant terminals based on a lottery (S2037). In the present invention, the manner to identify a target terminal, however, is not limited to lottery. The present invention can apply various manners of target-terminal identification as long as one target terminal can be identified anyhow.

Furthermore, in the third embodiment, the target terminal identification table is made up in such a fashion that probability that each participant terminal is identified to be a target terminal is set equally (refer to FIG. 44). In this regard, probability setting, however, is not limited to the above-mentioned fashion. For instance, the target terminal identification table may be made up in such a fashion that "identified-to-be-target-terminal probability" is made different by each participant terminal. For instance, the "identified-to-be-target-terminal probability" is made different depending on large or small of bet amount for a current game.

The numerical values of the base probability, the first probability and the second probability directed to the present invention is not limited to the values described in the third embodiment. In the present invention, various other values can be adopted as long as the values of the first probability, the base probability, and the second probability are in ascending order.

The present invention can also be realized as a gaming method for executing the above-described processes. The present invention can also adopt as a program for causing a computer to execute such gaming method, and a recording medium onto which such program is recorded.

[Fourth Embodiment]

Figure 46:
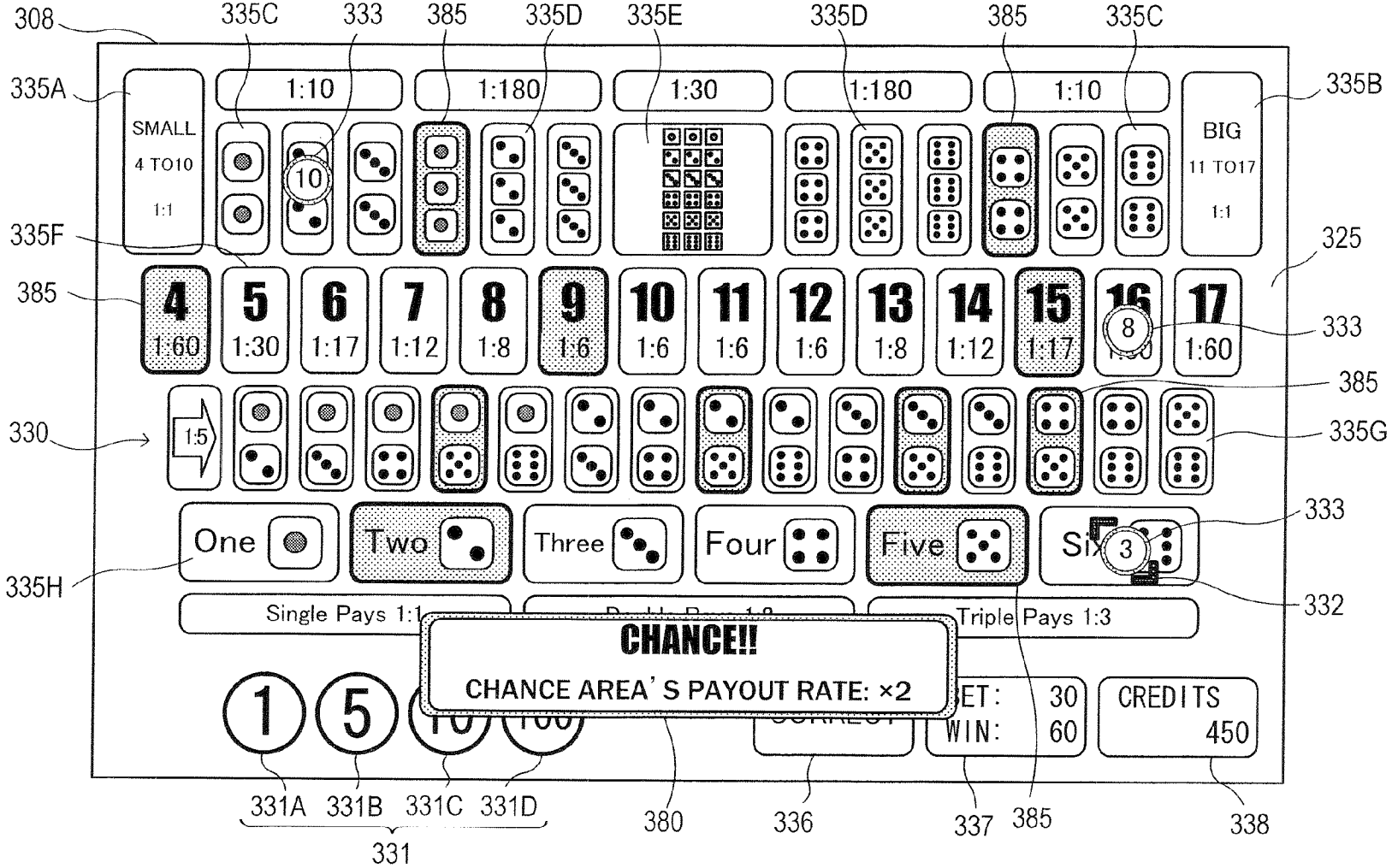
FIG. 46 is an exemplary diagram showing the characteristics of the dice gaming machine according to the fourth embodiment of the present invention.

Here, characteristics of a dice gaming machine 301 will next be described. FIG. 46 is an exemplary view showing characteristics of a dice gaming machine 301 according to the fourth embodiment.

A dice game which is called "Sic Bo" is played in the dice gaming machine 301. In "Sic-Bo", three dice 340 are rolled. Players predict the result of dice rolling (specifically, the spots on the three dice 340). Also, the players bet gaming values on a betting board 330 based on their prediction.

Here, the betting board 330 is made up of a plurality of bet areas 335 (refer to FIG. 46, etc.). Each bet area 335 is associated with a winning condition and a payout magnification ratio. The winning condition is a condition defined by spot(s) on some or all of the three dice 340. If the spots on the rolled dice 340 satisfy the winning condition, the player who placed a bet on this bet area 335 wins a prize. The payout magnification ratio is used for determining the contents of the prize which is thus awarded. More specifically, the payout magnification ratio defines the magnification ratio of the prize (payout amount) to be awarded with respect to a unit gaming value (specifically, one credit) thus bet. Specifically, players bet gaming values with respect to a bet area 335 corresponding to their prediction as described above.

If the spots on the rolled dice 340 satisfy the winning condition defined for the bet area on which a bet is placed by the player, the player wins a prize. The prize in this case is determined by multiplying the amount of gaming value bet by the player by the payout magnification ratio of the bet area 335 in question.

Here, once acceptance of gaming value bets ends, the dice gaming machine 301 according to the fourth embodiment executes a chance area determination process (S3006). The dice gaming machine 301 determines whether or not to change it into a chance area 385 by a lottery with respect to all of the bet areas 335 constituting the betting board 330. The dice gaming machine 301 determines chance area(s) 385 in a betting board 330 with respect to each terminal 305 constituting the dice gaming machine 301. Accordingly, a kind of a bet area 335 changed into a chance area 385 differs by betting boards 330 of respective terminals 305.

As described, if spots on the three rolled dice 340 satisfy a winning condition defined with the bet area 335 on which a bet is placed by the player, the player wins a prize based on bet amount bet on the bet area 335 in question and payout magnification ratio thereof.

If the bet area 335 in question corresponds to a chance area 385, the dice gaming machine 301 changes payout magnification ratios for determining prize contents of the chance area 385. More specifically, the dice gaming machine 301 calculates the prize contents of the chance area 385 by multiplying a payout magnification ratio defined for the bet area 335 in question by a special magnification ratio (for instance, "×2"). Accordingly, in the case of a win by betting on a chance area 385, the player can win twice a larger payout amount than the case of a normal win (i.e., in the case the bet area 335 in question does not correspond to a chance area 385).

In the fourth embodiment, the payout magnification ratio includes a base payout magnification ratio and a special payout magnification ratio. The base payout magnification ratio is the payout magnification ratio set for each bet area 335. The base payout magnification ratio is used in calculating the prize (e.g., payout amount) in the case the bet area 335 in question does not correspond to a chance area 385. The special payout magnification ratio is the changed payout magnification ratio set for each bet area 335, which is obtained by multiplying the base payout magnification ratio by the special magnification ratio (for instance, "×2"). Specifically, the special payout magnification ratio is used when the bet area 335 in question corresponds to the chance area 385.

Figure 47:
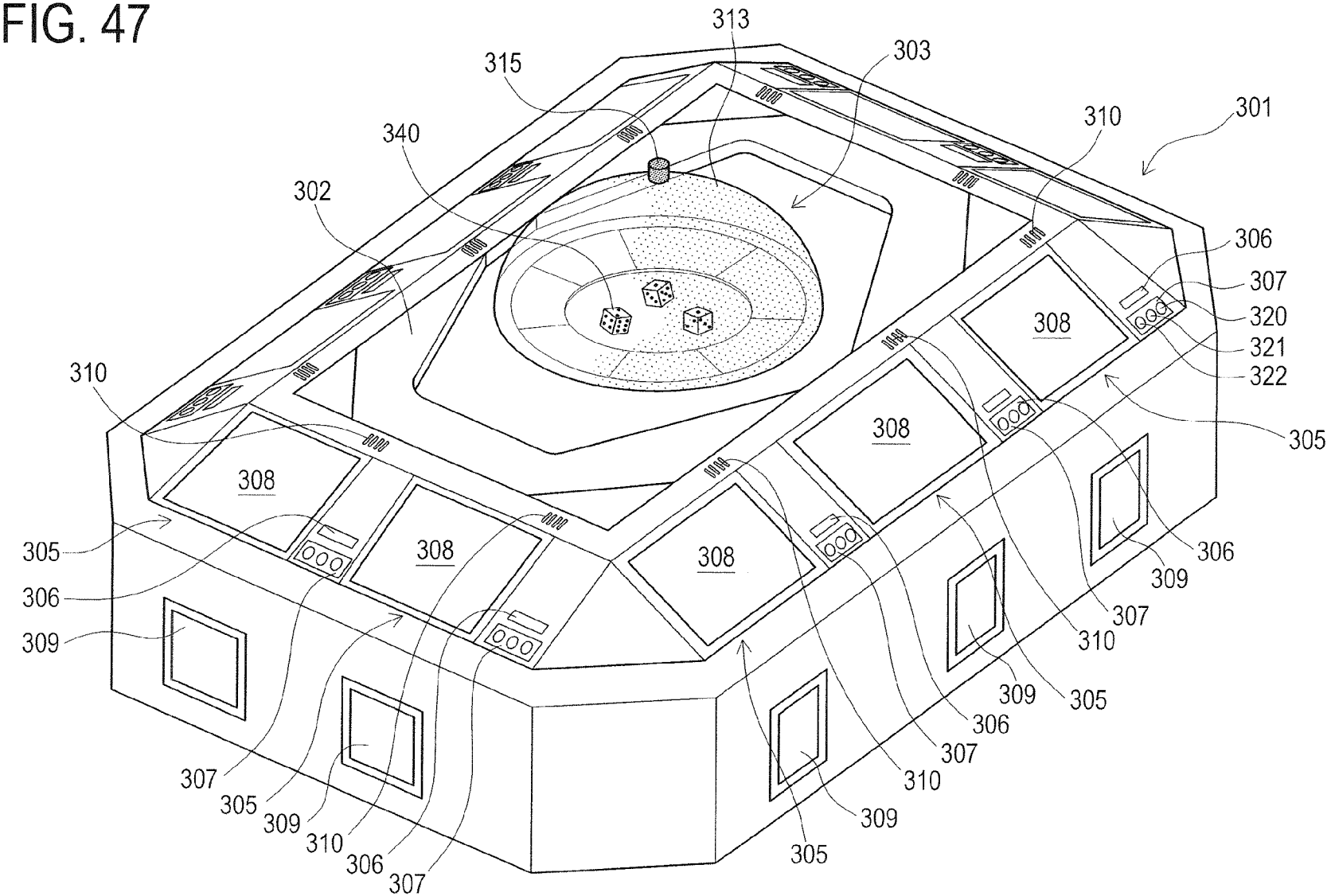
FIG. 47 is a perspective view showing an outer appearance of the dice gaming machine according to the fourth embodiment of the present invention.

Next, a schematic configuration of the dice gaming machine 301 will be described in detail while referring to the drawings. FIG. 47 is a schematic diagram showing an outer appearance of the dice gaming machine 301 according to the fourth embodiment.

As shown in FIG. 47, the dice gaming machine 301 according to the fourth embodiment has a cabinet 302, a dice rolling device 303 and a plurality of terminals 305 (in the fourth embodiment, ten terminals). The cabinet 302 makes up the main part of the dice gaming machine 301. The cabinet 302 houses mechanical components and electrical components such as a main control unit 350 and the like as will be described later.

The dice rolling device 303 is installed at a central portion on an upper face of the cabinet 302. The dice rolling device 303 has a dice box. The dice box houses three dice 340 therein. The three dice 340 are rolled inside the dice box and are then stopped. The configuration of the dice rolling device 303 will be described in detail later.

The terminals 305 are installed at the periphery of the dice rolling device 303. The terminals 305 each have a liquid crystal display 308. The terminals 305 are used in a player's operation with respect to the dice game (e.g., Sic Bo) played in the dice gaming machine 301. Specifically, players enter the dice game played in the dice gaming machine 301 by using the terminals 305.

In the fourth embodiment, the ten terminals 305 each constituting the dice gaming machine 301 are termed "first terminal" through "tenth terminal".

The terminals 305 each have a medal acceptance device 306, a control panel 307 and a liquid crystal display 308. The medal acceptance device 306 accepts medals, an exemplary type of gaming value, inserted by the player. Specifically, in the case of playing the dice game, the player inserts medals, an exemplary type of gaming value, in the medal acceptance device 306. The gaming values thus inserted are stored as credit. The player places a bet onto a bet area 335 using such credit.

The control panel 307 is installed at a lower side of the medal acceptance device 306. This control panel 307 has a plurality of operation buttons. More specifically, the control panel 307 also has a BET determination button 320, a CASHOUT button 321 and a HELP button 322.

The BET determination button 320 is operated by the player to determine a bet operation. Specifically, the player operates the BET determination button 320 to determine the bet area 335 which will be the bet target and the amount of gaming values to be bet with respect to the bet area 335 (hereinafter referred to as bet amount).

The CASHOUT button 321 is operated by the player to request payout of the credits he/she possesses. When this CASHOUT button 321 is operated, medals are paid out from a cash out port 309 in accordance with the number of credits that the player possesses.

The HELP button 322 is operated in the case the operation method and the rules of the game are unclear. When the HELP button 322 is operated, the dice gaming machine 301 displays a HELP screen containing explanations with respect to the game operation method and the like onto the liquid crystal display 308.

The liquid crystal display 308 is a display device for displaying information with respect to the dice game. When the dice game is started, each liquid crystal display 308 displays an image of the betting board 330. The touch panel 325 is arranged at a front face of the liquid crystal display 308 in each terminal 305. Accordingly, the player carries out a bet operation with respect to the bet area 335 using this touch panel 325.

Each terminal 305 has a cash out port 309 and a speaker 310. The cash out port 309 is arranged at a lower side of the liquid crystal display 308. This cash out port 309 serves to output medals. For instance, once the CASHOUT button 321 is operated, a number of medals corresponding to the credits the player possesses are paid out to the cash out port 309. Speaker 310 is installed at a right upper side of the liquid crystal display 308. The speaker 310 outputs sounds based on the progress of the game.

Next, the dice rolling device 303 installed in the dice gaming machine 301 will be described in detail while referring to the drawings.

As shown in FIG. 47, the dice rolling device 303 is installed at an upper face of the cabinet 302. The dice rolling device 303 houses three dice 340 therein. The three dice 340 are rolled inside the dice rolling device 303 by controlling the operation of the dice rolling motor 312 as will be described later. The rolled dice 340 are then stopped on a dice rolling board 311. The dice rolling device 303 is installed at a central portion of the cabinet 302. Accordingly, players who are seated at the terminals 305 can see the dice 340 as they are being rolled inside the dice rolling device 303 and the spots on the dice 340 after these are stopped inside the dice rolling device 303.

Figure 48:
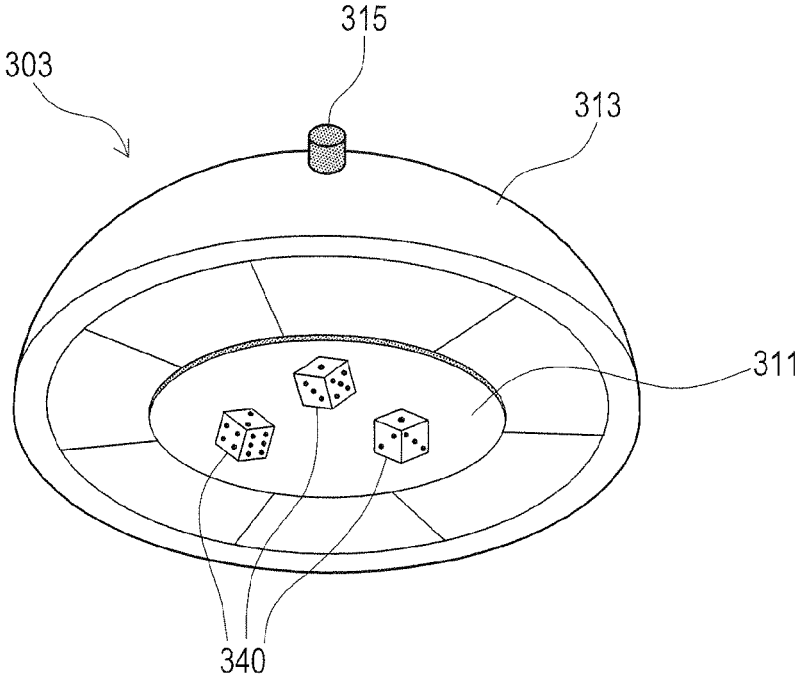
FIG. 48 is a view showing an outer appearance of a dice rolling device according to the fourth embodiment of the present invention.
Figure 49:
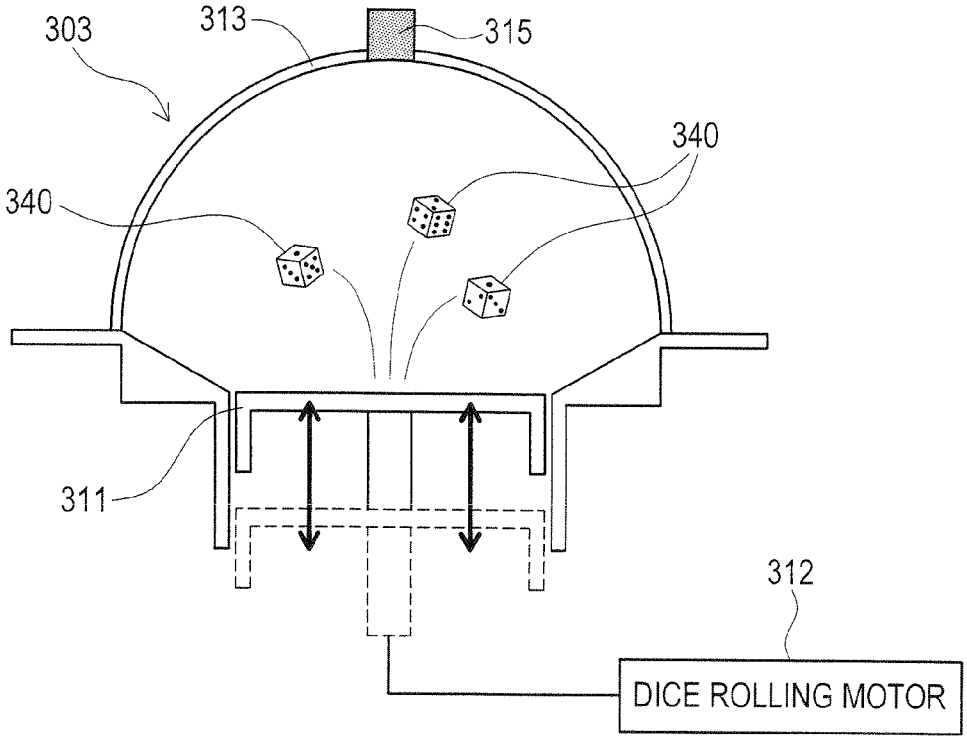
FIG. 49 is an exemplary diagram relating to an operation of the dice rolling device according to the fourth embodiment of the present invention.

As shown in FIG. 48 and FIG. 49, the dice rolling device 303 has a dice rolling board 311, a dice rolling motor 312, a cover member 313 and a rolling result detection unit 315. The dice rolling board 311 moves up and down within a predetermined range inside the dice rolling device 303 (refer to FIG. 49). The dice rolling board 311 is connected to the dice rolling motor 312. Specifically, the dice rolling board 311 moves up and down within the predetermined range based on driving and control of the dice rolling motor 312.

As shown in FIG. 49, in the case of rolling the dice 340, the dice rolling motor 312 causes the dice rolling board 311 to move upwards at a certain speed or faster. Once the dice rolling board 311 moves over a predetermined range, the board stops moving. Accordingly, the dice 340 on the dice rolling board 311 are thrown upwards and are thus rolled inside the dice rolling device 303. As shown in FIG. 49, an inclined face is formed at the periphery of the dice rolling board 311. Accordingly, the three dice 340 thus roll on the inclined face and then stop on the dice rolling board 311.

The cover member 313 is formed in a hemispherical shape to cover the three dice 340 and the dice rolling board 311 (refer to FIG. 48 and FIG. 49). Specifically, the three dice 340 are rolled inside a space defined by the upper face of the dice rolling board 311 and the inner face of the cover member 313. The cover member 313 is made of a transparent acrylic material. Accordingly, the player can sufficiently see the dice 340 while being rolled inside the dice rolling device 303 and the dice 340 as stopped on the dice rolling board 311.

The rolling result detection unit 315 is installed at a top of the cover member 313 (refer to FIG. 48 and FIG. 49). The rolling result detection device 315 detects the spots on each die 340 which is stopped on the dice rolling board 311 (hereinafter referred to as rolling result). More specifically, the rolling result detection unit 315 acquires an image of each die 340 which is stopped on the dice rolling board 311. The rolling result detection unit 315 identifies the spots on each die 340 by carrying out a predetermined image process with respect to the images thus acquired. Here, information showing the identified spots on the three dice 340 is referred to as rolling result information.

The image processing for identifying the spots on dice 340 is heretofore known in the art. Therefore, further description thereof will hereby be omitted.

Figure 50:
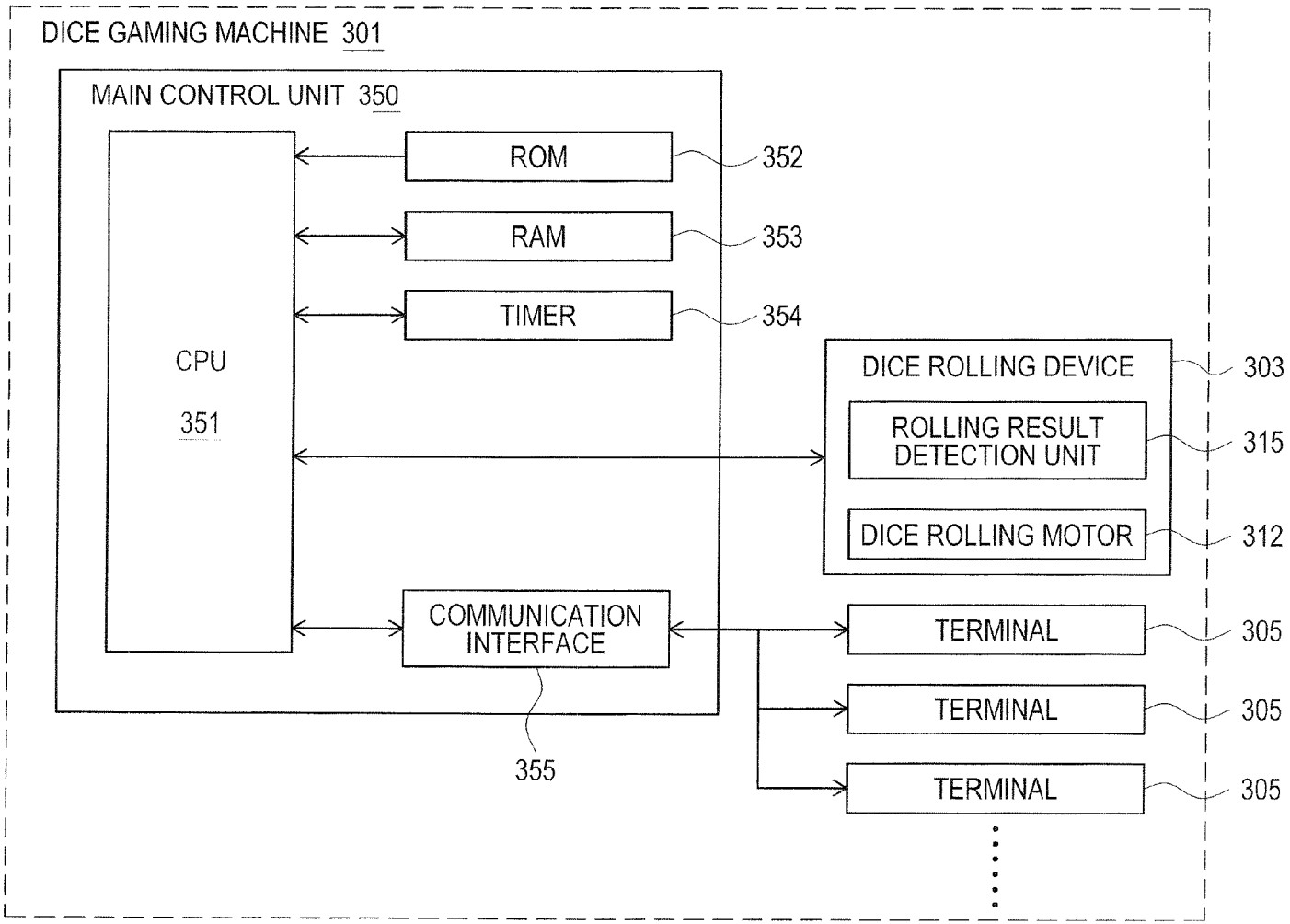
FIG. 50 is a block diagram showing an internal configuration of the dice gaming machine according to the fourth embodiment of the present invention.

Next, the internal configuration of the dice gaming machine 301 according to the fourth embodiment will be further described in detail while referring to the drawings. FIG. 50 is a block diagram showing an internal configuration of the dice gaming machine according to the fourth embodiment.

As shown in FIG. 50, the dice gaming machine 301 has a main control unit 350. The main control unit 350 controls the entire dice gaming machine 301. The main control unit 350 has a CPU 351, a ROM 352 and a RAM 353.

The CPU 351 is a central processing unit with respect to control by the main control unit 350. Specifically, the CPU 351 plays a central role in the control by the main control unit 350. In other words, the CPU 351 controls the entire dice gaming machine 301 by executing the various programs stored in the ROM 352. For instance, the CPU 351 progresses the dice game in the dice gaming machine 301 by executing a dice game execution process program (refer to FIG. 53 and FIG. 54) as will be described later.

The ROM 352 stores various types of programs to be executed in the CPU 351. More specifically, the ROM 352 stores a dice game execution process program (refer to FIG. 53 and FIG. 54), a chance area determination process program (refer to FIG. 55), a payout amount determination process program (refer to FIG. 58) and a lottery program and the like. The ROM 352 also stores various types of data tables. These data tables are referenced upon executing various programs. Accordingly, the payout table and chance lottery table (refer to FIG. 56 and FIG. 57) are also stored in the ROM 352. Specifically, the ROM 352 stores fifty-three chance lottery tables. A chance lottery table is associated with a bet area 335 constituting a part of the betting board 330. For instance, a chance lottery table shown in FIG. 56 is associated with a total bet area 335F directed to a total value "4" to be described later. Furthermore, a chance lottery table shown in FIG. 57 is associated with an any triple bet area 335E to be described later. Each chance lottery table is referred upon execution of the chance area determination process (S3006). Contents of those chance lottery tables will be described in detail.

The ROM 352 stores a BIOS (Basic Input/Output System) and an authentication program. When power is applied to the dice gaming machine 1, the CPU 351 executes the BIOS stored in the ROM 352. As a result, the CPU 351 initializes the peripheral devices constituting the dice gaming machine 301. The CPU 351 authenticates the dice game execution process program and the like by executing an authentication program. At this time, the CPU 351 checks the presence of any alterations with respect to the dice game execution process program and the like. These processes are executed in an initial setting process executed at the time of applying power.

The RAM 353 temporarily stores the results of the processing executed by the CPU 351. Specifically, the RAM 353 temporarily stores the processing results following execution of the above-mentioned programs (for instance, lottery results of the chance lottery process and the like). The RAM 353 temporarily stores various types of information regarding the dice game (for instance, bet information transmitted from the terminals 305, rolling result information transmitted from the rolling result detection device 315 and the like).

The main control unit 350 has a timer 354 and a communication interface 355. The timer 354 is a clock device which is connected to the CPU 351. The CPU 351 references the measurement result of the timer 354 in the case of judging the lapse of the bet period and in the case of judging the arrival of rolling timing.

The bet period refers to the period of accepting the bet operation made by the players at the terminals 305. Specifically, lapse of the bet period indicates that acceptance of bets for gaming values with respect to the bet area 335 has ended.

Rolling timing indicates the timing when rolling of dice 340 inside the dice rolling device 303 is started.

The communication interface 355 is connected to the CPU 351. The communication interface 355 is also connected to the terminals 305 constituting the dice gaming machine 301. Specifically, the CPU 351 transmits various types of information and control signals with respect to the terminals 305 through the communication interface 355. Further, the CPU 351 can receive the information (for instance, bet information) and the control signals from the terminals 305 through the communication interface 355.

Further, the CPU 351 constituting the main control unit 350 is connected to the dice rolling device 303. As was described earlier, the dice rolling device 303 has a dice rolling motor 312 and a rolling result detection device 315. Accordingly, the CPU 351 can drive and control the dice rolling motor 312 by transmitting a predetermined control signal to the dice rolling device 303. Specifically, the CPU 351 can cause the dice 340 to roll and stop in the dice rolling device 303. The rolling result detection device 315 can identify a rolling result indicating the spots on the stopped dice 340. Accordingly, the CPU 351 can acquire the rolling result information based on the spots on the dice 340 as identified by the rolling result detection device 315 (S3011).

Figure 51:
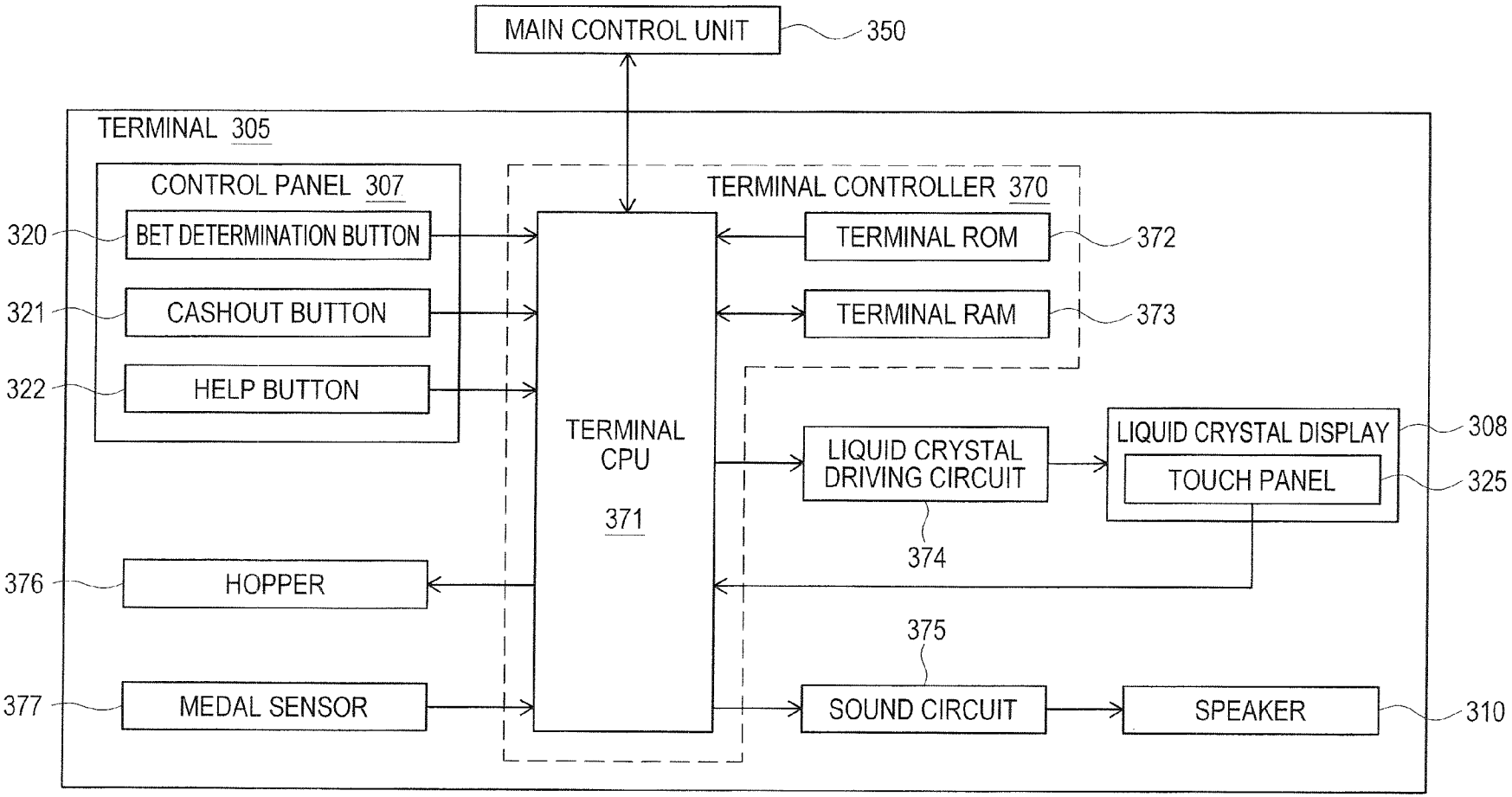
FIG. 51 is a block diagram showing an internal configuration of a terminal according to the fourth embodiment of the present invention.

Next, the terminals 305 constituting the dice gaming machine 301 will be described in detail while referring to the drawing. FIG. 51 is a block diagram showing the internal configuration of a terminal 305.

The terminals 305 constituting the dice gaming machine 301 all have the same configuration. Accordingly, the internal configuration of one terminal 305 will be described in detail. Description of the other terminals 305 constituting the dice gaming machine 301 will hereby be omitted.

As shown in FIG. 51, the terminal 305 has a terminal controller 370. This terminal controller 370 controls the various functions of the terminal 305. The terminal controller 370 has a terminal CPU 371, a terminal ROM 372 and a terminal RAM 373.

The terminal CPU 371 is a central processing unit with respect to control made by the terminal controller 370. Specifically, the terminal CPU 371 plays a central role in the control with respect to the terminal 305. More specifically, the terminal CPU 371 controls the terminal 305 by executing various types of programs stored in the terminal ROM 372. For instance, the terminal CPU 371 carries out control with respect to the dice game (for instance, control with respect to acceptance of bet operation and payment of payout) by executing the dice game execution process program (refer to FIG. 53 and FIG. 54) as will be described later.

The terminal ROM 372 stores various types of programs to be executed in the terminal CPU 371. More specifically, the terminal ROM 372 stores dice game execution process programs (refer to FIG. 53 and FIG. 54) and the like. The terminal ROM 372 stores various types of data tables. These data tables are referenced upon execution of the various programs.

The terminal ROM 372 also stores a BIOS (Basic Input/Output System) and an authentication program. When power is applied to the dice gaming machine 301, the terminal CPU 371 executes the BIOS stored in the terminal ROM 372. As a result, the terminal CPU 371 initializes the peripheral devices constituting the terminals 305. The terminal CPU 371 authenticates the dice game execution process program and the like by executing an authentication program. At this time, the terminal CPU 371 checks the presence of any alterations with respect to the dice game execution process program and the like. These processes are executed in an initial setting process executed at the time of power application.

The terminal RAM 373 temporarily stores the results of the processing executed in the terminal CPU 371. Specifically, the terminal RAM 373 temporarily stores the processing results following execution of the above-mentioned programs (for instance, bet information based on the players' bet operation). The terminal RAM 373 temporarily stores various types of information regarding the dice game (for instance, payout information transmitted from the main control unit 350 and the like).

The terminal CPU 371 is connected with the control panel 307. As was described earlier, the control panel 307 has a BET determination button 320, a CASHOUT button 321 and a HELP button 322. Specifically, the BET determination button 320, the CASHOUT button 321 and the HELP button 322 are each connected to the terminal CPU 371. Accordingly, when a player operates the BET determination button 320, the CASHOUT button 321 and the HELP button 322, a control signal based on each such operation can be inputted to the terminal CPU 371. The terminal CPU 371 can thus carry out control in accordance with the button that was operated, based on the operation signal thus inputted.

The terminal CPU 371 is connected with the liquid crystal display 308 through a liquid crystal driving circuit 374. The liquid crystal driving circuit 374 serves as a control circuit with respect to display on the liquid crystal display 308. The liquid crystal driving circuit 374 is made up of a program ROM, an image ROM, an image control CPU, a work RAM, a VDP (video display processor) and a video RAM, etc. The program ROM stores various types of selection tables and image control programs regarding display on the liquid crystal display 308. The image ROM stores dot data. This dot data is used for forming images to be displayed on the liquid crystal display 308. The image control CPU determines images to be displayed on the liquid crystal display 308 from the dot data stored in the image ROM, based on the parameters set in the terminal CPU 371 and the image control program. The work RAM serves as a temporary storage device at the time the image control program is executed in the image control CPU. The VDP forms images in accordance with the display contents determined by the image control CPU. The VDP outputs the images thus formed to the liquid crystal display 308. The video RAM serves as a temporary storage device at the time images are formed in the VDP.

As was described earlier, the liquid crystal display 308 has a touch panel 325 provided at a front face thereof. As is shown in FIG. 51, the terminal CPU 371 is connected with the touch panel 325. The touch panel 325 detects the coordinate information corresponding to a portion touched by the player. Accordingly, the touch panel 325 can identify a player's operation with respect to the touch panel 325 based on the coordinate information. The operation information indicating a player's operation with respect to the touch panel 325 is transmitted from the touch panel 325 to the terminal CPU 371.

In the dice gaming machine 301 according to the fourth embodiment, when the betting board 330 is displayed on the liquid crystal display 308 (refer to FIG. 52), the players select the bet areas 335 making up the betting board 330 and depress the unit BET button 331 using the touch panel 325. Accordingly, information with respect to the bet areas 335 thus selected and the unit BET button 331 is transmitted from the touch panel 325 to the terminal CPU 371.

The terminal CPU 371 is connected with the speaker 310 through a sound circuit 375. The sound circuit 375 carries out control with respect to sound output from speaker 310 based on the control signal transmitted from the terminal CPU 371. The speaker 310 outputs various effect sounds in accordance with the progress of the dice game. As a result, the dice gaming machine 301 can execute effects in accordance with the progress of the dice game at each terminal 305.

The terminal CPU 371 is connected with a hopper 376 and a medal sensor 377. The hopper 376 pays out medals to the cash out port 309 based on the control signal from the terminal CPU 371. The medal sensor 377 detects the medals paid out from the hopper 376. As a result, the terminal CPU 371 can pay out a predetermined number of medals to the players by controlling the hopper 376 and the medal sensor 377.

Figure 52:
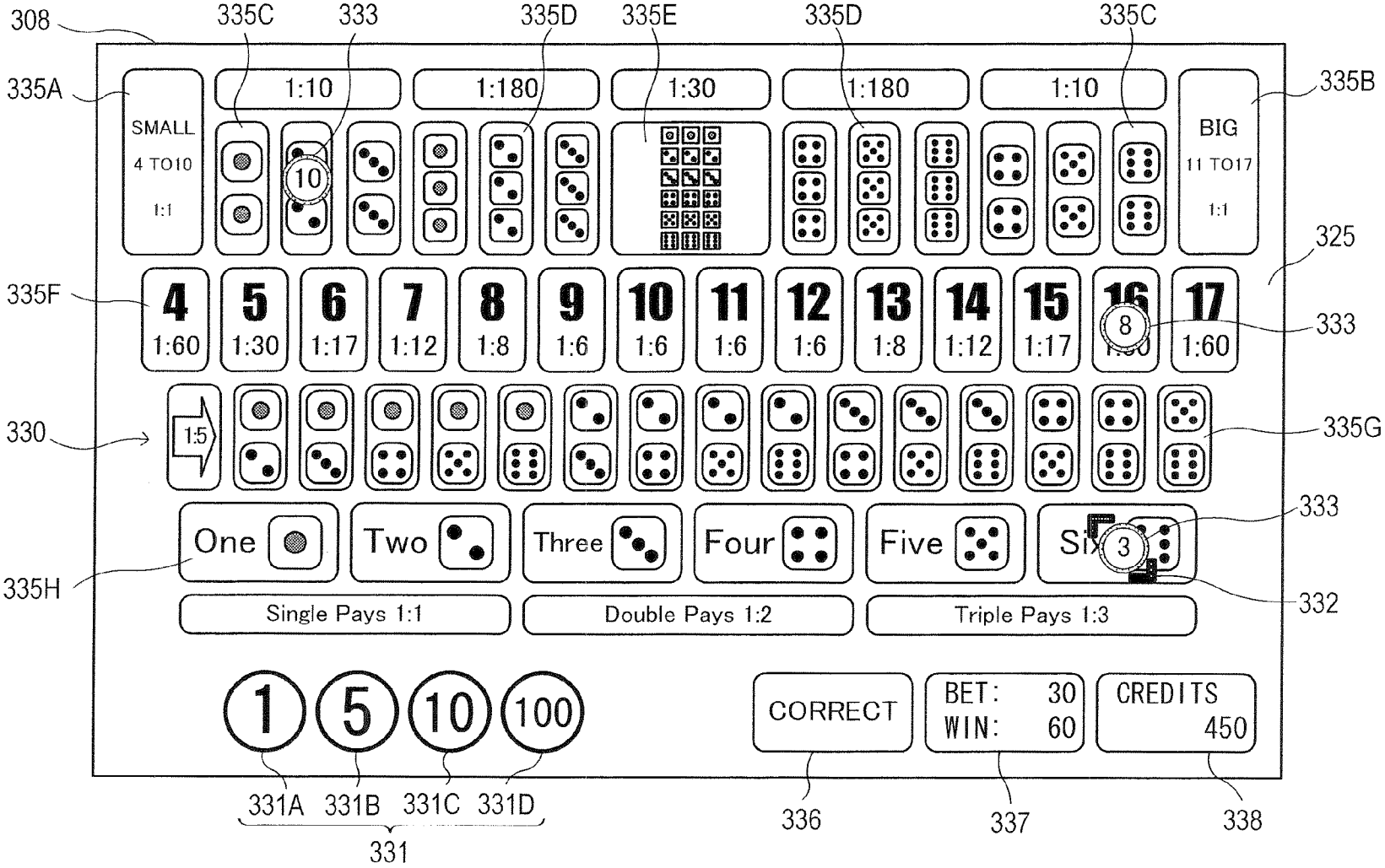
FIG. 52 is an exemplary view showing a game screen including a betting board according to the fourth embodiment of the present invention.

Next, a detailed description will be given with respect to the game screen to be displayed on the liquid crystal display 308 in the dice gaming machine 301 according to the fourth embodiment, while referring to the drawings. FIG. 52 is an explanatory diagram showing one example of a game screen to be displayed on the liquid crystal display 308.

As shown in FIG. 52, the game screen displayed on the liquid crystal display 308 includes the betting board 330. Here, when a dice game (e.g., Sic Bo) is played, the players bet gaming values with respect to the spots on the stopped three dice 340. The betting board 330 is used by the player in betting the gaming values.

The betting board 330 has a plurality of bet areas 335. Each bet area 335 is associated with a winning condition and a payout magnification ratio (e.g., base payout magnification ratio). The winning condition is the condition determined by the stopped three dice 340. The base payout magnification ratio shows the payout amount to be paid out in return to the unit gaming value (specifically, one credit) bet, in a case where spots on the stopped three dice 340 satisfy the winning condition of the bet area 335.

More specifically, the betting board 330 has eight types of bet areas 335. Specifically, the betting board 330 has a small bet area 335A, a big bet area 335B, a specific double bet area 335C, a specific triple bet area 335D, an any triple bet area 335E, a total bet area 335F, a combination bet area 335G and a number bet area 335H.

The small bet area 335A and the big bet area 335B are bet areas in each of which a condition is defined with a range of values as a result of adding up the spots on the stopped dice 340 (hereinafter referred to as total value). More specifically, the winning condition of the small bet area 335A is that "the total value is in a range between 4 and 10". The base payout magnification ratio of the small bet area 335A is set to 1:1 (two medals are paid out in return to a win with one medal placed as a bet). Alternatively, the winning condition of the big bet area 335B is that "the total value is in a range between 11 and 17". The base payout magnification ratio of the big bet area 335B is also set to 1:1.

The specific double bet area 335C is a bet area in which a winning condition is defined with a combination of spots on the stopped dice 340. More specifically, the winning condition of the specific double bet area 335C is satisfied if "amongst the three dice 340 which are stopped, the spots on two dice 340 are the same, and the spots on these two dice 340 correspond to specific spots". The betting board 330 has six specific double bet areas 335C. Accordingly, if the spots on two dice 340 from amongst the three dice 340 are "1,1", "2,2", "3,3" . . . or "6,6", the winning condition for one specific double bet area 335C is satisfied (refer to FIG. 52). The base payout magnification ratio of each specific double bet area 335C is set to 1:10.

The specific triple bet area 335D is a bet area in which a winning condition is defined a combination of the stopped three dice 340. More specifically, the winning condition of the specific triple bet area 335D is satisfied if "the spots on the three dice 340 which are stopped are the same and the spots on the three dice 340 correspond to specific spots". The betting board 30 has six specific triple bet areas 335D. Accordingly, if the spots on the three dice 340 are "1,1,1,", "2,2,2", "3,3,3" . . . or "6,6,6", the winning condition for one specific triple bet area 335D is satisfied (refer to FIG. 52). The base payout magnification ratio of each specific triple bet area 335D is set to 1:180.

The any triple bet area 335E is a bet area in which a winning condition is defined with a combination of the spots on the stopped three dice 340. More specifically, the winning combination of the any triple bet area 335E is satisfied if "the spots on the stopped dice 340 are all the same". Accordingly, if the spots on the three dice 340 are "1,1,1", "2,2,2", "3,3,3" . . . or "6,6,6", the winning combination of the any triple bet area 335E is satisfied (refer to FIG. 52). The base payout magnification ratio of the any triple bet area 335E is set to 1:30.

The total bet area 335F is a bet area in which a winning condition is defined with a total value of the spots on the stopped three dice 340. More specifically, the winning combination of the total bet area 335F is satisfied if "the total value is a specific value". As shown in FIG. 52, the betting board 330 has fourteen total bet areas 335F. Specifically, the betting board 330 has a total bet area 335F corresponding to each total value "4", "5" . . . "17". As shown in FIG. 52, the base payout magnification ratio of each total bet area 335F is set in accordance with the appearance frequency of the total value for each winning condition. For instance, if the winning condition for the total value "16" is the total bet area 335F thus set, the base payout magnification ratio is 1:30.

The combination bet area 335G is a bet area in which a winning condition is defined with a combination of the spots on the stopped dice 340. More specifically, the winning condition of the combination bet area 335G is satisfied if "the spots on two dice 340 from amongst the stopped three dice 340 correspond to a specific combination". As shown in FIG. 52, the betting board 330 has fifteen combination bet areas 335G. The base payout magnification ratio for the combination bet area 335G is set to 1:5.

The combination for the case that the spots on two dice 340 are the same is excluded from the combination bet area 335G.

The number bet area 335H is a bet area in which a winning condition is defined with the spots' numbers on the dice 340. More specifically, the winning combination of the number bet area 335H is satisfied if "a specific spot is included in the spots on the stopped three dice 340". As shown in FIG. 52, the betting board 330 has six number bet areas 335H. One number bet area 335H corresponds to any of "1", "2" . . . "6". The base payout magnification ratio of the number bet area 335H is set to "1:1", "1:2", "1:3", in accordance with the number of dices showing the spots corresponding to the winning combination.

The game screen can include a cursor 332 and a chip mark 333. The cursor 332 and the chip mark 333 are displayed on the betting board 330 in accordance with a player's operation. The cursor 332 shows the bet area 335 which is currently selected by the player. The chip mark 333 shows the amount of gaming values bet with respect to the bet area 335 (hereinafter referred to as bet amount). As shown in FIG. 52, the chip mark 333 shows the above-mentioned bet amount through the number displayed at the center of the chip mark 333. The chip mark 333 is displayed on the bet area 335. Specifically, the chip mark shows the bet area 335 onto which the bet is made through the location of its display.

Further, as shown in FIG. 52, the game screen includes a unit BET button 331, a CORRECT button 336, a payout result display portion 337 and a credit amount display portion 338.

The unit BET button 331 is formed at a lower left side of the betting board 330. The unit BET button 331 is used to set the bet amount with respect to the bet area 335 selected by the player.

As shown in FIG. 52, the unit BET button 331 is made up of 1 BET button 331A, 5 BET button 331B, 10 BET button 331C and 100 BET button 331D. The 1 BET button 331A is operated by the player to increase the bet amount with respect to the bet area 335 selected by the player by "1". The 5 BET button 331B is operated by the player to increase the bet amount with respect to the bet area 335 selected by the player by "5". The 10 BET button 331C is operated by the player to increase the bet amount with respect to the bet area 335 selected by the player by "10". The 100 BET button 331D is operated by the player to increase the bet amount with respect to the bet area 335 selected by the player by "100".

Each time the player carries out such operation, the unit BET button 331 adds a bet amount in accordance with such operation to the current bet amount.

The CORRECT button 336 is operated to cancel the bet area 335 already selected and the setting of the bet amount. If selection of the bet area 335 and setting of the bet amount are incorrect, the player can correct the bet area 335 and the bet amount by operating this CORRECT button 336.

The payout result display portion 337 displays the total bet amount in the previous game and the payout amount in the previous game (the payout credit amount).

The credit amount display portion 338 displays the credit amount possessed by the player. The display contents of the credit amount display portion 338 are updated based on the bet with respect to the bet area 335 and award of the payout in the dice game.

Next, the bet operation carried out by the player using the game screen will be described. As was described earlier, the touch panel 325 is installed at a front face of the liquid crystal display 308. The touch panel 325 transmits the coordinate information corresponding to the portion touched by the player to the terminal CPU 371. Accordingly, if the game screen is displayed on the liquid crystal display 308, the player can select the bet area 335 and set the bet amount using the touch panel 325.

More specifically, the player first touches with his/her finger the touch panel 325 at the portion corresponding to the desired bet area 335. As a result, the player selects the desired bet area 335. At this time, the cursor 332 is displayed on the bet area 335 thus selected. Thereafter, the player touches with his/her finger the touch panel 325 at the portion corresponding to the unit BET button 331. As a result, the player selects the bet amount with respect to the selected bet area 335. Once the bet amount is selected, the chip mark 333 is displayed on the bet area 335.

Figure 53:
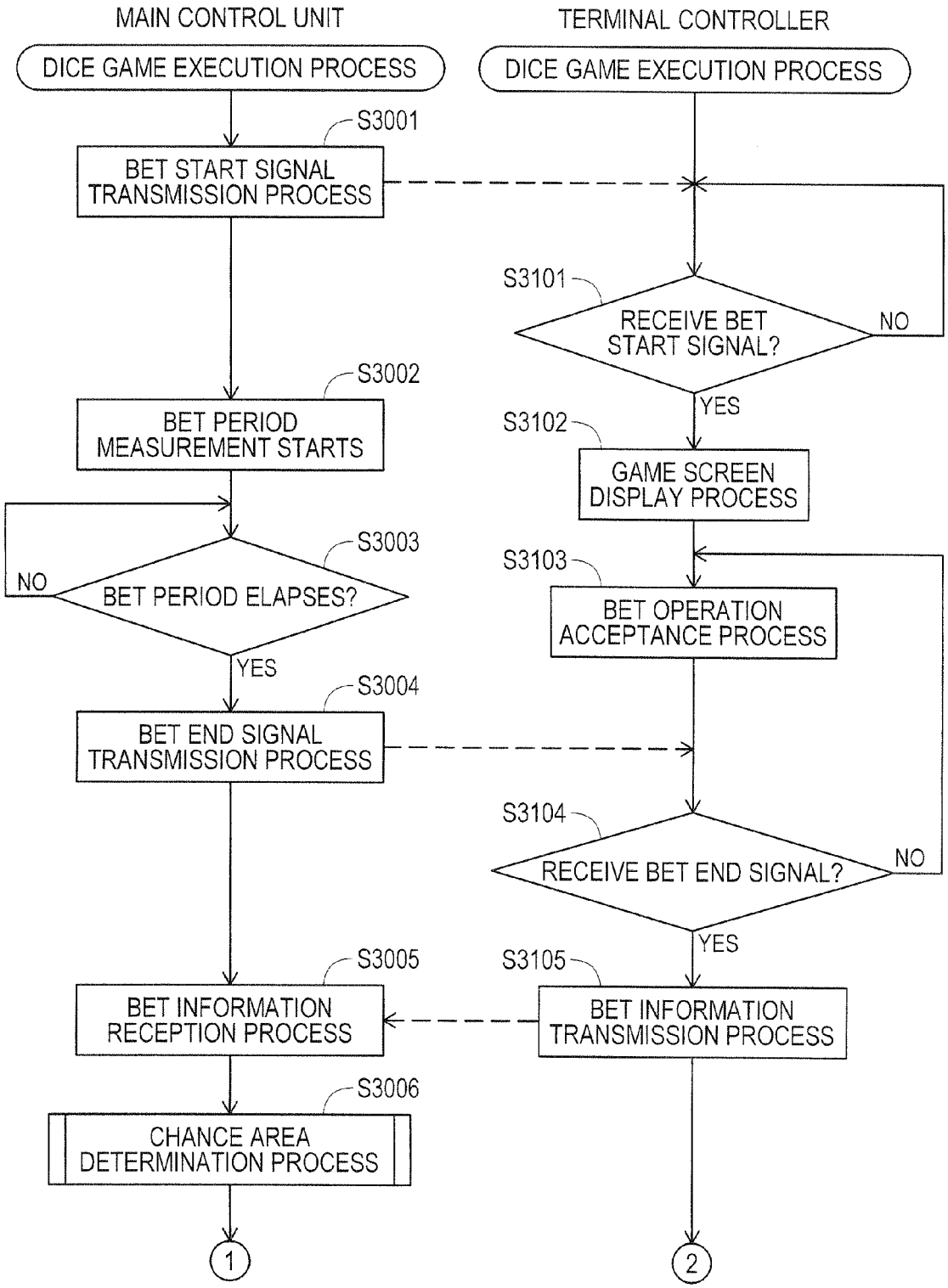
FIG. 53 is a flow chart (1) of a dice game execution process program according to the fourth embodiment of the present invention.
Figure 54:
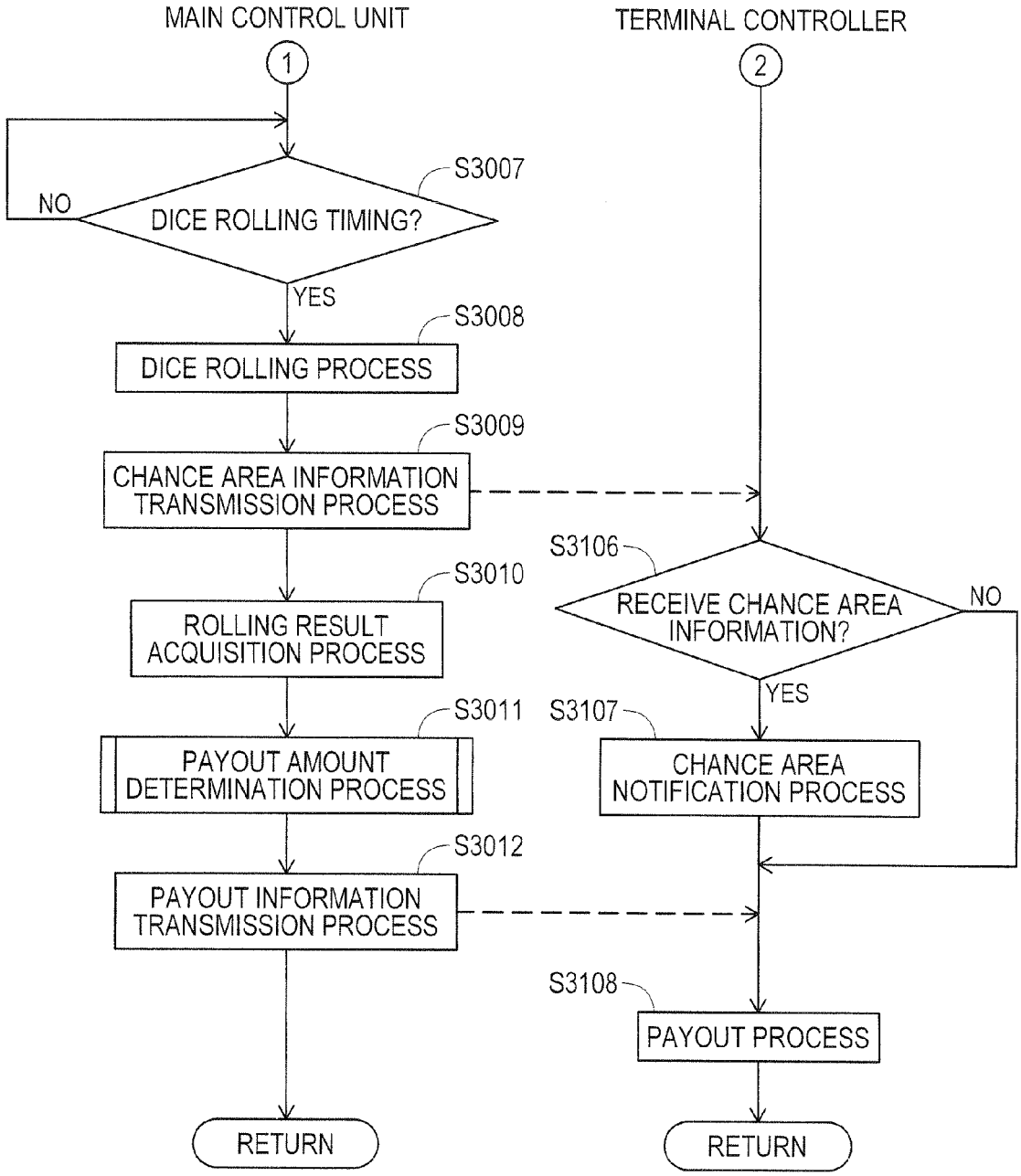
FIG. 54 is a flow chart (2) of the dice game execution process program according to the fourth embodiment of the present invention.

Next, a dice game execution process program to be executed in the dice gaming machine 301 according to the fourth embodiment will be described in detail while referring to the drawings. FIG. 53 and FIG. 54 are flow charts of the dice game execution process program.

The initial setting process executed in the main control unit 350 and the initial setting process executed in the terminal controller 370 of each terminal 305 are executed prior to the dice game execution process program. Specifically, the main control unit 350 and the terminal controller 370 end initialization of the peripheral devices and the program authentication process. These initial setting processes are heretofore known in the art. Therefore, description of the contents of such processes is hereby omitted.

First, the dice game execution process program in the main control unit 350 will be described in detail.

Once execution of the dice game execution process program is started, the CPU 351 first executes the bet start signal transmission process (S3001). In the bet start signal transmission process (S3001), the CPU 351 transmits the bet start signal to the terminals 305 through the communication interface 355. The bet start signal serves to instruct start of the bet period in the terminals 305. The bet period is the period for accepting the players' bets for the gaming values with respect to the bet areas 335 at each terminal 305. After the bet start signal is transmitted to the terminals 305, the CPU 351 shifts the process to S3002.

Once the bet start signal is received, the terminal CPU 371 executes the game screen display process (S3102) and the bet operation acceptance process (S3103). This will be described in more detail later.

After shifting to S3002, the CPU 351 starts measuring the bet period. More specifically, the CPU 351 transmits the control signal to the timer 354. As a result, the timer 354 starts measurement. After the control signal is transmitted to the timer 354, the CPU 351 shifts the process to S3003.

At S3003, the CPU 351 judges whether the bet period has lapsed. More specifically, the CPU 351 references the measurement results of the timer 354. The CPU 351 judges whether the predetermined period (e.g., bet period) has lapsed based on the measurement result of the timer 354. If the bet period has lapsed (S3003: YES), the CPU 351 shifts the process to S3004. Alternatively, if the bet period has not lapsed yet (S3003: NO), the CPU 351 puts the process in stand-by until the bet period lapses.

At S3004, the CPU 351 executes the bet end signal transmission process. In the bet end signal transmission process (S3004), the CPU 351 transmits a bet end signal to the terminals 305. The bet end signal serves to instruct ending of the bet period in each terminal 305. In other words, the bet end signal means that acceptance of bets for gaming values in the terminal 305 is ended. After the bet end signal is transmitted to each terminal 305, the CPU 351 shifts the process to S3005.

Once the bet end signal is received, the terminal CPU 371 ends the bet operation acceptance process (S3103). Accordingly, the terminal 305 ends acceptance of bets with respect to the bet area 335. Thereafter, the terminal CPU 371 transmits the bet information based on the bet operation carried out in the bet operation acceptance process (S3103) to the main control unit 350 (S3105). This bet information includes information showing the bet area 335 on which the gaming value has been bet and information showing the bet amount bet on the bet area 335 in question. The bet information includes identification information showing the terminal 305 from which the bet information is transmitted.

After shifting to S3005, the CPU 351 executes the bet information reception process. In the bet information reception process (S3005), the CPU 351 receives the bet information transmitted from each terminal 305 through the communication interface 355. The CPU 351 stores the bet information thus received in the RAM 353. At this time, the CPU 351 classifies the bet information for each terminal 305 based on the identification information included in the bet information. Once the bet information reception process (S3005) ends, the CPU 351 shifts the process to S3006.

At S3006, the CPU 351 executes a chance area determination process. In the chance area determination process (S3006), the CPU 351 first executes a chance area determination process program (refer to FIG. 55) to be described later. Next, in the chance area determination process (S3006), the CPU 351 determines a chance area 385 in the betting board 330 with respect to each terminal 305. More specifically, the CPU 351 carries out a lottery for bet area 335 constituting a part of the betting board 330 based on chance lottery tables (refer to FIG. 56 and FIG. 57). Then, based on the lottery result, the CPU 351 determines whether or not the lottery target bet area 335 coincides with a chance area 385. After storing chance area information in the RAM 353, the CPU 351 shifts the process to S3007. A piece of chance area information indicates one or more of chance areas 385 in a betting board 330 with respect to a terminal 305.

The contents of the chance area determination process will be described in detail later by referring to drawings. Accordingly, the details of the chance area determination process will be omitted here.

At S3007, the CPU 351 judges whether the dice rolling timing has arrived. The dice rolling timing shows the timing at which rolling of the three dice 340 is started in the dice rolling device 303. More specifically, at S3007, the CPU 351 first references the measurement results of the timer 354. Specifically, the CPU 351 carries out the judgment process at S3007 based on the measurement result of timer 354. When the dice rolling timing arrives (S3007: YES), the CPU 351 shifts the process to S3008. Alternatively, if the dice rolling timing has not yet arrived (S3007: NO), the CPU 351 puts the process in stand-by until such dice rolling timing arrives.

At S3008, the CPU 351 executes a dice rolling process. In this dice rolling process (S3008), the CPU 351 transmits a control signal to the dice rolling device 303. As a result, the dice rolling motor 312 is driven and controlled. Accordingly, the three dice 340 are rolled inside the dice rolling device 303. The three dice 340 which have been rolled are then stopped on the dice rolling board 311. Once the dice rolling process ends, the CPU 351 shifts the process to S3009.

After shifting to S3009, the CPU 351 executes a chance area information transmission process. In the chance area information transmission process (S3009), the CPU 351 transmits chance area information to all of the terminals 305 constituting the dice gaming machine 301. The chance area information is information indicating bet area(s) 335 determined to be chance area(s) 385 at the chance area determination process (S3006). In the case a chance area 385 is not present, the chance area information indicates absence of a chance area 385. In the chance area information transmission process (S3009), the CPU 351 first obtains every piece of chance area information stored in the RAM 353 of each terminal 305. Thereafter, the CPU 351 transmits an individual piece of chance area information to each terminal 305 through the communication interface 355. At this moment, the CPU 351 transmits chance area information to a terminal 305 which has been designated to receive the chance area information in question. Once the chance area information transmission process ends, the CPU 351 shifts the process to S3010.

At S3010, the CPU 351 executes a rolling result acquisition process. In this rolling result acquisition process (S3010), the CPU 351 acquires the rolling result information showing the spots on the stopped three dice 340, by controlling the rolling result detection device 315 of the dice rolling device 303. More specifically, the CPU 351 transmits the control signal to the dice rolling device 303. Upon receiving the control signal, the dice rolling device 303 acquires an image with an imaging device provided in the dice rolling device 303. The acquired image includes the image of the stopped three dice 340 on the dice rolling board 311. Thereafter, the dice rolling device 303 carries out a predetermined image process with respect to the acquired image by controlling the rolling result detection device 315. As a result, the dice rolling device 303 can identify the spots on the three dice 340 which are stopped on the dice rolling board 311. The dice rolling device 303 generates rolling result information showing the spots on the three dice 340 thus identified. The dice rolling device 303 then transmits the rolling result information thus generated to the CPU 351. Once the rolling result information acquired from the dice rolling device 303 is stored in the RAM 353, the CPU 351 shifts the process to S3011.

After shifting to S3011, the CPU 351 executes a payout amount determination process. In this payout amount determination process (S3011), the CPU 351 executes a payout amount determination process program (refer to FIG. 58) as will be described later. In this payout amount determination process, the CPU 351 calculates the payout amount of each terminal 305 based on the rolling result information and the bet information of each terminal 305. Here, in the case of calculating a payout amount of the chance area 385, the CPU 351 changes the payout magnification ratio used in the payout amount determination process (S3011) from "base payout magnification ratio"to "special payout magnification ratio". The contents of the payout amount determination process (S3011) will next be described in detail. Once the payout amount determination process ends, the CPU 351 shifts the process to S3012.

At S3012, the CPU 351 executes a payout information transmission process. In this payout information transmission process (S3012), the CPU 351 transmits the payout information to each terminal 305 through the communication interface 355. This payout information shows the payout amount calculated in the payout amount determination process (S3011). After transmitting the payout information to each terminal 305, the CPU 351 ends the payout information transmission process. The CPU 351 then ends the dice game execution process program in the main control unit 350.

Once execution of the dice game execution process program is ended, the CPU 351 restarts execution of the dice game execution process program. Specifically, the CPU 351 repeatedly executes the dice game execution process program while power is being supplied to the dice gaming machine 301.

Next, the dice game execution process program at each terminal 305 will be described in detail.

Upon starting the dice game execution process program, the terminal CPU 371 first judges whether the bet start signal has been received (S3101). As was described earlier, the bet start signal serves to instruct start of the bet period in the dice gaming machine 301. The bet start signal is transmitted from the main control unit 350 to each terminal 305 (S3001). If the bet start signal is received (S3101: YES), the terminal CPU 371 shifts the process to S3102. As a result, the bet period in each terminal 305 is started. Alternatively, if the bet start signal has not yet been received (S3101: NO), the terminal CPU 371 puts the process in stand-by until the bet start signal is received.

After shifting to S3102, the terminal CPU 371 executes a game screen display process. In this game screen display process (S3102), the terminal CPU 371 transmits the control signal to the liquid crystal driving circuit 374. The game screen is displayed on the liquid crystal display 308 based on the control of the liquid crystal driving circuit 374 (refer to FIG. 52). Once the game screen is displayed on the liquid crystal display 308, the terminal CPU 371 shifts the process to S3103.

At S3103, the terminal CPU 371 executes a bet operation acceptance process. In this bet operation acceptance process (S3103), the terminal CPU 371 accepts a player's operation using the touch panel 325. More specifically, the terminal CPU 371 carries out various types of controls corresponding to a player's operation based on the operation signal transmitted from the touch panel 325. Such controls include control with respect to selecting the bet area 335, control with respect to setting the bet amount corresponding to the selected bet area 335 and control corresponding to operation of the CORRECT button 336.

If the bet area 335 is selected and the bet amount with respect to the selected bet area 335 is set, the terminal CPU 371 stores the bet information in the terminal RAM 373. The bet information includes information with respect to the selected bet area 335 and information showing the bet amount of the bet area 335.

In the next step S3104, the terminal CPU 371 judges whether the bet end signal has been received. As was described earlier, the bet end signal shows the end of the bet period. Specifically, reception of the bet end signal means that acceptance of bets in the current dice game ends. The bet end signal is transmitted from the main control unit 350 (S3004). If the bet end signal is received (S3104: YES), the terminal CPU 371 shifts the process to S3105. Alternatively, if the bet end signal has not yet been received (S3104: NO), the terminal CPU 371 returns the process to the bet operation acceptance process (S3103). Thus, the player at each terminal 305 can bet a gaming value in the current game until the end of the bet period.

After shifting to S3105, the terminal CPU 371 executes a bet information transmission process. In this bet information transmission process (S3105), the terminal CPU 371 transmits the bet information stored in the terminal RAM 373 to the main control unit 350. Here, the terminal CPU 371 adds identification information showing the terminal 305 in question to the bet information. After transmitting the bet information including the identification information, the terminal CPU 371 shifts the process to S3106.

At S3106, the terminal CPU 371 judges whether the chance area information has been received. As was described earlier, the chance area information indicates a bet area 335 which has been determined to be chance area 385 at the chance area determination process (S3006). This chance area information is transmitted from the main control unit 350 to each terminal 305 through the communication interface 355 (S3009). If the chance area information is received (S3106: YES), the terminal CPU 371 shifts the process to S3107. Alternatively, if the chance area information is not received (S3106: NO), the terminal CPU 371 puts the process in stand-by until receiving the chance area information.

At S3107, the terminal CPU 371 executes the chance area notification process. In the chance area notification process (S3107), the terminal CPU 371 notifies the player of bet area(s) 335 corresponding to chance area(s) 385, through the display on the liquid crystal display 308. More specifically, the terminal CPU 371 transmits the control signal to the liquid crystal driving circuit 374. As a result, the liquid crystal display 308 displays the chance area notification image 380 on the game screen (refer to FIG. 46). Once the chance area notification process (S3107) ends, the terminal CPU 371 shifts the process to S3108.

In the chance area notification process (S3107), the terminal CPU 371 notifies the player that "which bet area(s) is/are the "chance area(s) 385 in the current game" and "win with the chance area(s) 385 will double payout at a normal time".

For instance, as shown in FIG. 46, bet areas 335 corresponding to chance areas 385 are indicated in a certain color different from a color applied to other bet areas 335 in the game screen. Furthermore, frames of the bet areas 335 corresponding to the chance areas 385 are indicated more boldly than those of other bet areas 335 (refer to FIG. 46). It is to be noted that "other bet areas 335" here means bet areas 335 which do not correspond to chance areas 385. Accordingly, the player can easily grasp which one(s) is/are chance area(s) 385 in a current dice game by observing the liquid crystal display 308. As a result, the dice gaming machine 301 can increase the sense of expectancy of the player with respect to payout for a winning chance area 385.

The chance area notification image 380 includes indication that "normal magnification ratio of each of the bet areas 335 corresponding to chance areas 385 will be multiplied by special magnification ratio (i.e., ×2)". That is, the chance area notification image 380 notifies the player that payout magnification ratio to be used for calculating payout has been changed from "normal payout magnification ratio" to "special payout magnification ratio". Accordingly, the player can understand that payout for the chance areas 385 will be larger payout by looking at the chance area notification image 380. As a result, the dice gaming machine 301 can increase the sense of expectancy of the player with respect to a larger payout.

After shifting to S3108, the terminal CPU 371 executes a payout process. In this payout process (S3108), the terminal CPU 371 awards to the player a payout in the current dice game based on the payout information. As was described earlier, the payout information is transmitted from the main control unit 350 to each terminal 305 (S3012). The payout information shows the payout amount calculated in the payout amount determination process (S3011). Accordingly, the terminal CPU 371 adds the payout amount calculated in the payout amount determination process (S3011) to the credit amount possessed by the player. The payout amount can also be awarded in the form of medals which are paid out from the cash out port 309. Once the payout process ends, the terminal CPU 371 ends the dice game execution process program in the terminal 305.

Once execution of the dice game execution process program ends, the terminal CPU 371 restarts execution of the dice game execution process program. Specifically, the terminal CPU 371 can repeatedly execute the dice game execution process program while power is being supplied to the dice gaming machine 301.

Figure 55:
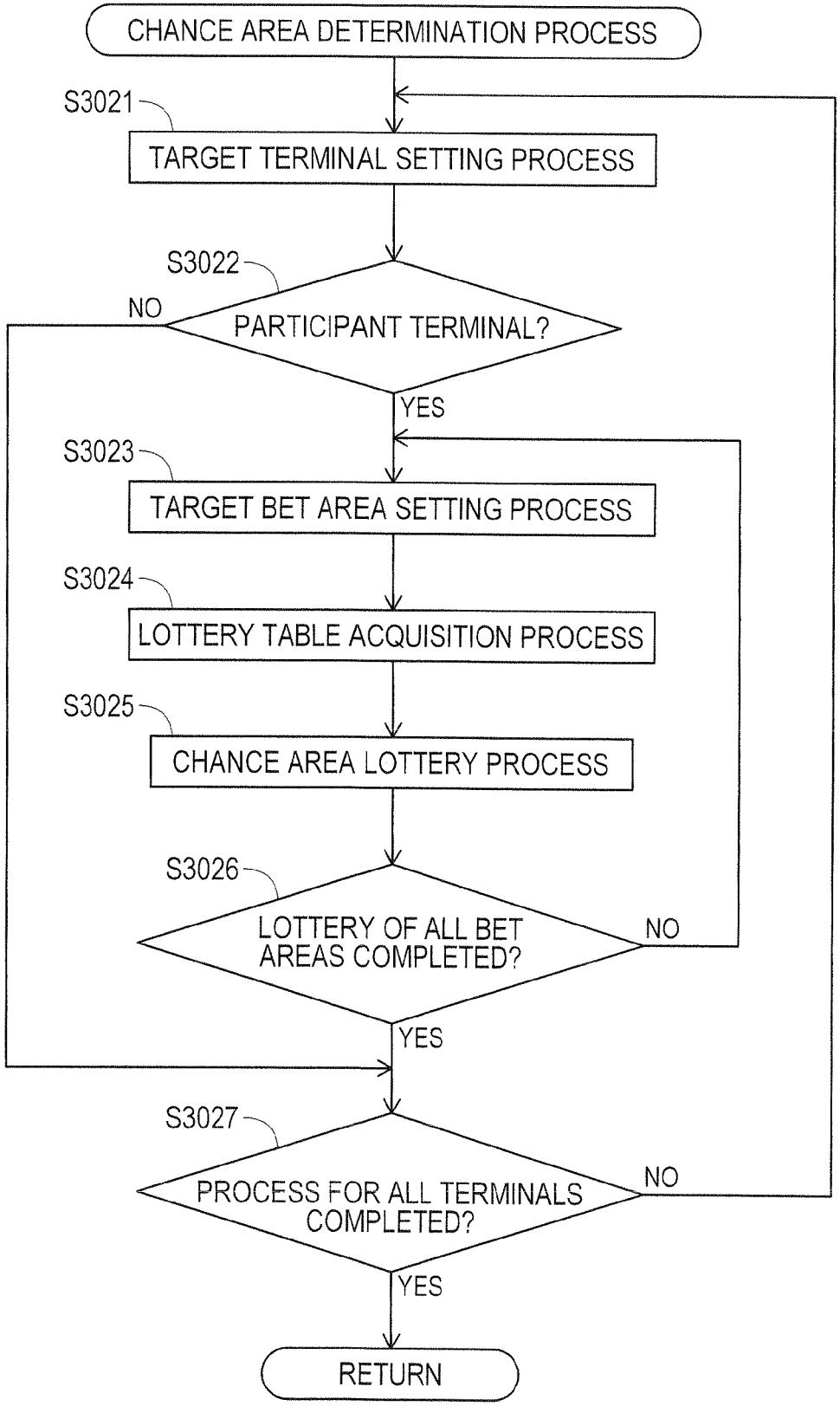
FIG. 55 is a flow chart of a chance area determination process according to the fourth embodiment of the present invention.

Next. There will be described on a chance area determination process program to be executed by the CPU 351 at the chance area determination process (S3006) by referring to drawings. FIG. 55 is a flow chart of the chance area determination process program.

In the dice game execution process program of the main control unit 350, the CPU 351 executes a target terminal setting process (S3021) upon shifting the process to the chance area determination process (S3006). In the target terminal setting process (S3021), the CPU 351 sets one of all the terminals 305 constituting the dice gaming machine 301 to a target terminal. Here, a "target terminal" refers to a terminal 305 which is subject to process for determining chance area (s) 385. Once the target terminal setting process (S3021) ends, the CPU 351 shifts the process to S3022.

After shifting to S3022, the CPU 351 judges whether or not the target terminal is a participant terminal. Here, a participant terminal corresponds to a terminal 305 which participates in a current dice game. That is, a participant terminal refers to a terminal 305 which has placed a bet on a bet area 335 in a current dice game. More specifically, at S3022, the CPU 351 judges whether the target terminal is a participant terminal or not based on bet information received at the bet information reception process (S3005). In the case the target terminal is a participant terminal (S3022: YES), the CPU 351 shifts the process to S3023. Alternatively, in the case the target terminal is not a participant terminal (S3022: NO), the CPU 351 shifts the process to S3027. In this case, the CPU 351 associates the target terminal with chance area information indicating absence of a chance area 385 and stores the chance area information in the RAM 353. Accordingly, a chance area 385 is not included in the betting board 330 of the target terminal which is not a participant terminal.

In S3023, the CPU 351 executes a target bet area setting process. In the target bet area setting process (S3023), the CPU 351 selects a bet area 335 from among all the bet areas 335 constituting the betting board 330 of the target terminal. Then, the CPU 351 sets the thus selected bet area 335 as a target bet area. Here, a "target bet area" refers to a bet area 335 which is subject to a series of processes (S3023 through S3025) for judging whether to coincide with a chance area 385. Once the target bet area setting process (S3023) ends, the CPU 351 shifts the process to S3024.

In S3024, the CPU 351 executes a lottery table acquisition process. In the lottery table acquisition process (S3024), the CPU 351 reads out a chance lottery table with respect to the target bet area from among chance lottery tables of respective bet areas stored in the ROM 352. For instance, an any triple bet area 335E is the target bet area, the CPU 351 reads out a chance lottery table as shown in FIG. 57 from the ROM 352. Once the lottery table acquisition process (S3024) ends, the CPU 351 shifts the process to S3025.

Shifting to S3025, the CPU 351 executes a chance area lottery process. In the chance area lottery process (S3025), a lottery based on the readout chance lottery table is carried out so as to determine whether the target bet area corresponds to a chance area 385. More specifically, the CPU 351 first executes a lottery program to extract a random number value from a predetermined random number value range. Thereafter, the CPU 351 determines a lottery result based on the extracted random number value and the chance lottery table (e.g., refer to FIG. 56 and FIG. 57) read out at the lottery table acquisition process (S3024). In the case it is "lottery result: win", the target bet area in question is determined to be a chance area 385. Alternatively, in the case it is "lottery result: lose", the target bet area in question is determined to be a bet area 335 which does not corresponds to a chance area 385. After that, the CPU 351 creates lottery result information based on the thus determined lottery result. At this time, the CPU 351 adds identification information of the target terminal to the lottery result information. The lottery result information constitutes the earlier-mentioned chance area information. After storing the lottery result information in the RAM 353, the CPU 351 shifts the process to S3026.

In S3026, the CPU 351 judges whether the chance area lottery process (S3025) has been made with respect to all the bet areas 335 constituting the betting board 330 of the target terminal. More specifically, the CPU 351 executes the judgment process of S3026 based on the lottery result information stored in the RAM 353 with respect to the target terminal. In the case the chance area lottery process has been made with respect to all the bet areas 335 (S3026: YES), the CPU 351 shifts the process to S3027. At this time, the CPU 351 creates chance area information of the target terminal based on all of the lottery result information with respect to the target terminal. Accordingly, the chance area information indicates all the chance area(s) 385 included in the betting board 330 of the target terminal. Then, the CPU 351 adds identification information of the target terminal to the chance area information. After that, the CPU 351 stores the resultant chance area information in the RAM 353.

Alternatively, in the case the chance area lottery process has not been made with respect to all the bet areas 335 (S3026: NO), the CPU 351 returns the process to the target bet area setting process (S3023). In this case, at the latest target bet area setting process (S3023), the CPU 351 sets another bet area 335 of which lottery result has not been stored as a new target bet area. Thereby, the CPU 351 executes the chance area lottery process (S3025) with respect to the new target bet area.

In S3027, the CPU 351 judges whether or not a series of processes (S3022 through S3026) concerning determination of chance area(s) 385 has been made with respect to all of the terminals 305 constituting the dice gaming machine 301. More specifically, the CPU 351 executes the judgment process of S3027 based on chance area information stored in the RAM 353. In the case the series of judgment processes has been made with respect to all of the terminals 305 (S3027: YES), the CPU 351 ends the chance area determination process program.

Alternatively, in the case the series of judgment processes has not been made with respect to all of the terminals 305 (S3027: NO), the CPU 351 returns the process to the target terminal setting process (S3021). In this case, the CPU 351 sets another terminal 305 of which chance area information has not been stored as a new target terminal. Thereby, the CPU 351 executes the series of processes (S3022 through S3026) concerning determination of chance area(s) 385 with respect to the new target terminal.

Next, there will be described on chance lottery tables used at the chance area determination process (S3006) by referring to drawings. FIG. 56 and FIG. 57 are exemplary diagrams of chance lottery tables.

As described earlier, a chance lottery table for each of all the bet areas 335 constituting the betting board 330 is stored in the ROM 352. Each chance lottery table is used when the chance area lottery process (S3023) is executed for a bet area 335 associated with the chance lottery table. Each chance lottery table is defined so as to make a winning probability of the associated bet area 335 proper for its chance lottery process. More specifically, each chance lottery table indicates a winning probability which satisfies conditions to be described later (namely, a first condition and a second condition).

Hereinafter, a bet area 335 associated with a certain chance lottery table will be termed as a "corresponding bet area".

The first condition concerning a winning probability of each chance lottery table is that "an expected value to win a payout for a corresponding bet area is equal to or larger than a predetermined reference expected value (0.975 in the fourth embodiment)". A chance lottery table is configured to define a winning probability which satisfies the first condition so that the dice gaming machine 301 can increase the sense of expectancy of the player with respect to a larger payout with the corresponding bet area.

As was earlier described, in the case a certain bet area 335 coincides with a chance area 385, the dice gaming machine 301 awards payout for said bet area 335 which has been calculated by using the "special payout magnification ratio". Alternatively, in the case a certain bet area 335 does not coincides with a chance area 385, the dice gaming machine 301 awards payout for said bet area 335 which has been calculated by using the "base payout magnification ratio". That is, when payout is awarded for a certain bet area 335, there are classified into two payout awarding patterns: awarding a payout calculated based on the special payout magnification ratio; and awarding payout calculated based on the base payout magnification ratio. Accordingly, "an expected value to win a payout for a corresponding bet area" directed to the first condition is calculated by summing up "an expected value concerning acquisition of payout based on special payout magnification ratio with respect to a corresponding bet area" and "an expected value concerning acquisition of payout based on base payout magnification ratio with respect to a corresponding bet area".

The "expected value concerning acquisition of payout based on special payout magnification ratio with respect to a corresponding bet area" is obtained by multiplying the following three multiplication factors: "a probability to acquire payout based on special payout magnification ratio with respect to a corresponding bet area"; "unit gaming value (i.e., 1 credit); and "special payout magnification ratio with respect to the corresponding bet area". The "probability to acquire payout based on special payout magnification ratio with respect to a corresponding bet area" is a probability to satisfy the following two conditions: satisfying a winning condition with respect to the corresponding bet area; and winning in a chance area lottery process (S3025) with respect to the corresponding bet area. That is, the "probability to acquire payout based on special payout magnification ratio with respect to a corresponding bet area" corresponds to a lottery winning probability with a chance lottery table directed to the corresponding bet area. It is to be noted that "special payout magnification ratio with respect to a corresponding bet area" is obtained by multiplying "base payout magnification ratio with respect to a corresponding bet area" by "special magnification ratio".

The "expected value concerning acquisition of payout based on base payout magnification ratio with respect to a corresponding bet area" is obtained by multiplying the following three multiplication factors: "a probability to acquire payout based on base payout magnification ratio with respect to a corresponding bet area"; "unit gaming value (i.e., 1 credit); and "base payout magnification ratio with respect to the corresponding bet area". The "probability to acquire payout based on base payout magnification ratio with respect to a corresponding bet area" is a probability to satisfy the following two conditions: satisfying a winning condition with respect to the corresponding bet area; and losing in a chance area lottery process (S3025) with respect to the corresponding bet area. That is, the "probability to acquire payout based on base payout magnification ratio with respect to a corresponding bet area" is obtained by subtracting "probability to acquire payout based on special payout magnification ratio with respect to a corresponding bet area" from "probability to satisfy a winning condition with respect to the corresponding bet area". It is to be noted that the "probability to satisfy a winning condition with respect to the corresponding bet area" is obtained by dividing "the number of combinations of spots on the stopped three dice 340 satisfying a winning condition of a corresponding bet area" by "the number of all the combinations of spots on the stopped three dice 340".

Accordingly, among the numerical values used for calculating an "expected value concerning acquisition of payout with respect to a corresponding bet area", only the numerical value directed to a "probability to acquire payout based on special magnification ratio with respect to a corresponding bet area" is an uncalculable value. The above-mentioned reference expected value is a calculable one. Accordingly, a "chance-lottery-table-based winning probability" for satisfying the first condition can be calculated by using the above-mentioned numerical values.

The second condition concerning an each-chance-lottery-table-based winning probability corresponds to a condition that "an expected value concerning acquisition of payout with respect to a corresponding bet area is smaller than 1". By defining a chance lottery table which indicates a lottery winning probability to satisfy the second condition, the dice gaming machine 301 can secure profit of a game arcade and the like which install the dice gaming machine 301.

As was described earlier, among the numerical values used for calculating an "expected value concerning acquisition of payout with respect to a corresponding bet area", only the numerical value directed to a "probability to acquire payout based on special magnification ratio with respect to a corresponding bet area" is an uncalculable one. Accordingly, a "chance-lottery-table-based winning probability" which satisfies the second condition can be calculated by using the above-mentioned various numerical values appropriately.

A numerical range for chance-lottery-table-based winning probability with reference to a corresponding bet area is fixed by a "lottery winning probability referenced with a chance-lottery-table-based winning probability" which satisfies both the first condition and the second condition. Accordingly, by using a winning probability within the numerical range, the chance-lottery-table-based winning probability with respect to a corresponding bet area satisfies the first condition and the second condition.

There will be described on a specific example of a chance lottery table which satisfies both the first condition and the second condition. FIG. 56 is an exemplary diagram showing one example of a chance lottery table with respect to a total bet area 335F directed to a total numerical value of "4".

As was described earlier, among the numerical values used for calculating an "expected value concerning acquisition of payout with respect to a corresponding bet area", only the numerical value directed to a "probability to acquire payout based on special magnification ratio with respect to a corresponding bet area" is an uncalculable one. As was described earlier, the base payout magnification ratio of the total bet area 335F for the total numerical value of "4" is "1:60". That is, in the case 1 credit is bet on the total bet area 335F, payout corresponding to 61 credits will be awarded in return for winning thereat. In other words, the base payout magnification ratio of the total bet area 335F is 61 times. Furthermore, "special payout magnification ratio" is calculated by multiplying the "base payout magnification ratio" by the "special payout magnification ratio (e.g., ×2)". Accordingly, the special payout magnification ratio of the total bet area 335F turns to be 122 times. Furthermore, a probability to satisfy the winning condition of the total bet area 335F for the total value of "4" is "3/216".

By using those numerical values, namely, the "reference expected value (i.e., 0.975)" and "1", there can be calculated a numerical range for a chance-lottery-table-based winning probability directed to the total bet area 335F that satisfies both the first condition and second condition. In the case calculation is based on the above-mentioned conditions, a winning probability to coincide with the total value "4" directed to the total bet area 35 is same as or larger than 0.21. Moreover, if the probability is smaller than 0.25%, it is regarded that both the first condition and the second condition are satisfied.

According to the chance lottery table shown in FIG. 56, "chance lottery result: win" is associated with a "random number value range between 0 and 4". Furthermore, "chance lottery result: lose" is associated with a "random number value range between 5 and 2047". Accordingly, the chance-lottery-table-based winning probability shown in FIG. 56 is "5/2048 (i.e., approximately 0.244%). Therefore, it is regarded that the chance lottery table of the total bet area 335F for the total value of "4" (refer to FIG. 56) corresponds to a lottery winning probability which satisfies both the first condition and the second condition with respect to the total bet area 335F.

Next, there will be described on a specific example of a chance lottery table with respect to an any triple bet area 335E shown in FIG. 57 in detail while referring to drawings.

As was earlier described, the base payout magnification ratio of the any triple bet area 335E is "1:30". That is, the base payout magnification ratio of the any triple bet area 335E is 31 times. Furthermore, the special payout magnification ratio of the any triple bet area 335E is 62 times. Furthermore, the probability to satisfy the winning condition of the any triple bet area 332 is "6/216".

By using those numerical values, the "reference expected value (i.e., 0.975)" and "1", there can be calculated a numerical range for a chance-lottery-table-based winning probability directed to the total bet area 335E that satisfies both the first condition and second condition. In the case calculation is based on the above-mentioned conditions, a winning probability to coincide with the condition of the total bet area 335E is same as or larger than 0.37. Moreover, if the probability is smaller than 0.44%, it is regarded that both the first condition and the second condition are satisfied.

According to the chance lottery table shown in FIG. 57, "chance lottery result: win" is associated with a "random number value range between 0 and 7". Furthermore, "chance lottery result: lose" is associated with a "random number value range between 8 and 2047". Accordingly, the chance-lottery-table-based winning probability shown in FIG. 57 is "8/2048 (i.e., approximately 0.39%). Therefore, it is regarded that the chance lottery table of the total bet area 335E (refer to FIG. 57) corresponds to a lottery winning probability which satisfies both the first condition and the second condition with respect to the total bet area 335E.

Each chance lottery table stored in the ROM 352 indicates a lottery winning probability which satisfies both the first condition and the second condition. Accordingly, the dice gaming machine 301 can increase the sense of expectancy of the player with respect to a larger payout. Furthermore, the dice gaming machine 301 can secure profit of a game arcade which installs the dice gaming machine 301.

Figure 58:
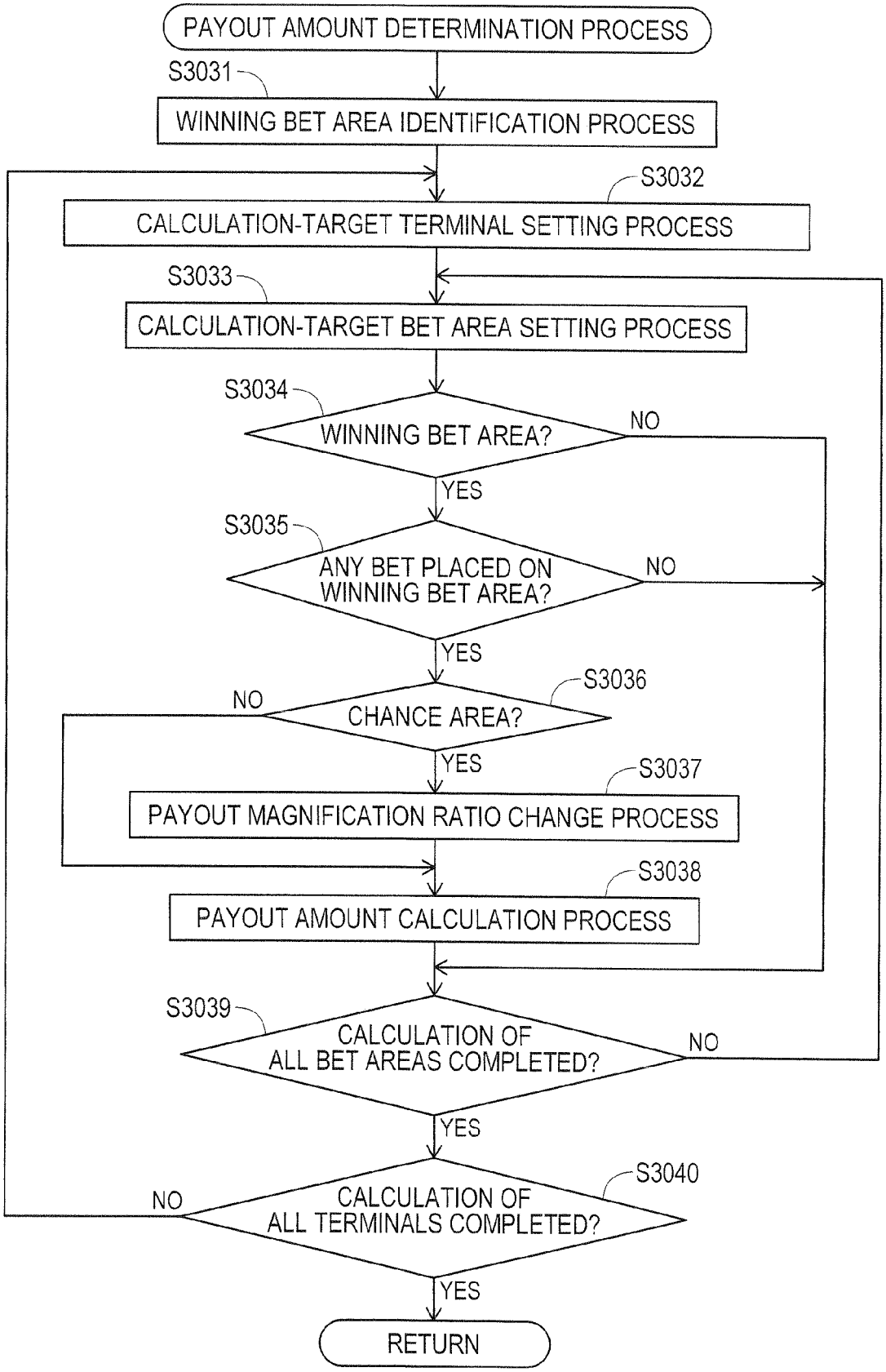
FIG. 58 is a flow chart of a payout amount determination process program according to the fourth embodiment of the present invention.

Next, the payout amount determination process program to be executed by the CPU 351 in the payout amount determination process (S3011) will be described in detail while referring to the drawings. FIG. 58 is a flow chart of the payout amount determination process program.

In the dice game execution process program of the main control unit 350, after shifting to the payout amount determination process (S3011), the CPU 351 executes a winning bet area identification process (S3031). In the winning bet area identification process (S3031), the CPU 351 identifies the winning bet area based on the rolling result information and the winning condition set for each bet area 335. The winning bet area is the bet area 335 whose specified winning condition is satisfied by the spots on the stopped dice 340. As was described earlier, the rolling result information shows the spots on the three stopped dice 340 which have been identified by the rolling result detection unit 315. Accordingly, the CPU 351 identifies the winning bet area based on the rolling result information and the winning condition of each bet area 335. After identifying the winning bet area, the CPU 351 shifts the process to S3032.

In S3032, the CPU 351 executes a calculation-target-terminal setting process. In the calculation-target-terminal setting process (S3032), the CPU 351 selects a terminal 305 among from all the terminals 305 constituting the dice gaming machine 301. After that, the CPU 351 sets the thus selected terminal 305 as a calculation target terminal. Accordingly, the CPU 351 calculates payout amount of the calculation target terminal in a current game by executing a series of processes S3033 through S3039 to be described later. Once the calculation-target-terminal setting process (S3032), the CPU 351 shifts the process to S3033.

In S3033, the CPU 351 executes a calculation-target-bet-area setting process. In the calculation-target-bet-area setting process (S3033), the CPU 351 selects a bet area 335 among from all the bet areas 335 constituting the betting board 330 with respect to the calculation target terminal. After that, the CPU 351 sets the thus selected bet area 335 as a calculation target bet area. Accordingly, the CPU 351 calculates the payout amount of the calculation target bet area by executing a series of processes S3034 through S3038 to be described later. Once the calculation-target-bet-area setting process (S3033) ends, the CPU 351 shifts the process to S3034.

At S3034, the CPU 351 judges whether the calculation target bet area coincides with a winning bet area. More specifically, the CPU 351 executes the judgment process of S3034 based on a processing result at the winning bet area identification process (S3031) and the processing contents at calculation-target-bet-area setting process (S3033). In the case the calculation target bet area coincides with a winning bet area (S3034: YES), the CPU 351 shifts the process to S3035. Alternatively, in the case the calculation target bet area does not coincide with a winning bet area (S3034: NO), the CPU 351 shifts the process to S3039.

A case that a calculation target bet area does not coincide with a winning bet area means that a rolling result does not satisfy a winning condition of the calculation target bet area. Accordingly, in this case, the CPU 351 sets payout amount of the calculation target bet area to "0". Thereafter, the CPU 351 stores payout information indicating "payout amount: 0" in the RAM 353.

After shifting to S3035, the CPU 351 judges whether or not there is a winning bet on the calculation target bet area. The winning bet refers to the gaming values bet on the winning bet area identified in the winning bet area identification process (S3031). More specifically, the CPU 351 carries out the judgment process at S3035 based on the bet information of the calculation target terminal stored in the RAM 353. If a winning bet has been made (S3035: YES), the CPU 351 shifts the process to S3034. Alternatively, if no winning bet has been made (S3035: NO), the CPU 351 shifts the process to S3039.

A case that no winning bet has been made means a case that the calculation target terminal has not bet on a calculation target bet area. As was earlier described, the calculation target bet area at S3035 should be a winning bet area. Accordingly, in this case, the CPU 351 sets payout amount of the calculation target bet area with respect to the calculation target terminal to "0". After that, the CPU 351 stores payout information indicating "payout: 0", in the RAM 353.

At S3036, the CPU 351 judges whether or not the calculation target bet area coincides with a chance area 385. More specifically, the CPU 351 carries out the judgment process at S3036 based on the chance area information of the calculation target terminal stored in the RAM 353 and setting contents at the calculation target bet area setting process. In the case the calculation target bet area coincides with the chance area 385 (S3036: YES), the CPU 351 shifts the process to a payout magnification ratio change process (S3037). Alternatively, in the case the calculation target bet area terminal does not coincide with the chance area 385 (S3036: NO), the CPU 351 shifts the process to S3038.

At S3037, the CPU 351 executes the payout magnification ratio change process. In the payout magnification ratio change process (S3037), the CPU 351 changes the payout magnification ratio of the calculation target bet area. More specifically, the CPU 351 multiplies the base payout magnification ratio of the calculation target area by the special magnification ratio (i.e., ×2). As a result, the payout magnification ratio of the calculation target area is changed from "base payout magnification ratio" to "special payout magnification ratio". After the payout magnification ratio of the calculation target bet area is changed to the "special payout magnification ratio", the CPU 351 shifts the process to S3038.

After shifting to S3038, the CPU 351 executes a payout amount calculation process. In this payout amount calculation process (S3038), the CPU 351 calculates the payout amount with respect to the calculation target bet area of the calculation target terminal. More specifically, the CPU 351 calculates the payout amount of the calculation target bet area by executing the following processes.

In the case the calculation target bet area coincides with a chance area 385, the CPU 351 calculates the payout amount with respect to the calculation target bet area of the calculation target terminal by using the "special magnification ratio". More specifically, the CPU 351 multiplies the "special payout magnification ratio" of the calculation target bet area directed to the calculation target terminal by the bet amount bet on the calculation target bet area. Alternatively, in the case the calculation target bet area does not coincide with a chance area 385, the CPU 351 calculates the payout amount related to the calculation target bet area of the calculation target terminal by using the "base payout magnification ratio". More specifically, the CPU 351 multiplies the "base payout magnification ratio" of the calculation target bet area by the bet amount bet on the target calculation bet area directed to the calculation target terminal. Then, the CPU 351 stores information concerning payout amount of the calculation target bet area (termed as payout amount information hereinafter) in the RAM 353. At this time, the CPU 351 adds identification information of the calculation target terminal to the payout amount information. The payout amount information constitutes payout information of the calculation target terminal. After storing the payout amount information of the calculation target bet area in the RAM 353, the CPU 351 shifts the process to S3039.

In S3039, the CPU 351 judges whether or not a series of payout amount calculation processes (S3034 through S3038) has been finished with respect to all the bet areas 335 constituting the betting board 330 of the calculation target terminal. More specifically, the CPU 351 carries out the judgment processes of S3039 based on the payout amount information of the calculation target terminal stored in the RAM 353. In the case the series of payout amount calculation processes has been finished with respect to all the bet areas 335 (S3039: YES), the CPU 351 shifts the process to S3040. At this time, the CPU 351 makes up payout information by summing up all the payout amounts indicated as payout amount information with respect to the calculation target terminal. Accordingly, the payout information indicates total payout amount to be awarded to the calculation target terminal in the current game. Thereafter, the CPU 351 adds identification information of the calculation target terminal to the payout information. After that, the CPU 351 stores the payout information in the RAM 353.

Alternatively, in the case the series of payout amount calculation processes has not been finished with respect to all the bet areas 335 (S3039: NO), the CPU 351 returns the process to the calculation-target-bet-area setting process (S3033). In this case, at the calculation-target-bet-area setting process (S3033), the CPU 351 sets a bet area of which payout amount has not been calculated as a new calculation target bet area. Thereby, the CPU 351 executes the series of payout amount calculation processes (S3034 through S3038) with respect to the new calculation target bet area.

After shifting to S3040, the CPU 351 judges whether or not a series of payout amount calculation processes for a terminal (S3033 through S3039) has been finished with respect to all the terminals 305 constituting the dice gaming machine 301. More specifically, the CPU 351 carries out the judgment process of S3040 based on plural pieces of payout information stored in the RAM 353. In the case the series of payout amount calculation process has been finished with respect to all the terminals 305 (S3040: YES), the CPU 351 ends the payout amount determination process program. As shown in FIG. 54, once the payout amount determination process (S3011) ends, the CPU 351 shifts the process to payout information transmission process (S3012).

Alternatively, in the case the series of payout amount calculation process has not been finished with respect to all the terminals 305 (S3040: NO), the CPU 351 returns the process to the calculation-target-terminal setting process (S3032). In this case, at the calculation-target-terminal setting process (S3032), the CPU 351 sets a terminal 305 in which payout information has not been stored, as a new calculation target terminal. Thereby, the CPU 351 newly executes the series of payout amount calculation processes (S3033 through S3039) with respect to the new calculation target terminal.

As was described earlier, in the payout information transmission process (S3012), the CPU 351 transmits the payout information showing the payout amount thus calculated, from the main control unit 350 to each terminal 305. In each terminal 305, the terminal CPU 371 executes the payout process (S3107) based on the payout information thus received.

In the case there is awarded payout for a winning bet area 335 which does not correspond to a chance area 385, the player can win a payout amount which is equal to a product of the number of bets placed on the chance area 385 and "base payout magnification ratio" of the chance area 385. Alternatively in the case there is awarded payout for the winning chance area 385, the player can win a payout amount which is equal to a product of the number of bets placed on the chance area 385 and "special payout magnification ratio" defined for the chance area 385. The "special payout magnification ratio" is obtained by multiplying the "base payout magnification ratio" by the "special magnification ratio (i.e., ×2)". Accordingly, in the case the player wins payout for the chance area 385, he/she can be awarded a larger payout amount as compared to the case of win with a bet area 335 which does not corresponds to a chance area 385.

As was described earlier, after finishing acceptance of bet of gaming values on any bet areas 335, the dice gaming machine 301 according to the fourth embodiment executes a chance area determination process (S3006). At the chance area determination process (S3006), the dice gaming machine 301 determines a chance area 385 for each terminal 305. More specifically, the dice gaming machine 301 determines the chance area 385 by executing a lottery based on a chance lottery table previously set for each bet area 335 constituting a part of the betting board 330. Accordingly, the dice gaming machine 301 can diversify identification of a chance area 385 of each terminal 305.

When awarding payout for the winning bet area, the dice gaming machine 301 changes to-be-awarded payout amount based on whether or not the winning bet area corresponds to a chance area 385. More specifically, in the case the winning bet area corresponds to a chance area 385, the dice gaming machine 301 calculates payout amount of the winning bet area by multiplying bet amount bet on the winning bet area by the special payout magnification ratio (S3037 and S3038).

Alternatively, in the case the winning bet area does not correspond to a chance area 385, the dice gaming machine 301 calculates payout amount of the winning bet area which does not coincides with the chance area 385 by multiplying bet amount bet on the winning bet area by the base payout magnification ratio (S3038). The "special payout magnification ratio" is obtained by multiplying the "base payout magnification ratio" by the "special magnification ratio (i.e., ×2)".

Thereafter, the player acquires payout amount calculated at the payout amount calculation process (S3038) as a prize for the current game. That is, payout for the winning chance area 385 is awarded, the player who has won with bet on the chance area 385 can acquire larger amount of payout. As a result, the dice gaming machine 301 can meet players' desire to win larger amount of payout.

Furthermore, at the chance area determination process (S3006), the dice gaming machine 301 executes a lottery using a chance lottery table (refer to FIG. 56 and FIG. 57). Each chance lottery table indicates a winning probability to satisfy the above mentioned first condition and second condition. Accordingly, the dice gaming machine 301 can increase the sense of expectancy of the player with respect to a larger payout. Even in a case of giving a chance to win large payout with a chance area 385, the dice gaming machine 301 can secure the possibility to gain profit by running the dice game. That is, the dice gaming machine 301 can secure sufficient profit of a game arcade which installs the dice gaming machine 301.

Furthermore, the dice gaming machine 301 indicates a chance area 385 distinctively from other bet areas 335 in the liquid crystal display 308 (refer to FIG. 46). Furthermore, the dice gaming machine 301 also displays the chance area notification image 380 in the liquid crystal display 308 (S3107). Accordingly, the player can understand that presence of a chance area 385 and a chance to win larger payout by looking at indication of the chance area 385 and the chance area notification image 380 on the game screen. As a result, the dice gaming machine 301 can increase the sense of expectancy of the player with respect to a larger payout.

The present invention is not limited to the fourth embodiments described above, but various improvements and modifications can be made thereto without departing from the spirit of the present invention. For instance, plural types of special magnification ratios (e.g., "×2", "×4", "×8" "×10", and the like) can be used. Such plural types of special magnification ratios may be applied simultaneously in a single dice game. Alternatively, type of special magnification ratio may be changed every dice game. In the case of changing special magnification ratio every game, it is preferable that the RAM 352 stores a plurality of chance lottery tables reflecting applicable special magnification ratios with respect to each bet area 335. Furthermore, types of special magnification ratios are not limited to the above-mentioned examples. Various numerical values can be used as special magnification ratios as long as larger payout amount can be awarded to the player.

In the payout magnification ratio change process (S3037) described in the fourth embodiments, the CPU 351 changes the payout magnification ratio of each bet area 335 by multiplying the base payout magnification ratio by the special magnification ratio. Multiplying the base payout magnification ratio by the special magnification ratio is not limited to the payout magnification ratio change process (S3037). Specifically, the special payout magnification ratio obtained by multiplying the base payout magnification ratio by the special magnification ratio can be stored in advance in a memory. In this case, in the payout magnification ratio change process (S3037), the CPU 351 reads out the special payout magnification ratio from the memory and changes the "base payout magnification ratio" in each bet area 335 to the corresponding "special payout magnification ratio". The dice gaming machine 301 can thus reduce the processing burden with respect to the payout magnification ratio change process (S3037).

The present invention can also be realized as a gaming method for executing the above-described processes. Further, the present invention can also be realized as a program for causing a computer to execute such gaming method, and a recording medium onto which such program is recorded.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A dice gaming machine comprising:

a dice box in which a plurality of dice are rolled and stopped;

a plurality of terminals each of which has a betting board having a plurality of bet areas each associated with a dice-winning condition based on spots on any of the plurality of dice stopped and a payout magnification ratio previously determined, and accepts an input by a player; and a processor executing processes to:

for each of the plurality of terminals:

(a) accept a bet of a gaming value on any of the plurality of bet areas of the terminal;

(b) when acceptance of the bet of the gaming value ends, carry out a lottery for each of the plurality of the bet areas making up the betting board of the terminal, each of the bet areas being associated with a lottery winning probability previously determined;

(c) determine which one of the plurality of bet areas won in the lottery based on the lottery winning probabilities associated with the plurality of the bet areas;

(d) change the payout magnification ratio of the determined bet area which won in the lottery with respect to the terminal;

(e) roll and stop the plurality of dice for the terminal;

(f) identify any of the bet areas which satisfies the dice-winning condition based on spots on the plurality of dice stopped; and (g) award a prize based on an amount of the gaming value bet at each bet area identified at the process (f) and the payout magnification ratio associated with each bet area identified at the process (f).

2. The dice gaming machine according to claim 1, wherein, when the process (d) is executed by the processor, the processor further executes a process to multiply the payout magnification ratio of the determined bet area which won in the lottery by a multiplier previously determined so that the payout magnification ratio of the determined bet area is changed to a special magnification ratio previously determined.

3. The dice gaming machine according to claim 1, wherein, for each of the plurality of the bet areas subject to the lottery for each of the plurality of terminals, the lottery winning probability associated with that bet area satisfies both conditions as follows:

(1) a sum of a first value and a second value is equal to or larger than a predetermined reference value, the first value being a product of: (a) the lottery winning probability previously determined associated with the bet area, (b) an amount of one unit of gaming value, and (c) the payout magnification ratio associated with the bet area if changed, and the second value being a product of: (a) a probability resulting from the subtraction of the lottery winning probability previously determined associated with the bet area from a winning probability to satisfy the dice-winning condition associated with the bet area, (b) the amount of one unit of gaming value, and (c) the payout magnification ratio associated with the bet area as previously determined before being changed; and (2) the sum of the first value and the second value is smaller than 1.

4. The dice gaming machine according to claim 2, wherein, for each of the plurality of the bet areas subject to the lottery for each of the plurality of terminals, the lottery winning probability associated with that bet area satisfies both conditions as follows:

(1) a sum of a first value and a second value is equal to or larger than a predetermined reference value, the first value being a product of: (a) the lottery winning probability previously determined associated with the bet area, (b) an amount of one unit of gaming value, and (c) the payout magnification ratio associated with the bet area if changed, and the second value being a product of: (a) a probability resulting from the subtraction of the lottery winning probability previously determined associated with the bet area from a winning probability to satisfy the dice-winning condition associated with the bet area, (b) the amount of one unit of gaming value, and (c) the payout magnification ratio associated with the bet area as previously determined before being changed; and (2) the sum of the first value and the second value is smaller than 1.

5. A dice gaming machine comprising:

a dice box in which a plurality of dice are rolled and stopped;

a betting board having a plurality of bet areas each associated with a dice-winning condition based on spots on any of the plurality of dice stopped and with a predetermined payout magnification ratio;

a plurality of terminals each accepting an input by a player; and a processor executing processes of:

(a) accepting a bet of a gaming value to any of the plurality of bet areas at any of the plurality of the terminals;

(b) carrying out a lottery based on a lottery-winning probability previously determined when acceptance of the bet of the gaming value ends;

(c) changing all of the payout magnification ratios of the plurality of bet areas making up the betting board for all of the plurality of terminals when the lottery is won;

(d) rolling and stopping the plurality of dice;

(e) identifying a bet area which satisfies the dice-winning condition based on spots on the plurality of dice stopped; and (f) awarding a prize based on an amount of the gaming value bet at the bet area identified and a payout magnification ratio of the bet area, wherein, relating to each of the plurality of the bet areas making up the betting board for each of the plurality of terminals, the lottery-winning probability at the lottery always satisfied a condition (1) that:

(1) a product of (I) and (II) and (III) is smaller than 1, (I) being a dice-winning probability that spots on the plurality of dice stopped satisfies the dice-winning condition defined for the bet area, (II) being an amount of a unit gaming value which stands for 1, and (III) being a changed payout magnification ratio of the bet area.

6. The dice gaming machine according to claim 5, wherein the processor further executes a process of multiplying each of all the payout magnification ratios provided for all the plurality of bet areas by a predetermined special magnification ratio when the process (c) is executed.

* * * * *